US007416027B2

(12) United States Patent
Ring et al.

(10) Patent No.: US 7,416,027 B2
(45) Date of Patent: Aug. 26, 2008

(54) ADJUSTABLE EXPANSION CONE ASSEMBLY

(75) Inventors: Lev Ring, Houston, TX (US); David Paul Brisco, Duncan, OK (US); Kevin Waddell, Houston, TX (US); Robert Lance Cook, Katy, TX (US)

(73) Assignee: Enventure Global Technology, LLC, Houston, TX (US)

( * ) Notice: Subject to any disclaimer, the term of this patent is extended or adjusted under 35 U.S.C. 154(b) by 291 days.

(21) Appl. No.: 10/488,574

(22) PCT Filed: Aug. 13, 2002

(86) PCT No.: PCT/US02/25608

§ 371 (c)(1),
(2), (4) Date: Sep. 13, 2004

(87) PCT Pub. No.: WO03/023178

PCT Pub. Date: Mar. 20, 2003

(65) Prior Publication Data

US 2005/0022986 A1 Feb. 3, 2005

Related U.S. Application Data

(60) Provisional application No. 60/318,021, filed on Sep. 7, 2001.

(51) Int. Cl.
*E21B 23/00* (2006.01)

(52) U.S. Cl. ..... 166/380; 166/207

(58) Field of Classification Search ..... 166/380, 166/382, 207, 206, 134, 137–140
See application file for complete search history.

(56) References Cited

U.S. PATENT DOCUMENTS

| | | | | |
|---|---|---|---|---|
| 46,818 | A | | 3/1865 | Patterson |
| 331,940 | A | | 12/1885 | Bole |
| 332,184 | A | | 12/1885 | Bole |
| 341,237 | A | | 5/1886 | Healey |
| 519,805 | A | | 5/1894 | Bavier |
| 802,880 | A | * | 10/1905 | Phillips, Jr. ..... 166/137 |
| 806,156 | A | | 12/1905 | Marshall |
| 958,517 | A | | 5/1910 | Mettler |
| 984,449 | A | | 2/1911 | Stewart |
| 1,166,040 | A | | 12/1915 | Burlingham |
| 1,233,888 | A | | 7/1917 | Leonard |
| 1,494,128 | A | * | 5/1924 | Primrose ..... 72/370.08 |
| 1,589,781 | A | | 6/1926 | Anderson |

(Continued)

FOREIGN PATENT DOCUMENTS

AU 767364 2/2004

(Continued)

OTHER PUBLICATIONS

Halliburton Energy Services, "Halliburton Completion Products" 1996, Page Packers 5-37, United States of America.

(Continued)

*Primary Examiner*—Hoang Dang

(57) ABSTRACT

An apparatus and method for radially expanding a tubular member. The apparatus includes a tubular support member, an adjustable expansion cone assembly coupled to the tubular support member and means for adjusting the expansion cone assembly.

105 Claims, 87 Drawing Sheets

U.S. PATENT DOCUMENTS

| | | | | | |
|---|---|---|---|---|---|
| 1,590,357 | A | | 6/1926 | Feisthamel | |
| 1,597,212 | A | | 8/1926 | Spengler | |
| 1,613,461 | A | | 1/1927 | Johnson | |
| 1,756,531 | A | | 4/1930 | Aldeen et al. | |
| 1,880,218 | A | | 10/1932 | Simmons | |
| 1,981,525 | A | | 11/1934 | Price | |
| 2,046,870 | A | | 7/1936 | Clasen et al. | |
| 2,087,185 | A | | 7/1937 | Dillom | |
| 2,122,757 | A | | 7/1938 | Scott | |
| 2,145,168 | A | | 1/1939 | Flagg | |
| 2,160,263 | A | | 5/1939 | Fletcher | |
| 2,187,275 | A | | 1/1940 | McLennan | |
| 2,204,586 | A | | 6/1940 | Grau | |
| 2,214,226 | A | | 9/1940 | English | |
| 2,226,804 | A | | 12/1940 | Carroll | |
| 2,255,451 | A | * | 9/1941 | Otis | 166/140 |
| 2,273,017 | A | | 2/1942 | Boynton | |
| 2,301,495 | A | | 11/1942 | Abegg | |
| 2,371,840 | A | * | 3/1945 | Otis | 166/126 |
| 2,383,214 | A | | 8/1945 | Prout | |
| 2,447,629 | A | | 8/1948 | Beissinger et al. | |
| 2,500,276 | A | | 3/1950 | Church | |
| 2,546,295 | A | | 3/1951 | Boice | |
| 2,583,316 | A | | 1/1952 | Bannister | |
| 2,627,891 | A | | 2/1953 | Clark | |
| 2,647,847 | A | | 8/1953 | Black et al. | |
| 2,734,580 | A | | 2/1956 | Layne | |
| 2,796,134 | A | | 6/1957 | Binkley | |
| 2,812,025 | A | | 11/1957 | Teague et al. | |
| 2,907,589 | A | | 10/1959 | Knox | |
| 2,929,741 | A | | 1/1960 | Strock et al. | |
| 3,015,362 | A | * | 1/1962 | Moosman | 166/216 |
| 3,015,500 | A | | 1/1962 | Barnett | |
| 3,018,547 | A | | 1/1962 | Marskell | |
| 3,067,819 | A | | 12/1962 | Gore | |
| 3,068,563 | A | | 12/1962 | Reverman | |
| 3,104,703 | A | | 9/1963 | Rike et al. | |
| 3,111,991 | A | | 11/1963 | O'Neal | |
| 3,167,122 | A | | 1/1965 | Lang | |
| 3,175,618 | A | | 3/1965 | Lang et al. | |
| 3,179,168 | A | | 4/1965 | Vincent | |
| 3,188,816 | A | | 6/1965 | Koch | |
| 3,191,677 | A | * | 6/1965 | Kinley | 166/277 |
| 3,191,680 | A | | 6/1965 | Vincent | |
| 3,203,451 | A | | 8/1965 | Vincent | |
| 3,203,483 | A | | 8/1965 | Vincent | |
| 3,209,546 | A | | 10/1965 | Lawton | |
| 3,210,102 | A | | 10/1965 | Joslin | |
| 3,233,315 | A | | 2/1966 | Levake | |
| 3,245,471 | A | | 4/1966 | Howard | |
| 3,270,817 | A | | 9/1966 | Papaila | |
| 3,297,092 | A | | 1/1967 | Jennings | |
| 3,326,293 | A | | 6/1967 | Skipper | |
| 3,343,252 | A | | 9/1967 | Reesor | |
| 3,353,599 | A | | 11/1967 | Swift | |
| 3,354,955 | A | | 11/1967 | Berry | |
| 3,358,760 | A | | 12/1967 | Blagg | |
| 3,358,769 | A | | 12/1967 | Berry | |
| 3,364,993 | A | | 1/1968 | Skipper | |
| 3,371,717 | A | | 3/1968 | Chenoweth | |
| 3,412,565 | A | | 11/1968 | Lindsey et al. | |
| 3,419,080 | A | | 12/1968 | Lebourg | |
| 3,424,244 | A | | 1/1969 | Kinley | |
| 3,427,707 | A | | 2/1969 | Nowosadko | |
| 3,477,506 | A | | 11/1969 | Malone | |
| 3,489,220 | A | | 1/1970 | Kinley | |
| 3,498,376 | A | | 3/1970 | Sizer et al. | |
| 3,504,515 | A | | 4/1970 | Reardon | |
| 3,520,049 | A | | 7/1970 | Lysenko et al. | |
| 3,528,498 | A | | 9/1970 | Carothers | |
| 3,568,773 | A | | 3/1971 | Chancellor | |
| 3,578,081 | A | | 5/1971 | Bodine | |
| 3,579,805 | A | | 5/1971 | Kast | |
| 3,605,887 | A | | 9/1971 | Lambie | |
| 3,631,926 | A | | 1/1972 | Young | |
| 3,665,591 | A | | 5/1972 | Kowal | |
| 3,667,547 | A | | 6/1972 | Ahlstone | |
| 3,669,190 | A | | 6/1972 | Sizer et al. | |
| 3,682,256 | A | | 8/1972 | Stuart | |
| 3,687,196 | A | | 8/1972 | Mullins | |
| 3,691,624 | A | | 9/1972 | Kinley | |
| 3,693,717 | A | | 9/1972 | Wuenschel | |
| 3,704,730 | A | | 12/1972 | Witzig | |
| 3,709,306 | A | | 1/1973 | Curington | |
| 3,711,123 | A | | 1/1973 | Arnold | |
| 3,712,376 | A | | 1/1973 | Owen et al. | |
| 3,746,068 | A | | 7/1973 | Deckert et al. | |
| 3,746,091 | A | | 7/1973 | Owen et al. | |
| 3,746,092 | A | | 7/1973 | Land | |
| 3,764,168 | A | | 10/1973 | Kisling, III et al. | |
| 3,776,307 | A | | 12/1973 | Young | |
| 3,779,025 | A | | 12/1973 | Godley et al. | |
| 3,780,562 | A | | 12/1973 | Kinley | |
| 3,781,966 | A | | 1/1974 | Lieberman | |
| 3,785,193 | A | * | 1/1974 | Kinley et al. | 72/393 |
| 3,797,259 | A | | 3/1974 | Kammerer, Jr. | |
| 3,812,912 | A | | 5/1974 | Wuenschel | |
| 3,818,734 | A | | 6/1974 | Bateman | |
| 3,834,742 | A | | 9/1974 | McPhillips | |
| 3,866,954 | A | | 2/1975 | Slator et al. | |
| 3,885,298 | A | | 5/1975 | Pogonowski | |
| 3,887,006 | A | | 6/1975 | Pitts | |
| 3,893,718 | A | | 7/1975 | Powell | |
| 3,898,163 | A | | 8/1975 | Mott | |
| 3,915,478 | A | | 10/1975 | Al et al. | |
| 3,935,910 | A | | 2/1976 | Gaudy et al. | |
| 3,942,824 | A | | 3/1976 | Sable | |
| 3,945,444 | A | | 3/1976 | Knudson | |
| 3,948,321 | A | | 4/1976 | Owen et al. | |
| 3,970,336 | A | | 7/1976 | O'Sickey et al. | |
| 3,977,473 | A | | 8/1976 | Page, Jr. | |
| 3,989,280 | A | | 11/1976 | Schwarz | |
| 3,997,193 | A | | 12/1976 | Tsuda et al. | |
| 4,011,652 | A | | 3/1977 | Black | |
| 4,019,579 | A | | 4/1977 | Thuse | |
| 4,026,583 | A | | 5/1977 | Gottlieb | |
| 4,053,247 | A | | 10/1977 | Marsh, Jr. | |
| 4,069,573 | A | | 1/1978 | Rogers, Jr. et al. | |
| 4,076,287 | A | | 2/1978 | Bill et al. | |
| 4,096,913 | A | | 6/1978 | Kenneday et al. | |
| 4,098,334 | A | | 7/1978 | Crowe | |
| 4,125,937 | A | | 11/1978 | Brown et al. | |
| 4,152,821 | A | | 5/1979 | Scott | |
| 4,168,747 | A | | 9/1979 | Youmans | |
| 4,190,108 | A | | 2/1980 | Webber | |
| 4,204,312 | A | | 5/1980 | Tooker | |
| 4,205,422 | A | | 6/1980 | Hardwick | |
| 4,226,449 | A | | 10/1980 | Cole | |
| 4,253,687 | A | | 3/1981 | Maples | |
| 4,257,155 | A | | 3/1981 | Hunter | |
| 4,274,665 | A | | 6/1981 | Marsh, Jr. | |
| RE30,802 | E | | 11/1981 | Rogers, Jr. | |
| 4,304,428 | A | | 12/1981 | Grigorian et al. | |
| 4,328,983 | A | | 5/1982 | Gibson | |
| 4,355,664 | A | | 10/1982 | Cook et al. | |
| 4,359,889 | A | | 11/1982 | Kelly | |
| 4,363,358 | A | | 12/1982 | Ellis | |
| 4,366,971 | A | | 1/1983 | Lula | |
| 4,368,571 | A | | 1/1983 | Cooper, Jr. | |
| 4,379,471 | A | | 4/1983 | Kuenzel | |
| 4,380,347 | A | | 4/1983 | Sable | |
| 4,384,625 | A | | 5/1983 | Roper et al. | |
| 4,388,752 | A | | 6/1983 | Vinciguerra et al. | |
| 4,391,325 | A | | 7/1983 | Baker et al. | |

4,393,931 A 7/1983 Muse et al.
4,396,061 A 8/1983 Tamplen et al.
4,401,325 A 8/1983 Tsuchiya et al.
4,402,372 A 9/1983 Cherrington
4,407,681 A 10/1983 Ina et al.
4,411,435 A 10/1983 McStravick
4,413,395 A 11/1983 Garnier
4,413,682 A 11/1983 Callihan et al.
4,420,866 A 12/1983 Mueller
4,421,169 A 12/1983 Dearth et al.
4,422,317 A 12/1983 Mueller
4,422,507 A 12/1983 Reimert
4,423,889 A 1/1984 Weise
4,423,986 A 1/1984 Skogberg
4,429,741 A 2/1984 Hyland
4,440,233 A 4/1984 Baugh et al.
4,442,586 A 4/1984 Ridenour
4,444,250 A 4/1984 Keithahn et al.
4,449,713 A 5/1984 Ishido et al.
4,462,471 A 7/1984 Hipp
4,467,630 A 8/1984 Kelly
4,468,309 A 8/1984 White
4,469,356 A 9/1984 Duret et al.
4,473,245 A 9/1984 Raulins et al.
4,483,399 A 11/1984 Colgate
4,485,847 A 12/1984 Wentzell
4,491,001 A 1/1985 Yoshida
4,501,327 A 2/1985 Retz
4,505,017 A 3/1985 Schukei
4,505,987 A 3/1985 Yamada et al.
4,507,019 A 3/1985 Thompson
4,508,129 A 4/1985 Brown
4,511,289 A 4/1985 Herron
4,519,456 A 5/1985 Cochran
4,526,232 A 7/1985 Hughson et al.
4,526,839 A 7/1985 Herman et al.
4,530,231 A 7/1985 Main
4,541,655 A 9/1985 Hunter
4,550,782 A 11/1985 Lawson
4,553,776 A 11/1985 Dodd
4,573,248 A 3/1986 Hackett
4,576,386 A 3/1986 Benson et al.
4,581,817 A 4/1986 Kelly
4,590,227 A 5/1986 Nakamura et al.
4,590,995 A 5/1986 Evans
4,592,577 A 6/1986 Ayres et al.
4,595,063 A 6/1986 Jennings et al.
4,601,343 A 7/1986 Lindsey, Jr. et al.
4,605,063 A 8/1986 Ross
4,611,662 A 9/1986 Harrington
4,614,233 A 9/1986 Menard
4,629,218 A 12/1986 Dubois
4,630,849 A 12/1986 Fukui et al.
4,632,944 A 12/1986 Thompson
4,634,317 A 1/1987 Skogberg et al.
4,635,333 A 1/1987 Finch
4,637,436 A 1/1987 Stewart, Jr. et al.
4,646,787 A 3/1987 Rush et al.
4,649,492 A 3/1987 Sinha et al.
4,651,836 A 3/1987 Richards
4,656,779 A 4/1987 Fedeli
4,660,863 A 4/1987 Bailey et al.
4,662,446 A 5/1987 Brisco et al.
4,669,541 A 6/1987 Bissonnette
4,674,572 A 6/1987 Gallus
4,682,797 A 7/1987 Hildner
4,685,191 A 8/1987 Mueller et al.
4,685,834 A 8/1987 Jordan
4,693,498 A 9/1987 Baugh et al.
4,711,474 A 12/1987 Patrick
4,714,117 A 12/1987 Dech
4,730,851 A 3/1988 Watts
4,735,444 A 4/1988 Skipper
4,739,654 A 4/1988 Pilkington et al.
4,739,916 A 4/1988 Ayres et al.
4,754,781 A 7/1988 Putter
4,758,025 A 7/1988 Frick
4,776,394 A 10/1988 Lynde et al.
4,778,088 A 10/1988 Miller
4,779,445 A 10/1988 Rabe
4,793,382 A 12/1988 Szalvay
4,796,668 A 1/1989 Depret
4,817,710 A 4/1989 Edwards et al.
4,817,712 A 4/1989 Bodine
4,817,716 A 4/1989 Taylor et al.
4,826,347 A 5/1989 Baril et al.
4,827,594 A 5/1989 Cartry et al.
4,828,033 A 5/1989 Frison
4,830,109 A 5/1989 Wedel
4,832,382 A 5/1989 Kapgan
4,836,579 A 6/1989 Wester et al.
4,842,082 A 6/1989 Springer
4,848,459 A 7/1989 Blackwell et al.
4,854,338 A 8/1989 Grantham
4,856,592 A 8/1989 Van Bilderbeek et al.
4,865,127 A 9/1989 Koster
4,871,199 A 10/1989 Ridenour et al.
4,872,253 A 10/1989 Carstensen
4,887,646 A 12/1989 Groves
4,892,337 A 1/1990 Gunderson et al.
4,893,658 A 1/1990 Kimura et al.
4,904,136 A 2/1990 Matsumoto
4,907,828 A 3/1990 Change
4,911,237 A 3/1990 Melenyzer
4,913,758 A 4/1990 Koster
4,915,177 A 4/1990 Claycomb
4,915,426 A 4/1990 Skipper
4,917,409 A 4/1990 Reeves
4,919,989 A 4/1990 Colangelo
4,930,573 A 6/1990 Lane et al.
4,934,312 A 6/1990 Koster et al.
4,938,291 A 7/1990 Lynde et al.
4,941,512 A 7/1990 McParland
4,941,532 A 7/1990 Hurt et al.
4,942,925 A 7/1990 Themig
4,942,926 A 7/1990 Lessi
4,958,691 A 9/1990 Hipp
4,968,184 A 11/1990 Reid
4,971,152 A 11/1990 Koster et al.
4,976,322 A 12/1990 Abdrakhmanov et al.
4,981,250 A 1/1991 Persson
4,995,464 A 2/1991 Watkins et al.
5,014,779 A 5/1991 Meling et al.
5,015,017 A 5/1991 Geary
5,026,074 A 6/1991 Hoes et al.
5,031,370 A 7/1991 Jewett
5,031,699 A 7/1991 Artynov et al.
5,040,283 A 8/1991 Pelgrom
5,044,676 A 9/1991 Burton et al.
5,052,483 A 10/1991 Hudson
5,059,043 A 10/1991 Kuhne
5,064,004 A 11/1991 Lundel
5,079,837 A 1/1992 Vanselow
5,083,608 A 1/1992 Abdrakhmanov et al.
5,093,015 A 3/1992 Oldiges
5,095,991 A 3/1992 Milberger
5,101,653 A 4/1992 Hermes et al.
5,105,888 A 4/1992 Pollock et al.
5,107,221 A 4/1992 N'Guyen et al.
5,119,661 A 6/1992 Abdrakhmanov et al.
5,134,891 A 8/1992 Canevet
5,150,755 A 9/1992 Cassel et al.
5,156,043 A 10/1992 Ose
5,156,213 A 10/1992 George et al.
5,156,223 A 10/1992 Hipp
5,174,376 A 12/1992 Singeetham 5,181,571 A 1/1993 Mueller et al.
5,195,583 A 3/1993 Toon et al.
5,197,553 A 3/1993 Leturno
5,209,600 A 5/1993 Koster
5,226,492 A 7/1993 Solaeche et al.
5,242,017 A 9/1993 Hailey
5,275,242 A 1/1994 Payne
5,282,508 A 2/1994 Ellingsen et al.
5,286,393 A 2/1994 Oldiges et al.
5,306,101 A 4/1994 Rockower et al.
5,309,621 A 5/1994 O'Donnell et al.
5,314,014 A 5/1994 Tucker
5,314,209 A 5/1994 Kuhne
5,318,122 A 6/1994 Murray et al.
5,318,131 A 6/1994 Baker
5,325,923 A 7/1994 Surjaatmadja et al.
5,326,137 A 7/1994 Lorenz et al.
5,327,964 A 7/1994 O'Donnell et al.
5,330,850 A 7/1994 Suzuki et al.
5,332,038 A 7/1994 Tapp et al.
5,332,049 A 7/1994 Tew
5,333,692 A 8/1994 Baugh et al.
5,335,736 A 8/1994 Windsor
5,337,808 A 8/1994 Graham
5,337,823 A 8/1994 Nobileau
5,337,827 A 8/1994 Hromas et al.
5,339,894 A 8/1994 Stotler
5,343,949 A 9/1994 Ross et al.
5,346,007 A 9/1994 Dillon et al.
5,348,087 A 9/1994 Williamson, Jr.
5,348,093 A 9/1994 Wood et al.
5,348,095 A 9/1994 Worrall et al.
5,348,668 A 9/1994 Oldiges et al.
5,351,752 A 10/1994 Wood et al.
5,360,239 A 11/1994 Klementich
5,360,292 A 11/1994 Allen et al.
5,361,843 A 11/1994 Shy et al.
5,366,010 A 11/1994 Zwart
5,366,012 A 11/1994 Lohbeck
5,368,075 A 11/1994 Bäro et al.
5,370,425 A 12/1994 Dougherty et al.
5,375,661 A 12/1994 Daneshy et al.
5,388,648 A 2/1995 Jordan, Jr.
5,390,735 A 2/1995 Williamson, Jr.
5,390,742 A 2/1995 Dines et al.
5,396,957 A 3/1995 Surjaatmadja et al.
5,400,827 A 3/1995 Baro et al.
5,405,171 A 4/1995 Allen et al.
5,413,180 A 5/1995 Ross et al.
5,425,559 A 6/1995 Nobileau
5,426,130 A 6/1995 Thurder et al.
5,431,831 A 7/1995 Vincent
5,435,395 A 7/1995 Connell
5,439,320 A 8/1995 Abrams
5,447,201 A 9/1995 Mohn
5,454,419 A 10/1995 Vloedman
5,456,319 A 10/1995 Schmidt et al.
5,458,194 A 10/1995 Brooks
5,462,120 A 10/1995 Gondouin
5,467,822 A 11/1995 Zwart
5,472,055 A 12/1995 Simson et al.
5,474,334 A 12/1995 Eppink
5,492,173 A 2/1996 Kilgore et al.
5,494,106 A 2/1996 Gueguen et al.
5,507,343 A 4/1996 Carlton et al.
5,511,620 A 4/1996 Baugh et al.
5,524,937 A 6/1996 Sides, III et al.
5,535,824 A 7/1996 Hudson
5,536,422 A 7/1996 Oldiges et al.
5,540,281 A 7/1996 Round
5,554,244 A 9/1996 Ruggles et al.
5,566,772 A 10/1996 Coone et al.
5,576,485 A 11/1996 Serata
5,584,512 A 12/1996 Carstensen
5,606,792 A 3/1997 Schafer
5,611,399 A 3/1997 Richard et al.
5,613,557 A 3/1997 Blount et al.
5,617,918 A 4/1997 Cooksey et al.
5,642,560 A 7/1997 Tabuchi et al.
5,642,781 A 7/1997 Richard
5,662,180 A 9/1997 Coffman et al.
5,664,327 A 9/1997 Swars
5,667,011 A 9/1997 Gill et al.
5,667,252 A 9/1997 Schafer et al.
5,678,609 A 10/1997 Washburn
5,685,369 A 11/1997 Ellis et al.
5,689,871 A 11/1997 Carstensen
5,695,008 A 12/1997 Bertet et al.
5,695,009 A 12/1997 Hipp
5,697,449 A 12/1997 Hennig et al.
5,718,288 A 2/1998 Bertet et al.
5,738,146 A 4/1998 Abe
5,743,335 A 4/1998 Bussear
5,749,419 A 5/1998 Coronado et al.
5,749,585 A 5/1998 Lembcke
5,775,422 A 7/1998 Wong et al.
5,785,120 A 7/1998 Smalley et al.
5,787,933 A 8/1998 Russ et al.
5,791,419 A 8/1998 Valisalo
5,794,702 A 8/1998 Nobileau
5,797,454 A 8/1998 Hipp
5,829,520 A 11/1998 Johnson
5,829,524 A 11/1998 Flanders et al.
5,833,001 A 11/1998 Song et al.
5,845,945 A 12/1998 Carstensen
5,849,188 A 12/1998 Voll et al.
5,857,524 A 1/1999 Harris
5,862,866 A 1/1999 Springer
5,875,851 A 3/1999 Vick, Jr. et al.
5,885,941 A 3/1999 Sateva et al.
5,895,079 A 4/1999 Carstensen et al.
5,901,789 A 5/1999 Donnelly et al.
5,918,677 A 7/1999 Head
5,924,745 A 7/1999 Campbell
5,931,511 A 8/1999 DeLange et al.
5,944,100 A 8/1999 Hipp
5,944,107 A 8/1999 Ohmer
5,944,108 A 8/1999 Baugh et al.
5,951,207 A 9/1999 Chen
5,957,195 A 9/1999 Bailey et al.
5,971,443 A 10/1999 Noel et al.
5,975,587 A 11/1999 Wood et al.
5,979,560 A 11/1999 Nobileau
5,984,369 A 11/1999 Crook et al.
5,984,568 A 11/1999 Lohbeck
6,012,521 A 1/2000 Zunkel et al.
6,012,522 A 1/2000 Donnelly et al.
6,012,523 A * 1/2000 Campbell et al. ..... 166/277
6,012,874 A 1/2000 Groneck et al.
6,015,012 A 1/2000 Reddick
6,017,168 A 1/2000 Fraser et al.
6,021,850 A 2/2000 Woo et al.
6,029,748 A 2/2000 Forsyth et al.
6,035,954 A 3/2000 Hipp
6,044,906 A 4/2000 Saltel
6,047,505 A 4/2000 Willow
6,047,774 A 4/2000 Allen
6,050,341 A 4/2000 Metcalf
6,050,346 A 4/2000 Hipp
6,056,059 A 5/2000 Ohmer
6,056,324 A 5/2000 Reimert et al.
6,062,324 A 5/2000 Hipp
6,065,500 A 5/2000 Metcalfe
6,070,671 A 6/2000 Cumming et al.
6,073,692 A 6/2000 Wood et al.
6,074,133 A 6/2000 Kelsey 6,078,031 A 6/2000 Bliault et al.
6,079,495 A 6/2000 Ohmer
6,085,838 A 7/2000 Vercaemer et al.
6,089,320 A 7/2000 LaGrange
6,098,717 A 8/2000 Bailey et al.
6,102,119 A 8/2000 Raines
6,109,355 A 8/2000 Reid
6,112,818 A 9/2000 Campbell
6,131,265 A 10/2000 Bird
6,135,208 A 10/2000 Gano et al.
6,138,761 A 10/2000 Freeman et al.
6,142,230 A 11/2000 Smalley et al.
6,158,963 A 12/2000 Hollis
6,167,970 B1 1/2001 Stout
6,182,775 B1 2/2001 Hipp
6,196,336 B1 3/2001 Fincher et al.
6,226,855 B1 5/2001 Maine
6,231,086 B1 5/2001 Tierling
6,250,385 B1 6/2001 Montaron
6,263,966 B1 7/2001 Haut et al.
6,263,968 B1 7/2001 Freeman et al.
6,263,972 B1 7/2001 Richard et al.
6,267,181 B1 7/2001 Rhein-Knudsen et al.
6,275,556 B1 8/2001 Kinney et al.
6,283,211 B1 9/2001 Vloedman
6,315,043 B1 11/2001 Farrant et al.
6,318,457 B1 11/2001 Den Boer et al.
6,318,465 B1 11/2001 Coon et al.
6,322,109 B1 11/2001 Campbell et al.
6,325,148 B1 12/2001 Trahan et al.
6,328,113 B1 12/2001 Cook
6,334,351 B1 1/2002 Tsuchiya
6,343,495 B1 2/2002 Cheppe et al.
6,343,657 B1 2/2002 Baugh et al.
6,345,373 B1 2/2002 Chakradhar et al.
6,345,431 B1 2/2002 Greig
6,352,112 B1 3/2002 Mills
6,354,373 B1 3/2002 Vercaemer et al.
6,390,720 B1 5/2002 LeBegue et al.
6,405,761 B1 6/2002 Shimizu et al.
6,406,063 B1 6/2002 Pfeiffer
6,409,175 B1 6/2002 Evans et al.
6,419,025 B1 7/2002 Lohbeck et al.
6,419,026 B1 7/2002 MacKenzie et al.
6,419,033 B1 7/2002 Hahn et al.
6,419,147 B1 7/2002 Daniel
6,425,444 B1 7/2002 Metcalfe et al.
6,431,277 B1 8/2002 Cox et al.
6,446,724 B2 9/2002 Baugh et al.
6,450,261 B1 9/2002 Baugh
6,454,013 B1 9/2002 Metcalfe
6,457,532 B1 10/2002 Simpson
6,457,533 B1 10/2002 Metcalfe
6,457,749 B1 10/2002 Heijnen
6,460,615 B1 10/2002 Heijnen
6,464,008 B1 10/2002 Roddy et al.
6,464,014 B1 10/2002 Bernat
6,470,966 B2 10/2002 Cook et al.
6,470,996 B1 10/2002 Kyle et al.
6,478,092 B2 11/2002 Voll et al.
6,491,108 B1 12/2002 Slup et al.
6,497,289 B1 12/2002 Cook et al.
6,516,887 B2 2/2003 Nguyen et al.
6,517,126 B1 2/2003 Peterson et al.
6,527,049 B2 3/2003 Metcalfe et al.
6,543,545 B1 4/2003 Chatterji et al.
6,543,552 B1 4/2003 Metcalfe et al.
6,550,539 B2 4/2003 Maguire et al.
6,550,821 B2 4/2003 DeLange et al.
6,557,640 B1 5/2003 Cook et al.
6,561,227 B2 5/2003 Cook et al.
6,561,279 B2 5/2003 MacKenzie et al.
6,564,875 B1 5/2003 Bullock
6,568,471 B1 5/2003 Cook et al.
6,568,488 B2 5/2003 Wentworth et al.
6,575,240 B1 6/2003 Cook et al.
6,578,630 B2 6/2003 Simpson et al.
6,585,053 B2 7/2003 Coon
6,591,905 B2 7/2003 Coon
6,598,677 B1 7/2003 Baugh et al.
6,598,678 B1 7/2003 Simpson
6,604,763 B1 8/2003 Cook et al.
6,607,220 B2 8/2003 Sivley, IV
6,619,696 B2 9/2003 Baugh et al.
6,622,797 B2 9/2003 Sivley, IV
6,629,567 B2 10/2003 Lauritzen et al.
6,631,759 B2 10/2003 Cook et al.
6,631,760 B2 10/2003 Cook et al.
6,631,765 B2 10/2003 Baugh et al.
6,631,769 B2 10/2003 Cook et al.
6,634,431 B2 10/2003 Cook et al.
6,640,895 B2 11/2003 Murray
6,640,903 B1 11/2003 Cook et al.
6,648,075 B2 11/2003 Badrak et al.
6,672,759 B2 1/2004 Feger
6,679,328 B2 1/2004 Davis et al.
6,681,862 B2 1/2004 Freeman
6,684,947 B2 2/2004 Cook et al.
6,688,397 B2 2/2004 McClurkin et al.
6,695,012 B1 2/2004 Ring et al.
6,695,065 B2 2/2004 Simpson et al.
6,698,517 B2 3/2004 Simpson
6,701,598 B2 3/2004 Chen et al.
6,702,030 B2 3/2004 Simpson
6,705,395 B2 3/2004 Cook et al.
6,708,767 B2 3/2004 Harrall et al.
6,712,154 B2 3/2004 Cook et al.
6,712,401 B2 3/2004 Coulon et al.
6,719,064 B2 4/2004 Price-Smith et al.
6,722,427 B2 4/2004 Gano et al.
6,722,437 B2 4/2004 Vercaemer et al.
6,722,443 B1 4/2004 Metcalfe
6,725,919 B2 4/2004 Cook et al.
6,725,934 B2 4/2004 Coronado et al.
6,725,939 B2 4/2004 Richard
6,732,806 B2 5/2004 Mauldin et al.
6,739,392 B2 5/2004 Cook et al.
6,745,845 B2 6/2004 Cook et al.
6,758,278 B2 7/2004 Cook et al.
6,763,893 B2 * 7/2004 Braddick ..... 166/382
6,796,380 B2 9/2004 Xu
6,814,147 B2 11/2004 Baugh
6,820,690 B2 11/2004 Vercaemer et al.
6,823,937 B1 11/2004 Cook et al.
6,832,649 B2 12/2004 Bode et al.
6,834,725 B2 12/2004 Whanger et al.
6,843,322 B2 1/2005 Burtner et al.
6,857,473 B2 2/2005 Cook et al.
6,892,819 B2 5/2005 Cook et al.
6,902,000 B2 6/2005 Simpson et al.
6,907,652 B1 6/2005 Heijnen
2001/0002626 A1 6/2001 Frank et al.
2001/0020532 A1 9/2001 Baugh et al.
2001/0045284 A1 11/2001 Simpson et al.
2001/0045289 A1 11/2001 Cook et al.
2001/0047870 A1 12/2001 Cook et al.
2002/0011339 A1 1/2002 Murray
2002/0014339 A1 2/2002 Ross
2002/0020524 A1 2/2002 Gano
2002/0020531 A1 2/2002 Ohmer
2002/0033261 A1 3/2002 Metcalfe
2002/0060068 A1 5/2002 Cook et al.
2002/0062956 A1 5/2002 Murray et al.
2002/0066576 A1 6/2002 Cook et al.
2002/0066578 A1 6/2002 Broome
2002/0070023 A1 6/2002 Turner et al.

| | | | |
|---|---|---|---|
| 2002/0070031 | A1 | 6/2002 | Voll et al. |
| 2002/0079101 | A1 | 6/2002 | Baugh et al. |
| 2002/0084070 | A1 | 7/2002 | Voll et al. |
| 2002/0092654 | A1 | 7/2002 | Coronado et al. |
| 2002/0108756 | A1 | 8/2002 | Harrall et al. |
| 2002/0139540 | A1 | 10/2002 | Lauritzen |
| 2002/0144822 | A1 | 10/2002 | Hackworth et al. |
| 2002/0148612 | A1 | 10/2002 | Cook et al. |
| 2002/0185274 | A1 | 12/2002 | Simpson et al. |
| 2002/0189816 | A1 | 12/2002 | Cook et al. |
| 2002/0195252 | A1 | 12/2002 | Maguire et al. |
| 2002/0195256 | A1 | 12/2002 | Metcalfe et al. |
| 2003/0024708 | A1 | 2/2003 | Ring et al. |
| 2003/0024711 | A1 | 2/2003 | Simpson et al. |
| 2003/0034177 | A1 | 2/2003 | Chitwood et al. |
| 2003/0042022 | A1 | 3/2003 | Lauritzen et al. |
| 2003/0047322 | A1 | 3/2003 | Maguire et al. |
| 2003/0047323 | A1 | 3/2003 | Jackson et al. |
| 2003/0056991 | A1 | 3/2003 | Hahn et al. |
| 2003/0066655 | A1 | 4/2003 | Cook et al. |
| 2003/0067166 | A1 | 4/2003 | Maguire |
| 2003/0075337 | A1 | 4/2003 | Maguire |
| 2003/0075338 | A1 | 4/2003 | Sivley, IV |
| 2003/0075339 | A1 | 4/2003 | Gano et al. |
| 2003/0094277 | A1 | 5/2003 | Cook et al. |
| 2003/0094278 | A1 | 5/2003 | Cook et al. |
| 2003/0094279 | A1 | 5/2003 | Ring et al. |
| 2003/0098154 | A1 | 5/2003 | Cook et al. |
| 2003/0098162 | A1 | 5/2003 | Cook |
| 2003/0107217 | A1 | 6/2003 | Daigle et al. |
| 2003/0111234 | A1 | 6/2003 | McClurkin et al. |
| 2003/0116325 | A1 | 6/2003 | Cook et al. |
| 2003/0121558 | A1 | 7/2003 | Cook et al. |
| 2003/0121655 | A1 | 7/2003 | Lauritzen et al. |
| 2003/0121669 | A1 | 7/2003 | Cook et al. |
| 2003/0140673 | A1 | 7/2003 | Marr et al. |
| 2003/0168222 | A1 | 9/2003 | Maguire et al. |
| 2003/0173090 | A1 | 9/2003 | Cook et al. |
| 2003/0192705 | A1 | 10/2003 | Cook et al. |
| 2003/0222455 | A1 | 12/2003 | Cook et al. |
| 2004/0011534 | A1 | 1/2004 | Simonds et al. |
| 2004/0045616 | A1 | 3/2004 | Cook et al. |
| 2004/0045718 | A1 | 3/2004 | Brisco et al. |
| 2004/0060706 | A1 | 4/2004 | Stephenson |
| 2004/0065446 | A1 | 4/2004 | Tran et al. |
| 2004/0069499 | A1 | 4/2004 | Cook et al. |
| 2004/0112589 | A1 | 6/2004 | Cook et al. |
| 2004/0112606 | A1 | 6/2004 | Lewis et al. |
| 2004/0118574 | A1 | 6/2004 | Cook et al. |
| 2004/0123983 | A1 | 7/2004 | Cook et al. |
| 2004/0123988 | A1 | 7/2004 | Cook et al. |
| 2004/0129431 | A1 | 7/2004 | Jackson |
| 2004/0159446 | A1 | 8/2004 | Haugen et al. |
| 2004/0188099 | A1 | 9/2004 | Cook et al. |
| 2004/0216873 | A1 | 11/2004 | Frost, Jr. et al. |
| 2004/0221996 | A1 | 11/2004 | Burge |
| 2004/0231839 | A1 | 11/2004 | Ellington et al. |
| 2004/0231855 | A1 | 11/2004 | Cook et al. |
| 2004/0238181 | A1 | 12/2004 | Cook et al. |
| 2004/0244968 | A1 | 12/2004 | Cook et al. |
| 2004/0262014 | A1 | 12/2004 | Cook et al. |
| 2005/0011641 | A1 | 1/2005 | Cook et al. |
| 2005/0015963 | A1 | 1/2005 | Costa et al. |
| 2005/0028988 | A1 | 2/2005 | Cook et al. |
| 2005/0039910 | A1 | 2/2005 | Lohbeck |
| 2005/0039928 | A1 | 2/2005 | Cook et al. |
| 2005/0045324 | A1 | 3/2005 | Cook et al. |
| 2005/0045341 | A1 | 3/2005 | Cook et al. |
| 2005/0045342 | A1 | 3/2005 | Luke et al. |
| 2005/0056433 | A1 | 3/2005 | Watson et al. |
| 2005/0056434 | A1 | 3/2005 | Ring et al. |
| 2005/0077051 | A1 | 4/2005 | Cook et al. |
| 2005/0081358 | A1 | 4/2005 | Cook et al. |
| 2005/0087337 | A1 | 4/2005 | Brisco et al. |
| 2005/0098323 | A1 | 5/2005 | Cook et al. |
| 2005/0103502 | A1 | 5/2005 | Watson et al. |
| 2005/0123639 | A1 | 6/2005 | Ring et al. |
| 2005/0133225 | A1 | 6/2005 | Oosterling |
| 2005/0138790 | A1 | 6/2005 | Cook et al. |
| 2005/0144771 | A1 | 7/2005 | Cook et al. |
| 2005/0144772 | A1 | 7/2005 | Cook et al. |
| 2005/0144777 | A1 | 7/2005 | Cook et al. |
| 2005/0150098 | A1 | 7/2005 | Cook et al. |
| 2005/0150660 | A1 | 7/2005 | Cook et al. |
| 2005/0161228 | A1 | 7/2005 | Cook et al. |
| 2005/0166387 | A1 | 8/2005 | Cook et al. |
| 2005/0166388 | A1 | 8/2005 | Cook et al. |
| 2005/0173108 | A1 | 8/2005 | Cook et al. |
| 2005/0175473 | A1 | 8/2005 | Cook et al. |
| 2005/0183863 | A1 | 8/2005 | Cook et al. |
| 2005/0205253 | A1 | 9/2005 | Cook et al. |
| 2005/0217866 | A1 | 10/2005 | Watson et al. |

FOREIGN PATENT DOCUMENTS

| | | | |
|---|---|---|---|
| AU | 770008 | | 7/2004 |
| AU | 770359 | | 7/2004 |
| AU | 771884 | | 8/2004 |
| AU | 776580 | | 1/2005 |
| CA | 736288 | | 6/1966 |
| CA | 771462 | | 11/1967 |
| CA | 1171310 | | 7/1984 |
| CA | 2292171 | | 6/2000 |
| CA | 2298139 | | 8/2000 |
| CA | 2234386 | | 3/2003 |
| DE | 174521 | | 4/1953 |
| DE | 2458188 | | 6/1975 |
| DE | 203767 | | 11/1983 |
| DE | 233607 | A1 | 3/1986 |
| DE | 278517 | A1 | 5/1990 |
| EP | 0084940 | A1 | 8/1983 |
| EP | 0272511 | | 12/1987 |
| EP | 0294264 | | 5/1988 |
| EP | 0553566 | A1 | 12/1992 |
| EP | 0633391 | A2 | 1/1995 |
| EP | 0713953 | B1 | 11/1995 |
| EP | 0823534 | | 2/1998 |
| EP | 0881354 | | 12/1998 |
| EP | 0881359 | | 12/1998 |
| EP | 0899420 | | 3/1999 |
| EP | 0937861 | | 8/1999 |
| EP | 0952305 | | 10/1999 |
| EP | 0952306 | | 10/1999 |
| EP | 1141515 | A | 10/2001 |
| EP | 1152120 | A2 | 11/2001 |
| EP | 1152120 | A3 | 11/2001 |
| EP | 1235972 | A | 9/2002 |
| EP | 1555386 | A1 | 7/2005 |
| FR | 1325596 | | 6/1962 |
| FR | 2717855 | A1 | 9/1995 |
| FR | 2741907 | A1 | 6/1997 |
| FR | 2771133 | A | 5/1999 |
| FR | 2780751 | | 1/2000 |
| FR | 2841626 | A1 | 1/2004 |
| GB | 557823 | | 12/1943 |
| GB | 788150 | | 12/1957 |
| GB | 851096 | | 10/1960 |
| GB | 961750 | | 6/1964 |
| GB | 1000383 | | 10/1965 |
| GB | 1062610 | | 3/1967 |
| GB | 1111536 | | 5/1968 |
| GB | 2125876 | A | 3/1974 |
| GB | 1448304 | | 9/1976 |
| GB | 1460864 | | 1/1977 |
| GB | 1542847 | | 3/1979 |
| GB | 1563740 | | 3/1980 |

| | | | |
|---|---|---|---|
| GB | 2058877 | A | 4/1981 |
| GB | 2108228 | A | 5/1983 |
| GB | 2115860 | A | 9/1983 |
| GB | 2211573 | A | 7/1989 |
| GB | 2216926 | A | 10/1989 |
| GB | 2243191 | A | 10/1991 |
| GB | 2256910 | A | 12/1992 |
| GB | 2257184 | A | 6/1993 |
| GB | 2305682 | A | 4/1997 |
| GB | 2325949 | A | 5/1998 |
| GB | 2322655 | A | 9/1998 |
| GB | 2326896 | A | 1/1999 |
| GB | 2329916 | A | 4/1999 |
| GB | 2329918 | A | 4/1999 |
| GB | 2336383 | A | 10/1999 |
| GB | 2355738 | A | 4/2000 |
| GB | 2343691 | A | 5/2000 |
| GB | 2344606 | A | 6/2000 |
| GB | 2368865 | A | 7/2000 |
| GB | 2346165 | A | 8/2000 |
| GB | 2346632 | A | 8/2000 |
| GB | 2347445 | A | 9/2000 |
| GB | 2347446 | A | 9/2000 |
| GB | 2347950 | A | 9/2000 |
| GB | 2347952 | A | 9/2000 |
| GB | 2348223 | A | 9/2000 |
| GB | 2348657 | A | 10/2000 |
| GB | 2357099 | A | 12/2000 |
| GB | 2356651 | A | 5/2001 |
| GB | 2350137 | B | 8/2001 |
| GB | 2361724 | | 10/2001 |
| GB | 2359837 | B | 4/2002 |
| GB | 2370301 | A | 6/2002 |
| GB | 2371064 | A | 7/2002 |
| GB | 2371574 | A | 7/2002 |
| GB | 2373524 | | 9/2002 |
| GB | 2367842 | A | 10/2002 |
| GB | 2374622 | A | 10/2002 |
| GB | 2375560 | A | 11/2002 |
| GB | 2380213 | A | 4/2003 |
| GB | 2380503 | A | 4/2003 |
| GB | 2381019 | A | 4/2003 |
| GB | 2343691 | B | 5/2003 |
| GB | 2382828 | A | 6/2003 |
| GB | 2344606 | B | 8/2003 |
| GB | 2347950 | B | 8/2003 |
| GB | 2380213 | B | 8/2003 |
| GB | 2380214 | B | 8/2003 |
| GB | 2380215 | B | 8/2003 |
| GB | 2348223 | B | 9/2003 |
| GB | 2347952 | B | 10/2003 |
| GB | 2348657 | B | 10/2003 |
| GB | 2384800 | B | 10/2003 |
| GB | 2384801 | B | 10/2003 |
| GB | 2384802 | B | 10/2003 |
| GB | 2384803 | B | 10/2003 |
| GB | 2384804 | B | 10/2003 |
| GB | 2384805 | B | 10/2003 |
| GB | 2384806 | B | 10/2003 |
| GB | 2384807 | B | 10/2003 |
| GB | 2384808 | B | 10/2003 |
| GB | 2385353 | B | 10/2003 |
| GB | 2385354 | B | 10/2003 |
| GB | 2385355 | B | 10/2003 |
| GB | 2385356 | B | 10/2003 |
| GB | 2385357 | B | 10/2003 |
| GB | 2385358 | B | 10/2003 |
| GB | 2385359 | B | 10/2003 |
| GB | 2385360 | B | 10/2003 |
| GB | 2385361 | B | 10/2003 |
| GB | 2385362 | B | 10/2003 |
| GB | 2385363 | B | 10/2003 |
| GB | 2385619 | B | 10/2003 |
| GB | 2385620 | B | 10/2003 |
| GB | 2385621 | B | 10/2003 |
| GB | 2385622 | B | 10/2003 |
| GB | 2385623 | B | 10/2003 |
| GB | 2387405 | A | 10/2003 |
| GB | 2388134 | A | 11/2003 |
| GB | 2388860 | A | 11/2003 |
| GB | 2355738 | B | 12/2003 |
| GB | 2374622 | B | 12/2003 |
| GB | 2388391 | B | 12/2003 |
| GB | 2388392 | B | 12/2003 |
| GB | 2388393 | B | 12/2003 |
| GB | 2388394 | B | 12/2003 |
| GB | 2388395 | B | 12/2003 |
| GB | 2356651 | B | 2/2004 |
| GB | 2368865 | B | 2/2004 |
| GB | 2388860 | B | 2/2004 |
| GB | 2388861 | B | 2/2004 |
| GB | 2388862 | B | 2/2004 |
| GB | 2390628 | B | 3/2004 |
| GB | 2391033 | B | 3/2004 |
| GB | 2392686 | A | 3/2004 |
| GB | 2373524 | B | 4/2004 |
| GB | 2390387 | B | 4/2004 |
| GB | 2392686 | B | 4/2004 |
| GB | 2392691 | B | 4/2004 |
| GB | 2391575 | B | 5/2004 |
| GB | 2394979 | A | 5/2004 |
| GB | 2395506 | A | 5/2004 |
| GB | 2392932 | B | 6/2004 |
| GB | 2396635 | A | 6/2004 |
| GB | 2396640 | A | 6/2004 |
| GB | 2396641 | A | 6/2004 |
| GB | 2396642 | A | 6/2004 |
| GB | 2396643 | A | 6/2004 |
| GB | 2396644 | A | 6/2004 |
| GB | 2373468 | B | 7/2004 |
| GB | 2397261 | A | 7/2004 |
| GB | 2397262 | A | 7/2004 |
| GB | 2397263 | A | 7/2004 |
| GB | 2397264 | A | 7/2004 |
| GB | 2397265 | A | 7/2004 |
| GB | 2390622 | B | 8/2004 |
| GB | 2398317 | A | 8/2004 |
| GB | 2398318 | A | 8/2004 |
| GB | 2398319 | A | 8/2004 |
| GB | 2398320 | A | 8/2004 |
| GB | 2398321 | A | 8/2004 |
| GB | 2398322 | A | 8/2004 |
| GB | 2398323 | A | 8/2004 |
| GB | 2382367 | B | 9/2004 |
| GB | 2396643 | B | 9/2004 |
| GB | 2397261 | B | 9/2004 |
| GB | 2397262 | B | 9/2004 |
| GB | 2397263 | B | 9/2004 |
| GB | 2397264 | B | 9/2004 |
| GB | 2397265 | B | 9/2004 |
| GB | 2399120 | A | 9/2004 |
| GB | 2399579 | A | 9/2004 |
| GB | 2399580 | A | 9/2004 |
| GB | 2399848 | A | 9/2004 |
| GB | 2399849 | A | 9/2004 |
| GB | 2399850 | A | 9/2004 |
| GB | 2384502 | B | 10/2004 |
| GB | 2396644 | B | 10/2004 |
| GB | 2400126 | A | 10/2004 |
| GB | 2400624 | A | 10/2004 |
| GB | 2396640 | B | 11/2004 |
| GB | 2396642 | B | 11/2004 |
| GB | 2401136 | A | 11/2004 |
| GB | 2401137 | A | 11/2004 |
| GB | 2401138 | A | 11/2004 |
| GB | 2401630 | A | 11/2004 |

| | | | |
|---|---|---|---|
| GB | 2401631 | A | 11/2004 |
| GB | 2401632 | A | 11/2004 |
| GB | 2401633 | A | 11/2004 |
| GB | 2401634 | A | 11/2004 |
| GB | 2401635 | A | 11/2004 |
| GB | 2401636 | A | 11/2004 |
| GB | 2401637 | A | 11/2004 |
| GB | 2401638 | A | 11/2004 |
| GB | 2401639 | A | 11/2004 |
| GB | 2381019 | B | 12/2004 |
| GB | 2382368 | B | 12/2004 |
| GB | 2401136 | B | 12/2004 |
| GB | 2401137 | B | 12/2004 |
| GB | 2401138 | B | 12/2004 |
| GB | 2403970 | A | 1/2005 |
| GB | 2403971 | A | 1/2005 |
| GB | 2403972 | A | 1/2005 |
| GB | 2400624 | B | 2/2005 |
| GB | 2404676 | A | 2/2005 |
| GB | 2388134 | B | 3/2005 |
| GB | 2398320 | B | 3/2005 |
| GB | 2398323 | B | 3/2005 |
| GB | 2399120 | B | 3/2005 |
| GB | 2399848 | B | 3/2005 |
| GB | 2399849 | B | 3/2005 |
| GB | 2405893 | A | 3/2005 |
| GB | 2406117 | A | 3/2005 |
| GB | 2406118 | A | 3/2005 |
| GB | 2406119 | A | 3/2005 |
| GB | 2406120 | A | 3/2005 |
| GB | 2406125 | A | 3/2005 |
| GB | 2406126 | A | 3/2005 |
| GB | 2389597 | B | 5/2005 |
| GB | 2399119 | B | 5/2005 |
| GB | 2399580 | B | 5/2005 |
| GB | 2401630 | B | 5/2005 |
| GB | 2401631 | B | 5/2005 |
| GB | 2401632 | B | 5/2005 |
| GB | 2401633 | B | 5/2005 |
| GB | 2401634 | B | 5/2005 |
| GB | 2401635 | B | 5/2005 |
| GB | 2401636 | B | 5/2005 |
| GB | 2401637 | B | 5/2005 |
| GB | 2401638 | B | 5/2005 |
| GB | 2401639 | B | 5/2005 |
| GB | 2408278 | A | 5/2005 |
| GB | 2399579 | B | 6/2005 |
| GB | 2409216 | A | 6/2005 |
| GB | 2409218 | A | 6/2005 |
| GB | 2401893 | B | 7/2005 |
| GB | 2398326 | B | 8/2005 |
| GB | 2403970 | B | 8/2005 |
| GB | 2403971 | B | 8/2005 |
| GB | 2403972 | B | 8/2005 |
| GB | 2412681 | A | 10/2005 |
| GB | 2412682 | A | 10/2005 |
| GB | 2408277 | A | 5/2008 |
| JP | 208458 | | 10/1985 |
| JP | 6475715 | | 3/1989 |
| JP | 102875 | | 4/1995 |
| JP | 11-169975 | | 6/1999 |
| JP | 94068 | A | 4/2000 |
| JP | 107870 | A | 4/2000 |
| JP | 162192 | | 6/2000 |
| NL | 9001081 | | 12/1991 |
| RO | 113267 | B1 | 5/1998 |
| RU | 1786241 | A1 | 1/1993 |
| RU | 1804543 | A3 | 3/1993 |
| RU | 1810482 | A1 | 4/1993 |
| RU | 1818459 | A1 | 5/1993 |
| RU | 2016345 | C1 | 7/1994 |
| RU | 2039214 | C1 | 7/1995 |
| RU | 2056201 | C1 | 3/1996 |
| RU | 2064357 | C1 | 7/1996 |
| RU | 2068940 | C1 | 11/1996 |
| RU | 2068943 | C1 | 11/1996 |
| RU | 2079633 | C1 | 5/1997 |
| RU | 2083798 | C1 | 7/1997 |
| RU | 2091655 | C1 | 9/1997 |
| RU | 2095179 | C1 | 11/1997 |
| RU | 2105128 | C1 | 2/1998 |
| RU | 2108445 | C1 | 4/1998 |
| RU | 2144128 | C1 | 1/2000 |
| SU | 350833 | | 9/1972 |
| SU | 511468 | | 9/1976 |
| SU | 607950 | | 5/1978 |
| SU | 612004 | | 5/1978 |
| SU | 620582 | | 7/1978 |
| SU | 641070 | | 1/1979 |
| SU | 909114 | | 5/1979 |
| SU | 832049 | | 5/1981 |
| SU | 853089 | | 8/1981 |
| SU | 874952 | | 10/1981 |
| SU | 894169 | | 1/1982 |
| SU | 899850 | | 1/1982 |
| SU | 907220 | | 2/1982 |
| SU | 953172 | | 8/1982 |
| SU | 959878 | | 9/1982 |
| SU | 976019 | | 11/1982 |
| SU | 976020 | | 11/1982 |
| SU | 989038 | | 1/1983 |
| SU | 1002514 | | 3/1983 |
| SU | 1041671 | A | 9/1983 |
| SU | 1051222 | A | 10/1983 |
| SU | 1086118 | A | 4/1984 |
| SU | 1077803 | A | 7/1984 |
| SU | 1158400 | A | 5/1985 |
| SU | 1212575 | A | 2/1986 |
| SU | 1250637 | A1 | 8/1986 |
| SU | 1324722 | A1 | 7/1987 |
| SU | 1411434 | | 7/1988 |
| SU | 1430498 | A1 | 10/1988 |
| SU | 1432190 | A1 | 10/1988 |
| SU | 1601330 | A1 | 10/1990 |
| SU | 1627663 | A2 | 2/1991 |
| SU | 1659621 | A1 | 6/1991 |
| SU | 1663179 | A2 | 7/1991 |
| SU | 1663180 | A1 | 7/1991 |
| SU | 1677225 | A1 | 9/1991 |
| SU | 1677248 | A1 | 9/1991 |
| SU | 1686123 | A1 | 10/1991 |
| SU | 1686124 | A1 | 10/1991 |
| SU | 1686125 | A1 | 10/1991 |
| SU | 1698413 | A1 | 12/1991 |
| SU | 1710694 | A | 2/1992 |
| SU | 1730429 | A1 | 4/1992 |
| SU | 1745873 | A1 | 7/1992 |
| SU | 1747673 | A1 | 7/1992 |
| SU | 1749267 | A1 | 7/1992 |
| SU | 1295799 | A1 | 2/1995 |
| WO | WO81/00132 | | 1/1981 |
| WO | WO90/05598 | | 3/1990 |
| WO | WO92/01859 | | 2/1992 |
| WO | WO92/08875 | | 5/1992 |
| WO | WO93/25799 | | 12/1993 |
| WO | WO93/25800 | | 12/1993 |
| WO | WO94/21887 | | 9/1994 |
| WO | WO94/25655 | | 11/1994 |
| WO | WO95/03476 | | 2/1995 |
| WO | WO96/01937 | | 1/1996 |
| WO | WO96/21083 | | 7/1996 |
| WO | WO96/26350 | | 8/1996 |
| WO | WO96/37681 | | 11/1996 |
| WO | WO97/06346 | | 2/1997 |
| WO | WO97/11306 | | 3/1997 |
| WO | WO97/17524 | | 5/1997 |

| | | | |
|---|---|---|---|
| WO | WO97/17526 | | 5/1997 |
| WO | WO97/17527 | | 5/1997 |
| WO | WO97/20130 | | 6/1997 |
| WO | WO97/21901 | | 6/1997 |
| WO | WO97/35084 | | 9/1997 |
| WO | WO98/00626 | | 1/1998 |
| WO | WO98/07957 | | 2/1998 |
| WO | WO98/09053 | | 3/1998 |
| WO | WO98/22690 | | 5/1998 |
| WO | WO98/26152 | | 6/1998 |
| WO | WO98/42947 | | 10/1998 |
| WO | WO98/49423 | | 11/1998 |
| WO | WO99/02818 | | 1/1999 |
| WO | WO99/04135 | | 1/1999 |
| WO | WO99/06670 | | 2/1999 |
| WO | WO99/08827 | | 2/1999 |
| WO | WO99/08828 | | 2/1999 |
| WO | WO99/18328 | | 4/1999 |
| WO | WO99/23354 | | 5/1999 |
| WO | WO99/25524 | | 5/1999 |
| WO | WO99/25951 | | 5/1999 |
| WO | WO99/35368 | | 7/1999 |
| WO | WO99/43923 | | 9/1999 |
| WO | WO00/01926 | | 1/2000 |
| WO | WO00/04271 | | 1/2000 |
| WO | WO00/08301 | | 2/2000 |
| WO | WO00/26500 | | 5/2000 |
| WO | WO00/26501 | | 5/2000 |
| WO | WO00/26502 | | 5/2000 |
| WO | WO00/31375 | | 6/2000 |
| WO | WO00/37766 | | 6/2000 |
| WO | WO00/37767 | | 6/2000 |
| WO | WO00/37768 | | 6/2000 |
| WO | WO00/37771 | | 6/2000 |
| WO | WO00/37772 | | 6/2000 |
| WO | WO00/39432 | | 7/2000 |
| WO | WO00/46484 | | 8/2000 |
| WO | WO00/50727 | | 8/2000 |
| WO | WO00/50732 | | 8/2000 |
| WO | WO00/50733 | | 8/2000 |
| WO | WO00/77431 | A2 | 12/2000 |
| WO | WO01/04520 | A1 | 1/2001 |
| WO | WO01/04535 | A1 | 1/2001 |
| WO | WO01/18354 | A1 | 3/2001 |
| WO | WO01/21929 | A1 | 3/2001 |
| WO | WO01/26860 | A1 | 4/2001 |
| WO | WO01/33037 | A1 | 5/2001 |
| WO | WO01/38693 | A1 | 5/2001 |
| WO | WO01/60545 | A1 | 8/2001 |
| WO | WO01/83943 | A1 | 11/2001 |
| WO | WO01/98623 | A1 | 12/2001 |
| WO | WO02/01102 | A1 | 1/2002 |
| WO | WO02/10550 | A1 | 2/2002 |
| WO | WO02/10551 | A1 | 2/2002 |
| WO | WO 02/20941 | A1 | 3/2002 |
| WO | WO02/25059 | A1 | 3/2002 |
| WO | WO02/29199 | A1 | 4/2002 |
| WO | WO02/40825 | A1 | 5/2002 |
| WO | WO02/95181 | A1 | 5/2002 |
| WO | WO02/053867 | A2 | 7/2002 |
| WO | WO02/053867 | A3 | 7/2002 |
| WO | WO02/059456 | A1 | 8/2002 |
| WO | WO02/066783 | A1 | 8/2002 |
| WO | WO02/068792 | A1 | 9/2002 |
| WO | WO02/075107 | A1 | 9/2002 |
| WO | WO02/077411 | A1 | 10/2002 |
| WO | WO02/081863 | A1 | 10/2002 |
| WO | WO02/081864 | A2 | 10/2002 |
| WO | WO02/086285 | A1 | 10/2002 |
| WO | WO02/086286 | A2 | 10/2002 |
| WO | WO02/090713 | | 11/2002 |
| WO | WO02/103150 | A2 | 12/2002 |
| WO | WO03/004819 | A2 | 1/2003 |
| WO | WO03/004819 | A3 | 1/2003 |
| WO | WO03/004820 | A2 | 1/2003 |
| WO | WO03/004820 | A3 | 1/2003 |
| WO | WO03/008756 | A1 | 1/2003 |
| WO | WO03/012255 | A1 | 2/2003 |
| WO | WO03/016669 | A2 | 2/2003 |
| WO | WO03/016669 | A3 | 2/2003 |
| WO | WO03/023178 | A2 | 3/2003 |
| WO | WO03/023178 | A3 | 3/2003 |
| WO | WO03/023179 | A2 | 3/2003 |
| WO | WO03/023179 | A3 | 3/2003 |
| WO | WO03/029607 | A1 | 4/2003 |
| WO | WO03/029608 | A1 | 4/2003 |
| WO | WO03/042486 | A2 | 5/2003 |
| WO | WO03/042486 | A3 | 5/2003 |
| WO | WO03/042487 | A2 | 5/2003 |
| WO | WO03/042487 | A3 | 5/2003 |
| WO | WO03/042489 | A2 | 5/2003 |
| WO | WO03/048520 | A1 | 6/2003 |
| WO | WO03/048521 | A2 | 6/2003 |
| WO | WO03/055616 | A2 | 7/2003 |
| WO | WO03/058022 | A2 | 7/2003 |
| WO | WO03/058022 | A3 | 7/2003 |
| WO | WO03/059549 | A1 | 7/2003 |
| WO | WO03/064813 | A1 | 8/2003 |
| WO | WO03/071086 | A2 | 8/2003 |
| WO | WO03/071086 | A3 | 8/2003 |
| WO | WO03/078785 | A2 | 9/2003 |
| WO | WO03/078785 | A3 | 9/2003 |
| WO | WO03/086675 | A2 | 10/2003 |
| WO | WO03/089161 | A2 | 10/2003 |
| WO | WO03/089161 | A3 | 10/2003 |
| WO | WO03/093623 | A2 | 11/2003 |
| WO | WO03/093623 | A3 | 11/2003 |
| WO | WO03/102365 | A1 | 12/2003 |
| WO | WO03/104601 | A2 | 12/2003 |
| WO | WO03/104601 | A3 | 12/2003 |
| WO | WO03/106130 | A2 | 12/2003 |
| WO | WO2004/003337 | A1 | 1/2004 |
| WO | WO2004/009950 | A1 | 1/2004 |
| WO | WO2004/010039 | A2 | 1/2004 |
| WO | WO2004/010039 | A3 | 1/2004 |
| WO | WO2004/011776 | A2 | 2/2004 |
| WO | WO2004/011776 | A3 | 2/2004 |
| WO | WO2004/018823 | A2 | 3/2004 |
| WO | WO2004/018823 | A3 | 3/2004 |
| WO | WO2004/018824 | A2 | 3/2004 |
| WO | WO2004/018824 | A3 | 3/2004 |
| WO | WO2004/020895 | A2 | 3/2004 |
| WO | WO2004/020895 | A3 | 3/2004 |
| WO | WO2004/023014 | A2 | 3/2004 |
| WO | WO2004/023014 | A3 | 3/2004 |
| WO | WO2004/026017 | A2 | 4/2004 |
| WO | WO2004/026017 | A3 | 4/2004 |
| WO | WO2004/026073 | A2 | 4/2004 |
| WO | WO2004/026073 | A3 | 4/2004 |
| WO | WO2004/026500 | A2 | 4/2004 |
| WO | WO2004/026500 | A3 | 4/2004 |
| WO | WO2004/027200 | A2 | 4/2004 |
| WO | WO2004/027200 | A3 | 4/2004 |
| WO | WO2004/027204 | A2 | 4/2004 |
| WO | WO2004/027204 | A3 | 4/2004 |
| WO | WO2004/027205 | A2 | 4/2004 |
| WO | WO2004/027205 | A3 | 4/2004 |
| WO | WO2004/027392 | A1 | 4/2004 |
| WO | WO2004/027786 | A2 | 4/2004 |
| WO | WO2004/027786 | A3 | 4/2004 |
| WO | WO2004/053434 | A2 | 6/2004 |
| WO | WO2004/053434 | A3 | 6/2004 |
| WO | WO2004/057715 | A2 | 7/2004 |
| WO | WO2004/057715 | A3 | 7/2004 |
| WO | WO2004/067961 | A2 | 8/2004 |
| WO | WO2004/072436 | A1 | 8/2004 |

| | | | |
|---|---|---|---|
| WO | WO2004/074622 | A2 | 9/2004 |
| WO | WO2004/074622 | A3 | 9/2004 |
| WO | WO2004/076798 | A2 | 9/2004 |
| WO | WO2004/076798 | A3 | 9/2004 |
| WO | WO2004/081346 | A2 | 9/2004 |
| WO | WO2004/083591 | A2 | 9/2004 |
| WO | WO2004/083591 | A3 | 9/2004 |
| WO | WO2004/083592 | A2 | 9/2004 |
| WO | WO2004/083592 | A3 | 9/2004 |
| WO | WO2004/083593 | A2 | 9/2004 |
| WO | WO2004/083594 | A2 | 9/2004 |
| WO | WO2004/083594 | A3 | 9/2004 |
| WO | WO2004/085790 | A2 | 10/2004 |
| WO | WO2004/089608 | A2 | 10/2004 |
| WO | WO2004/092527 | A2 | 10/2004 |
| WO | WO2004/092528 | A2 | 10/2004 |
| WO | WO2004/092530 | A2 | 10/2004 |
| WO | WO2004/092530 | A3 | 10/2004 |
| WO | WO2004/094766 | A2 | 11/2004 |
| WO | WO2005/017303 | A2 | 2/2005 |
| WO | WO2005/021921 | A2 | 3/2005 |
| WO | WO2005/021921 | A3 | 3/2005 |
| WO | WO2005/021922 | A2 | 3/2005 |
| WO | WO2005/021922 | A3 | 3/2005 |
| WO | WO2005/024170 | A2 | 3/2005 |
| WO | WO2005/024171 | A2 | 3/2005 |
| WO | WO2005/028803 | A2 | 3/2005 |
| WO | WO2005/071212 | A1 | 4/2005 |
| WO | WO2005/081803 | A2 | 9/2005 |
| WO | WO2005/086614 | A2 | 9/2005 |

OTHER PUBLICATIONS

Turcotte and Schubert, Geodynamics (1982) John Wiley & Sons, Inc., pp. 9, 432.
Baker Hughes Incorporated, "EXPatch Expandable Cladding System" (2002).
Baker Hughes Incorporated, "EXPress Expandable Screen System".
High-Tech Wells, "World's First Completion Set Inside Expandable Screen" (2003) Gilmer, J.M., Emerson, A.B.
Baker Hughes Incorporated, "Technical Overview Production Enhancement Technology" (Mar. 3, 2003) Geir Owe Egge.
Baker Hughes Incorporated, "FORMlock Expandable Liner Hangers".
Weatherford Completion Systems, "Expandable Sand Screens" (2002).
Expandable Tubular Technology, "EIS Expandable Isolation Sleeve" (Feb. 2003).
Oilfield Catalog; "Jet-Lok Product Application Description" (Aug. 8, 2003).
Power Ultrasonics, "Design and Optimisation of an Ultrasonic Die System For Form" Chris Cheers (1999, 2000).
Research Area—Sheet Metal Forming—Superposition of Vibra; Fraunhofer IWU (2001).
Research Projects; "Analysis of Metal Sheet Formability and It's Factors of Influence" Prof. Dorel Banabic (2003).
www.materialsresources.com, "Low Temperature Bonding of Dissimilar and Hard-to-Bond Materials and Metal-Including.."(2004).
www.tribtech.com. "Trib-gel A Chemical Cold Welding Agent" G R Linzell (Sep. 14, 1999).
www.spurind.com, "Galvanic Protection, Metallurgical Bonds, Custom Fabrication—Spur Industries" (2000).
Lubrication Engineering, "Effect of Micro-Surface Texturing on Breakaway Torque and Blister Formation on Carbon-Graphite Faces in a Mechanical Seal" Philip Guichelaar, Karalyn Folkert, Izhak Etsion, Steven Pride (Aug. 2002).
Surface Technologies Inc., "Improving Tribological Performance of Mechanical Seals by Laser Surface Texturing" Izhak Etsion.
Tribology Transactions "Experimental Investigation of Laser Surface Texturing for Reciprocating Automotive Components" G Ryk, Y Klingerman and I Etsion (2002).
Proceeding of the International Tribology Conference, "Microtexturing of Functional Surfaces for Improving Their Tribological Performance" Henry Haefke, Yvonne Gerbig, Gabriel Dumitru and Valerio Romano (2002).
Sealing Technology, "A laser surface textured hydrostatic mechanical seal" Izhak Etsion and Gregory Halperin (Mar. 2003).
Metalforming Online, "Advanced Laser Texturing Tames Tough Tasks" Harvey Arbuckle.
Tribology Transactions, "A Laser Surface Textured Parallel Thrust Bearing" V. Brizmer, Y. Klingerman and I. Etsion (Mar. 2003).
PT Design, "Scratching the Surface" Todd E. Lizotte (Jun. 1999).
Tribology Transactions, "Friction-Reducing Surface-Texturing in Reciprocating Automotive Components" Aviram Ronen, and Izhak Etsion (2001).
International Search Report, Application PCT/US01/04753, Jul. 3, 2001.
International Search Report, Application PCT/IL00/00245, Sep. 18, 2000.
International Search Report, Application PCT/US00/18635, Nov. 24, 2000.
International Search Report, Application PCT/US00/30022, Mar. 27, 2001.
International Search Report, Application PCT/US00/27645, Dec. 29, 2000.
International Search Report, Application PCT/US01/19014, Nov. 23, 2001.
International Search Report, Application PCT/US01/41446, Oct. 30, 2001.
International Search Report, Application PCT/US01/23815, Nov. 16, 2001.
International Search Report, Application PCT/US01/28960, Jan. 22, 2002.
International Search Report, Application PCT/US01/30256, Jan. 3, 2002.
International Search Report, Application PCT/US02/04353, Jun. 24, 2002.
International Search Report, Application PCT/US02/00677, Jul. 17, 2002.
International Search Report, Application PCT/US02/00093, Aug. 6, 2002.
International Search Report, Application PCT/US02/29856, Dec. 16, 2002.
International Search Report, Application PCT/US02/20256, Jan. 3, 2003.
International Search Report, Application PCT/US02/39418, Mar. 24, 2003.
International Search Report, Application PCT/US03/15020; Jul. 30, 2003.
International Search Report, Application PCT/US02/36157; Sep. 29, 2003.
International Search Report, Application PCT/US02/20477; Oct. 31, 2003.
International Search Report, Application PCT/US03/10144; Oct. 31, 2003.
International Search Report, Application PCT/US03/20694; Nov. 12, 2003.
International Search Report, Application PCT/US03/11765; Nov. 13, 2003.
Search Report to Application No. GB 9926450.9, Feb. 28, 2000.
Search Report to Application No. GB 9926449.1, Mar. 27, 2000.
Search Report to Application No. GB 9930398.4, Jun. 27, 2000.
Search Report to Application No. GB 0004285.3, Jul. 12, 2000.
Search Report to Application No. GB 0003251.6, Jul. 13, 2000.
Examination Report to Application No. GB 0005399.1; Jul. 24, 2000.
Search Report to Application No. GB 0004282.0, Jul. 31, 2000.
Search Report to Application No. GB 0013661.4, Oct. 20, 2000.
Search Report to Application No. GB 0004282.0 Jan. 15, 2001.
Search Report to Application No. GB 0004285.3, Jan. 17, 2001.
Search Report to Application No. GB 0005399.1, Feb. 15, 2001.
Search Report to Application No. GB 0013661.4, Apr. 17, 2001.
Examination Report to Application No. GB 9926450.9, May 15, 2002.
Search Report to Application No. GB 9926449.1, Jul. 4, 2001.

Search Report to Application No. GB 9926449.1, Sep. 5, 2001.
Search Report to Application No. 1999 5593, Aug. 20, 2002.
Search Report to Application No. GB 0004285.3, Aug. 28, 2002.
Examination Report to Application No. GB 0005399.1; Oct. 14, 2002.
Examination Report to Application No. GB 9926450.9, Nov. 22, 2002.
Search Report to Application No. GB 0219757.2, Nov. 25, 2002.
Search Report to Application No. GB 0220872.6, Dec. 5, 2002.
Search Report to Application No. GB 0219757.2, Jan. 20, 2003.
Search Report to Application No. GB 0013661.4, Feb. 19, 2003.
Search Report to Application No. GB 0225505.7, Mar. 5, 2003.
Search Report to Application No. GB 0220872.6, Mar. 13, 2003.
Examination Report to Application No. 0004285.3, Mar. 28, 2003.
Examination Report to Application No. GB 0208367.3, Apr. 4, 2003.
Examination Report to Application No. GB 0212443.6, Apr. 10, 2003.
Search and Examination Report to Application No. GB 0308296.3, Jun. 2, 2003.
Search and Examination Report to Application No. GB 0308297.1, Jun. 2, 2003.
Search and Examination Report to Application No. GB 0308295.5, Jun. 2, 2003.
Search and Examination Report to Application No. GB 0308293.0, Jun. 2, 2003.
Search and Examination Report to Application No. GB 0308294.8, Jun. 2, 2003.
Search and Examination Report to Application No. GB 0308303.7, Jun. 2, 2003.
Search and Examination Report to Application No. GB 0308290.6, Jun. 2, 2003.
Search and Examination Report to Application No. GB 0308299.7, Jun. 2, 2003.
Search and Examination Report to Application No. GB 0308302.9, Jun. 2, 2003.
Search and Examination Report to Application No. GB 0004282.0, Jun. 3, 2003.
Search and Examination Report to Application No. GB 0310757.0, Jun. 12, 2003.
Search and Examination Report to Application No. GB 0310836.2, Jun. 12, 2003.
Search and Examination Report to Application No. GB 0310785.1, Jun. 12, 2003.
Search and Examination Report to Application No. GB 0310759.6, Jun. 12, 2003.
Search and Examination Report to Application No. GB 0310801.6, Jun. 12, 2003.
Search and Examination Report to Application No. GB 0310772.9, Jun. 12, 2003.
Search and Examination Report to Application No. GB 0310795.0, Jun. 12, 2003.
Search and Examination Report to Application No. GB 0310833.9, Jun. 12, 2003.
Search and Examination Report to Application No. GB 0310799.2, Jun. 12, 2003.
Search and Examination Report to Application No. GB 0310797.6, Jun. 12, 2003.
Search and Examination Report to Application No. GB 0310770.3, Jun. 12, 2003.
Search and Examination Report to Application No. GB 0310099.7, Jun. 24, 2003.
Search and Examination Report to Application No. GB 0310104.5, Jun. 24, 2003.
Search and Examination Report to Application No. GB 0310101.1, Jun. 24, 2003.
Search and Examination Report to Application No. GB 0310118.5, Jun. 24, 2003.
Search and Examination Report to Application No. GB 0310090.6, Jun. 24, 2003.
Search and Examination Report to Application No. GB 0225505.7, Jul. 1, 2003.
Examination Report to Application No. GB 0310836.2, Aug. 7, 2003.
Search and Examination Report to Application No. GB 0316883.8, Aug. 14, 2003.
Search and Examination Report to Application No. GB 0316886.1, Aug. 14, 2003.
Search and Examination Report to Application No. GB 0316887.9, Aug. 14, 2003.
Search and Examination Report to Application No. GB 0318547.4; Sep. 3, 2003.
Search and Examination Report to Application No. GB 0318549.3; Sep. 3, 2003.
Search and Examination Report to Application No. GB 0318545.1, Sep. 3, 2003.
Search and Examination Report to Application No. GB 0318550.1, Sep. 3, 2003.
Search and Examination Report to Application No. GB 0313406.1, Sep. 3, 2003.
Search and Examination Report to Application No. GB 0324174.2, Nov. 4, 2003.
Search and Examination Report to Application No. GB 0324172.6, Nov. 4, 2003.
Examination Report to Application No. GB 0208367.3, Nov. 17, 2003.
Search and Examination Report to Application No. GB 0325071.9, Nov. 18, 2003.
Examination Report to Application No. GB 0316886.1, Nov. 25, 2003.
Examination Report to Application No. GB 0316887.9 Nov. 25, 2003.
Examination Report to Application No. GB 0013661.4, Nov. 25, 2003.
Examination Report to Application No. GB 0316883.8, Nov. 25, 2003.
Examination Report to Application No. GB 0300085.8, Nov. 28, 2003.
Examination Report to Application No. GB 030086.6, Dec. 1, 2003.
Search and Examination Report to Application No. GB 0325072.7; Dec. 3, 2003.
Search and Examination Report to Application No. GB 0320579.6, Dec. 16, 2003.
Search and Examination Report to Application No. GB 0320580.4, Dec. 17, 2003.
Search and Examination Report to Application No. GB 0323891.2, Dec. 19, 2003.
Examination Report to Application No. GB 0325072.7, Feb. 5, 2004.
Michigan Metrology "3D Surface Finish Roughness Texture Wear WYKO Veeco" C.A. Brown, PHD; Charles, W.A. Johnsen, S. Chester.
International Search Report, Application PCT/US02/00677, Feb. 24, 2004.
International Search Report, Application PCT/US02/20477; Apr. 6, 2004.
International Search Report, Application PCT/US02/24399; Feb. 27, 2004.
International Search Report, Application PCT/US02/25608; May 24, 2004.
International Search Report, Application PCT/US02/25727; Feb. 19, 2004.
International Search Report, Application PCT/US02/36157; Apr. 14, 2004.
International Search Report, Application PCT/US02/36267; May 21, 2004.
International Search Report, Application PCT/US02/39425, May 28, 2004.
International Search Report, Application PCT/US03/00609, May 20, 2004.
International Search Report, Application PCT/US03/04837, May 28, 2004.
International Search Report, Application PCT/US03/06544, Jun. 9, 2004.
Examination Report, Application PCT/US03/10144; Jul. 7, 2004.
International Search Report, Application PCT/US03/13787; May 28, 2004.

International Search Report, Application PCT/US03/14153; May 28, 2004.
International Search Report, Application PCT/US03/18530; June 24, 2004.
International Search Report, Application PCT/US03/19993; May 24, 2004.
International Search Report, Application PCT/US03/20870; May 24, 2004.
International Search Report, Application PCT/US03/24779; Mar. 3, 2004.
International Search Report, Application PCT/US03/25675; May 25, 2004.
International Search Report, Application PCT/US03/25676; May 17, 2004.
International Search Report, Application PCT/US03/25677; May 21, 2004.
International Search Report, Application PCT/US03/25707; Jun. 23, 2004.
International Search Report, Application PCT/US03/25715; Apr. 9, 2004.
International Search Report, Application PCT/US03/25742; May 27, 2004.
International Search Report, Application PCT/US03/29460; May 25, 2004.
International Search Report, Application PCT/US03/25667; Feb. 26, 2004.
International Search Report, Application PCT/US03/29859; May 21, 2004.
International Search Report, Application PCT/US03/38550; Jun. 15, 2004.
Examination Report to Application No. GB 0208367.3, Jan. 30, 2004.
Examination Report to Application No. GB 0216409.3, Feb. 9, 2004.
Examination Report to Application No. GB 0219757.2, May 10, 2004.
Examination Report to Application No. GB 0314846.7, Jul. 15, 2004.
Search and Examination Report to Application No. GB 0308293.0, Jul. 14, 2003.
Search and Examination Report to Application No. GB 0308294.8, Jul. 14, 2003.
Search and Examination Report to Application No. GB 0308295.5, Jul. 14, 2003.
Search and Examination Report to Application No. GB 0308296.3, Jul. 14, 2003.
Search and Examination Report to Application No. GB 0308297.1, Jul. 2003.
Search and Examination Report to Application No. GB 0308303.7, Jul. 14, 2003.
Examination Report to Application No. GB 0311596.1, May 18, 2004.
Examination Report to Application No. GB 0320747.9, May 25, 2004.
Examination Report to Application No. GB 0325071.9, Feb. 2, 2004.
Examination Report to Application No. GB 0325072.7; Apr. 13, 2004.
Examination Report to Application No. GB 0404796.5; May 20, 2004.
Search and Examination Report to Application No. GB 0404826.0, Apr. 21, 2004.
Search and Examination Report to Application No. GB 0404828.6, Apr. 21, 2004.
Search and Examination Report to Application No. GB 0404830.2, Apr. 21, 2004.
Search and Examination Report to Application No. GB 0404832.8, Apr. 21, 2004.
Search and Examination Report to Application No. GB 0404833.6, Apr. 21, 2004.
Search and Examination Report to Application No. GB 0404837.7, May 17, 2004.
Examination Report to Application No. GB 0404837.7, Jul. 12, 2004.
Search and Examination Report to Application No. GB 0404839.3, May 14, 2004.
Search and Examination Report to Application No. GB 0404842.7, May 14, 2004.
Search and Examination Report to Application No. GB 0404845.0, May 14, 2004.
Search and Examination Report to Application No. GB 0404849.2, May 17, 2004.
Examination Report to Application No. GB 0406257.6, Jun. 28, 2004.
Examination Report to Application No. GB 0406258.4, May 20, 2004.
Examination Report to Application No. GB 0408672.4, Jul. 12, 2004.
Search and Examination Report to Application No. GB 0411892.3, Jul. 14, 2004.
Search and Examination Report to Application No. GB 0411893.3, Jul. 14, 2004.
Search and Examination Report to Application No. GB 0411894.9, Jun. 30, 2004.
Written Opinion to Application No. PCT/US01/19014; Dec. 10, 2002.
Written Opinion to Application No. PCT/US01/23815; Jul. 25, 2002.
Written Opinion to Application No. PCT/US01/28960; Dec. 2, 2002.
Written Opinion to Application No. PCT/US01/30256; Nov. 11, 2002.
Written Opinion to Application No. PCT/US02/00093; Apr. 21, 2003.
Written Opinion to Application No. PCT/US02/00677; Apr. 17, 2003.
Written Opinion to Application No. PCT/US02/04353; Apr. 11, 2003.
Written Opinion to Application No. PCT/US02/20256; May 9, 2003.
Written Opinion to Application No. PCT/US02/24399; Apr. 28, 2004.
Written Opinion to Application No. PCT/US02/25727; May 17, 2004.
Written Opinion to Application No. PCT/US02/39418; Jun. 9, 2004.
Written Opinion to Application No. PCT/US03/11765 May 11, 2004.
International Examination Report, Application PCT/US02/24399, Aug. 6, 2004.
Examination Report, Application PCT/US02/25727; Jul. 7, 2004.
International Examination Report, Application PCT/US03/11765; Dec. 10, 2004.
International Examination Report, Application PCT/US03/20870; Sep. 30, 2004.
International Examination Report, Application PCT/US03/25676, Aug. 17, 2004.
International Examination Report, Application PCT/US03/25677, Aug. 17, 2004.
International Examination Report, Application PCT/US03/25742; Dec. 20, 2004.
International Examination Report, Application PCT/US03/29460; Dec. 8, 2004.
International Examination Report, Application PCT/US03/29859, Aug. 16, 2004.
Examination Report to Application GB 0220872.6, Oct. 29, 2004.
Examination Report to Application No. GB 0225505.7, Oct. 27, 2004.
Examination Report to Application No. GB 0306046.4, Sep. 10, 2004.
Examination Report to Application No. GB 0400018.8; Oct. 29, 2004.
Examination Report to Application No. GB 0400019.6; Oct. 29, 2004.
Search and Examination Report to Application No. GB 0404833.6, Aug. 19, 2004.
Examination Report to Application No. GB 0404830.2, Aug. 17, 2004.
Search and Examination Report to Application No. GB 0412190.1, Jul. 22, 2004.
Search and Examination Report to Application No. GB 0412191.9, Jul. 22, 2004.
Search and Examination Report to Application No. GB 0412192.7, Jul. 22, 2004.
Search Report to Application No. GB 0415835.8, Dec. 2, 2004.

Search and Examination Report to Application No. GB 0416834.0, Aug. 11, 2004.
Search and Examination Report to Application No. GB 0416834.0, Nov. 16, 2004.
Search and Examination Report to Application No. GB 0417810.9, Aug. 25, 2004.
Search and Examination Report to Application No. GB 0417811.7, Aug. 25, 2004.
Search and Examination Report to Application No. GB 0418005.5, Aug. 25, 2004.
Search and Examination Report to Application No. GB 0418425.5, Sep. 10, 2004.
Search and Examination Report to Application No. GB 0418426.3 Sep. 10, 2004.
Search and Examination Report to Application No. GB 0418427.1 Sep. 10, 2004.
Search and Examination Report to Application No. GB 0418429.7 Sep. 10, 2004.
Search and Examination Report to Application No. GB 0418430.5 Sep. 10, 2004.
Search and Examination Report to Application No. GB 0418431.3 Sep. 10, 2004.
Search and Examination Report to Application No. GB 0418432.1 Sep. 10, 2004.
Search and Examination Report to Application No. GB 0418433.9 Sep. 10, 2004.
Search and Examination Report to Application No. GB 0418439.6 Sep. 10, 2004.
Search and Examination Report to Application No. GB 0418442.0 Sep. 10, 2004.
Examination Report to Application No. GB 0422419.2 Dec. 8, 2004.
Search and Examination Report to Application No. GB 0422893.8 Nov. 24, 2004.
Search and Examination Report to Application No. GB 0423416.7 Nov. 12, 2004.
Search and Examination Report to Application No. GB 0423417.5 Nov. 12, 2004.
Search and Examination Report to Application No. GB 0423418.3 Nov. 12, 2004.
Written Opinion to Application No. PCT/US02/25608 Sep. 13, 2004.
Written Opinion to Application No. PCT/US02/25675 Nov. 24, 2004.
Written Opinion to Application No. PCT/US02/39425; Nov. 22, 2004.
Written Opinion to Application No. PCT/US03/13787 Nov. 9, 2004.
Written Opinion to Application No. PCT/US03/14153 Sep. 9, 2004.
Written Opinion to Application No. PCT/US03/14153 Nov. 9, 2004.
Written Opinion to Application No. PCT/US03/18530 Sep. 13, 2004.
Written Opinion to Application No. PCT/US03/19993 Oct. 15, 2004.
Written Opinion to Application No. PCT/US03/38550 Dec. 10, 2004.
Combined Search Report and Written Opinion to Application No. PCT/US04/08030 Jan. 6, 2005.
Letter From Baker Oil Tools to William Norvell in Regards to Enventure's Claims of Baker Infringement Of Enventure's Expandable Patents Apr. 1, 2005.
Offshore, "Agbada Well Solid Tubulars Expanded Bottom Up, Screens Expanded Top Down" William Furlow, Jan. 2002.
Drilling Contractor, "Solid Expandable Tubulars are Enabling Technology" Mar./Apr. 2001.
Hart's E & P, "SET Technology: Setting the Standard" Mar. 2002.
Hart's E & P, "An Expanded Horizon" Jim Brock, Lev Ring, Scott Costa, Andrei Filippov. Feb. 2000.
Hart's E & P, "Technology Strategy Breeds Value" Ali Daneshy. May 2004.
Hart's E & P, "Solid Expandable Tubulars Slimwell: Stepping Stone to MonoDiameter" Jun. 2003.
Innovators Chart the Course, Shell Exploration & Production.
"Case Study: Value in Drilling Derived From Application-Specific Technology" Langley, Diane., Oct. 2004.
L'Usine Nouvelle, "Les Tubes Expansibles Changent La Face Du Forage Petrolier" Demoulin, Laurence, No. 2878 . pp. 50-52, Jul. 3, 2003.
Offshore, "Monodiameter Technology Keeps Hole Diameter to TD", Hull, Jennifer., Oct. 2002.
News Release, "Shell and Halliburton Agree to Form Company to Develop and Market Expandable Casing Technology", 1998.
Offshore, "Expandable Tubulars Enable Multilaterals Without Compromise on Hole Size," DeMong, Karl, et al., Jun. 2003.
Offshore Engineer, "From Exotic to Routine- the offshore quickstep" Apr. 2004, pp. 77-83.
Offshore, "Expandable Solid Casing Reduces Telescope Effect," Furlow, William, Aug. 1998, pp. 102 & 140.
Offshore, "Casing Expansion, Test Process Fine Tuned on Ultradeepwater Well," Furlow, William, Dec. 2000.
Offshore Engineer, "Oilfield Service Trio Target Jules Verne Territory," Von Flater, Rick., Aug. 2001.
Offshore, "Expandable Casing Program Helps Operator Hit TD With Larger Tubulars" Furlow, William, Jan. 2000.
Offshore, "Same Internal Casing Diameter From Surface to TD", Cook, Lance., Jul. 2002.
Oil and Gas Investor, "Straightening the Drilling Curve," Williams, Peggy. Jan. 2003.
Petroleum Engineer International, "Expandable Casing Accesses Remote Reservoirs" Apr. 1999.
New Technology Magazine, "Pipe Dream Reality," Smith, Maurice, Dec. 2003.
Roustabout, "First ever SET Workshop Held in Aberdeen," Oct. 2004.
Roustabout, "Enventure Ready to Rejuvenate the North Sea" Sep. 2004.
EP Journal of Technology, "Solid Expandable Tubulars (SET) Provide Value to Operators Worldwide in a Variety of Applications," Fonlova, Rick, Apr. 2005.
The American Oil & Gas Reporter, "Advances Grow Expandable Applications," Bullock, Michael D., Sep. 2004.
Upstream, "Expandable Tubulars Close in on the Holy Grail of Drilling", Cottrill, Adrian, Jul. 26, 2002.
Oil and Gas, "Shell Drills World's First Monodiameter Well in South Texas" Sumrow, Mike., Oct. 21, 2002.
World Oil, "Expandables and the Dream of the Monodiameter Well: A Status Report", Fischer, Perry, Jul. 2004.
World Oil, "Well Remediation Using Expandable Cased-Hole Liners", Merritt, Randy et al., Jul. 2002.
World Oil, "How in Situ Expansion Affects Casing and Tubing Properties", Mack, R.D., et al., Jul. 1999. pp. 69-71.
Enventure Global Technology "Expandable Tubular Technology—Drill Deeper, Farther, More Economically" Mark Rivenbark.
Society of Petroleum Engineers, "Addressing Common Drilling Challenges Using Solid Expandable Tubular Technology" Perez-Roca, Eduardo, et al., 2003.
Society of Petroleum Engineers, "Monodiameter Drilling Liner—From Concept to Reality" Dean, Bill, et al. 2003.
Offshore Technology Conference, "Expandable Liner Hangers: Case Histories" Moore, Melvin, J., et al., 2002.
Offshore Technology Conference, "Deepwater Expandable Openhole Line Case Histories: Learnings Through Field Applications" Grant, Thomas P., et al., 2002.
Offshore Technology Conference, "Realization of the MonoDiameter Well: Evolution of a Game-Changing Technology" Dupal, Kenneth, et al., 2002.
Offshore Technology Conference, "Water Production Reduced Using Solid Expandable Tubular Technology to "Clad" in Fractured Carbonate Formation" van Noort, Roger, et al., 2003.
Offshore Technology Conference, "Overcoming Well Control Challenges with Solid Expandable Tubular Technology" Patin, Michael, et al., 2003.
Offshore Technology Conference, "Expandable Cased-hole Liner Remediates Prolific Gas Well and Minimizes Loss of Production" Buckler Bill, et al., 2002.
Offshore Technology Conference, "Development and Field Testing of Solid Expandable Corrosion Resistant Cased-hole Liners to Boost Gas Production in Corrosive Environments" Siemers Gertjan, et al., 2003.

"Practices for Providing Zonal Isolation in Conjunction with Expandable Casing Jobs-Case Histories" Sanders, T, et al. 2003.
Society of Petroleum Engineers, "Increasing Solid Expandable Tubular Technology Reliability in a Myriad of Downhole Environments", Escobar, C. et al., 2003.
Society of Petroleum Engineers, "Water Production Management—PDO's Successful Application of Expandable Technology", Braas, JCM., et al., 2002.
Society of Petroleum Engineers, "Expandable Tubular Solutions", Filippov, Andrei, et al., 1999.
Society of Petroleum Engineers, "Expandable Liner Hanger Provides Cost-Effective Alternative Solution" Lohoefer, C. Lee, et al., 2000.
Society of Petroleum Engineers, "Solid Expandable Tubular Technology—A Year of Case Histories in the Drilling Environment" Dupal, Kenneth, et al., 2001.
"In-Situ Expansion of Casing and Tubing" Mack, Robert et al.
Society of Petroleum Engineers, "Expandable Tubulars: Field Examples of Application in Well Construction and Remediation" Diagle, Chan, et al., 2000.
AADE Houston Chapter, "Subsidence Remediation—Extending Well Life Through the Use of Solid Expandable Casing Systems" Shepherd, David, et al., Mar. 2001 Conference.
Society of Petroleum Engineers, "Planning the Well Construction Process for the Use of Solid Expandable Casing" DeMong, Karl, et al., 2003.
Enventure Global Technology, "The Development and Applications of Solid Expandable Tubular Technology" Cales, GL., 2003.
Society of Petroleum Engineers, "Installation of Solid Expandable Tubular Systems Through Milled Casing Windows" Waddell, Kevin, et al., 2004.
Society of Petroleum Engineers, "Solid Expandable Tubular Technology in Mature Basins" Blasingame, Kate, et al., 2003.
"Casing Design in Complex Wells: The Use of Expandables and Multilateral Technology to Attack the size Reduction Issue" DeMong, Karl., et al.
"Well Remediation Using Expandable Cased-Hole Liners- Summary of Case Histories" Merritt, Randy, et al.
Offshore Technology Conference, "Transforming Conventional Wells to Bigbore Completions Using Solid Expandable Tubular Technology" Mohd Nor, Norlizah, et al., 2002.
Society of Petroleum Engineers, "Using Solid Expandable Tubulars for Openhole Water Shutoff" van Noort, Roger, et al., 2002.
Society of Petroleum Engineers, "Case Histories- Drilling and Recompletion Applications Using Solid Expandable Tubular Technology" Campo. Don, et al., 2002.
Society of Petroleum Engineers, "Reaching Deep Reservoir Targets Using Solid Expandable Tubulars" Gusevik Rune, et al., 2002.
Society of Petroleum Engineers, "Breakthroughs Using Solid Expandable Tubulars to Construct Extended Reach Wells" Demong, Karl, et al., 2004.
Deep Offshore Technology Conference "Meeting Economic Challenges of Deepwater Drilling with Expandable-Tubular Technology" Haut, Richard, et al., 1999.
Offshore Technology Conference, "Field Trial Proves Upgrades to Solid Expandable Tubulars" Moore, Melvin, et al., 2002.
"Well Design with Expandable Tubulars Reduces Cost and Increases Success in Deepwater Applications" Dupal, Ken, et al., Deep Shore Technology 2000.
Offshore Technology Conference, "Reducing Non-Productive Time Through the Use of Solid Expandable Tubulars: How to Beat the Curve Through Pre-Planning" Cales, Gerry, et al., 2004.
Offshore Technology Conference, "Three Diverse Applications on Three Continents for a Single Major Operator" Sanders, Tom, et al., 2004.
Offshore Technology Conference,, "Expanding Oil Field Tubulars Through a Window Demonstrates Value and Provides New Well Contruction Option" Sparling, Steven, et al., 2004.
Society of Petroleum Engineers, "Advances in Single-diameter Well Technology: The Next Step to Cost-Effective Optimization" Waddell, Kevin, et al., 2004.
Society of Petroleum Engineers, "New Technologies Combine to Reduce Drilling Cost in Ultradeepwater Applications" Touboul, Nicolas, et al., 2004.
Society of Petroleum Engineers, "Solid Expandable Tubular Technology: The Value of Planned Installation vs. Contingency" Rivenbark, Mark, et al., 2004.
Society of Petroleum Engineers, "Changing Safety Paradigms in the Oil and Gas Industry" Ratilff, Matt, et al., 2004.
"Casing Remediation- Extending Well Life Through The Use of Solid Expandable Casing Systems" Merritt, Randy, et al.
Society of Petroleum Engineers, "Window Exit Sidetrack Enhancements Through the Use of Solid Expandable Casing", Rivenbark, Mark, et al., 2004.
"Solid Expandable Tubular Technology: The Value of Planned Installations vs. Contingency", Carstens, Chris, et al.
Data Sheet, "Enventure Cased-Hole Liner (CHL) System" Enventure Global Technology, Dec. 2002.
Case History, "Graham Ranch No. 1 Newark East Barnett Field" Enventure Global Technology, Feb. 2002.
Case History, "K.K. Camel No. 1 Ridge Field Lafayette Parish, Louisiana" Enventure Global Technology, Feb. 2002.
Case History, "Eemskanaal—2 Groningen" Enventure Global Technology, Feb. 2002.
Case History, "Yibal 381 Oman" Enventure Global Technology, Feb. 2002.
Case History, "Mississippi Canyon 809 URSA TLP, OSC-G 5868, No. A-12" Enventure Global Technology, Mar. 2004.
Case History, "Unocal Sequoia Mississippi Canyon 941 Well No. 2" Enventure Global Technology, 2005.
"SET Technology: The Facts" Enventure Global Technology, 2004.
Data Sheet, "Enventure Openhole Liner (OHL) System" Enventure Global Technology, Dec. 2002.
Data Sheet, "Window Exit Applications OHL Window Exit Expansion" Enventure Global Technology, Jun. 2003.
"Expand Your Opportunities." *Enventure*. CD-ROM. Jun. 1999.
"Expand Your Opportunities." *Enventure*. CD-ROM. May 2001.
International Examination Report, Application PCT/US02/39418, Feb. 18, 2005.
International Examination Report, Application PCT/US03/06544, May 10, 2005.
International Examination Report, Application PCT/US03/11765;; Jan. 25, 2005.
International Examination Report, Application PCT/US03/13787; Mar. 2, 2005.
International Examination Report, Application PCT/US03/14153; May 12, 2005.
International Examination Report, Application PCT/US03/15020, May 9, 2005.
International Examination Report, Application PCT/US03/25667, May 25, 2005.
International Search Report, Application PCT/US03/25716; Jan. 13, 2005.
International Examination Report, Application PCT/US03/29858; May 23, 2005.
International Search Report, Application PCT/US03/38550; May 23, 2005.
International Preliminary Report on Patentability, Application PCT/US04/02122; May 13, 2005.
International Preliminary Report on Patentability, Application PCT/US04/04740; Apr. 27, 2005.
International Preliminary Report on Patentability, Application PCT/US04/06246; May 5, 2005.
International Preliminary Report on Patentability, Application PCT/US04/08030; Apr. 7, 2005.
International Preliminary Report on Patentability, Application PCT/US04/08030; Jun. 10, 2005.
International Preliminary Report on Patentability, Application PCT/US04/08073; May 9, 2005.
International Preliminary Report on Patentability, Application PCT/US04/11177;Jun. 9, 2005.
Examination Report to Application No. AU 2001278196 ,Apr. 21, 2005.
Examination Report to Application No. AU 2002237757 ,Apr. 28, 2005.
Examination Report to Application No. AU 2002240366 ,Apr. 13, 2005.

Search Report to Application No. EP 02806451.7; Feb. 9, 2005.
Examination Report to Application No. GB 0225505.7 Feb. 15, 2005.
Examination Report to Application No. GB 0400019.6; May 19, 2005.
Examination Report to Application No. GB 0403891.5, Feb. 14, 2005.
Examination Report to Application No. GB 0403893.1, Feb. 14, 2005.
Examination Report to Application No. GB 0403894.9, Feb. 15, 2005.
Examination Report to Application No. GB 0403920.2, Feb. 15, 2005.
Examination Report to Application No. GB 0403921.0, Feb. 15, 2005.
Examination Report to Application No. GB 0404796.5; Apr. 14, 2005.
Examination Report to Application No. GB 0406257.6, Jan. 25, 2005.
Examination Report to Application No. GB 0406258.4; Jan. 12, 2005.
Examination Report to Application No. GB 0408672.4, Mar. 21, 2005.
Examination Report to Application No. GB 0411698.4, Jan. 24, 2005.
Examination Report to Application No. GB 0411892.3, Feb. 21, 2005.
Examination Report to Application No. GB 0412533.2, May 20, 2005.
Search Report to Application No. GB 0415835.8; Mar. 10, 2005.
Examination Report to Application No. 0416625.2 Jan. 20, 2005.
Search and Examination Report to Application No. GB 0425948.7 Apr. 13, 2005.
Search and Examination Report to Application No. GB 0425951.1 Apr. 14, 2005.
Search and Examination Report to Application No. GB 0425956.0 Apr. 14, 2005.
Search and Examination Report to Application No. GB 0426155.8 Jan. 12, 2005.
Search and Examination Report to Application No. GB 0426156.6 Jan. 12, 2005.
Search and Examination Report to Application No. GB 0426157.4 Jan. 12, 2005.
Examination Report to Application No. GB 0428141.6 Feb. 9, 2005.
Examination Report to Application No. GB 0500184.7 Feb. 9, 2005.
Search and Examination Report to Application No. GB 0500600.2 Feb. 15, 2005.
Examination Report to Application No. GB 0501667.0 May 27, 2005.
Search and Examination Report to Application No. GB 0503470.7 Mar. 21, 2005.
Search and Examination Report to Application No. GB 0506697.2 May 20, 2005.
Written Opinion to Application No. PCT/US02/25608 Feb. 2, 2005.
Written Opinion to Application No. PCT/US03/25675 Nov. 24, 2004.
Written Opinion to Application No. PCT/US02/39425; Apr. 11, 2005.
Written Opinion to Application No. PCT/US03/06544; Feb. 18, 2005.
Written Opinion to Application No. PCT/US03/25675 May 9, 2005.
Written Opinion to Application No. PCT/US03/29858 Jan. 21, 2004.
Written Opinion to Application No. PCT/US04/08171 May 5, 2005.
Combined Search Report and Written Opinion to Application No. PCT/US04/00631; Mar. 28, 2005.
Combined Search Report and Written Opinion to Application No. PCT/US04/02122 Feb. 24, 2005.
Combined Search Report and Written Opinion to Application No. PCT/US04/04740 Jan. 19, 2005.
Combined Search Report and Written Opinion to Application No. PCT/US04/06246 Jan. 26, 2005.
Combined Search Report and Written Opinion to Application No. PCT/US04/08073 Mar. 4, 2005.
Combined Search Report and Written Opinion to Application No. PCT/US04/08170 Jan. 13, 2005.
Combined Search Report and Written Opinion to Application No. PCT/US04/08171 Feb. 16, 2005.
Combined Search Report and Written Opinion to Application No. PCT/US04/11172 Feb. 14, 2005.
Combined Search Report and Written Opinion to Application No. PCT/US04/28438 Mar. 14, 2005.
Arbuckle, "Advanced Laser Texturing Tames Tough Tasks," Metal Forming Magazine.
Brizmer et al., "A Laser Surface Textured Parallel Thrust Bearing," *Tribology Transactions*, 46(3):397-403, 2003.
Duphorne, "Letter Re: Enventure Claims of Baker Infringement of Enventure's Expandable Patents," Apr. 1, 2005.
Egge, "Technical Overview Production Enhancement Technology," Baker Hughes, Mar. 10, 2003.
"EIS Expandable Isolation Sleeve" *Expandable Tubular Technology*, Feb. 2003.
Enventure Global Technology, Solid Expandable Tubulars are Enabling Technology, *Drilling Contractor*, Mar.-Apr. 2001.
Etsion, "Improving Tribological Performance of Mechanical Seals by Laser Surface Texturing," *Surface Technologies, LTD*.
Etsion, "A Laser Surface Textured Hydrostatic Mechanical Seal," *Sealing Technology*, Mar. 2003.
"Expandable Sand Screens," *Weatherford Completion Systems*, 2002.
Fontova, "Solid Expandable Tubulars (SET) Provide Value to Operators Worldwide in a Variety of Applications," *EP Journal of Technology*, Apr. 2005.
Fraunhofer IWU, "Research Area: Sheet Metal Forming—Superposition of Vibrations," 2001.
Gilmer et al., "World's First Completion Set Inside Expandable Screen," *High-Tech Wells*, 2003.
Guichelaar et al., "Effect of Micro-Surface Texturing on Breakaway Torque and Blister Formation on Carbon-Graphite Faces in a Mechanical Seal," *Lubrication Engineering*, Aug. 2002.
Haefke et al., "Microtexturing of Functional Surfaces for Improving Their Tribological Performance," *Proceedings of the International Tribology Conference*, 2000.
Halliburton Completion Products, 1996.
Linzell, "Trib-Gel A Chemical Cold Welding Agent," 1999.
Lizotte, "Scratching The Surface," *PT Design*, Jun. 19993.
Power Ultrasonics, "Design and Optimisation of An Ultrasonic Die System For Forming Metal Cans," 1999.
Ratliff, "Changing Safety Paradigms in the Oil and Gas Industry," *Society of Petroleum Engineers*, SPE 90828, 2004.
Ronen et al., "Friction-Reducing Surface-Texturing in Reciprocating Automotive Components," *Tribology Transactions*, 44(3):359-366, 2001.
RKY et al., "Experimental Investigation of Laser Surface Texturing for Reciprocating Automotive Components," *Tribology Transactions*, 45(4):444-449, 2002.
Turcotte et al., "Geodynamics Applications of Continuum Physics to Geological Problems," 1982.
Von Flatern, "From Exotic to Routine—the Offshore Quick-step," *Offshore Engineer*, Apr. 2004.
Von Flatern, "Oilfield Service Trio Target Jules Verne Territory," *Offshore Engineer*, Aug. 2001.
www.JETLUBE.com, "Oilfield Catalog—Jet-Lok Product Applicatin Descriptions," 1998.
www.MATERIALSRESOURCES.com, "Low Temperature Bonding of Dissimilar and Hard-to-Bone Materials and Metals Including," 2004.
www.MITCHMET.com, "3d Surface Texture Parameters," 2004.
www.SPURIND.com, "Glavanic Protection, Metallurgical Bonds, Custom Fabrications -Spur Industries," 2000.
International Preliminary Examination Report, Application PCT/US03/11765, Jul. 18, 2005.
International Preliminary Examination Report, Application PCT/US01/11765, Aug. 15, 2005.
International Preliminary Examination Report, Application PCT/US03/20870, Sep. 30, 2004.

International Preliminary Examination Report, Application PCT/US03/25675, Aug. 30, 2005.
International Preliminary Examination Report, Application PCT/US03/25742, Dec. 20, 2004.
International Preliminary Examination Report, Application PCT/US03/38550, May 23, 2005.
International Preliminary Report on Patentability, Application PCT/US04/08171, Sep. 13, 2005.
International Preliminary Report on Patentability, Application PCT/US04/28438, Sep. 20, 2005.
Combined Search Report and Written Opinion to Application No. PCT/US04/11973, Sep. 27, 2005.
Combined Search Report and Written Opinion to Application No. PCT/US04/28423, Jul. 13, 2005.
Search Report to Application No. GB 0415835.8, Dec. 2, 2004.
Search Report to Application No. GB 0415835.8, Mar. 10, 2005.
Examination Report to Application No. GB 0316887.9, Nov. 25, 2003.
Examination Report to Application No. GB 0406257.6, Jun. 16, 2005.
Examination Report to Application No. GB 0406257.6, Sep. 2, 2005.
Examination Report to Application No. GB 0406258.4, Jul. 27, 2005.
Examination Report to Application No. GB 0416834.0, Nov. 16, 2004.
Examination Report to Application No. GB 0500184.7, Sep. 12, 2005.
Examination Report to Application No. GB 0500600.2, Sep. 6, 2005.
Examination Report to Application No. GB 0507979.3, Jun. 16, 2005.
Search and Examination Report to Application No. GB 0505039.8, Jul. 22, 2005.
Search and Examination Report to Application No. GB 0506700.4, Sep. 20, 2005.
Search and Examination Report to Application No. GB 0509618.5, Sep. 27, 2005.
Search and Examination Report to Application No. GB 0509620.1, Sep. 27, 2005.
Search and Examination Report to Application No. GB 0509626.8, Sep. 27, 2005.
Search and Examination Report to Application No. GB 0509627.6, Sep. 27, 2005.
Search and Examination Report to Application No. GB 0509629.2, Sep. 27, 2005.
Search and Examination Report to Application No. GB 0509630.0, Sep. 27, 2005.
Search and Examination Report to Application No. GB 0509631.8, Sep. 27, 2005.
Search and Examination Report to Application No. GB 0512396.3, Jul. 26, 2005.
Search and Examination Report to Application No. GB 0512398.9, Jul. 27, 2005.
Search Report to Application No. Norway 1999 5593, Aug. 20, 2002.

* cited by examiner

ADJUSTABLE EXPANSION CONE ASSEMBLY

CROSS REFERENCE TO RELATED APPLICATIONS

This application is a National Stage filing of PCT patent application Ser. No. PCT/US02/25608, filed on Aug. 13, 2002, which claimed the benefit of the filing date of U.S. provisional patent application Ser. No. 60/318,021, filed on Sep. 7, 2001, the disclosure of which is incorporated herein by reference.

This application is related to the following: (1) U.S. Pat. No. 6,497,289, which was filed as U.S. patent application Ser. No. 09/454,139, filed on Dec. 3, 1999, which claims priority from provisional application 60/111,293, filed on Dec. 7, 1998, (2) U.S. patent application Ser. No. 09/510,913, filed on Feb. 23, 2000, which claims priority from provisional application 60/121,702, filed on Feb. 25, 1999, (3) U.S. Pat. No. 6,823,937, which was filed as U.S. patent application Ser. No. 09/502,350, filed on Feb. 10, 2000, which claims priority from provisional application 60/119,611, filed on Feb. 11, 1999, (4) U.S. Pat. No. 6,328,113, which was filed as U.S. patent application Ser. No. 09/440,338, filed on Nov. 15, 1999, which claims priority from provisional application 60/108,558, filed on Nov. 16, 1998, (5). U.S. patent application Ser. No. 10/169,434, filed on Jul. 1, 2002, which claims priority from provisional application 60/183,546, filed on Feb. 18, 2000, (6) U.S. Pat No. 6,640,903, which was filed as U.S. patent application Ser. No. 09/523,463, filed on Mar. 10, 2000, which claims priority from provisional application 60/124,042, filed on Mar. 11, 1999, (7) U.S. Pat. No. 6,568,471, which was filed as U.S. patent application Ser. No. 09/512,895, filed on Feb. 24, 2000, which claims priority from provisional application 60/121,841, filed on Feb. 26, 1999, (8) U.S. Pat. No. 6,575,240, which was filed as patent application Ser. No. 09/511,941, filed on, Feb. 24, 2000, which claims priority from provisional application 60/121,907, filed on Feb. 26, 1999 (9) U S. Pat. No. 6,557,640, which was filed as patent application Ser. No. 09/588,946, filed on Jun. 7, 2000, which claims priority from provisional application 60/137,998, filed on Jun. 7, 1999, (10) U.S. Pat. No. 6,712,154, which was filed as U.S. patent application Ser. No. 09/981,916, filed on Oct. 18, 2001 as a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (11) U.S. Pat No. 6,604,763, which was filed as application Ser. No. 09/559,122, filed on Apr. 26, 2000, which claims priority from provisional application 60/131,106, filed on Apr. 26, 1999, (12) U.S. patent application Ser. No. 10/030,593, filed on Jan. 8, 2002, which claims priority from provisional application 60/146,203, filed on Jul. 29, 1999, (13) U.S. provisional patent application Ser. No. 60/143,039, filed on Jul. 9, 1999, (14) U.S. Pat. No. 7,048,067, which was filed as U.S. patent application Ser. No. 10/111,982, filed on Apr. 30, 2002, which claims priority from provisional patent application Ser. No. 60/162,671, filed on Nov. 1, 1999, (15) U.S. provisional patent application Ser. No. 60/154,047, filed on Sep. 16, 1999, (16) U.S. provisional patent application Ser. No. 60/438,828, filed on Jan. 9, 2003, (17) U.S. Pat. No. 6,564,875, which was filed as application Ser. No. 09/679,907, filed on Oct. 5, 2000, which claims priority from provisional patent application Ser. No. 60/159,082, filed on Oct. 12, 1999, (18) U.S. Pat. No. 6,695,012, which was filed as U.S. patent application Ser. No. 10/089,419, filed on Mar. 27, 2002, which claims priority from provisional patent application Ser. No. 60/159,039, filed on Oct. 12, 1999, (19) U.S. patent application Ser. No. 09/679,906, filed on Oct. 5, 2000, which is Abandoned and which claims priority from provisional patent application Ser. No. 60/159,033, filed on Oct. 12, 1999, (20) U.S. patent application Ser. No. 10/303,992, filed on Nov. 22, 2002, which claims priority from provisional patent application Ser. No. 60/212,359, filed on Jun. 19, 2000, (21) U.S. provisional patent application Ser. No. 60/165,228, filed on Nov. 12, 1999, (22) U.S. provisional patent application Ser. No. 60/455,051, filed on Mar. 14, 2003, (23) PCT application US02/2477, filed on Jun. 26, 2002, which claims priority from U.S. provisional patent application Ser. No. 60/303,711, filed on Jul. 6, 2001, (24) U.S. patent application Ser. No. 10/311,412, filed on Dec. 12, 2002, which claims priority from provisional patent application Ser. No. 60/221,443, filed on Jul. 28, 2000, (25) U.S. Pat. No. 7,100,684, which was filed as U.S. patent application Ser. No. 10/322,947, filed on Dec. 18, 2002, which claims priority from provisional patent application Ser. No. 60/221,645, filed on Jul. 28, 2000, (26) U.S. Pat. No. 6,976,541, which was filed as U.S. patent application Ser. No. 10/351,160, filed on Jan. 22, 2003, which claims priority from provisional patent application Ser. No. 60/233,638, filed on Sep. 18, 2000, (27) U.S. Pat. No. 7,172,024, which was filed as U.S. patent application. Ser. No. 10/406,648, filed on Mar. 31, 2003, which claims priority from provisional patent application Ser. No. 60/237,334, filed on Oct. 2, 2000, (28) PCT application US02/04353, filed on Feb. 14, 2002, which claims priority from U.S. provisional patent application Ser. No. 60/270,007, filed on Feb. 20, 2001, (29) U.S. Pat. No. 7,185,710, which was filed as U.S. patent application Ser. No. 10/465,835, filed on Jun. 13, 2003, which claims priority from provisional patent application Ser. No. 60/262,434, filed on Jan. 17, 2001, (30) U.S. Pat. No. 7,100,685, which was filed as U.S. patent application Ser. No. 10/465,831, filed on Jun. 13, 2003, which claims priority from U.S. provisional patent application Ser. No. 60/259,486, filed on Jan. 3, 2001, (31) U.S. provisional patent application Ser. No. 60/452,303, filed on Mar. 5, 2003, (32) U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (33) U.S. Pat. No. 6,561,227, which was filed as patent application Ser. No. 09/852,026, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (34) U.S. Pat. No. 6,631,760, which was filed as U.S. patent application Ser. No. 09/852,027, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (35) PCT Application US02/25608, filed on Aug. 13, 2002, which claims priority from provisional application 60/318,021, filed on Sep. 7, 2001, (36) PCT Application US02/24399, filed on Aug. 1, 2002, which claims priority from U.S. provisional patent application Ser. No. 60/313,453, filed on Aug. 20, 2001, (37) PCT Application US02/29856, filed on Sep. 19, 2002, which claims priority from U.S. provisional patent application Ser. No. 60/326,886, filed on Oct. 3, 2001, (38) PCT Application US02/20256, filed on Jun. 26, 2002, which claims priority from U.S. provisional patent application Ser. No. 60/303,740, filed on Jul. 6, 2001, (39) U.S. Pat. No. 6,892,819, which was filed as U.S. patent application Ser. No 09/962,469, filed on Sep. 25, 2001, which is a divisional of U.S. Pat. No. 6,640,903, which was filed as U.S. patent application Ser. No. 09/523,468, filed on Mar. 10, 2000, which claims priority from provisional application 60/124,042, filed on Mar. 11, 1999, (40) U.S. patent application Ser. No. 09/962,470, filed on Sep. 25, 2001, which is a divisional of U.S. Pat. No. 6,640,903, which was filed as U.S. patent application Ser. No. 09/523,468, filed on Mar. 10, 2000, which claims priority from provisional application 60/124,042, filed on Mar. 11, 1999, (41) U.S. Pat. No. 6,739,392, which was filed as U.S. patent application Ser. No. 09/962,471, filed on Sep. 25, 2001, which is a divisional of U.S. Pat. No. 6,640,903, which as filed as U.S. patent application Ser. No. 09/523,468, filed on Mar. 10, 2000, which claims priority from provisional application 60/124,042, filed on Mar. 11, 1999, (42) U.S. Pat. No. 6,725,919, which was filed as U.S. patent application Ser. No. 09/962,467, filed on Sep. 25, 2001, which is a divisional of U.S. Pat. No. 6,640,903, which was filed as U.S. patent application Ser. No. 09/523,468, filed on Mar. 10, 2000, which claims priority from provisional application 60/124,042, filed on Mar. 11, 1999, (43) U.S. Pat. No. 6,758,278, which was filed as U.S. patent application Ser. No. 09/962,468, filed on Sep. 25, 2001, which is a divisional of U.S. Pat. No. 6,640,903, which was filed as U.S. patent application Ser. No. 09/523,468, filed on Mar. 10, 2000, which claims priority from provisional application 60/124,042, filed on Mar. 11, 1999, (44) PCT application US02/25727 filed on Aug. 14, 2002, which claims priority from U.S. provisional patent application Ser. No. 60/317,985, filed on Sep. 6, 2001, and U.S. provisional patent application Ser. No. 60/318,386, filed on Sep. 10, 2001, (45) PCT application US02/39425, filed on Dec. 10, 2002, which claims priority from U.S. provisional patent application Ser. No. 60/343,674, filed on Dec. 27, 2001, (46) U.S. Pat. No. 6,634,431, which was filed as U.S. utility patent application Ser. No. 09/969,922, filed on Oct. 3, 2001, which is a continuation-in-part application of U.S. Pat, No. 6,328,113, which was filed as U.S. patent application Ser. No. 09/440,338, filed on Nov. 15, 1999, which claims priority from provisional application 60/108,558, filed on Nov. 16, 1998, (47) U.S. Pat. No. 6,745,845, which was filed as U.S. utility patent application Ser. No. 10/516,467, filed on Dec. 10, 2001, which is a continuation application of U.S. Pat. No. 6,634,431, which was filed as U.S. utility patent application Ser. No. 09/969,922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (48) PCT application US03/00609, filed on Jan. 9, 2003, which claims priority from U.S. provisional patent application Ser. No. 60/357,372, filed on Feb. 15, 2002, (49) U.S. Pat. No. 6,705,395, which was filed as U.S. patent application Ser. No. 10/074,703, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (50) U.S. Pat. No. 6,631,759, which was filed as U.S. patent application Ser. No. 10/074,244, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (51) U.S. patent application Ser. No. 10/076,660, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (52) U.S. Pat. No. 6,631,769, which was filed as U.S. patent application Ser. No. 10/076,661, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (53) U.S. Pat. No. 7,063,142, which was filed as U.S. patent application Ser. No. 10/076,659, filed on Feb. 15, 2002, which is a divisional of U.S. Pat. No. 6,568,471, which was filed as patent application Ser. No. 09/512,895, filed on Feb. 24, 2000, which claims priority from provisional application 60/121,811, filed on Feb. 26, 1999, (54) US. Pat. No. 6,684,947, which was filed as U.S. patent application Ser. No. 10/078,928, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (55) U.S. Pat. No. 6,966,370, which was filed as U.S. patent application Ser. No. 10/078,922, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (56) U.S. Pat. No. 7,044,221, which was filed as U.S. patent application Ser. No. 10/078,921, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (57) U.S. Pat. No. 7,011,161, which was filed as U.S. patent application Ser. No. 10/261,928, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (58) U.S. Pat. No. 7,040,396, which was filed as U.S. patent application Ser. No. 10/079,276, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (59) U.S. Pat. No. 7,048,062, which was filed as U.S. patent application Ser. No. 10/262,009, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (60) U.S. Pat. No. 6,857,473, which was filed as U.S. patent application Ser. No. 10/092,481, filed on Mar. 7, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (61) U.S. Pat. No. 7,086,475 which was filed as U.S. patent application Ser. No. 10/261,926, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (62) PCT application US02/36157, filed on Nov. 12, 2002, which claims priority from U.S. provisional patent application Ser. No. 60/338,996, filed on Nov. 12, 2001 (63) PCT application US02/36267, filed on Nov. 12, 2002, which claims priority from U.S. provisional patent application Ser. No. 60/339,013, filed on Nov. 12, 2001, (64) PCT application US03/11765, filed on Apr. 16, 2003, which claims priority from U.S. provisional patent application Ser. No. 60/383,917, filed on May 29, 2002, (65) PCT application US03/15020, filed on May 12, 2003, which claims priority from U.S. provisional patent application Ser. No. 60/391,703, filed on Jun. 26, 2002, (66) PCT application US02/39418, filed on Dec. 10, 2002, which claims priority from U.S. provisional patent application Ser. No. 60/346,309, filed on Jan. 7, 2002, (67) PCT application US03/06544, filed on Mar. 4, 2003, which claims priority from U.S. provisional patent application Ser. No. 60/372,048, filed on Apr. 12, 2002, (68) U.S. patent application Ser. No. 10/331,718, filed on Dec. 30, 2002, which is Abandoned and which is a divisional U.S. patent application Ser. No. 09/679,906, filed on Oct. 5, 2000, which claims priority from provisional patent application Ser. No. 60/159,033, filed on Oct. 12, 1999, (69) PCT application US03/04837, filed on Feb. 29, 2003, which claims priority from U.S. provisional patent application Ser. No. 60/363,829, filed on Mar. 13, 2002, (70) U.S. Pat. No. 7,077,213, which was filed as U.S. patent application Ser. No. 10/261,927, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (71) U.S. Pat. No. 7,036,582, which was filed as U.S. patent application Ser. No. 10/262,008, filed on Oct. 1, 2002, which is a divisional of U.S. Pat. No. 5,557,640, which was filed as patent application Ser. No. 09/588,946, filed on. Jun. 7, 2000, which claims priority from provisional application 60/137,998, filed on Jun. 7, 1999, (72) U.S. Pat. No. 7,044,218, which was filed as U.S. patent application Ser. No. 10/261,925, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (73) U.S. Pat. No. 7,159,665, which was filed as U.S. patent application Ser. No. 10/199,524, filed on Jul. 19, 2002, which is a continuation of U.S. Pat. No. 6,497,289, which was filed as U.S. patent application Ser. No. 09/454,139, filed on Dec. 3, 1999, which claims priority from provisional application 60/111,293, filed on Dec. 7, 1998, (74) PCT application US03/10144, filed on Mar. 28, 2003, which claims priority from U.S. provisional patent application Ser. No. 60/372,632, filed on Apr. 15, 2002, (75) U.S. provisionsal patent application Ser. No. 60/412,542, filed on Sep. 20, 2002, (76) PCT application US03/14153, filed on May 6, 2003, which claims priority from U.S. provisional patent application Ser. No. 60/380,147, filed on May 6, 2002, (77) PCT application US03/19993, filed on Jun. 24, 2003, which claims priority from U.S. provisional patent application Ser. No. 60/397,284, filed on Jul. 19, 2002, (78) PCT application US03/13787, filed on May 15, 2003, which claims priority from U.S. provisional patent application Ser. No. 60/387,486, filed on Jun. 10, 2002, (79) PCT application US03/18530, filed on Jun. 11, 2003, which claims priority from U.S. provisional patent application Ser. No. 60/387,961, filed on Jun. 12, 2002, (80) PCT application US03/20694, filed on Jul. 1, 2003, which claims priority from U.S. provisional patent application Ser. No. 60/398,061, filed on Jul. 24, 2002, (81) PCT application US03/20870, filed on Jul. 2, 2003, which claims priority from U.S. provisional patent application Ser. No. 60/399,240, filed on Jul. 29, 2002, (82). U.S. provisional patent application Ser. No. 60/412,487, filed on Sep. 20, 2002, (83) U.S. provisional patent application Ser. No. 60/412,488, filed on Sep. 20, 2002, (84) U.S. Pat. No. 7,108,061, which was filed as U.S. patent application Ser. No. 10/280,356, filed on Oct. 25, 2002, which is a continuation of U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (85) U.S. provisional patent application Ser. No. 60/412,177, filed on Sep. 20, 2002, (86) U.S. provisional patent application Ser. No. 60/412,653, filed on Sep. 20, 2002, (87) U.S. provisional patent application Ser. No. 60/405,610, filed on Aug. 23, 2002, (88) U.S. provisional patent application Ser. No. 60/405,394, filed on Aug. 23, 2002, (89) U.S. provisional patent application Ser. No. 60/412,544, filed on Sep. 20, 2002, (90) PCT application PCT/US03/24779, filed on Aug. 8, 2003, which claims priority from U.S. provisional patent application Ser. No. 60/407,442, filed on Aug. 30, 2002, (91) U.S. provisional patent application Ser. No. 60/423,363, filed on Dec. 10, 2002, (92) U.S. provisional patent application Ser. No. 60/412,196, filed on Sep. 20, 2002, (93) U.S. provisional patent application Ser. No. 60/412,187, filed on Sep. 20, 2002, (94) U.S. provisional patent application Ser. No. 60/412,371, filed on Aug. 20, 2002, (95) U.S. Pat. No. 7,108,072, which was filed as U.S. patent application Ser. No. 10/382,325, filed on Mar. 5, 2003, which is a continuation of U.S. Pat. No. 6,557,640, which was filed as patent application Ser. No. 09/588,946, filed on Jun. 7, 2000, which claims priority from provisional application 60/137,998, filed on Jun. 7, 1999, (96) U.S. Pat. No. 7,174,964, which was filed as U.S. patent application Ser. No. 10/624,842, filed on Jul. 22, 2003, which is a divisional of U.S. Pat. No. 6,823,937, which was filed as U.S. patent application Ser. No. 09/502,350, filed on Feb. 10, 2000, which claims priority from provisional application 60/119,611, filed on Feb. 11, 1999, (97) U.S. provisional patent application Ser. No. 60/431,184, filed on Dec. 5, 2002, (98) U.S. provisional patent application Ser. No. 60/448,526, filed on Feb. 18, 2003, (99) U.S. provisional patent application Ser. No. 60/461,539, filed on Apr. 9, 2003, (100) U.S. provisional patent application Ser. No. 60/462,750, filed on Apr. 14, 2003, (101) U.S. provisional patent application Ser. No. 60/436,106, filed on Dec. 23, 2002, (102) U.S. provisional patent application Ser. No. 60/442,942, filed on Jan. 27, 2003, (103) U.S. provisional patent application Ser. No. 60/442,938, filed on Jan. 27, 2003, (104) U.S. provisional patent application Ser. No. 60/418,687, filed on Apr. 18, 2003, (105) U.S. provisional patent application Ser. No. 60/454,896, filed on Mar. 14, 2003, (106) U.S. provisional patent application Ser. No. 60/450,504, filed on Feb. 26, 2003, (107) U.S. provisional patent application Ser. No. 60/451,152, filed on Mar. 9, 2003, (108) U.S. provisional patent application Ser. No. 60/455,124, filed on Mar. 17, 2003, (109) U.S. provisional patent application Ser. No. 60/453,678, filed on Mar. 11, 2003, (110) U.S. patent application Ser. No. 10/421,682, filed on Apr. 23, 2003, which is a continuation of U.S. patent application Ser. No. 09/523,468, filed on Mar. 10, 2000, which claims priority from provisional application 60/124,042, filed on Mar. 11, 1999, (111) U.S. provisional patent application Ser. No. 60/457,965, filed on Mar. 27, 2003, (112) U.S. provisional patent application Ser. No. 60/455,718, filed on Mar. 18, 2003, (113) U.S. Pat. No. 6,550,821, which was filed as patent application Ser. No. 09/811,734, filed on Mar. 19, 2001, (114) U.S. Pat. No. 6,968,618, which was filed as U.S. patent application Ser. No. 10/436,467, filed on May 12, 2003, which is a continuation of U.S. Pat. No. 6,604,763, which was filed as application Ser. No. 09/559,122, filed on Apr. 26, 2000, which claims priority from provisional application 60/131,106, filed on Apr. 26, 1999, (115) U.S. provisional patent application Ser. No. 60/459,776, filed on Apr. 2, 2003, (116) U.S. provisional patent application Ser. No. 60/461,094, filed on Apr. 8, 2003, (117) U.S. provisional patent application Ser. No. 60/461,038, filed on Apr. 7, 2003, (118) U.S. provisional patent application Ser. No. 60/453,586, filed on Apr. 17, 2003, (119) U.S. provisional patent application Ser. No. 60/472,240, filed on May 20, 2003, (120) U.S. Pat. No. 7,121,352, which was filed as U.S. patent application Ser. No. 10/619,285, filed on Jul. 14, 2003, which is a continuation-in-part of U.S. Pat. No. 6,634,431, which was filed as U.S. utility patent application Ser. No. 09/969,922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (121) U.S. Pat. No. 7,055,608, which was filed as U.S. utility patent application Ser. No. 10/418,688, filed on Apr. 18, 2003, as a division of U.S. Pat. No. 6,640,903, which was filed as U.S. utility patent application Ser. No. 09/523,468, filed on Mar. 10, 2000, which claims priority from provisional application 60/124,042, filed on Mar. 11, 1999, and (122) U.S. utility patent application Ser. No. 10/784,679, filed on Feb. 23, 2004, which was a continuation-in-part of U.S. utility patent application Ser. No. 10/089,419, filed on Mar. 27, 2002, which issued as U.S. Pat. No. 6,695,012, the disclosures of which are incorporated herein by reference.

BACKGROUND OF THE INVENTION

This invention relates generally to wellbore casings, and in particular to wellbore casings that are formed using expandable tubing.

Conventionally, when a wellbore is created, a number of casings are installed in the borehole to prevent collapse of the borehole wall and to prevent undesired outflow of drilling fluid into the formation or inflow of fluid from the formation into the borehole. The borehole is drilled in intervals whereby a casing which is to be installed in a lower borehole interval is lowered through a previously installed casing of an upper borehole interval. As a consequence of this procedure the casing of the lower interval is of smaller diameter than the casing of the upper interval. Thus, the casings are in a nested arrangement with casing diameters decreasing in downward direction. Cement annuli are provided between the outer surfaces of the casings and the borehole wall to seal the casings from the borehole wall. As a consequence of this nested arrangement a relatively large borehole diameter is required at the upper part of the wellbore. Such a large borehole diameter involves increased costs due to heavy casing handling equipment, large drill bits and increased volumes of drilling fluid and drill cuttings. Moreover, increased drilling rig time is involved due to required cement pumping, cement hardening, required equipment changes due to large variations in hole diameters drilled in the course of the well, and the large volume of cuttings drilled and removed.

The present invention is directed to overcoming one or more of the limitations of the existing procedures for forming new sections of casing in a wellbore.

SUMMARY OF THE INVENTION

According to one aspect of the present invention, an apparatus for radially expanding a tubular member is provided that includes a tubular support member that includes a first tubular support body defining a longitudinal passage, a first lug coupled to and extending from the first tubular support body in the radial direction, a second lug coupled to and extending from the first tubular support body in the radial direction, and an expansion cone support body coupled to the first tubular support body. The expansion cone support body includes an N-sided tapered tubular support member, wherein each side of the multi-sided tapered tubular support member defines a T-shaped slot. N expansion cone segments are movably coupled to the expansion cone support body, each including an expansion cone segment body including arcuate conical outer surfaces, a first T-shaped retaining member coupled to the expansion cone segment body for movably coupling the expansion cone segment body to a corresponding one of the T-shaped slots of the expansion cone support body, and a second T-shaped retaining member coupled to the expansion cone segment body. A split ring collar assembly is movably coupled to the exterior of the tubular support member that includes a second tubular support body defining N T-shaped slots for movably receiving corresponding ones of the second T-shaped retaining members of the expansion cone segments, and an L-shaped retaining member coupled to the second tubular support body. A first drag block assembly is movably coupled to the tubular support member that includes a first drag block body defining a slot for receiving and mating with the L-shaped retaining member of the split ring collar, and a first J-shaped slot for receiving the first lug, and one or more first drag blocks coupled to the first drag block body. A second drag block assembly is movably coupled to the tubular support member that includes a second drag block body defining a second J-shaped slot for receiving the second lug, and one or more second drag blocks coupled to the second drag block body. First and second packer cups are coupled to the tubular support member between the first and second drag block assemblies.

According to another aspect of the present invention, an apparatus for radially expanding a tubular member is provided that includes a tubular support member that includes a first tubular support body defining a longitudinal passage, a first flange coupled to the first tubular support body, a second flange coupled to the first tubular support body, a first tapered flange coupled to the first tubular support body, a second tapered flange coupled to the first tubular support body, and an expansion cone support body coupled to the first tubular support body. The expansion cone support body includes an N-sided tapered tubular support member, wherein each side of the multi-sided tapered tubular support member defines a T-shaped slot. N expansion cone segments are movably coupled to the expansion cone support body, each including an expansion cone segment body including arcuate conical outer surfaces, a first T-shaped retaining member coupled to the expansion cone segment body for movably coupling the expansion cone segment body to a corresponding one of the T-shaped slots of the expansion cone support body, and a second T-shaped retaining member coupled to the expansion cone segment body. A split ring collar is movably coupled to the exterior of the tubular support member that includes a second tubular support body that defines N T-shaped slots for movably receiving corresponding ones of the second T-shaped retaining members of the expansion cone segments, and an L-shaped retaining member coupled to the second tubular support body. A first collet assembly is movably coupled to the tubular support member that includes a first tubular sleeve that defines a slot for receiving and mating with the L-shaped retaining member of the split ring collar, a first counterbore for receiving the first flange, and a first radial passage, a first spring received within the first counterbore, a first retaining ring received within the first counterbore, a first load transfer pin coupled to the first retaining ring and extending through the first radial passage, a second tubular sleeve coupled to the first load transfer pin, a first resilient collet coupled to the second tubular sleeve and positioned above the first tapered flange, and a third tubular sleeve coupled to the first resilient collet. A second collet assembly is movably coupled to the tubular support member that includes a fourth tubular sleeve that defines a second counterbore for receiving the second flange, and a second radial passage, a second spring received within the second counterbore, a second retaining ring received within the second counterbore, a second load transfer pin coupled to the second retaining ring and extending through the second radial passage, a fifth tubular sleeve coupled to the second load transfer pin, a second resilient collet coupled to the fifth tubular sleeve and positioned above the second tapered flange, and a sixth tubular sleeve coupled to the second resilient collet. First and second packer cups coupled to the tubular support member between the first and second collet assemblies.

According to another aspect of the present invention, an apparatus for radially expanding a tubular member is provided that includes a tubular support member that includes a first tubular support body defining a longitudinal passage, a first radial passage defined in the first tubular support body fluidicly coupled to the longitudinal passage, a first flange coupled to the first tubular support body, a second flange coupled to the first tubular support body, a first tapered flange coupled to the first tubular support body, a second tapered flange coupled to the first tubular support body, and an expansion cone support body coupled to the first tubular support body. The expansion cone support body includes an N-sided tapered tubular support member, wherein each side of the multi-sided tapered tubular support member defines a T-shaped slot. N expansion cone segments are movably coupled to the expansion cone support body, each including an expansion cone segment body including arcuate conical outer surfaces, a first T-shaped retaining member coupled to the expansion cone segment body for movably coupling the expansion cone segment body to a corresponding one of the T-shaped slots of the expansion cone support body, and a second T-shaped retaining member coupled to the expansion cone segment body. A split ring collar is movably coupled to the exterior of the tubular support member that includes a second tubular support body that defines N T-shaped slots for movably receiving corresponding ones of the second T-shaped retaining members of the expansion cone segments, and an L-shaped retaining member coupled to the second tubular support body. A first dog assembly is movably coupled to the tubular support member that includes a first tubular sleeve that defines a slot for receiving and mating with the L-shaped retaining member of the split ring collar, a first counterbore for receiving the first flange, and a second radial passage, a first spring received within the first counterbore, a first retaining ring received within the first counterbore, a first load transfer pin coupled to the first retaining ring and extending through the second radial passage, and a second tubular sleeve coupled to the first load transfer pin that defines a second counterbore for receiving the first tubular sleeve, a first resilient dog coupled to the second tubular sleeve and positioned adjacent to the first tapered flange. A second dog assembly is movably coupled to the tubular support member that includes a third tubular sleeve that defines a second counterbore for receiving the second flange, a third radial passage, and a fourth radial passage fluidicly coupled to the first radial passage, a second spring received within the second counterbore, a second retaining ring received within the second counterbore, a second load transfer pin coupled to the second retaining ring and extending through the third radial passage, a fourth tubular sleeve coupled to the second load transfer pin, and a second resilient dog coupled to the fourth tubular sleeve and positioned adjacent to the second tapered flange. First and second packer cups are coupled to the tubular support member between the first and second dog assemblies.

According to another aspect of the present invention, an apparatus for radially expanding a tubular member is provided that includes a tubular support member that includes a first tubular support body defining a longitudinal passage including a throat passage, a first radial passage defined in the first tubular support body fluidicly coupled to the longitudinal passage, a first flange coupled to the first tubular support body, a second flange coupled to the first tubular support body that defines a second radial passage defined in the second flange fluidicly coupled to the longitudinal passage, a tapered flange coupled to the first tubular support body, and an expansion cone support body coupled to the first tubular support body. The expansion cone support body includes an N-sided tapered tubular support member, wherein each side of the multi-sided tapered tubular support member defines a T-shaped slot. N expansion cone segments are movably coupled to the expansion cone support body, each including an expansion cone segment body including arcuate conical outer surfaces, a first T-shaped retaining member coupled to the expansion cone segment body for movably coupling the expansion cone segment body to a corresponding one of the T-shaped slots of the expansion cone support body, and a second T-shaped retaining member coupled to the expansion cone segment body. A split ring collar is movably coupled to the exterior of the tubular support member that includes a second tubular support body that defines N T-shaped slots for movably receiving corresponding ones of the second T-shaped retaining members of the expansion cone segments, and an L-shaped retaining member coupled to the second tubular support body. A dog assembly is movably coupled to the tubular support member that includes a first tubular sleeve that defines a slot for receiving and mating with the L-shaped retaining member of the split ring collar, a first counterbore for receiving the first flange, and a third radial passage, a spring received within the first counterbore, a retaining ring received within the first counterbore, a load transfer pin coupled to the retaining ring and extending through the third radial passage, a second tubular sleeve coupled to the first load transfer pin that defines a first counterbore for receiving the first tubular sleeve, a second counterbore for receiving and mating with the tapered flange, and includes a third flange that defines a third counterbore for receiving the second flange, a fourth counterbore for receiving the second flange, and a fourth radial passage, and a resilient dog coupled to the second tubular sleeve and positioned adjacent to the tapered flange. First and second packer cups are coupled to the tubular support member between the resilient dog and the third flange.

According to another aspect of the present invention, an adjustable expansion cone assembly is provided that includes a tubular support member that includes a tubular support body and an expansion cone support body coupled to the tubular support body. The expansion cone support body includes an N-sided tapered tubular support member, wherein each side of the multi-sided tapered tubular support member defines a T-shaped slot. N expansion cone segments are movably coupled to the expansion cone support body, each including an expansion cone segment body including arcuate conical outer surfaces, a first T-shaped retaining member coupled to the expansion cone segment body for movably coupling the expansion cone segment body to a corresponding one of the T-shaped slots of the expansion cone support body, and a second T-shaped retaining member coupled to the expansion cone segment body. A split ring collar is movably coupled to the exterior of the tubular support member that includes a second tubular support body that defines N T-shaped slots for movably receiving corresponding ones of the second T-shaped retaining members of the expansion cone segments, and an L-shaped retaining member coupled to the second tubular support body. A tubular actuating sleeve is movably coupled to the tubular support member that includes a third tubular support body that defines a slot for receiving and mating with the L-shaped retaining member of the split ring collar.

According to another aspect of the present invention, an adjustable expansion cone assembly is provided that includes a tubular support member that includes a first tubular support body, and an expansion cone support body coupled to the tubular support body. The expansion cone support body includes a tapered tubular support member defining N stepped slots. An expansion cone assembly is movably coupled to the tubular support member that includes a second tubular support body movably coupled to the first tubular support body defining an L-shaped slot, and N expansion cone segments extending from the second tubular support member. Each expansion cone segment includes a resilient collet coupled to the second tubular support member, an expansion cone segment body coupled to the resilient collet including arcuate conical outer surfaces, and a retaining member coupled to the expansion cone segment body for movably coupling the expansion cone segment body to a corresponding one of the stepped slots of the expansion cone support body. A split ring collar is movably coupled to the exterior of the tubular support member that includes a third tubular support body, a first L-shaped retaining member coupled to the third tubular support body for mating with the L-shaped slot of the second tubular support body of the expansion cone assembly, and a second L-shaped retaining member coupled to the third tubular body. A tubular actuating sleeve is movably coupled to the tubular support member that includes a third tubular support body that defines a slot for receiving and mating with the second L-shaped retaining member of the split ring collar.

According to another aspect of the present invention, an adjustable expansion cone assembly is provided that includes a tubular support member that includes a first tubular support body, and an expansion cone support body coupled to the tubular support body. The expansion cone support body includes a tapered tubular support member defining N slots. An expansion cone assembly is movably coupled to the tubular support member that includes a second tubular support body movably coupled to the first tubular support body defining an L-shaped slot, and N expansion cone segments extending from the second tubular support member. Each expansion cone segment includes a resilient collet coupled to the second tubular support member, an expansion cone segment body coupled to the resilient collet including arcuate conical outer surfaces, and a retaining member coupled to the expansion cone segment body for movably coupling the expansion cone segment body to a corresponding one of the slots of the expansion cone support body. A split ring collar is movably coupled to the exterior of the tubular support member that includes a third tubular support body, a first L-shaped retaining member coupled to the third tubular support body for mating with the L-shaped slot of the second tubular support body, and a second L-shaped retaining member coupled to the third tubular support body. A tubular actuating sleeve is movably coupled to the tubular support member that includes a third tubular support body that defines a slot for receiving and mating with the second L-shaped retaining member of the split ring collar.

According to another aspect of the present invention, an adjustable expansion cone assembly is provided that includes a tubular support member that includes a first tubular support body, and an expansion cone support body coupled to the tubular support body. The expansion cone support body includes a tapered tubular support member defining N slots. An expansion cone assembly is movably coupled to the tubular support member that includes a second tubular support body movably coupled to the first tubular support body defining an L-shaped slot, N/2 first expansion cone segments extending from the second tubular support member, and N/2 second expansion cone segments extending from the second tubular member. Each first expansion cone segment includes a first resilient collet coupled to the second tubular support member, a first expansion cone segment body coupled to the resilient collet including arcuate conical outer surfaces, and a first retaining member coupled to the expansion cone segment body for movably coupling the expansion cone segment body to a corresponding one of the slots of the expansion cone support body. Each second expansion cone segment includes a second resilient collet coupled to the second tubular support member, a second expansion cone segment body coupled to the resilient collet including arcuate conical outer surfaces, and a second retaining member coupled to the expansion cone segment body for movably coupling the expansion cone segment body to a corresponding one of the slots of the expansion cone support body. The second expansion cone segments overlap and are interleaved with the first expansion cone segments. A split ring collar is movably coupled to the exterior of the tubular support member that includes a third tubular support body, a first L-shaped retaining member coupled to the third tubular support body for mating with L-shaped slot of the second tubular support body, and a second L-shaped retaining member coupled to the third tubular support body. A tubular actuating sleeve is movably coupled to the tubular support member that includes a third tubular support body that defines a slot for receiving and mating with the second L-shaped retaining member of the split ring collar.

According to another aspect of the present invention, an adjustable expansion cone assembly is provided that includes a tubular support member that includes a first tubular support body, and an expansion cone support body coupled to the first tubular support body. The expansion cone support body includes an N-sided tapered tubular support member, wherein each side of the multi-sided tapered tubular support member defines a T-shaped slot. N/2 first expansion cone segments are movably coupled to the expansion cone support body, each including a first expansion cone segment body including arcuate conical outer surfaces, a first T-shaped retaining member coupled to the first expansion cone segment body for movably coupling the first expansion cone segment body to a corresponding one of the T-shaped slots of the expansion cone support body, and a second T-shaped retaining member coupled to the first expansion cone segment body. N/2 second expansion cone segments are also movably coupled to the expansion cone support body, each including a second expansion cone segment body including arcuate conical outer surfaces, a third T-shaped retaining member coupled to the second expansion cone segment body for movably coupling the second expansion cone segment body to a corresponding one of the T-shaped slots of the expansion cone support body, and a fourth T-shaped retaining member coupled to the expansion cone segment body. The first and second expansion cone segments are interleaved. The first expansion cone segment bodies are complementary shaped with respect to the second expansion cone segment bodies. A split ring collar assembly is movably coupled to the exterior of the tubular support member that includes a second tubular support body that defines N T-shaped slots for movably receiving corresponding ones of the second and fourth T-shaped retaining members of the interleaved first and second expansion cone segments, and an L-shaped retaining member coupled to the second tubular support body. A tubular actuating sleeve movably coupled to the tubular support member that includes a third tubular support body that defines a slot for receiving and mating with the L-shaped retaining member of the split ring collar.

According to another aspect of the present invention, an apparatus for radially expanding a tubular member is provided that includes a tubular support member that includes a first tubular support body defining a longitudinal passage, a first lug coupled to and extending from the first tubular support body in the radial direction, and a second lug coupled to and extending from the first tubular support body in the radial direction. An adjustable expansion cone assembly is movably coupled to the tubular support member. A first drag block assembly is movably coupled to the tubular support member that includes a first drag block body coupled to the adjustable expansion cone assembly that defines: a first J-shaped slot for receiving the first lug, and one or more first drag blocks coupled to the first drag block body. A second drag block assembly is movably coupled to the tubular support member that includes a second drag block body that defines: a second J-shaped slot for receiving the second lug, and one or more second drag blocks coupled to the second drag block body. First and second packer cups are coupled to the tubular support member between the first and second drag block assemblies.

According to another aspect of the present invention, an apparatus for radially expanding a tubular member is provided that includes a tubular support member that includes a first tubular support body defining a longitudinal passage, a first flange coupled to the first tubular support body, a second flange coupled to the first tubular support body, a first tapered flange coupled to the first tubular support body, and a second tapered flange coupled to the first tubular support body. An adjustable expansion cone assembly is movably coupled to the tubular support member. A first collet assembly is movably coupled to the tubular support member that includes a first tubular sleeve coupled to the adjustable expansion cone assembly and defines a first counterbore for receiving the first flange, and a first radial passage, a first spring received within the first counterbore, a first retaining ring received within the first counterbore, a first load transfer pin coupled to the first retaining ring and extending through the first radial passage, a second tubular sleeve coupled to the first load transfer pin, a first resilient collet coupled to the second tubular sleeve and positioned above the first tapered flange, and a third tubular sleeve coupled to the first resilient collet. A second collet assembly is movably coupled to the tubular support member that includes a fourth tubular sleeve that defines: a second counterbore for receiving the second flange, and a second radial passage, a second spring received within the second counterbore, a second retaining ring received within the second counterbore, a second load transfer pin coupled to the second retaining ring and extending through the second radial passage, a fifth tubular sleeve coupled to the second load transfer pin, a second resilient collet coupled to the fifth tubular sleeve and positioned above the second tapered flange, and a sixth tubular sleeve coupled to the second resilient collet. First and second packer cups are coupled to the tubular support member between the first and second collet assemblies.

According to another aspect of the present invention, an apparatus for radially expanding a tubular member is provided that includes a tubular support member that includes a first tubular support body defining a longitudinal passage, a first radial passage defined in the first tubular support body fluidicly coupled to the longitudinal passage, a first flange coupled to the first tubular support body, a second flange coupled to the first tubular support body, a first tapered flange coupled to the first tubular support body, and a second tapered flange coupled to the first tubular support body. An adjustable expansion cone assembly is movably coupled to the tubular support member. A first dog assembly is movably coupled to the tubular support member that includes a first tubular sleeve coupled to the adjustable expansion cone assembly that defines: a first counterbore for receiving the first flange, and a second radial passage, a first spring received within the first counterbore, a first retaining ring received within the first counterbore, a first load transfer pin coupled to the first retaining ring and extending through the second radial passage, a second tubular sleeve coupled to the first load transfer pin that defines: a second counterbore for receiving the first tubular sleeve, a first resilient dog coupled to the second tubular sleeve and positioned adjacent to the first tapered flange. A second dog assembly is movably coupled to the tubular support member that includes a third tubular sleeve that defines a second counterbore for receiving the second flange;

a third radial passage, and a fourth radial passage fluidicly coupled to the first radial passage, a second spring received within the second counterbore, a second retaining ring received within the second counterbore, a second load transfer pin coupled to the second retaining ring and extending through the third radial passage, a fourth tubular sleeve coupled to the second load transfer pin, a second resilient dog coupled to the fourth tubular sleeve and positioned adjacent to the second tapered flange. First and second packer cups are coupled to the tubular support member between the first and second dog assemblies.

According to another aspect of the present invention, an apparatus for radially expanding a tubular member is provided that includes a tubular support member that includes a first tubular support body defining a longitudinal passage including a throat passage, a first radial passage defined in the first tubular support body fluidicly coupled to the longitudinal passage, a first flange coupled to the first tubular support body, and a second flange coupled to the first tubular support body that defines: a second radial passage defined in the second flange fluidicly coupled to the longitudinal passage. An adjustable expansion cone assembly is movably coupled to the tubular support member. A dog assembly is movably coupled to the tubular support member that includes a first tubular sleeve coupled to the adjustable expansion cone assembly that defines a first counterbore for receiving the first flange, and a third radial passage, a spring received within the first counterbore, a retaining ring received within the first counterbore, a load transfer pin coupled to the retaining ring and extending through the third radial passage, a second tubular sleeve coupled to the first load transfer pin that defines: a first counterbore for receiving the first tubular sleeve, a second counterbore for receiving and mating with the tapered flange, and includes a third flange that defines a third counterbore for receiving the second flange, a fourth counterbore for receiving the second flange, and a fourth radial passage, and a resilient dog coupled to the second tubular sleeve and positioned adjacent to the tapered flange. First and second packer cups are coupled to the tubular support member between the resilient dog and the third flange.

According to another aspect of the present invention, an apparatus for radially expanding a tubular member is provided that includes a tubular support member, an adjustable expansion cone assembly movably coupled to the tubular support member, and means for adjusting the adjustable expansion cone assembly.

According to another aspect of the present invention, an adjustable expansion cone assembly is provided that includes a tubular support member. An adjustable expansion cone is movably coupled to the tubular support member that includes a plurality of expansion cone segments, and means for guiding the expansion cone segments on the tubular support member. The assembly further includes means for adjusting the adjustable expansion cone.

According to another aspect of the present invention, a method of operating an adjustable expansion cone assembly including a plurality of expansion cone segments is provided that includes guiding the expansion cone segments on a tapered body, and controllably displacing the expansion cone segments along the tapered body.

According to another aspect of the present invention, a method of operating an adjustable expansion cone assembly including a plurality of expansion cone segments is provided that includes guiding the expansion cone segments on a multi-sided tapered body, interlocking the expansion cone segments, and controllably displacing the expansion cone segments along the tapered body.

According to another aspect of the present invention, a method of operating an adjustable expansion cone assembly including a plurality of expansion cone segments is provided that includes resiliently guiding the expansion cone segments on a multi-sided tapered body, guiding each of the expansion cone segments on opposite sides in the circumferential direction, interlocking the expansion cone segments, and controllably displacing the expansion cone segments along the tapered body.

According to another aspect of the present invention, a method of operating an adjustable expansion cone assembly including a plurality of expansion cone segments is provided that includes dividing the expansion cone segments into first and second groups of expansion cone segments, interleaving the first and second groups of expansion cone segments, overlapping the first and second groups of expansion cone segments, resiliently guiding the expansion cone segments on a multi-sided tapered body, guiding each of the expansion cone segments on opposite sides in the circumferential direction, and controllably displacing the expansion cone segments along the tapered body.

According to another aspect of the present invention, a method of operating an adjustable expansion cone assembly including a plurality of expansion cone segments is provided that includes dividing the expansion cone segments into first and second groups of expansion cone segments, interleaving the first and second groups of expansion cone segments, guiding the expansion cone segments on a multi-sided tapered body, and controllably displacing the expansion cone segments along the tapered body while also relatively displacing the first and second groups of expansion cone segments in opposite directions.

According to another aspect of the present invention, a method of plastically deforming and radially expanding an expandable tubular member using an apparatus including a tubular support member, an adjustable expansion cone assembly movably coupled to the tubular support member, and an actuator movably coupled to the tubular support member for adjusting the adjustable expansion cone assembly, is provided that includes coupling a first end of the expandable tubular member to a tubular structure, locking the actuator to the tubular support member of the apparatus, inserting the apparatus into the first end of the expandable tubular member, moving the actuator and the adjustable expansion cone assembly of the apparatus out of the second end of the expandable tubular member, reinserting the actuator of the apparatus into the second end of the expandable tubular member, unlocking the actuator from the tubular support member of the apparatus, rotating the actuator relative to the tubular support member of the apparatus, and increasing the outside diameter of the adjustable expansion cone assembly by moving the tubular support member relative to the actuator, the adjustable expansion cone assembly and the expandable tubular member, and plastically deforming and radially expanding the expandable tubular member by moving the adjustable expansion cone assembly through the expandable tubular member.

According to another aspect of the present invention, a method of plastically deforming and radially expanding an expandable tubular member using an apparatus including a tubular support member, an adjustable expansion cone assembly movably coupled to the tubular support member, and an actuator movably coupled to the tubular support member for adjusting the adjustable expansion cone assembly, is provided that includes coupling a first end of the expandable tubular member to a tubular structure, inserting the apparatus into the first end of the expandable tubular member in a first direction, displacing the actuator of the apparatus in a second direction opposite to the first direction, applying a resilient biasing force to the adjustable expansion cone assembly in the second direction, moving the actuator and the adjustable expansion cone assembly of the apparatus out of the second end of the expandable tubular member, reinserting the actuator of the apparatus into the second end of the expandable tubular member in the second direction, increasing the outside diameter of the adjustable expansion cone assembly by displacing the actuator and the adjustable expansion cone assembly relative to the expandable tubular member in the first direction, and plastically deforming and radially expanding the expandable tubular member by moving the adjustable expansion cone assembly through the expandable tubular member in the second direction.

According to another aspect of the present invention, an adjustable expansion cone assembly is provided that includes a plurality of expansion cone segments, means for guiding the expansion cone segments on a tapered body, and means for controllably displacing the expansion cone segments along the tapered body.

According to another aspect of the present invention, an adjustable expansion cone assembly is provided that includes a plurality of expansion cone segments, means for guiding the expansion cone segments on a multi-sided tapered body, means for interlocking the expansion cone segments, and means for controllably displacing the expansion cone segments along the tapered body.

According to another aspect of the present invention, an adjustable expansion cone assembly is provided that includes a plurality of expansion cone segments, means for resiliently guiding the expansion cone segments on a multi-sided tapered body, means for guiding each of the expansion cone segments on opposite sides in the circumferential direction, means for interlocking the expansion cone segments, and means for controllably displacing the expansion cone segments along the tapered body.

According to another aspect of the present invention, an adjustable expansion cone assembly is provided that includes a plurality of expansion cone segments, means for dividing the expansion cone segments into first and second groups of expansion cone segments, means for interleaving the first and second groups of expansion cone segments, means for overlapping the first and second groups of expansion cone segments, means for resiliently guiding the expansion cone segments on a multi-sided tapered body, means for guiding each of the expansion cone segments on opposite sides in the circumferential direction, and means for controllably displacing the expansion cone segments along the tapered body.

According to another aspect of the present invention, an adjustable expansion cone assembly is provided that includes a plurality of expansion cone segments, means for dividing the expansion cone segments into first and second groups of expansion cone segments, means for interleaving the first and second groups of expansion cone segments, means for guiding the expansion cone segments on a multi-sided tapered body, and means for controllably displacing the expansion cone segments along the tapered body while also relatively displacing the first and second groups of expansion cone segments in opposite directions.

According to another aspect of the present invention, an apparatus for plastically deforming and radially expanding an expandable tubular member is provided that includes a tubular support member, an adjustable expansion cone assembly movably coupled to the tubular support member, means for actuating the adjustable expansion cone assembly, means for locking the actuator to the tubular support member of the apparatus, means for unlocking the actuator from the tubular support member of the apparatus, and means for increasing the outside diameter of the adjustable expansion cone assembly by moving the tubular support member relative to the actuator, the adjustable expansion cone assembly, and the expandable tubular member.

According to another aspect of the present invention, an apparatus for plastically deforming and radially expanding an expandable tubular member is provided that includes a tubular support member, an adjustable expansion cone assembly movably coupled to the tubular support member, means for actuating the adjustable expansion cone assembly, means for displacing the actuator of the apparatus in a first direction, means for applying a resilient biasing force to the adjustable expansion cone assembly when the actuator is displaced in the first direction, and means for increasing the outside diameter of the adjustable expansion cone assembly by displacing the actuator and the adjustable expansion cone assembly relative to the expandable tubular member in a second direction opposite to the first direction.

DETAILED DESCRIPTION OF THE ILLUSTRATIVE EMBODIMENTS

Figure 1:
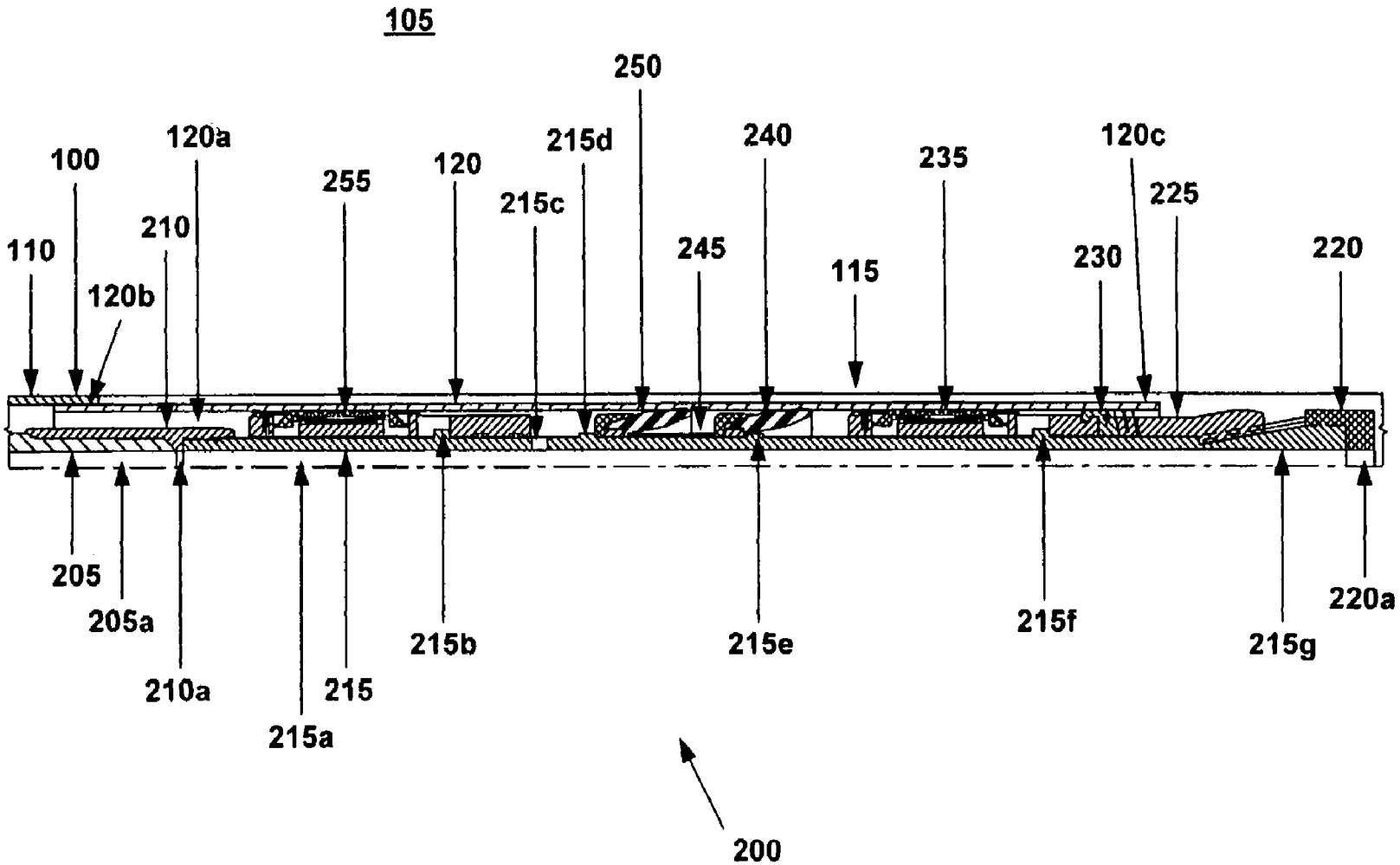
FIGS. 1 and 1*a*-1*d* are fragmentary cross-sectional views of an embodiment of the placement of an apparatus for radially expanding a tubular member within a tubular member within a borehole within a subterranean formation.
Figure 1A:
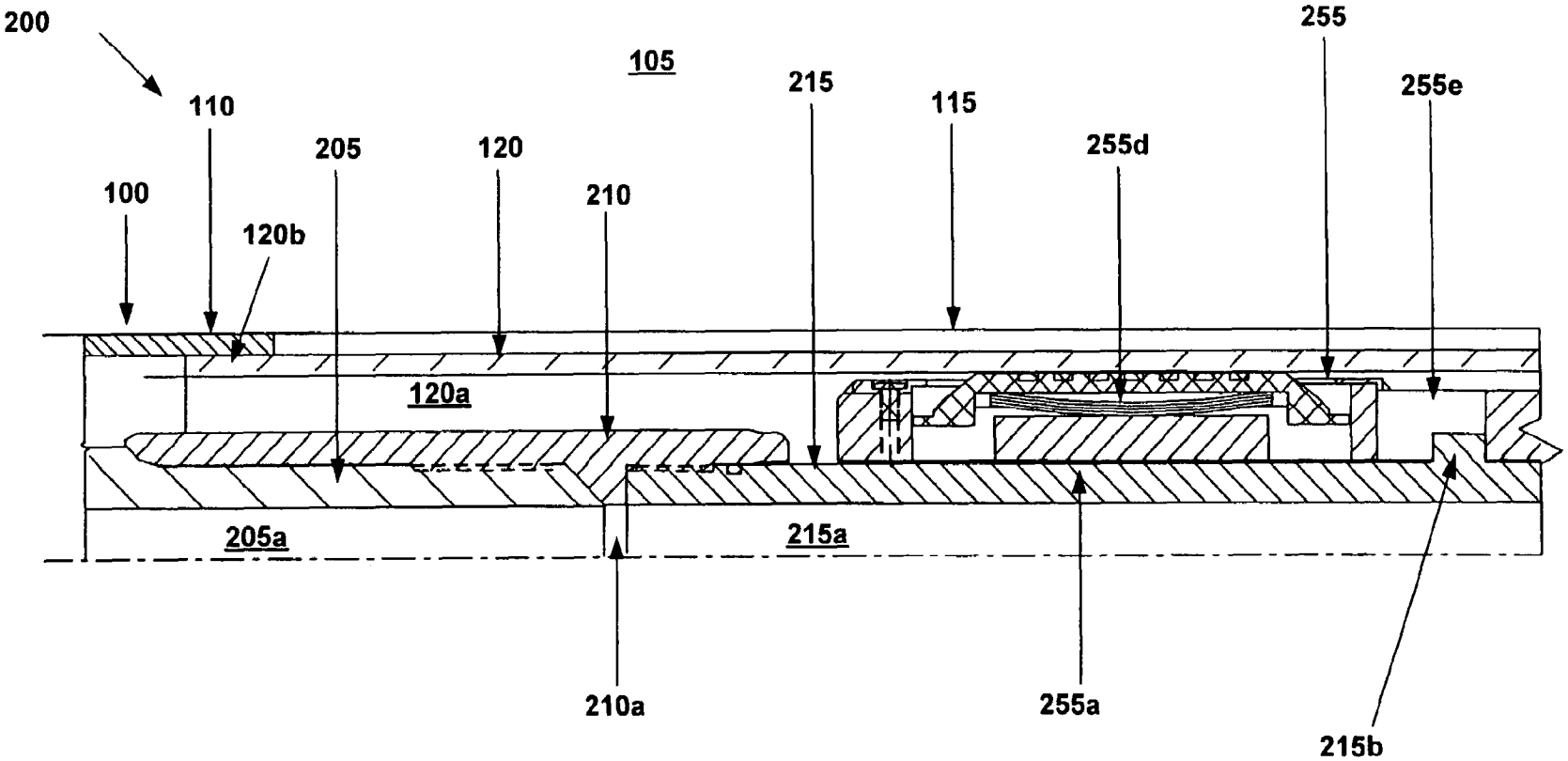
Figure 1B:
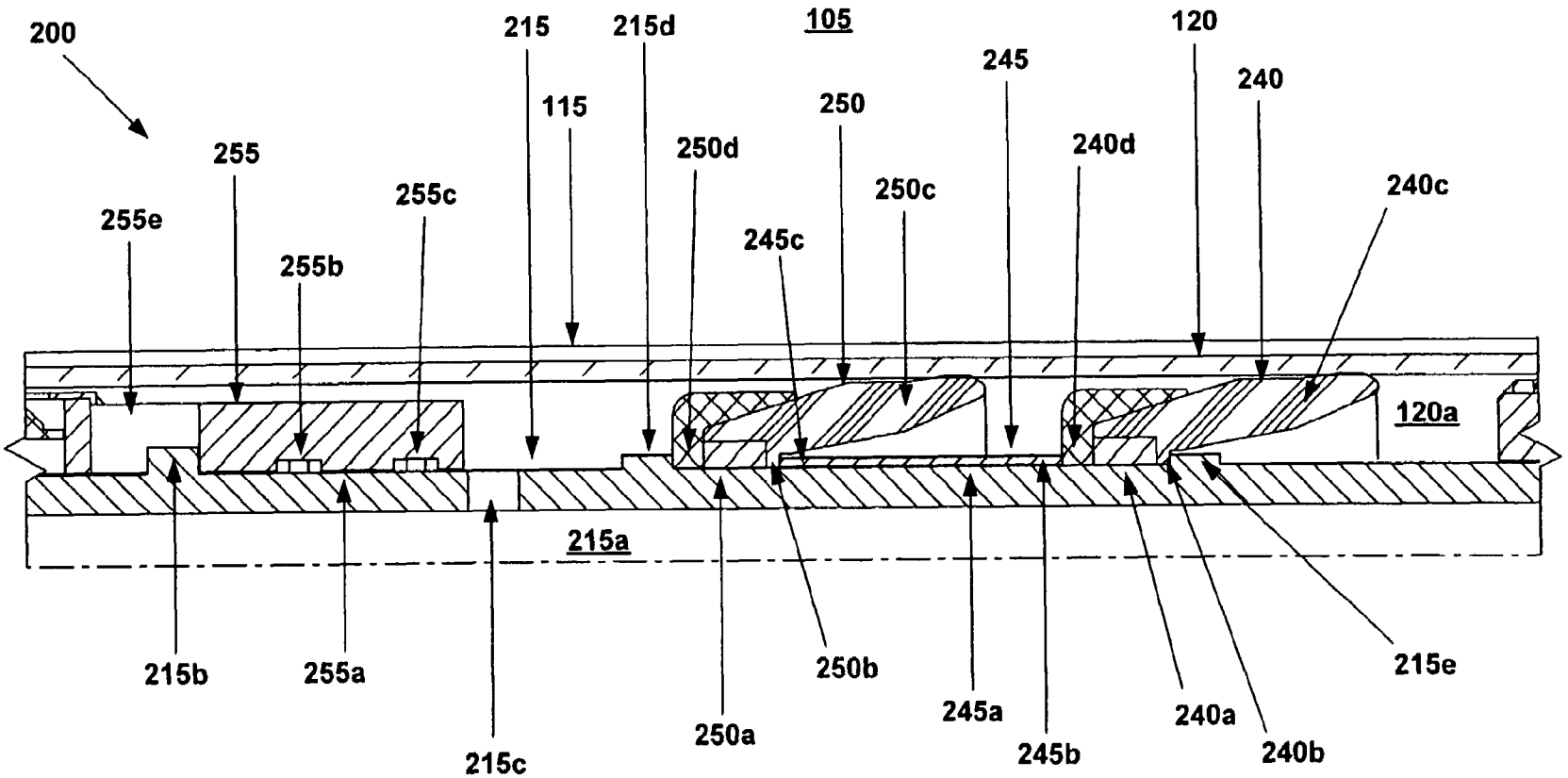
Figure 1C:
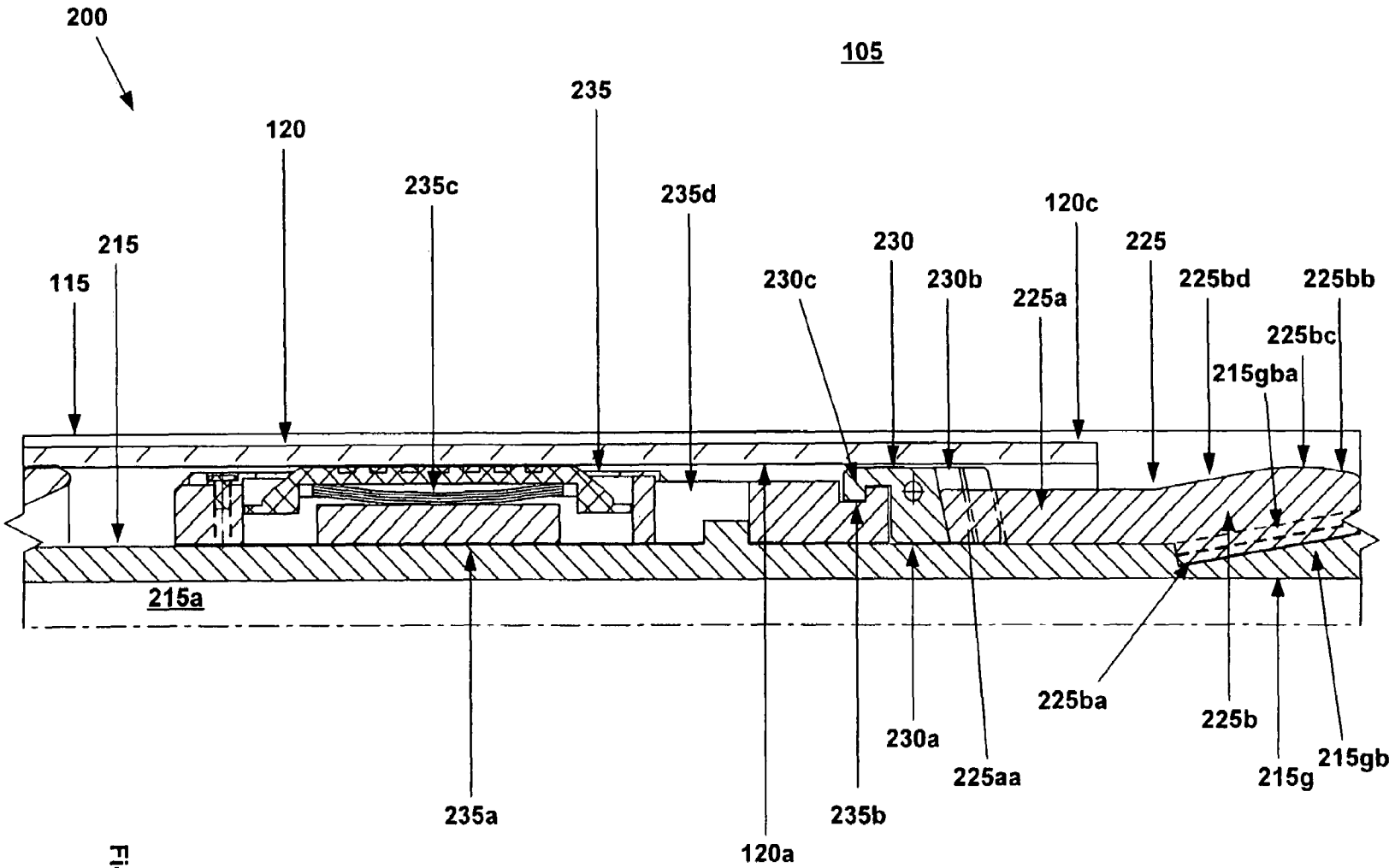
Figure 1D:
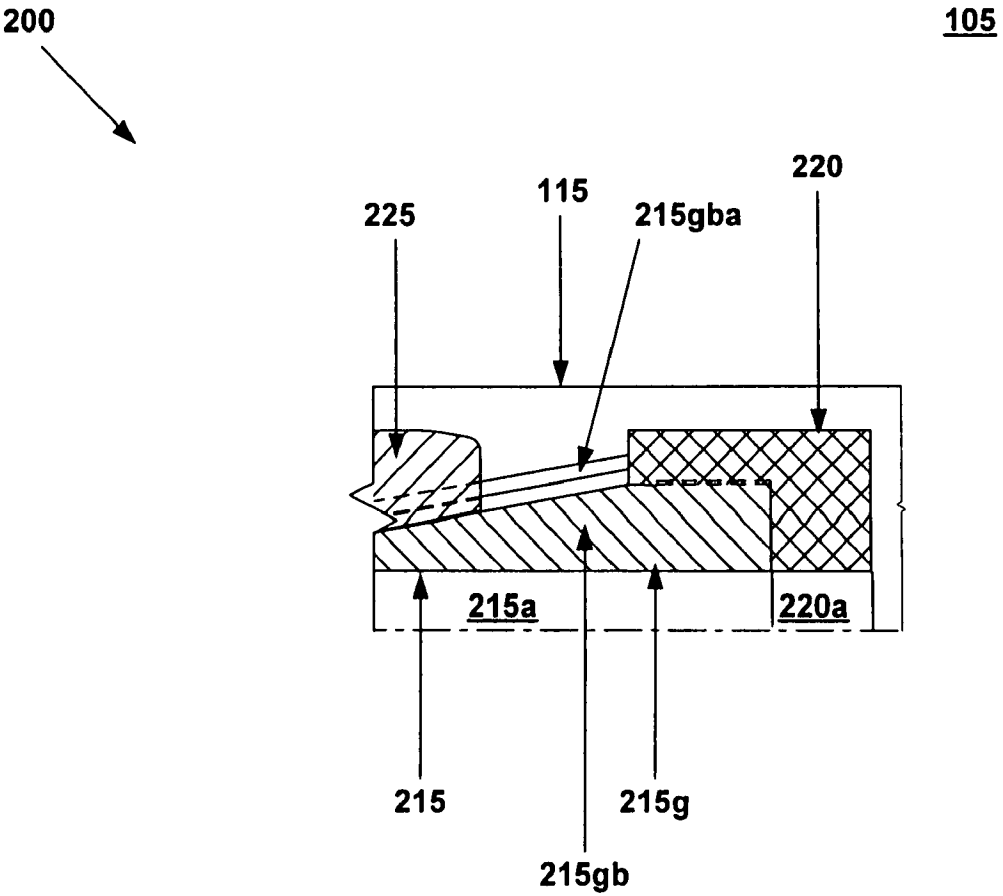

Referring initially to FIGS. 1 and 1*a*-1*d*, an embodiment of an apparatus and method for radially expanding a tubular member will now be described. As illustrated in FIGS. 1 and 1*a*-1*d*, a wellbore 100 is positioned in a subterranean formation 105. In an exemplary embodiment, the wellbore 100 may include a pre-existing cased section 110. The wellbore 100 may be positioned in any orientation from vertical to horizontal.

In order to extend the wellbore 100 into the subterranean formation 105, a drill string is used in a well known manner to drill out material from the subterranean formation 105 to form a new wellbore section 115. In a preferred embodiment, the inside diameter of the new wellbore section 115 is greater than or equal to the inside diameter of the preexisting wellbore casing 110.

A tubular member 120 defining a passage 120*a* may then be positioned within the wellbore section 115 with the upper end 120*b* of the tubular member coupled to the wellbore casing 110 and the lower end 120*c* of the tubular member extending into the wellbore section. The tubular member 120 may be positioned within the wellbore section 115 and coupled to the wellbore casing 110 in a conventional manner. In a preferred embodiment, the tubular member 120 is positioned within the wellbore section 115 and coupled to the wellbore casing 110 using one or more of the methods and apparatus disclosed in one or more of the following: (1) U.S. Pat. No. 6,497,289, which was filed as U.S. patent application Ser. No. 09/454,139, filed on Dec. 3, 1999, which claims priority from provisional application 60/111,293, filed on Dec. 7, 1998, (2) U.S. patent application Ser. No. 09/510,913, filed on Feb. 23, 2000, which claims priority from provisional application 60/121,702, filed on Feb. 25, 1999, (3) U.S. Pat. No. 6,823,937, which was filed as U.S. patent application Ser. No. 09/502,350, filed on Feb. 10, 2000, which claims priority from provisional application 60/110,611, filed on Feb. 11, 1999, (4) U.S. Pat. No. 6,328,113, which was filed as U.S. patent application Ser. No. 09/440,338, filed on Nov. 15, 1999, which claims priority from provisional application 60/108,558, filed on Nov. 16, 1998, (5). U.S. patent application Ser. No. 10/169,434, filed on Jul. 1, 2002, which claims priority from provisional application 60/183,546, filed on Feb. 18, 2000, (6) U.S. Pat No. 6,640,903, which was filed as U.S. patent application Ser. No. 09/523,463, filed on Mar. 10, 2000, which claims priority from provisional application 60/124,042, filed on Mar. 11, 1999, (7) U.S. Pat. No. 6,568,471, which was filed as U.S. patent application Ser. No. 09/512,895, filed on Feb. 24, 2000, which claims priority from provisional application 60/121,841, filed on Feb. 26, 1999, (8) U.S. Pat. No. 6,575,240, which was filed as patent application Ser. No. 09/511,941, filed on, Feb. 24, 2000, which claims priority from provisional application 60/121,907, filed on Feb. 26, 1999 (9) U S. Pat. No. 6,557,640, which was filed as patent application Ser. No. 09/588,946, filed on Jun. 7, 2000, which claims priority from provisional application 60/137,998, filed on Jun. 7, 1999, (10) U.S. Pat. No. 6,712,154, which was filed as U.S. patent application Ser. No. 09/981,916, filed on Oct. 18, 2001 as a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (11) U.S. Pat No. 6,604,763, which was filed as application Ser. No. 09/559,122, filed on Apr. 26, 2000, which claims priority from provisional application 60/131,106, filed on Apr. 26, 1999, (12) U.S. patent application Ser. No. 10/030,593, filed on Jan. 8, 2002, which claims priority from provisional application 60/146,203, filed on Jul. 29, 1999, (13) U.S. provisional patent application Ser. No. 60/143,039, filed on Jul. 9, 1999, (14) U.S. Pat. No. 7,048,067, which was filed as U.S. patent application Ser. No. 10/111,982, filed on Apr. 30, 2002, which claims priority from provisional patent application Ser. No. 60/162,671, filed on Nov. 1, 1999, (15) U.S. provisional patent application Ser. No. 60/154,047, filed on Sep. 16, 1999, (16) U.S. provisional patent application Ser. No. 60/438,828, filed on Jan. 9, 2003, (17) U.S. Pat. No. 6,564,875, which was filed as application Ser. No. 09/679,907, filed on Oct. 5, 2000, which claims priority from provisional patent application Ser. No. 60/159,082, filed on Oct. 12, 1999, (18) U.S. Pat. No. 6,695,012, which was filed as U.S. patent application Ser. No. 10/089,419, filed on Mar. 27, 2002, which claims priority from provisional patent application Ser. No. 60/159,039, filed on Oct. 12, 1999, (19) U.S. patent application Ser. No. 09/679,906, filed on Oct. 5, 2000, which is Abandoned and which claims priority from provisional patent application Ser. No. 60/159,033, filed on Oct. 12, 1999, (20) U.S. patent application Ser. No. 10/303,992, filed on Nov. 22, 2002, which claims priority from provisional patent application Ser. No. 60/212,359, filed on Jun. 19, 2000, (21) U.S. provisional patent application Ser. No. 60/165,228, filed on Nov. 12, 1999, (22) U.S. provisional patent application Ser. No. 60/455,051, filed on Mar. 14, 2003, (23) PCT application US02/2477, filed on Jun. 26, 2002, which claims priority from U.S. provisional patent application Ser. No. 60/303,711, filed on Jul. 6, 2001, (24) U.S. patent application Ser. No. 10/311,412, filed on Dec. 12, 2002, which claims priority from provisional patent application Ser. No. 60/221,443, filed on Jul. 28, 2000, (25) U.S. Pat. No. 7,100,684, which was filed as U.S. patent application Ser. No. 10/322,947, filed on Dec. 18, 2002, which claims priority from provisional patent application Ser. No. 60/221,645, filed on Jul. 28, 2000, (26) U.S. Pat. No. 6,976,541, which was filed as U.S. patent application Ser. No. 10/351,160, filed on Jan. 22, 2003, which claims priority from provisional patent application Ser. No. 60/233,638, filed on Sep. 18, 2000, (27) U.S. Pat. No. 7,172,024, which was filed as U.S. patent application. Ser. No. 10/406,648, filed on Mar. 31, 2003, which claims priority from provisional patent application Ser. No. 60/237,334, filed on Oct. 2, 2000, (28) PCT application US02/04353, filed on Feb. 14, 2002, which claims priority from U.S. provisional patent application Ser. No. 60/270,007, filed on Feb. 20, 2001, (29) U.S. Pat. No. 7,185,710, which was filed as U.S. patent application Ser. No. 10/465,835, filed on Jun. 13, 2003, which claims priority from provisional patent application Ser. No. 60/262,434, filed on Jan. 17, 2001, (30) U.S. Pat. No. 7,100,685, which was filed as U.S. patent application Ser. No. 10/465,831, filed on Jul. 13, 2003, which claims priority from U.S. provisional patent application Ser. No. 60/259,486, filed on Jan. 3, 2001, (31) U.S. provisional patent application Ser. No. 60/452,303, filed on Mar. 5, 2003, (32) U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (33) U.S. Pat. No. 6,561,227, which was filed as patent application Ser. No. 09/852,026, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (34) U.S. Pat. No. 6,631,760, which was filed as U.S. patent application Ser. No. 09/852,027, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (35) PCT Application US02/25608, filed on Aug. 13, 2002, which claims priority from provisional application 60/318,021, filed on Sep. 7, 2001, (36) PCT Application US02/24399, filed on Aug. 1, 2002, which claims priority from U.S. provisional patent application Ser. No. 60/313,453, filed on Aug. 20, 2001, (37) PCT Application US02/29856, filed on Sep. 19, 2002, which claims priority from U.S. provisional patent application Ser. No. 60/326,886, filed on Oct. 3, 2001, (38) PCT Application US02/20256, filed on Jun. 26, 2002, which claims priority from U.S. provisional patent application Ser. No. 60/303,740, filed on Jul. 6, 2001, (39) U.S. Pat. No. 6,892,819, which was filed as U.S. patent application Ser. No 09/962,469, filed on Sep. 25, 2001, which is a divisional of U.S. Pat. No. 6,640,903, which was filed as U.S. patent application Ser. No. 09/523,468, filed on Mar. 10, 2000, which claims priority from provisional application 60/124,042, filed on Mar. 11, 1999, (40) U.S. patent application Ser. No. 09/962,470, filed on Sep. 25, 2001, which is a divisional of U.S. Pat. No. 6,640,903, which was filed as U.S. patent application Ser. No. 09/523,468, filed on Mar. 10, 2000, which claims priority from provisional application 60/124,042, filed on Mar. 11, 1999, (41) U.S. Pat. No. 6,739,392, which was filed as U.S. patent application Ser. No. 09/962,471, filed on Sep. 25, 2001, which is a divisional of U.S. Pat. No. 6,640,903, which as filed as U.S. patent application Ser. No. 09/523,468, filed on Mar. 10, 2000, which claims priority from provisional application 60/124,042, filed on Mar. 11, 1999, (42) U.S. Pat. No. 6,725,919, which was filed as U.S. patent application Ser. No. 09/962,467, filed on Sep. 25, 2001, which is a divisional of U.S. Pat. No. 6,640,903, which was filed as U.S. patent application Ser. No. 09/523,468, filed on Mar. 10, 2000, which claims priority from provisional application 60/124,042, filed on Mar. 11, 1999, (43) U.S. Pat. No. 6,758,278, which was filed as U.S. patent application Ser. No. 09/962,468, filed on Sep. 25, 2001, which is a divisional of U.S. Pat. No. 6,640,903, which was filed as U.S. patent application Ser. No. 09/523,468, filed on Mar. 10, 2000, which claims priority from provisional application 60/124,042, filed on Mar. 11, 1999, (44) PCT application US02/25727 filed on Aug. 14, 2002, which claims priority from U.S. provisional patent application Ser. No. 60/317,985, filed on Sep. 6, 2001, and U.S. provisional patent application Ser. No. 60/318,386, filed on Sep. 10, 2001, (45) PCT application US02/39425, filed on Dec. 10, 2002, which claims priority from U.S. provisional patent application Ser. No. 60/343,674, filed on Dec. 27, 2001, (46) U.S. Pat. No. 6,634,431, which was filed as U.S. utility patent application Ser. No. 09/969,922, filed on Oct. 3, 2001, which is a continuation-in-part application of U.S. Pat, No. 6,328,113, which was filed as U.S. patent application Ser. No. 09/440,338, filed on Nov. 15, 1999, which claims priority from provisional application 60/108,558, filed on Nov. 16, 1998, (47) U.S. Pat. No. 6,745,845, which was filed as U.S. utility patent application Ser. No. 10/516,467, filed on Dec. 10, 2001, which is a continuation application of U.S. Pat. No. 6,634,431, which was filed as U.S. utility patent application Ser. No. 09/969,922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (48) PCT application US03/00609, filed on Jan. 9, 2003, which claims priority from U.S. provisional patent application Ser. No. 60/357,372, filed on Feb. 15, 2002, (49) U.S. Pat. No. 6,705,395, which was filed as U.S. patent application Ser. No. 10/074,703, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (50) U.S. Pat. No. 6,631,759, which was filed as U.S. patent application Ser. No. 10/074,244, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (51) U.S. patent application Ser. No. 10/076,660, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (52) U.S. Pat. No. 6,631,769, which was filed as U.S. patent application Ser. No. 10/076,661, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (53) U.S. Pat. No. 7,063,142, which was filed as U.S. patent application Ser. No. 10/076,659, filed on Feb. 15, 2002, which is a divisional of U.S. Pat. No. 6,568,471, which was filed as patent application Ser. No. 09/512,895, filed on Feb. 24, 2000, which claims priority from provisional application 60/121,811, filed on Feb. 26, 1999, (54) US. Pat. No. 6,684,947, which was filed as U.S. patent application Ser. No. 10/078,928, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (55) U.S. Pat. No. 6,966,370, which was filed as U.S. patent application Ser. No. 10/078,922, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (56) U.S. Pat. No. 7,044,221, which was filed as U.S. patent application Ser. No. 10/078,921, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (57) U.S. Pat. No. 7,011,161, which was filed as U.S. patent application Ser. No. 10/261,928, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (58) U.S. Pat. No. 7,040,396, which was filed as U.S. patent application Ser. No. 10/079,276, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (59) U.S. Pat. No. 7,048,062, which was filed as U.S. patent application Ser. No. 10/262,009, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (60) U.S. Pat. No. 6,857,473, which was filed as U.S. patent application Ser. No. 10/092,481, filed on Mar. 7, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (61) U.S. Pat. No. 7,086,475 which was filed as U.S. patent application Ser. No. 10/261,926, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (62) PCT application US02/36157, filed on Nov. 12, 2002, which claims priority from U.S. provisional patent application Ser. No. 60/338,996, filed on Nov. 12, 2001 (63) PCT application US02/36267, filed on Nov. 12, 2002, which claims priority from U.S. provisional patent application Ser. No. 60/339,013, filed on Nov. 12, 2001, (64) PCT application US03/11765, filed on Apr. 16, 2003, which claims priority from U.S. provisional patent application Ser. No. 60/383,917, filed on May 29, 2002, (65) PCT application US03/15020, filed on May 12, 2003, which claims priority from U.S. provisional patent application Ser. No. 60/391,703, filed on Jun. 26, 2002, (66) PCT application US02/39418, filed on Dec. 10, 2002, which claims priority from U.S. provisional patent application Ser. No. 60/346,309, filed on Jan. 7, 2002, (67) PCT application US03/06544, filed on Mar. 4, 2003, which claims priority from U.S. provisional patent application Ser. No. 60/372,048, filed on Apr. 12, 2002, (68) U.S. patent application Ser. No. 10/331,718, filed on Dec. 30, 2002, which is Abandoned and which is a divisional U.S. patent application Ser. No. 09/679,906, filed on Oct. 5, 2000, which claims priority from provisional patent application Ser. No. 60/159,033, filed on Oct. 12, 1999, (69) PCT application US03/04837, filed on Feb. 29, 2003, which claims priority from U.S. provisional patent application Ser. No. 60/363,829, filed on Mar. 13, 2002, (70) U.S. Pat. No. 7,077,213, which was filed as U.S. patent application Ser. No. 10/261,927, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (71) U.S. Pat. No. 7,036,582, which was filed as U.S. patent application Ser. No. 10/262,008, filed on Oct. 1, 2002, which is a divisional of U.S. Pat. No. 6,557,640, which was filed as patent application Ser. No. 09/588, 946, filed on. Jun. 7, 2000, which claims priority from provisional application 60/137,998, filed on Jun. 7, 1999, (72) U.S. Pat. No. 7,044,218, which was filed as U.S. patent application Ser. No. 10/261,925, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (73) U.S. Pat. No. 7,159,665, which was filed as U.S. patent application Ser. No. 10/199,524, filed on Jul. 19, 2002, which is a continuation of U.S. Pat. No. 6,497,289, which was filed as U.S. patent application Ser. No. 09/454,139, filed on Dec. 3, 1999, which claims priority from provisional application 60/111,293, filed on Dec. 7, 1998, (74) PCT application US03/10144, filed on Mar. 28, 2003, which claims priority from U.S. provisional patent application Ser. No. 60/372,632, filed on Apr. 15, 2002, (75) U.S. provisionsal patent application Ser. No. 60/412,542, filed on Sep. 20, 2002, (76) PCT application US03/14153, filed on May 6, 2003, which claims priority from U.S. provisional patent application Ser. No. 60/380,147, filed on May 6, 2002, (77) PCT application US03/19993, filed on Jun. 24, 2003, which claims priority from U.S. provisional patent application Ser. No. 60/397,284, filed on Jul. 19, 2002, (78) PCT application US03/13787, filed on May 15, 2003, which claims priority from U.S. provisional patent application Ser. No. 60/387,486, filed on Jun. 10, 2002, (79) PCT application US03/18530, filed on Jun. 11, 2003, which claims priority from U.S. provisional patent application Ser. No. 60/387,961, filed on Jun. 12, 2002, (80) PCT application US03/20694, filed on Jul. 1, 2003, which claims priority from U.S. provisional patent application Ser. No. 60/398,061, filed on Jul. 24, 2002, (81) PCT application US03/20870, filed on Jul. 2, 2003, which claims priority from U.S. provisional patent application Ser. No. 60/399,240, filed on Jul. 29, 2002, (82). U.S. provisional patent application Ser. No. 60/412,487, filed on Sep. 20, 2002, (83) U.S. provisional patent application Ser. No. 60/412,488, filed on Sep. 20, 2002, (84) U.S. Pat. No. 7,108,061, which was filed as U.S. patent application Ser. No. 10/280,356, filed on Oct. 25, 2002, which is a continuation of U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (85) U.S. provisional patent application Ser. No. 60/412,177, filed on Sep. 20, 2002, (86) U.S. provisional patent application Ser. No. 60/412,653, filed on Sep. 20, 2002, (87) U.S. provisional patent application Ser. No. 60/405,610, filed on Aug. 23, 2002, (88) U.S. provisional patent application Ser. No. 60/405,394, filed on Aug. 23, 2002, (89) U.S. provisional patent application Ser. No. 60/412,544, filed on Sep. 20, 2002, (90) PCT application PCT/US03/24779, filed on Aug. 8, 2003, which claims priority from U.S. provisional patent application Ser. No. 60/407,442, filed on Aug. 30, 2002, (91) U.S. provisional patent application Ser. No. 60/423,363, filed on Dec. 10, 2002, (92) U.S. provisional patent application Ser. No. 60/412,196, filed on Sep. 20, 2002, (93) U.S. provisional patent application Ser. No. 60/412,187, filed on Sep. 20, 2002, (94) U.S. provisional patent application Ser. No. 60/412,371, filed on Sep. 20, 2002, (95) U.S. Pat. No. 7,108,072, which was filed as U.S. patent application Ser. No. 10/382,325, filed on Mar. 5, 2003, which is a continuation of U.S. Pat. No. 6,557,640, which was filed as patent application Ser. No. 09/588,946, filed on Jun. 7, 2000, which claims priority from provisional application 60/137,998, filed on Jun. 7, 1999, (96) U.S. Pat. No. 7,174,964, which was filed as U.S. patent application Ser. No. 10/624,842, filed on Jul. 22, 2003, which is a divisional of U.S. Pat. No. 6,823,937, which was filed as U.S. patent application Ser. No. 09/502,350, filed on Feb. 10, 2000, which claims priority from provisional application 60/119,611, filed on Feb. 11, 1999, (97) U.S. provisional patent application Ser. No. 60/431,184, filed on Dec. 5, 2002, (98) U.S. provisional patent application Ser. No. 60/448,526, filed on Feb. 18, 2003, (99) U.S. provisional patent application Ser. No. 60/461,539, filed on Apr. 9, 2003, (100) U.S. provisional patent application Ser. No. 60/462,750, filed on Apr. 14, 2003, (101) U.S. provisional patent application Ser. No. 60/436,106, filed on Dec. 23, 2002, (102) U.S. provisional patent application Ser. No. 60/442,942, filed on Jan. 27, 2003, (103) U.S. provisional patent application Ser. No. 60/442,938, filed on Jan. 27, 2003, (104) U.S. provisional patent application Ser. No. 60/418,687, filed on Apr. 18, 2003, (105) U.S. provisional patent application Ser. No. 60/454,896, filed on Mar. 14, 2003, (106) U.S. provisional patent application Ser. No. 60/450,504, filed on Feb. 26, 2003, (107) U.S. provisional patent application Ser. No. 60/451,152, filed on Mar. 9, 2003, (108) U.S. provisional patent application Ser. No. 60/455,124, filed on Mar. 17, 2003, (109) U.S. provisional patent application Ser. No. 60/453,678, filed on Mar. 11, 2003, (110) U.S. patent application Ser. No. 10/421,682, filed on Apr. 23, 2003, which is a continuation of U.S. patent application Ser. No. 09/523,468, filed on Mar. 10, 2000, which claims priority from provisional application 60/124,042, filed on Mar. 11, 1999, (111) U.S. provisional patent application Ser. No. 60/457,965, filed on Mar. 27, 2003, (112) U.S. provisional patent application Ser. No. 60/455,718, filed on Mar. 18, 2003, (113) U.S. Pat. No. 6,550,821, which was filed as patent application Ser. No. 09/811,734, filed on Mar. 19, 2001, (114) U.S. Pat. No. 6,968,618, which was filed as U.S. patent application Ser. No. 10/436,467, filed on May 12, 2003, which is a continuation of U.S. Pat. No. 6,604,763, which was filed as application Ser. No. 09/559,122, filed on Apr. 26, 2000, which claims priority from provisional application 60/131,106, filed on Apr. 26, 1999, (115) U.S. provisional patent application Ser. No. 60/459,776, filed on Apr. 2, 2003, (116) U.S. provisional patent application Ser. No. 60/461,094, filed on Apr. 8, 2003, (117) U.S. provisional patent application Ser. No. 60/461,038, filed on Apr. 7, 2003, (118) U.S. provisional patent application Ser. No. 60/453,586, filed on Apr. 17, 2003, (119) U.S. provisional patent application Ser. No. 60/472,240, filed on May 20, 2003, (120) U.S. Pat. No. 7,121,352, which was filed as U.S. patent application Ser. No. 10/619,285, filed on Jul. 14, 2003, which is a continuation-in-part of U.S. Pat. No. 6,634,431, which was filed as U.S. utility patent application Ser. No. 09/969,922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (121) U.S. Pat. No. 7,055,608, which was filed as U.S. utility patent application Ser. No. 10/418,688, filed on Apr. 18, 2003, as a division of U.S. Pat. No. 6,640,903, which was filed as U.S. utility patent application Ser. No. 09/523,468, filed on Mar. 10, 2000, which claims priority from provisional application 60/124,042, filed on Mar. 11, 1999, and (122) U.S. utility patent application Ser. No. 10/784,679, filed on Feb. 23, 2004, which was a continuation-in-part of U.S. utility patent application Ser. No. 10/089,419, filed on Mar. 27, 2002, which issued as U.S. Pat. No. 6,695,012, the disclosures of which are incorporated herein by reference.

As illustrated in FIGS. 1 and 1*a*-1*d*, an apparatus 200 for radially expanding a tubular member may then be positioned in the new section 115 of the wellbore 100 within the tubular member 120. The apparatus 200 includes a tubular support member 205 defining an internal passage 205*a* that is coupled to an end of a tubular coupling 210 defining an internal passage 210*a*. The other end of the tubular coupling 210 is coupled to an end of a tubular support member 215 defining an internal passage 215*a* that includes a first lug 215*b*, a radial passage 215*c*, a first flange 215*d*, a second flange 215*e*, a second lug 215*f*, and an expansion cone support body 215*g*. The other end of the tubular support member 215 is coupled to a tubular end stop 220 that defines a passage 220*a*.

Figure 1F:
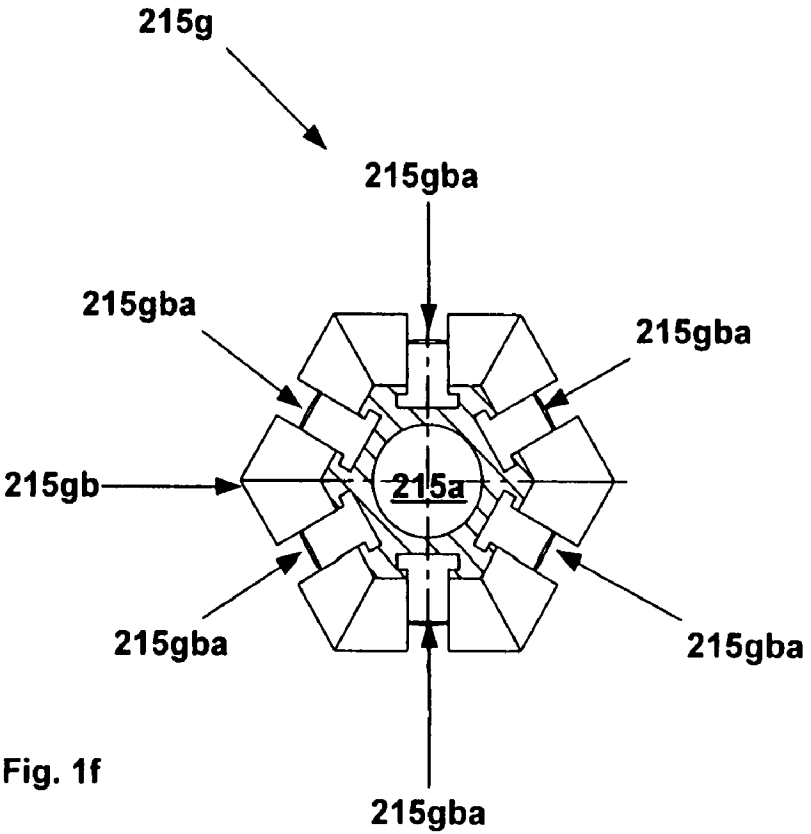
FIG. 1*f* is a cross-sectional view of the expansion cone support body of FIG. 1*e*.
Figure 1E:
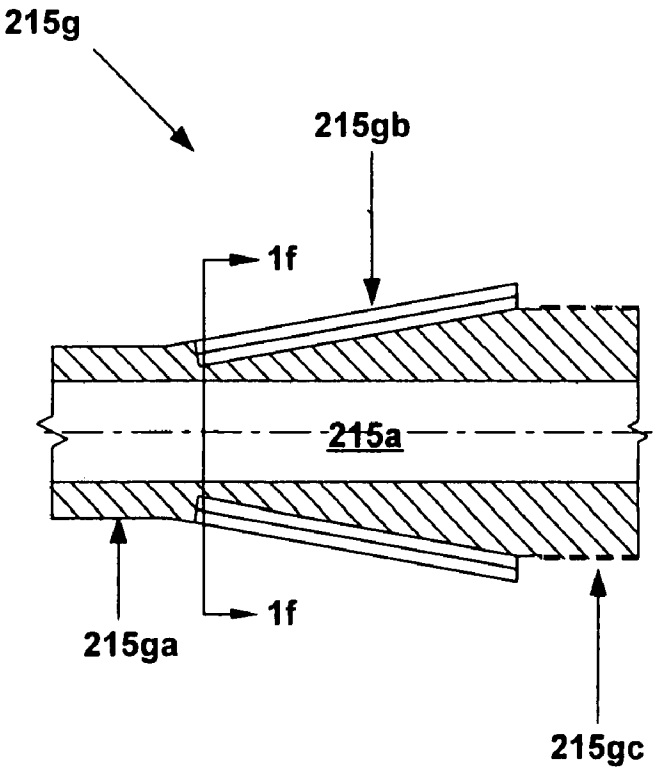
FIG. 1*e* is a cross-sectional view of an embodiment of the expansion cone support body of the apparatus of FIGS. 1 and 1*a*-1*d*.
Figure 1H:
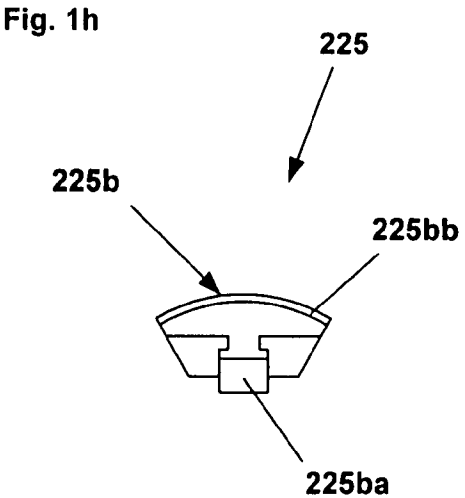
FIG. 1*h* is a front view of the expansion cone segment of FIG. 1*g*.
Figure 1G:
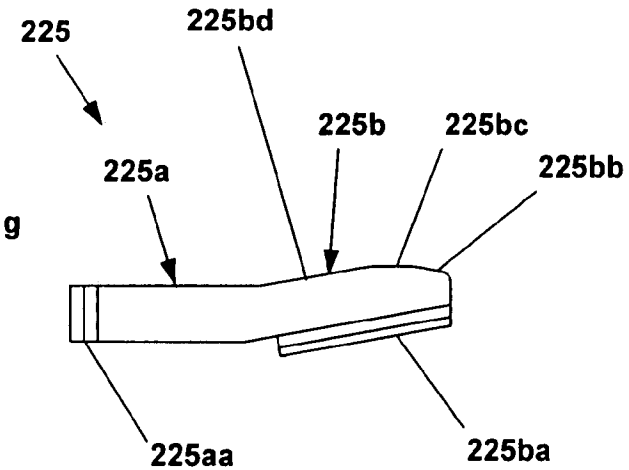
FIG. 1*g* is a side view of an embodiment of an expansion cone segment for use in the apparatus of FIGS. 1 and 1*a*-1*d*.
Figure 1I:
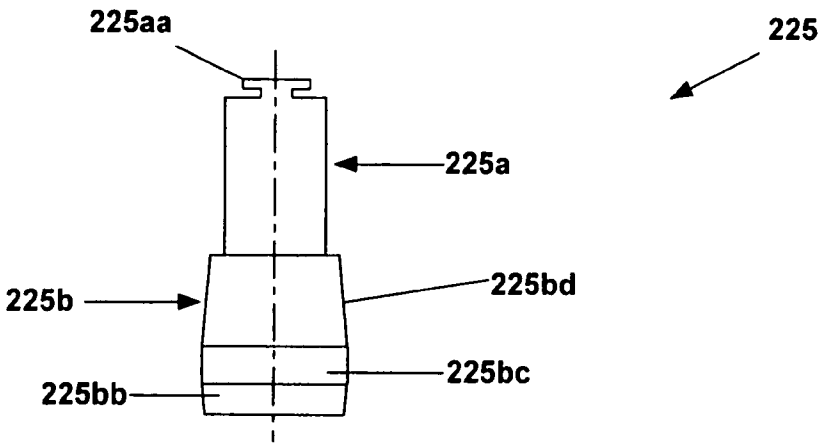
FIG. 1*i* is a top view of the expansion cone segment of FIG. 1*g*.

As illustrated in FIGS. 1*e* and 1*f*, the expansion cone support body 215*g* includes a first end 215*ga*, a tapered hexagonal portion 215*gb* that includes a plurality of T-shaped slots 215*gba* provided on each of the external faceted surfaces of the tapered hexagonal portion, and a second end 215*gc*. In an exemplary embodiment, the angle of attack of the tapered hexagonal portion ranges from about 35 to 50 degrees for reasons to be described.

As illustrated in FIGS. 1, 1*a*-1*d*, 1*g*,1*h*, and 1*i*, a plurality of expansion cone segments 225 are provided that include first ends 225*a* that include T-shaped retaining members 225*aa* and second ends 225*b* that include T-shaped retaining members 225*ba* that mate with and are received within corresponding T-shaped slots 215*gba* on the tapered hexagonal portion 215*gb* of the expansion cone support body 215*g*, first external surfaces 225*bb*, second external surfaces 225*bc*, and third external surfaces 225*bd*. Thus, in an exemplary embodiment, a total of six expansion cone segments 225 are provided that are slidably coupled to corresponding sides of the tapered hexagonal portion 215*gb* of the expansion cone support body.

In an exemplary embodiment, the widths of the first external surfaces 225*bb* of the expansion cone segments 225 increase in the direction of the second external surfaces 225*bc*, the widths of the second external surfaces are substantially constant, and the widths of the third external surfaces 225*bd* decrease in the direction of the first ends 225*a* of the expansion cone segments for reasons to be described. In an exemplary embodiment, the first external surfaces 225*bb* of the expansion cone segments 225 taper upwardly in the direction of the second external surfaces 225*bc*, the second external surfaces taper upwardly in the direction of the third external surfaces 225*bd*, and the third external surfaces 225*bd* taper downwardly in the direction of the first ends 225*a* of the expansion cone segments for reasons to be described. In an exemplary embodiment, the angle of attack of the taper of the first external surfaces 225*bb* of the expansion cone segments 225 are greater than the angle of attack of the taper of the second external surfaces 225*bc*. In an exemplary embodiment, the first and second external surfaces, 225*bb* and 225*bc*, of the expansion cone segments 225 are arcuate such that when the expansion cone segments 225 are displaced in the direction of the end stop 220, the first and second external surfaces of the expansion cone segments provide a substantially continuous outer circumferential surface for reasons to be described.

Figure 1J:
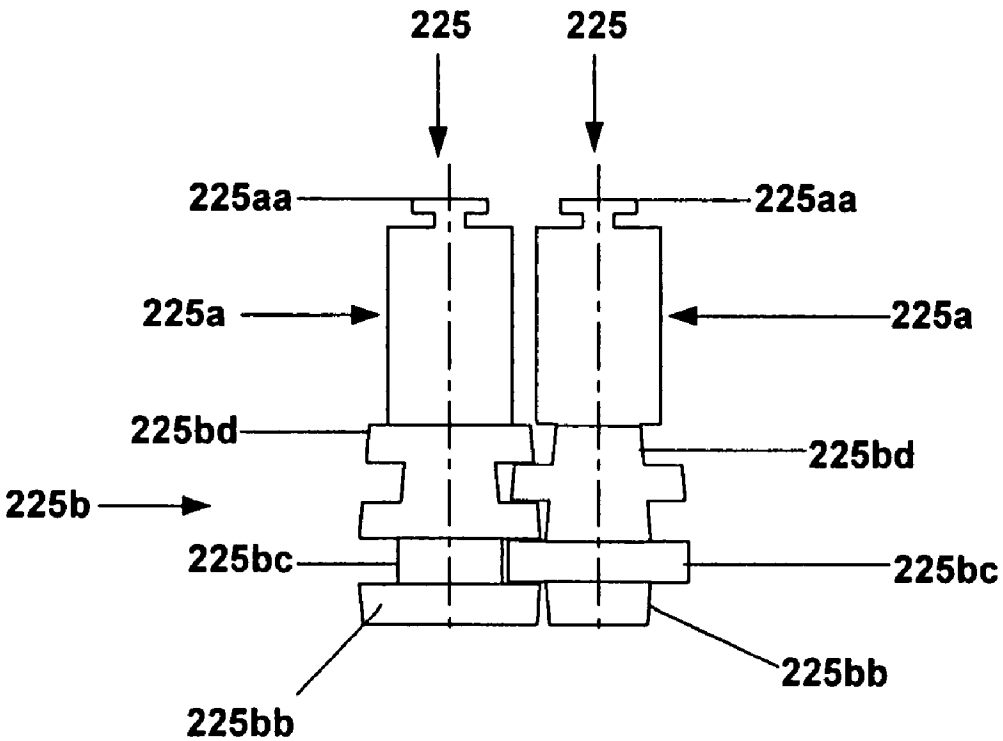
FIG. 1*j* is a top view of an embodiment of interlocking expansion cone segments for use in the apparatus of FIGS. 1 and 1*a*-1*d*.
Figure 1K:
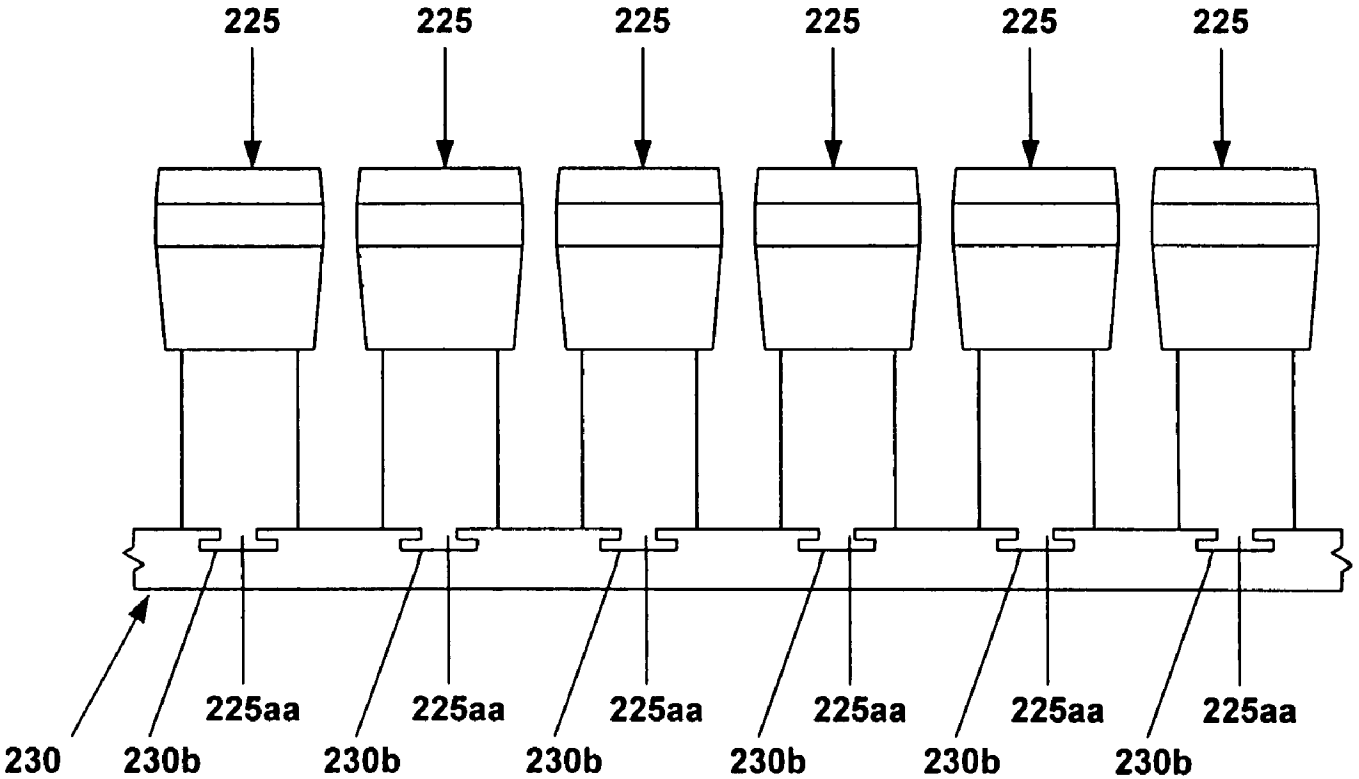
FIG. 1*k* is a top fragmentary circumferential view of an embodiment of the coupling arrangement between the expansion cone segments and the split ring collar for use in the apparatus of FIGS. 1 and 1*a*-1*d*.
Figure 1M:
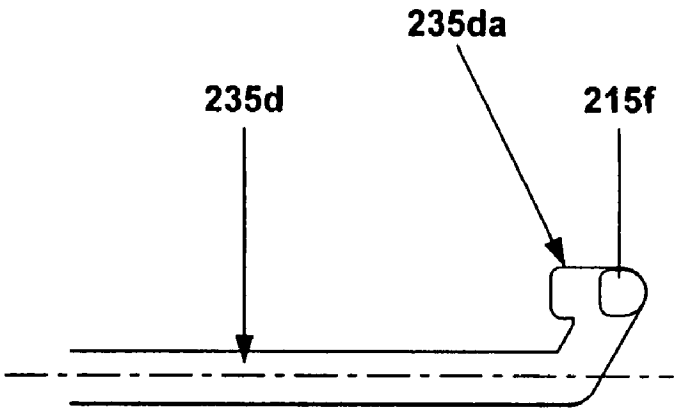
FIGS. 1*l* and 1*m* are top schematic views of an embodiment of the coupling between the J-slots of the drag blocks and the lugs of the tubular support member of the apparatus of FIGS. 1 and 1*a*-1*d*.
Figure 1L:
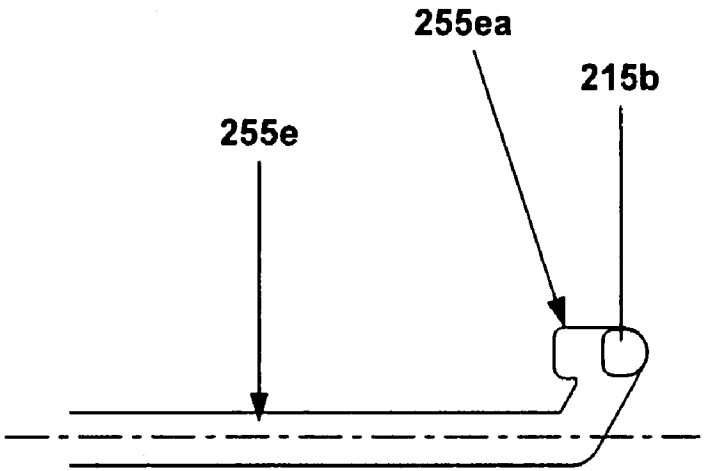

As illustrated in FIG. 1*j*, in an exemplary embodiment, the external surfaces, 225*bb*, 225*bc*, and 225*bd*, of the second ends 225*b* of the expansion cone segments 225 are adapted to mate with one another in order to interlock adjacent expansion cone segments.

As illustrated in FIGS. 1, 1*a*-1*d*, and 1*k*, a split ring collar 230 that defines a passage 230*a* for receiving the tubular support member 215 is provided that includes a first end that includes plurality of T-shaped slots 230*b* for receiving and mating with corresponding T-shaped retaining members 225*aa* of the expansion cone segments 225 and a second end that includes an L-shaped retaining member 230*c*. In an exemplary embodiment, the split ring collar 230 is a conventional split ring collar commercially available from Halliburton Energy Services modified in accordance with the teachings of the present disclosure.

As illustrated in FIGS. 1, 1*a*-1*d*, and 1*m*, a drag block assembly 235 that defines a passage 235*a* for receiving the tubular support member 215 is provided that includes a first end that includes an L-shaped slot 235*b* for receiving and mating with the L-shaped retaining member 230*c* of the split ring collar 230, one or more conventional drag block elements 235*c*, and a J-shaped slot 235*d* including a retaining slot 235*da* for receiving the second lug 215*f* of the tubular support member 215. In an exemplary embodiment, the longitudinal axis of the J-shaped slot 235*d* of the drag block assembly 235 is substantially parallel to the longitudinal axis of the tubular support member 215 for reasons to be described.

A first conventional packer cup assembly 240 that defines a passage 240*a* for receiving the tubular support member 215 includes a first end 240*b* that mates with the second flange 215*e* of the tubular support member, a conventional sealing cup 240*c*, and a second end 240*d*. A tubular spacer 245 that defines a passage 245*a* for receiving the tubular support member 215 includes a first end 245*b* that mates with the second end 240*c* of the first packer cup assembly 240 and a second end 245*c*. A second conventional packer cup assembly 250 that defines a passage 250*a* for receiving the tubular support member 215 includes a first end 250*b* that mates with the second end 245*c* of the spacer 245, a conventional sealing cup 250*c*, and a second end 250*d* that mates with the first flange 215*d* of the tubular support member.

As illustrated in FIGS. 1, 1*a*-1*d*, and 1*l*, a drag block assembly 255 that defines a passage 255*a* for receiving the tubular support member 215 is provided that includes a first end that includes sealing members, 255*b* and 255*c*, one or more conventional drag block elements 255*d*, and a J-shaped slot 255*e* including a retaining slot 255*ea* for receiving the first lug 215*b* of the tubular support member 215. In an exemplary embodiment, the longitudinal axis of the J-shaped slot 255*e* of the drag block assembly 255 is substantially parallel to the longitudinal axis of the tubular support member 215 for reasons to be described.

In an exemplary embodiment, during operation of the apparatus 200, as illustrated in FIGS. 1 and 1*a*-1*m*, the apparatus may be positioned in the wellbore 115, within the tubular member 120, with the first and second lugs, 215*b* and 215*f*, respectively, positioned within the retaining slots, 255*ea* and 235*da*, respectively, of the J-slots, 255*e* and 235*da*, respectively, of the drag block assembly 255 and 235, respectively. In this manner, the drag block assembly 235 is maintained in a substantially stationary position relative to the tubular support member 215 thereby preventing the expansion cone segments 225 from being displaced downwardly in the longitudinal direction relative to the tubular support member 215 towards the end stop 220. Furthermore, in this manner, the drag block assembly 255 is also maintained in a substantially stationary position relative to the tubular support member 215 thereby preventing the drag block assembly from sealing off the radial passage 215*c*. In an exemplary embodiment, during the placement of the apparatus 200 within the wellbore 115 and the tubular member 120, the radial passage 215*c* permits fluidic materials outside of the tubular support member 215 to pass into the passage 215*a* thereby minimizing overpressure conditions within the annulus outside of the tubular support member.

In an exemplary embodiment, the apparatus 200 is positioned within the expandable tubular member 120 such that the expansion cone body 215*g*, the end stop 220, and the expansion cone segments 225 extend out of the expandable tubular member. In this manner, the expansion cone segments 225 may be driven up the tapered hexagonal portion 215*gb* of the expansion cone body 215*g*, thereby increasing the outside diameters of the expansion cone segments, without impacting the expandable tubular member 120.

The tubular support member 215 may then be rotated relative to the drag block assemblies, 235 and 255, thereby displacing the lugs, 215*f* and 215*b*, with respect to the J-shaped slots, 235*d* and 255*e*, respectively. The tubular support member 215 may then be displaced upwardly relative to the drag block assemblies, 235 and 255, in the longitudinal direction thereby displacing the drag block assemblies downwardly relative to the tubular support member. During the longitudinal upward displacement of the tubular support member 215 relative to the drag block assemblies, 235 and 255, the drag block assemblies, 235 and 255, are maintained in a substantially stationary position with respect to the expandable tubular member 120 by the frictional forces exerted by the drag blocks, 235*c* and 255*d*, of the drag block assemblies on the expandable tubular member, and during the upward longitudinal displacement of the tubular support member 215 relative to the drag block assemblies, the lugs, 215*f* and 215*b*, are guided in a substantially longitudinal direction by the J-slots, 235*d* and 255*e*, respectively, of the drag block assemblies.

The downward longitudinal displacement of the drag block assembly 235 relative to the tubular support member 215 displaces the split ring collar 230 downwardly along with the expansion cone segments 225. As a result, the expansion cone segments 225 are driven up the tapered hexagonal portion 215*gb* of the expansion cone support body 215*g* until the end faces of the expansion cone segments impact the stop member 220. As a result, the outside diameter of the expansion cone segments 225 increases. In an exemplary embodiment, once the expansion cone segments 225 impact the stop member 220, the outer surfaces, 225*bb* and 225*bc*, of the expansion cone segments provide a substantially continuous outer surface in the circumferential direction having a diameter that is greater than the inside diameter of the expandable tubular member 120. The downward longitudinal displacement of the drag block assembly 255 relative to the tubular support member 215 seals off the radial passage 215*c* thereby preventing the pressurized fluidic material 275 from entering the annulus surrounding the tubular support member 215 through the radial passage.

In an exemplary embodiment, as illustrated in FIGS. 2 and 2*a*-2*f*, the expandable tubular member 120 may then be radially expanded using the apparatus 200 by injecting a fluidic material 275 into the apparatus through the passages 205*a*, 210*a*, and 215*a*. The injection of the fluidic material 275 may pressurize the interior 120*a* of the expandable tubular member 120. In addition, because the packer cup assemblies, 240 and 250, seal off an annular region 120*aa* below the packer cup assemblies between the expandable tubular member 120 and the tubular support member 215, the injection of the fluidic material 275 may also pressurize the annular region.

The continued injection of the fluidic material 275 may then pressurize the interior 120*a* of the expandable tubular member 120 thereby plastically deforming and radially expanding the expandable tubular member off of the expansion cone segments 225. Because the outer surfaces, 225*bb* and 225*bc*, of the expansion cone segments 225 are tapered, the plastic deformation and radial expansion of the expandable tubular member 120 proximate the expansion cone segments is facilitated. Furthermore, in an exemplary embodiment, the continued injection of the fluidic material 275 also pressurizes the annular region 120*aa* defined between the interior surface of the expandable tubular member 120 and the exterior surface of the tubular support member 215 that is bounded on the upper end by the packer cup assembly 240 and on the lower end by the expansion cone segments 225. Furthermore, in an exemplary embodiment, the pressurization of the annular region 120*aa* also radially expands the surrounding portion of the expandable tubular member 120. In this manner, the plastic deformation and radial expansion of the expandable tubular member 120 is enhanced. Furthermore, during operation of the apparatus 200, the packer cup assemblies 240 and 250 prevent the pressurized fluidic material 275 from passing above and beyond the packer cup assemblies and thereby define the length of the pressurized annular region 120*aa*. In an exemplary embodiment, the pressurization of the annular region 120*aa* decreases the operating pressures required for plastic deformation and radial expansion of the expandable tubular member 120 by as much as 50% and also reduces the angle of attack of the tapered external surfaces, 225*bb* and 225*bc*, of the expansion cone segments 225.

The radial expansion of the expandable tubular member 120 may then continue until the upper end 120*b* of the expandable tubular member is radially expanded and plastically deformed along with the overlapping portion of the wellbore casing 110. Because the expansion cone segments 225 may be adjustable positioned from an outside diameter less than the inside diameter of the expandable tubular member 120 to an outside diameter substantially equal to the inside diameter of the pre-existing casing 110, the resulting wellbore casing, including the casing 110 and the radially expanded tubular member 120, created by the operation of the apparatus 200 may have a single substantially constant inside diameter thereby providing a mono-diameter wellbore casing.

If the expansion cone segments 225 become lodged within the tubular member 120 during the radial expansion process, the tubular support member 215 may be displaced downwardly in the longitudinal direction and then rotated relative to the drag block assemblies, 235 and 255, thereby positioning the lugs, 215*b* and 215*f*, within the retaining slots, 255*ea* and 235*da*, respectively, of the J-slots, 255*e* and 235*d*, respectively. As a result, the expansion cone segments 225 may be displaced down the tapered hexagonal portion 215*gb* of the expansion cone support body 215*g* and away from the end stop 220 thereby decreasing the external diameter of the expansion cone segments. In this manner, the tubular support member 205, the tubular support member 210, the tubular support member 215, the end stop 220, the expansion cone segments 225, the split ring collar 230, the drag block assembly 235, the pack cup assembly 240, the spacer 245, the packer cup assembly 250, and the drag block assembly 255 may then be removed from the tubular member 120.

During the radial expansion process, the expansion cone segments 225 may be raised out of the expanded portion of the tubular member 120 by applying an upward axial force to the tubular support member 215. In a preferred embodiment, during the radial expansion process, the expansion cone segments 225 are raised at approximately the same rate as the tubular member 120 is expanded in order to keep the tubular member stationary relative to the new wellbore section 115. In an alternative preferred embodiment, the expansion cone segments 225 are maintained in a stationary position during the radial expansion process thereby allowing the tubular member 120 to be radially expanded and plastically deformed off of the expansion cone segments 225 and into the new wellbore section 115 under the force of gravity and the operating pressure of the interior of the tubular member 120.

In a preferred embodiment, when the upper end portion of the expandable tubular member 120 and the lower portion of the wellbore casing 110 that overlap with one another are plastically deformed and radially expanded by the expansion cone segments 225, the expansion cone segments 225 are displaced out of the wellbore 100 by both the operating pressure within the interior of the tubular member 120 and a upwardly directed axial force applied to the tubular support member 205.

In a preferred embodiment, the operating pressure and flow rate of the fluidic material 275 is controllably ramped down when the expansion cone segments 225 reach the upper end portion of the expandable tubular member 120. In this manner, the sudden release of pressure caused by the complete radial expansion and plastic deformation of the expandable tubular member 120 off of the expansion cone segments 225 can be minimized. In a preferred embodiment, the operating pressure is reduced in a substantially linear fashion from 100% to about 10% during the end of the extrusion process beginning when the expansion cone segments 225 are within about 5 feet from completion of the extrusion process.

Alternatively, or in combination, the wall thickness of the upper end portion of the expandable tubular member 120 is tapered in order to gradually reduce the required operating pressure for plastically deforming and radially expanding the upper end portion of the tubular member. In this manner, shock loading of the apparatus is at least reduced.

Alternatively, or in combination, a shock absorber is provided in the tubular support member 205 in order to absorb the shock caused by the sudden release of pressure. The shock absorber may comprise, for example, any conventional commercially available shock absorber, bumper sub, or jars adapted for use in wellbore operations.

Alternatively, or in combination, an expansion cone catching structure is provided in the upper end portion of the expandable tubular member 120 in order to catch or at least decelerate the expansion cone segments 225.

Alternatively, or in combination, during the radial expansion process, an upward axial force is applied to the tubular support member 215 sufficient to plastically deform and radially expand the tubular member 120 off of the external surfaces, 225*bb* and 225*bc*, of the expansion cone segments 225.

Alternatively, or in combination, in order to facilitate the pressurization of the interior 120*a* of the expandable tubular member by the injection of the fluidic materials 275, the region within the wellbore section 115 below the apparatus 200 may be fluidicly sealed off in a convention manner using, for example, a packer.

Once the radial expansion process is completed, the tubular support member 205, the tubular support member 210, the tubular support member 215, the end stop 220, the expansion cone segments 225, the split ring collar 230, the drag block assembly 235, the pack cup assembly 240, the spacer 245, the packer cup assembly 250, and the drag block assembly 255 are removed from the wellbore 100.

Figure 2:
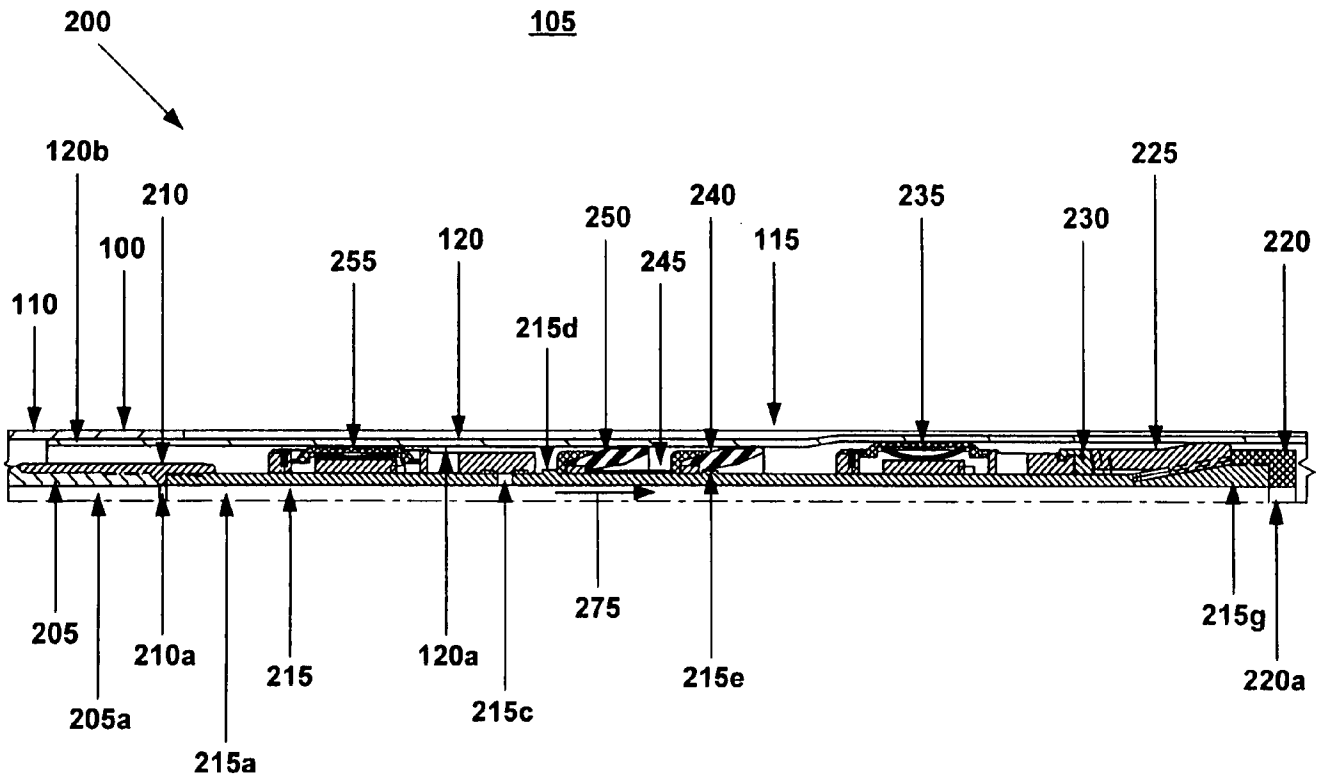
FIGS. 2 and 2*a*-2*d* are fragmentary cross-sectional illustrations of the apparatus of FIGS. 1 and 1*a*-1*d* during the radial expansion of the tubular member within the borehole within the subterranean formation.
Figure 2A:
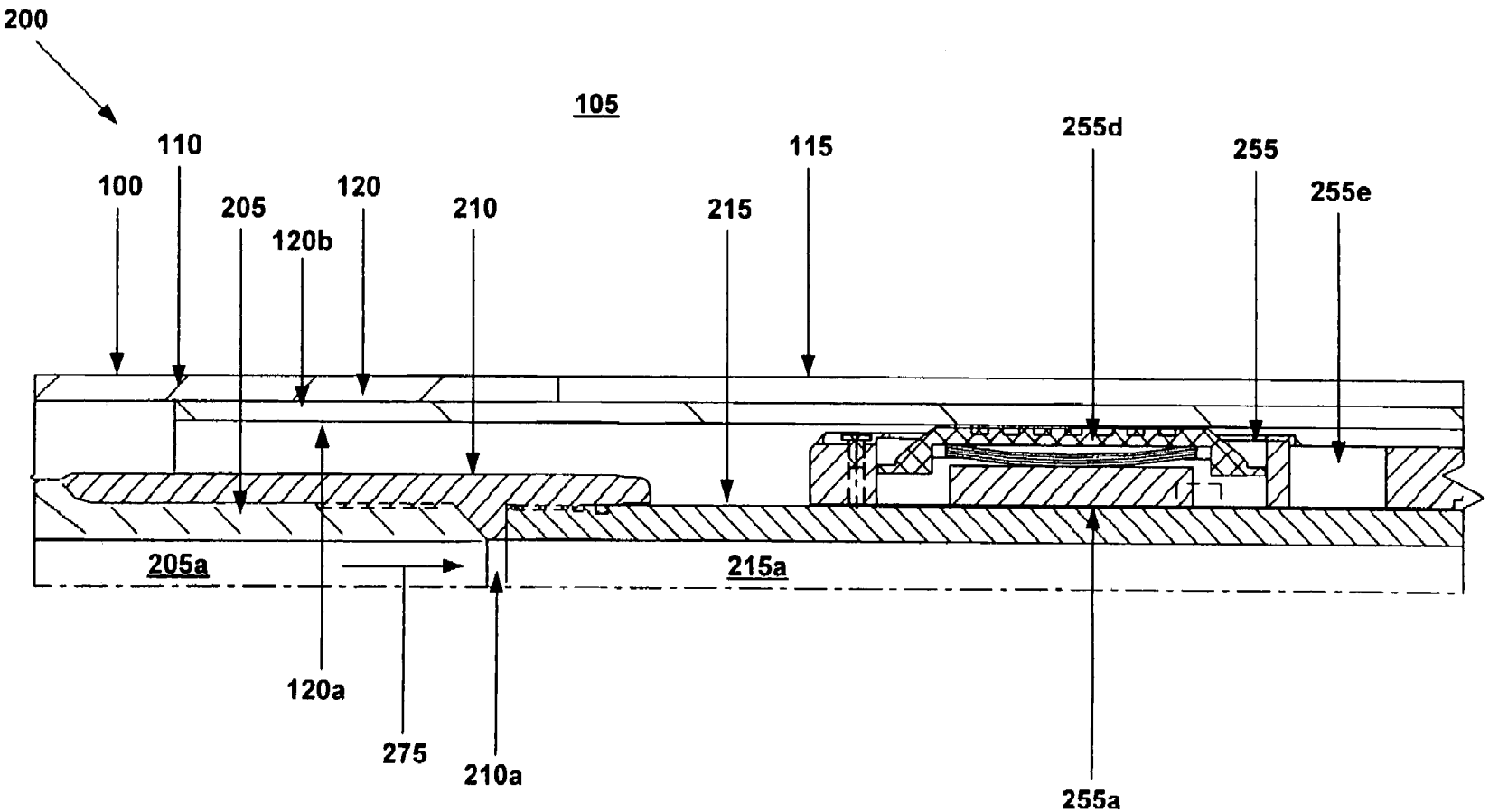
Figure 2B:
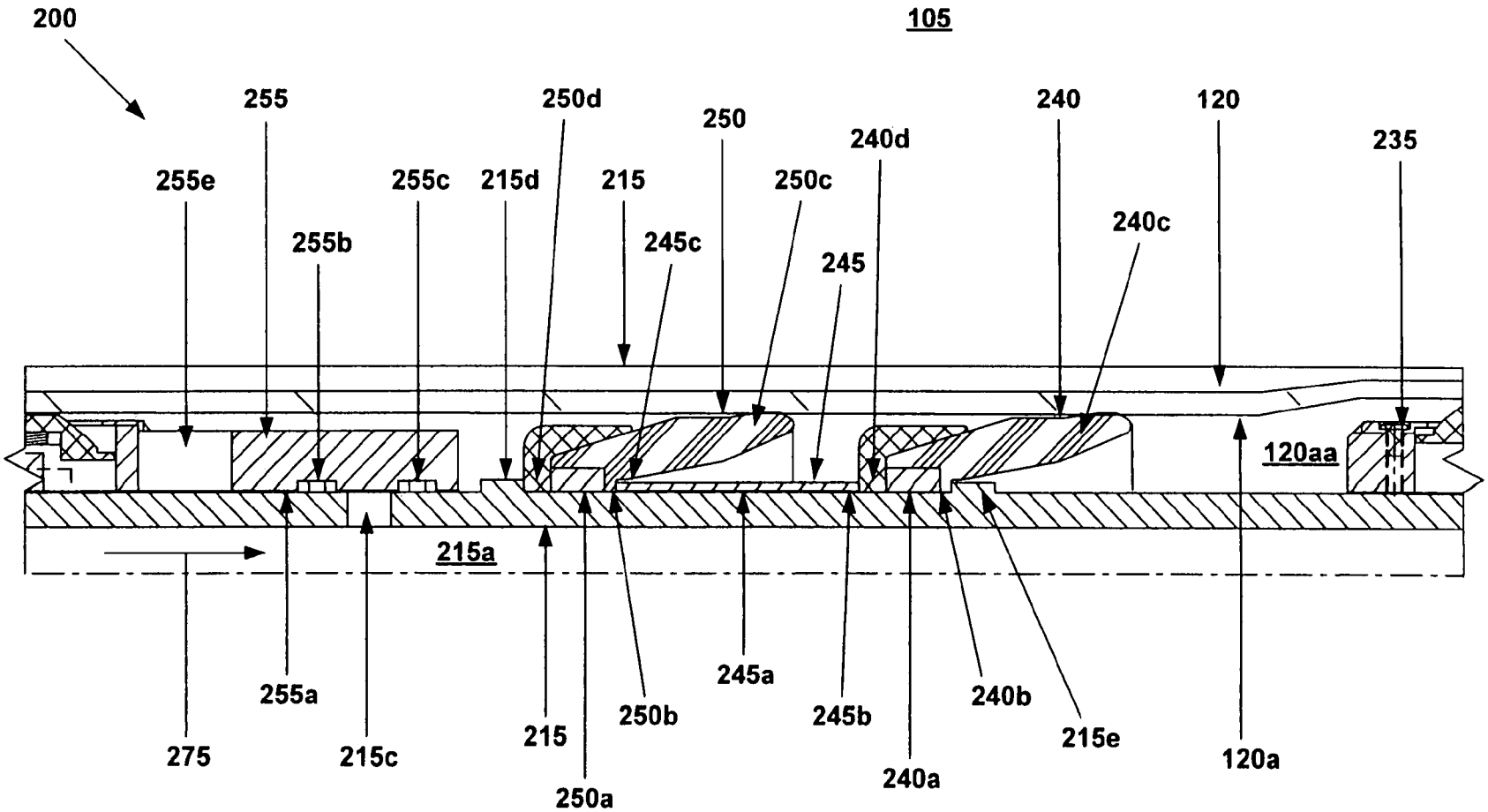
Figure 2C:
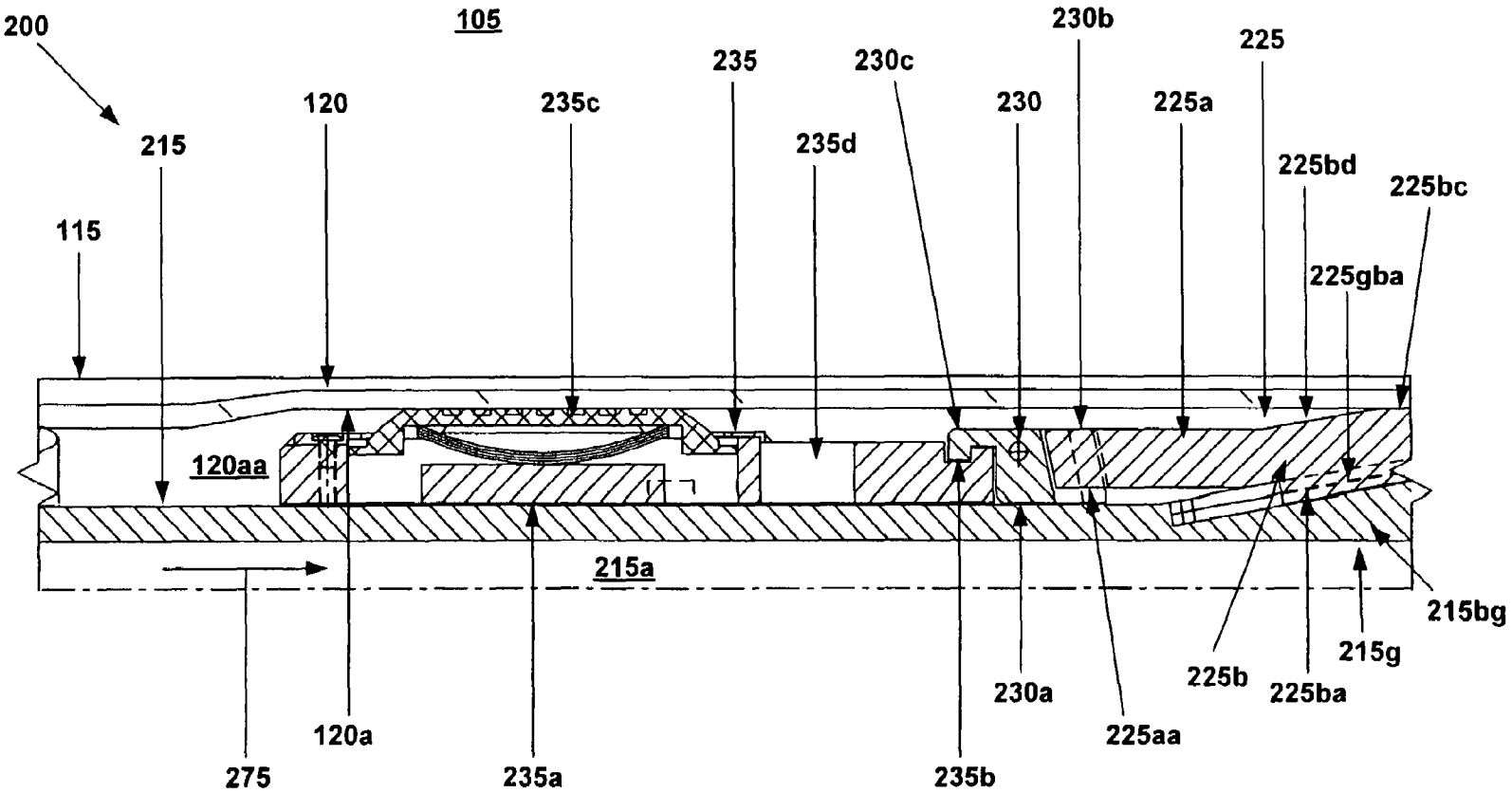
Figure 2D:
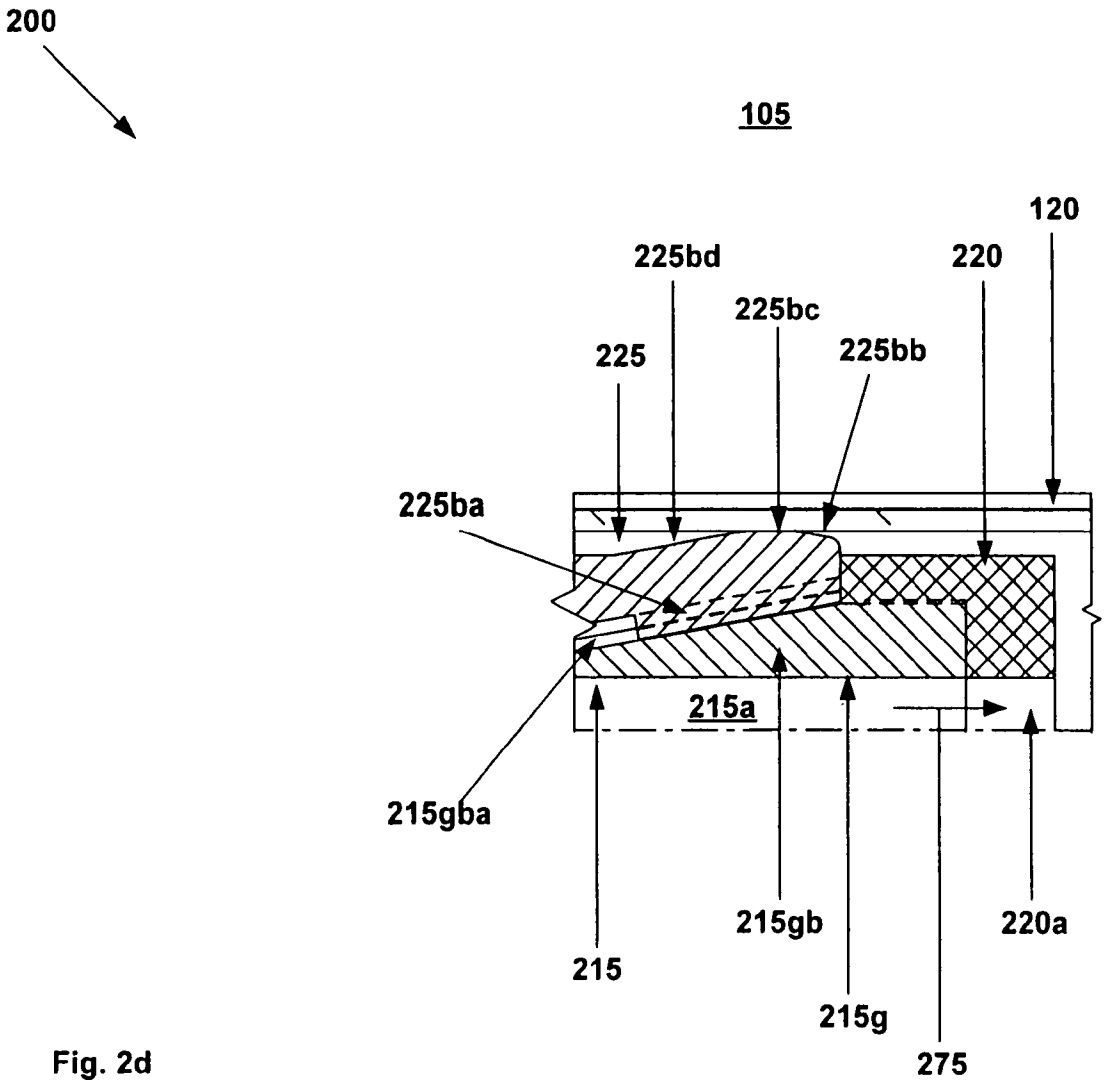
Figure 2F:
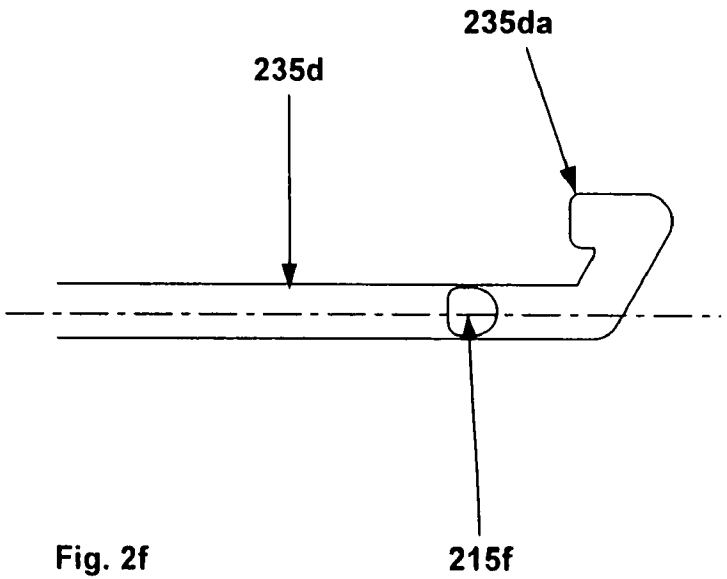
FIGS. 2*e* and 2*f* are illustrations of an embodiment of the J-slots of the drag blocks and the lugs of the tubular support member of the apparatus of FIGS. 2 and 2*a*-2*d*.
Figure 2E:
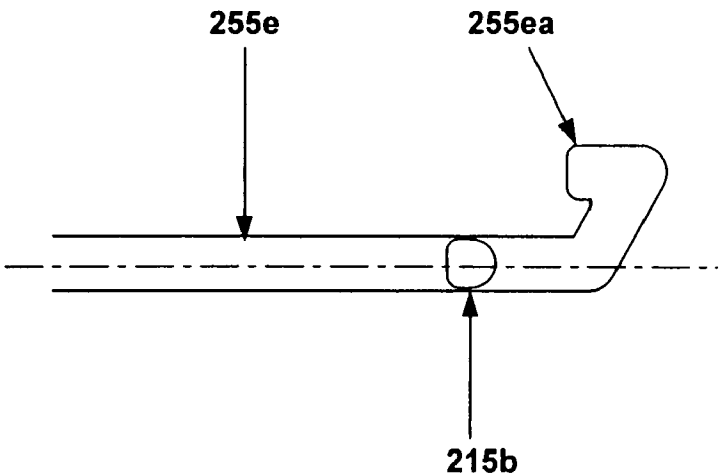
Figure 2H:
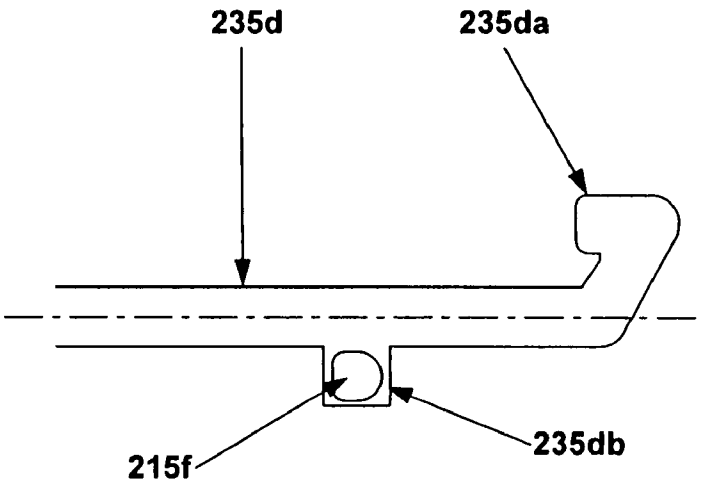
FIGS. 2*g* and 2*h* are illustrations of an alternative embodiment of the J-slots of the drag blocks and the lugs of the tubular support member of the apparatus of FIGS. 2 and 2*a*-2*d*.
Figure 2G:
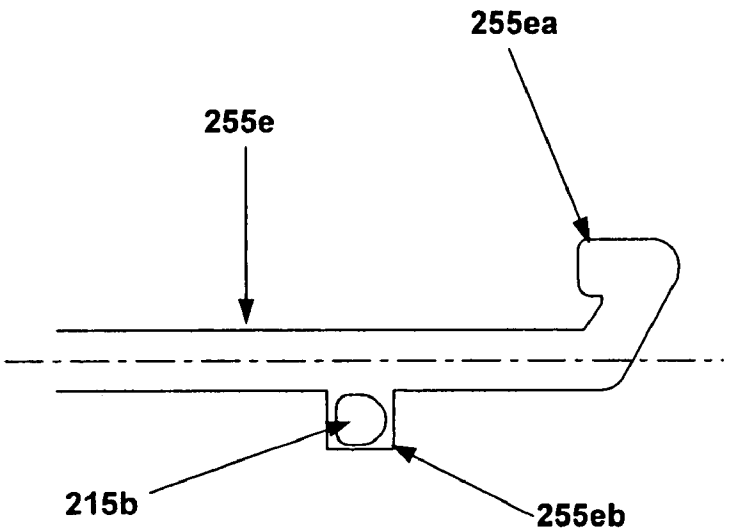

In an alternative embodiment, as illustrated in FIGS. 2*h* and 2*i*, the J-slots, 235*d* and 255*e*, include one or more intermediate retaining slots, 235*db* and 255*eb*, respectively, that permit the relative longitudinal displacement of the tubular support member 215 relative to the drag block assemblies, 235 and 255, to be set at one or more intermediate stop positions. In this manner, the expansion segments 225 may be positioned at one or more intermediate positions on the tapered hexagonal portion 215*gb* of the expansion cone support body 215*g* thereby permitting the external diameter of the expansion cone segments 225 to be adjusted to one or more intermediate sizes. In this manner, the radial expansion and plastic deformation of the expandable tubular member 120 be provided in different operation stages, each having a different expansion diameter. Furthermore, if the expansion cone segments 225 become lodged within the expandable tubular member 120, then the position of the expansion cone segments may be adjusted to provide a smaller outside diameter and the radial expansion process may be continued by injecting the fluidic material 275 and/or applying an upward axial force to the tubular support member 215.

Referring to FIGS. 3 and 3*a*-3*j*, an alternative embodiment of an apparatus 300 for forming a wellbore casing in a subterranean formation will now be described. The apparatus 300 includes a tubular support member 305 defining an internal passage 305*a* that is coupled to an end of a tubular coupling 310 defining an internal passage 310*a*. The other end of the tubular coupling 310 is coupled to an end of a tubular support member 315 defining an internal passage 315*a* that includes a first flange 315*b* having oppositely tapered end-walls, 315*ba* and 315*bb*, a second flange 315*c*, a radial passage 315*d*, a third flange 315*e*, a fourth flange 315*f*, a fifth flange 315*g* having oppositely tapered end-walls, 315*ga* and 315*gb*, a fifth flange 315*h*, and an expansion cone support body 315*i*. The other end of the tubular support member 315 is coupled to a tubular end stop 320 that defines a passage 320*a*.

Figure 3:
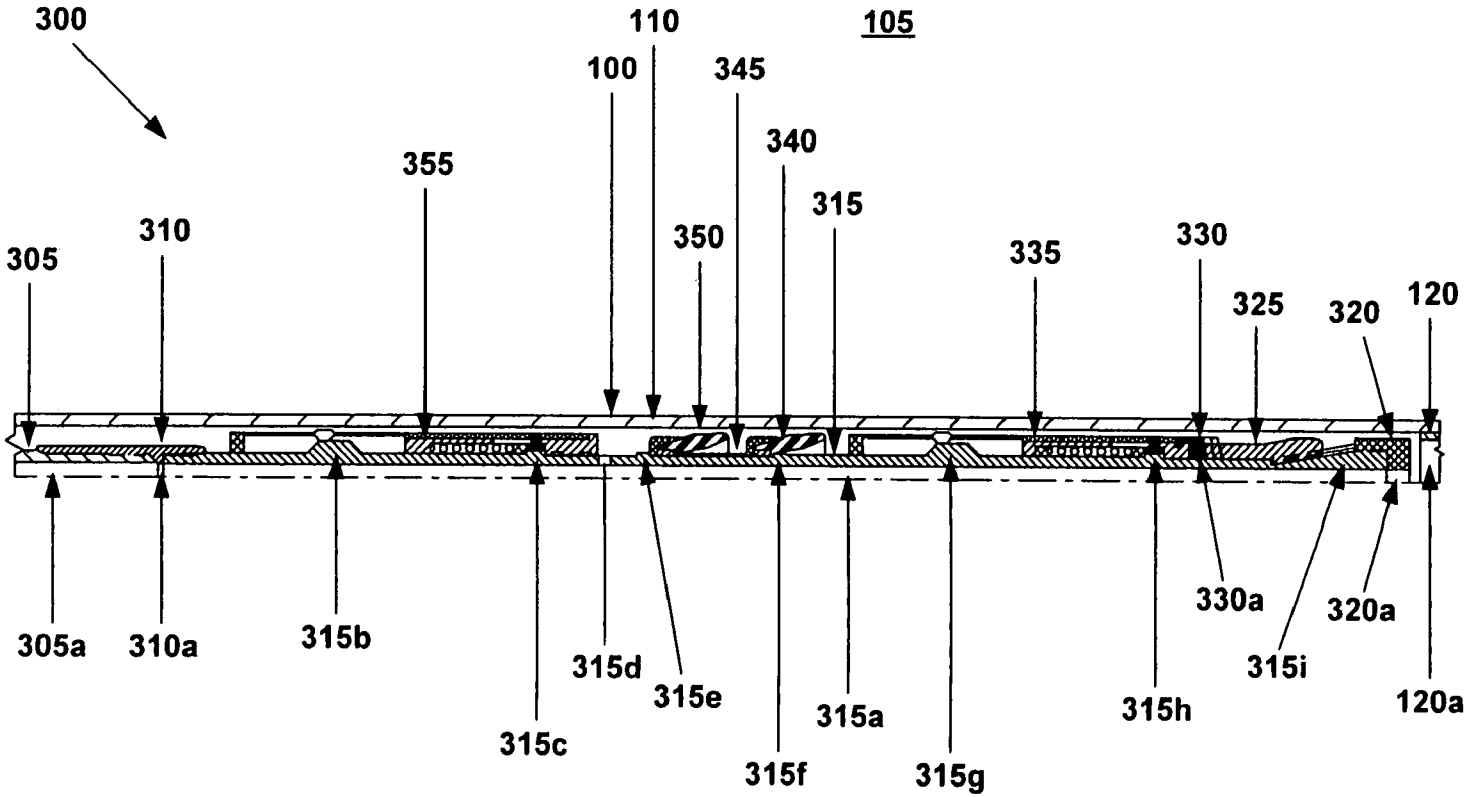
FIGS. 3 and 3*a*-3*c* are fragmentary cross-sectional illustrations of an embodiment of the placement of an apparatus for radially expanding a tubular member within a wellbore casing within a subterranean formation.
Figure 3A:
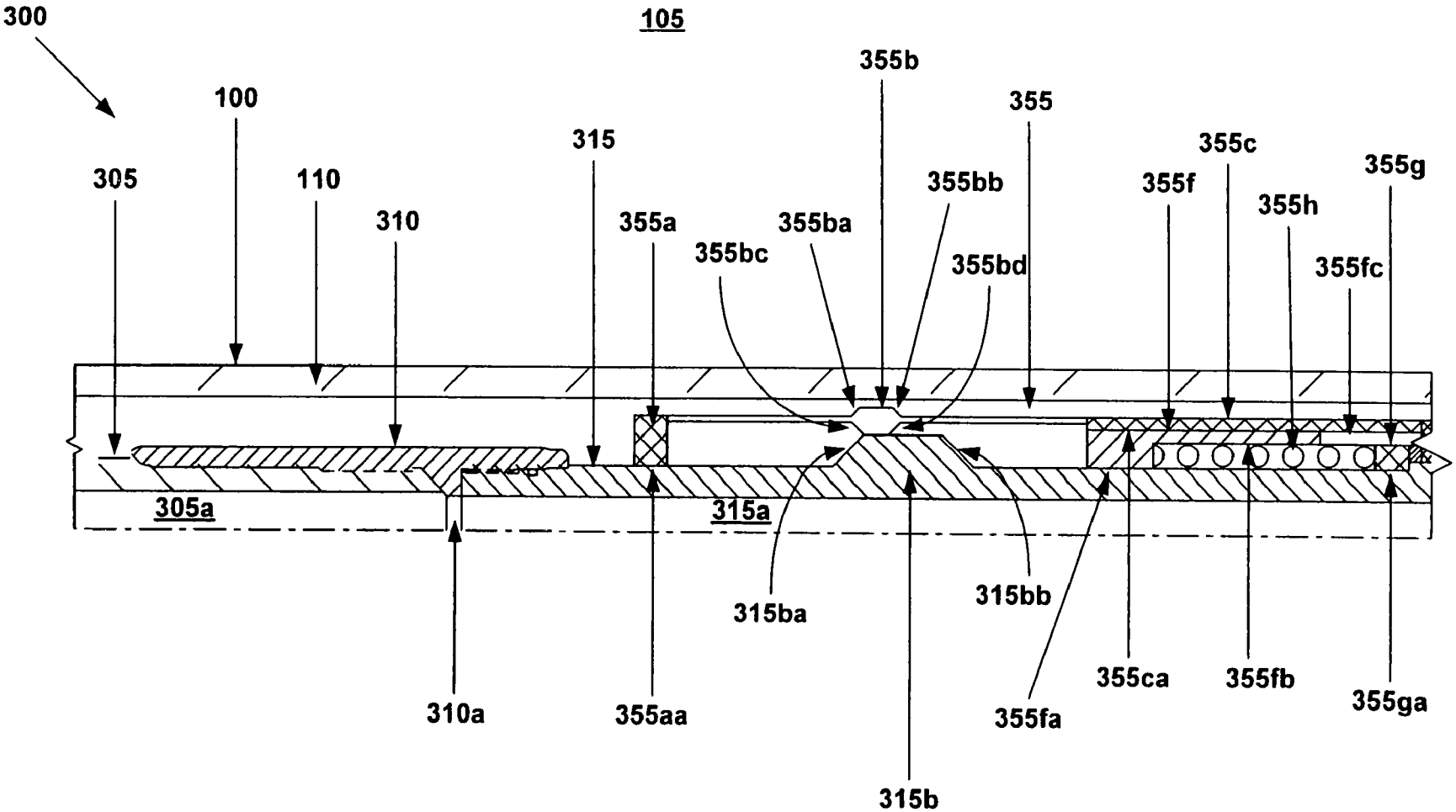
Figure 3B:
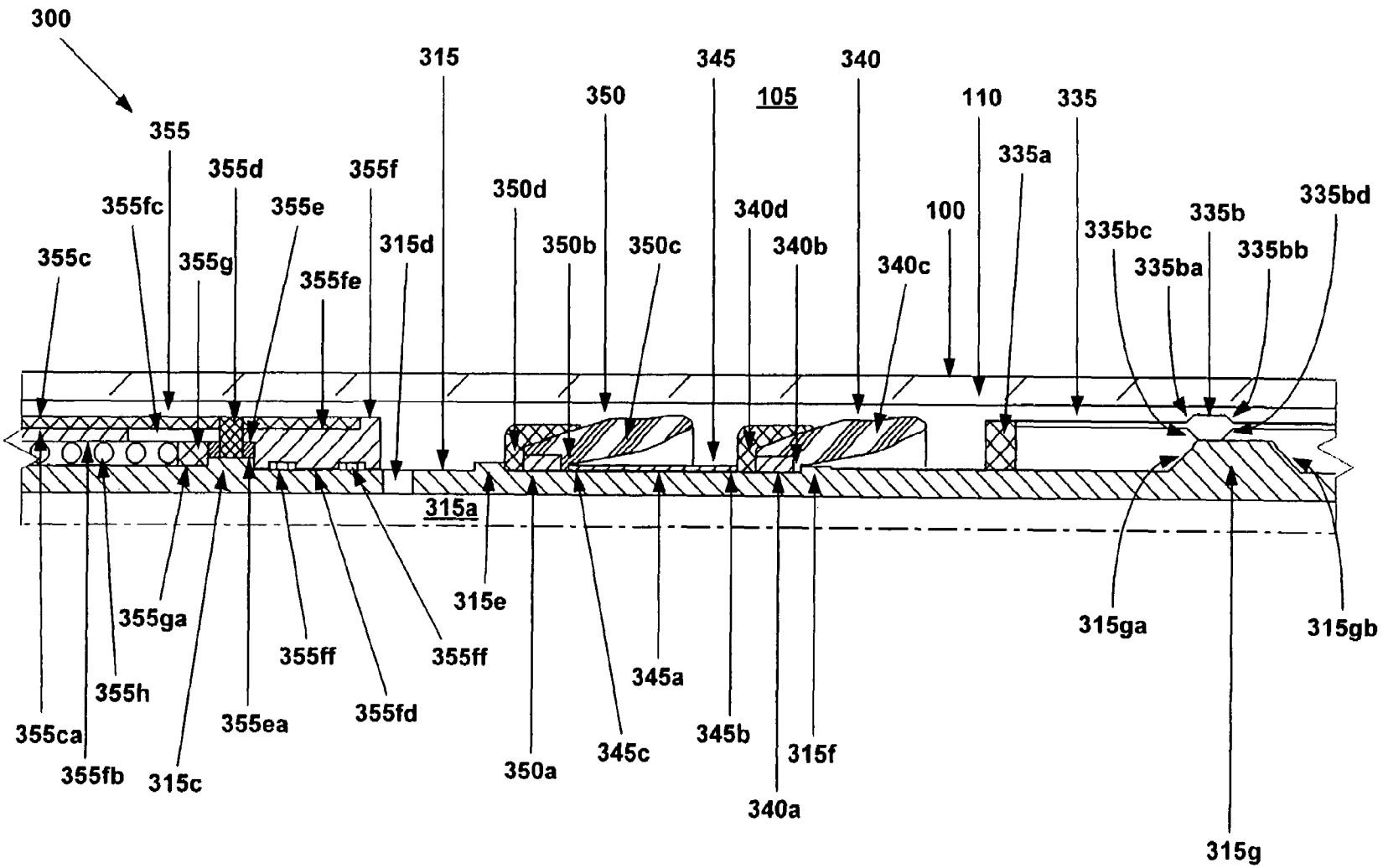
Figure 3C:
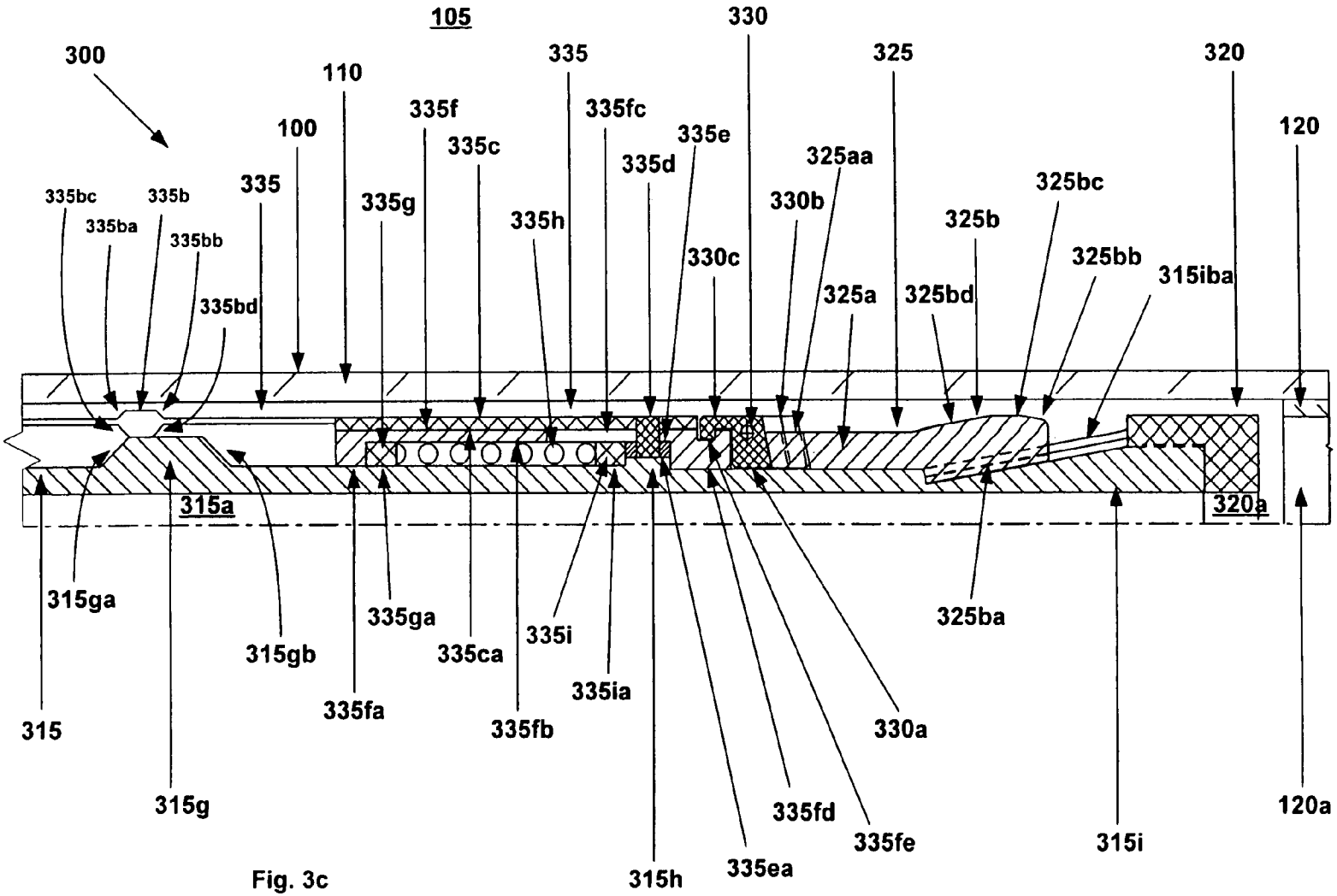
Figure 3E:
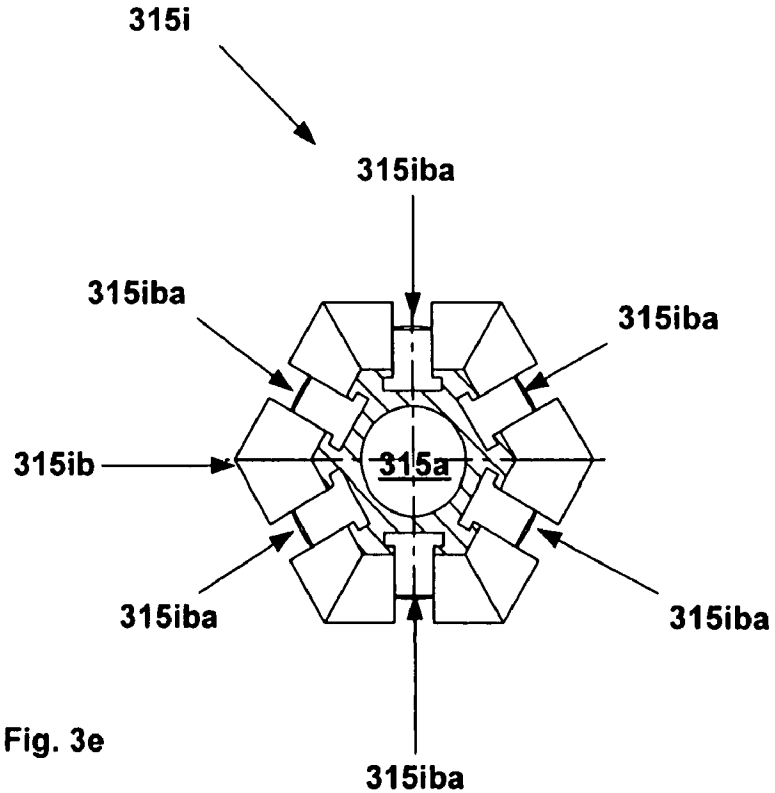
FIG. 3*e* is a cross-sectional view of the expansion cone support body of FIG. 3*d*.
Figure 3D:
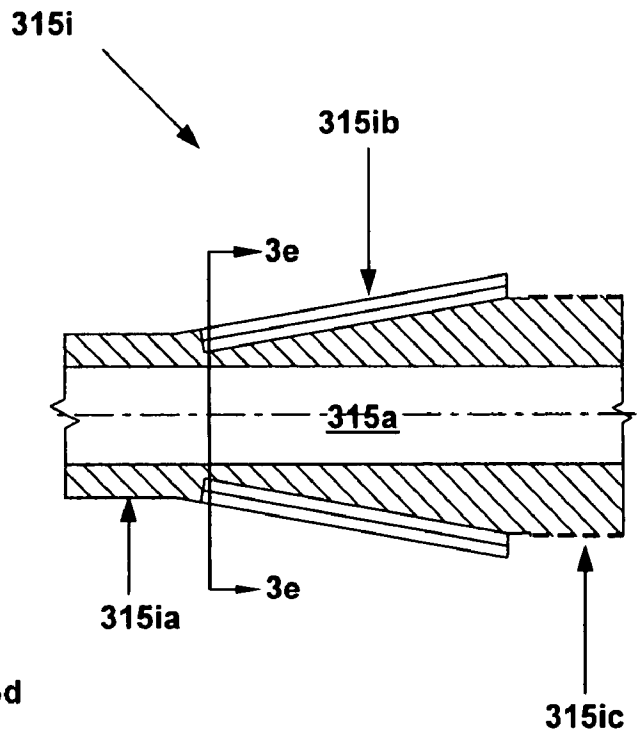
FIG. 3*d* is a cross-sectional view of an embodiment of the expansion cone support body of the apparatus of FIGS. 3 and 3*a*-3*c*.
Figure 3G:
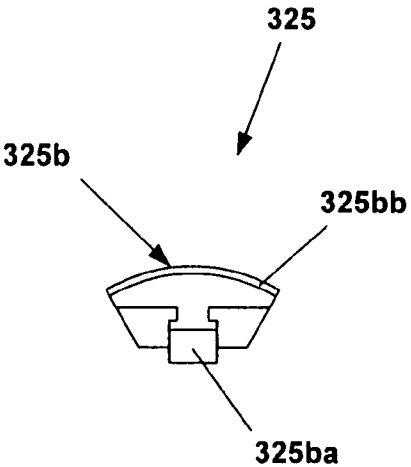
FIG. 3*g* is a front view of the expansion cone segment of FIG. 3*f*.
Figure 3F:
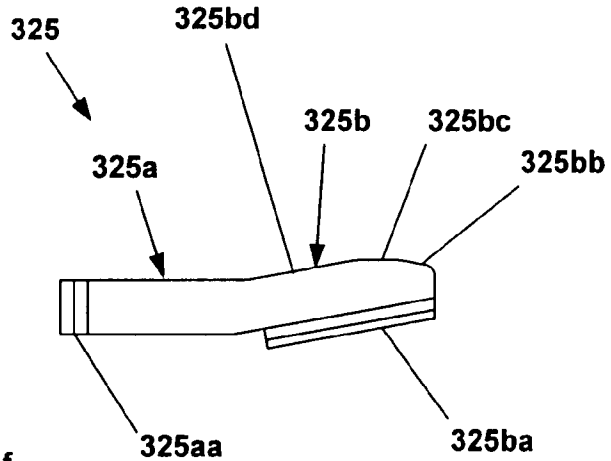
FIG. 3*f* is a side view of an embodiment of an expansion cone segment for use in the apparatus of FIGS. 3 and 3*a*-3*c*.
Figure 3H:
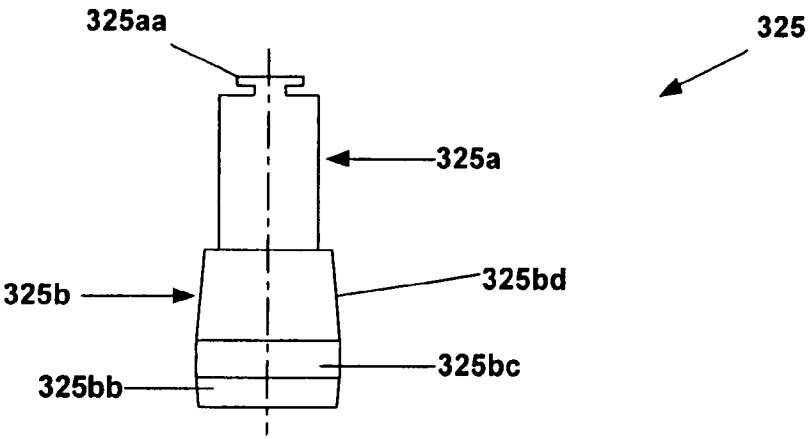
FIG. 3*h* is a top view of the expansion cone segment of FIG. 3*f*.

As illustrated in FIGS. 3*d* and 3*e*, the expansion cone support body 315*i* includes a first end 315*ia*, a tapered hexagonal portion 315*ib* that includes a plurality of T-shaped slots 315*iba* provided on each of the external faceted surfaces of the tapered hexagonal portion, and a second end 315*ic*. In an exemplary embodiment, the angle of attack of the tapered hexagonal portion 315*ib* ranges from about 35 to 50 degrees for reasons to be described.

As illustrated in FIGS. 3, 3*a*-3*c*, and 3*f*-3*h*, a plurality of expansion cone segments 325 are provided that include first ends 325*a* that include T-shaped retaining members 325*aa* and second ends 325*b* that include T-shaped retaining members 325*ba* that mate with and are received within corresponding T-shaped slots 315*iba* on the tapered hexagonal portion 315*ib* of the expansion cone support body 315*i*, first external surfaces 325*bb*, second external surfaces 325*bc*, and third external surfaces 325*bd*. Thus, in an exemplary embodiment, a total of six expansion cone segments 325 are provided that are slidably coupled to corresponding sides of the tapered hexagonal portion 315*ib* of the expansion cone support body 315*i*.

In an exemplary embodiment, the widths of the first external surfaces 325*bb* of the expansion cone segments 325 increase in the direction of the second external surfaces 325*bc*, the widths of the second external surfaces are substantially constant, and the widths of the third external surfaces 325*bd* decrease in the direction of the first ends 325*a* of the expansion cone segments for reasons to be described. In an exemplary embodiment, the first external surfaces 325*bb* of the expansion cone segments 325 taper upwardly in the direction of the second external surfaces 325*bc*, the second external surfaces taper upwardly in the direction of the third external surfaces 325*bd*, and the third external surfaces 325*bd* taper downwardly in the direction of the first ends 325*a* of the expansion cone segments for reasons to be described. In an exemplary embodiment, the angle of attack of the taper of the first external surfaces 325*bb* of the expansion cone segments 325 are greater than the angle of attack of the taper of the second external surfaces 325*bc*. In an exemplary embodiment, the first and second external surfaces, 325*bb* and 325*bc*, of the expansion cone segments 325 are arcuate such that when the expansion cone segments 325 are displaced in the direction of the end stop 320, the first and second external surfaces of the expansion cone segments provide a substantially continuous outer circumferential surface for reasons to be described.

Figure 3I:
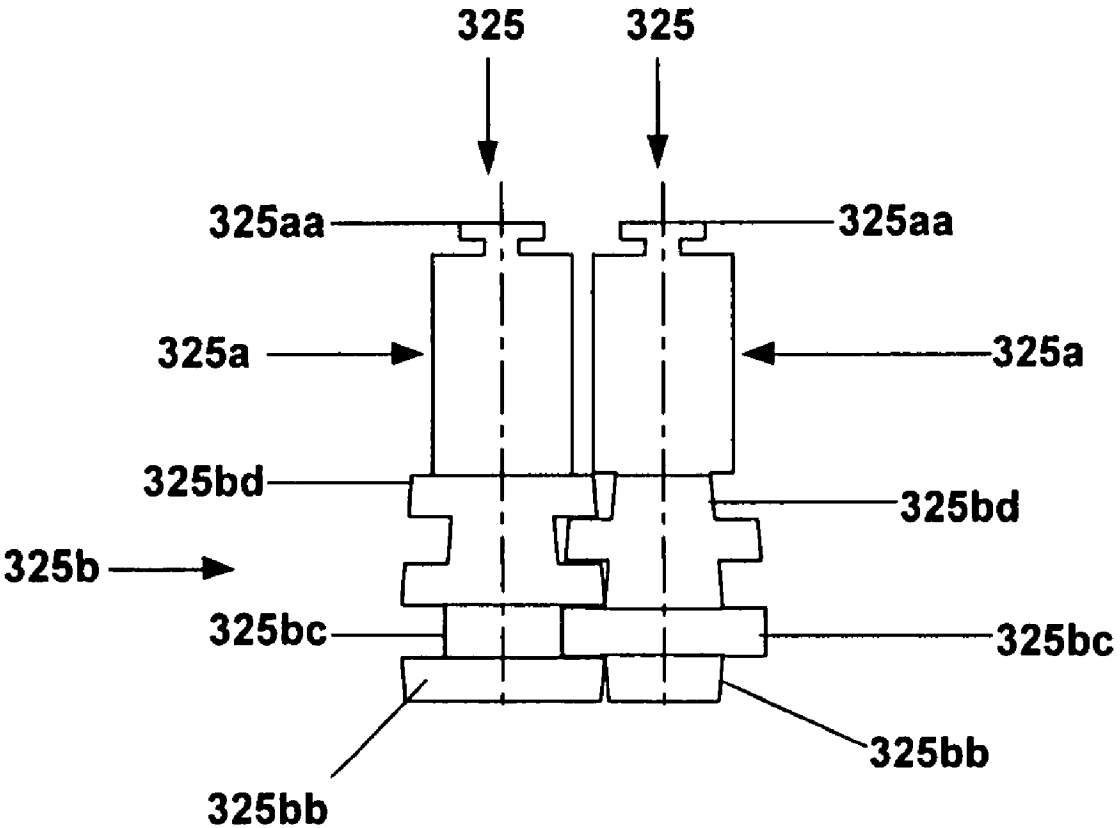
FIG. 3*i* is a top view of an embodiment of interlocking expansion cone segments for use in the apparatus of FIGS. 3 and 3*a*-3*c*.
Figure 3J:
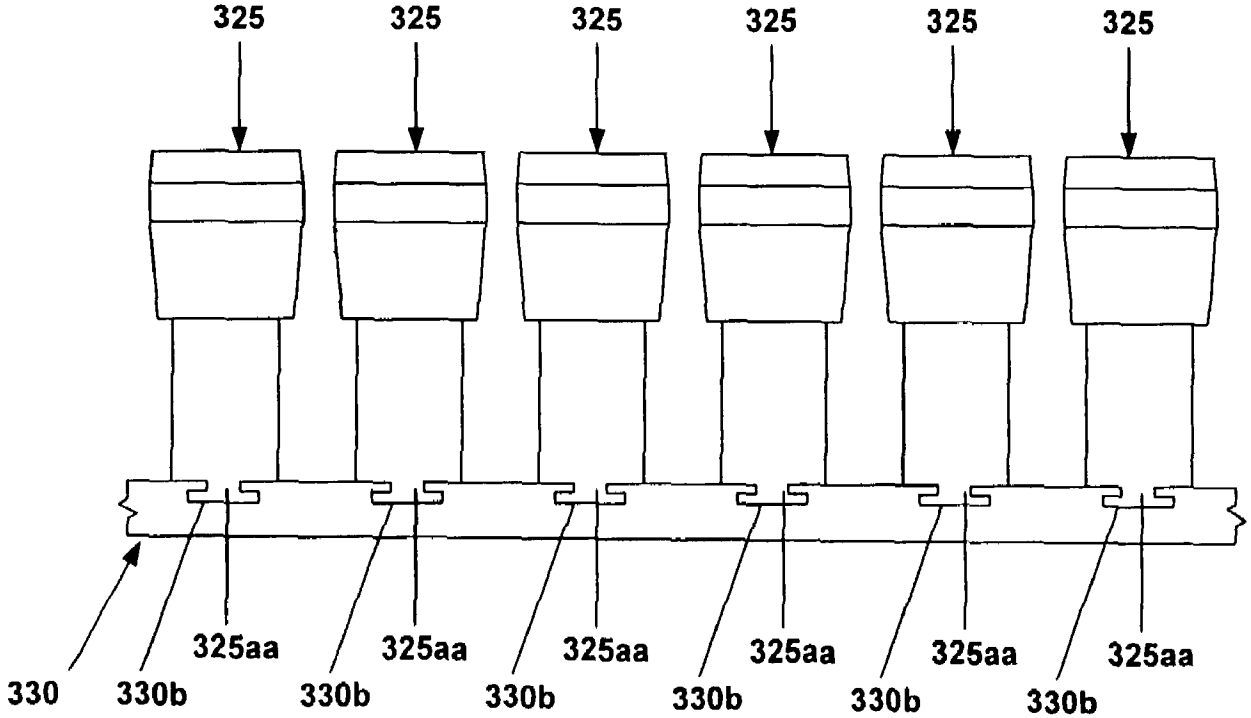
FIG. 3*j* is a top fragmentary circumferential view of an embodiment of the coupling arrangement between the expansion cone segments and the split ring collar for use in the apparatus of FIGS. 3 and 3*a*-3*c*.
Figure 4:
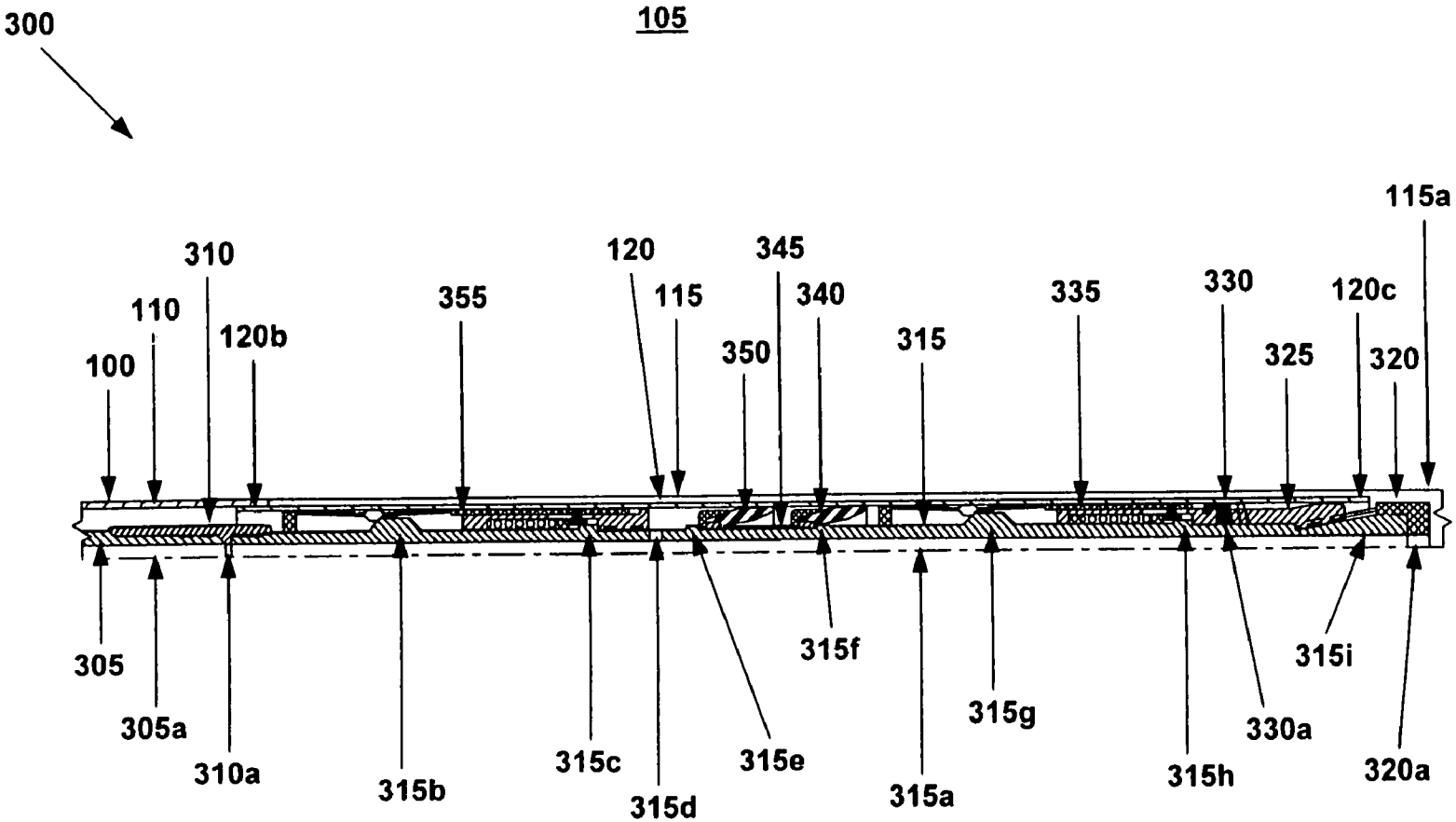
FIGS. 4 and 4*a*-4*d* are fragmentary cross-sectional illustrations of an embodiment of the placement of the apparatus of FIGS. 3 and 3*a*-3*c* including an expandable tubular member within an expandable tubular member within a subterranean formation.
Figure 4A:
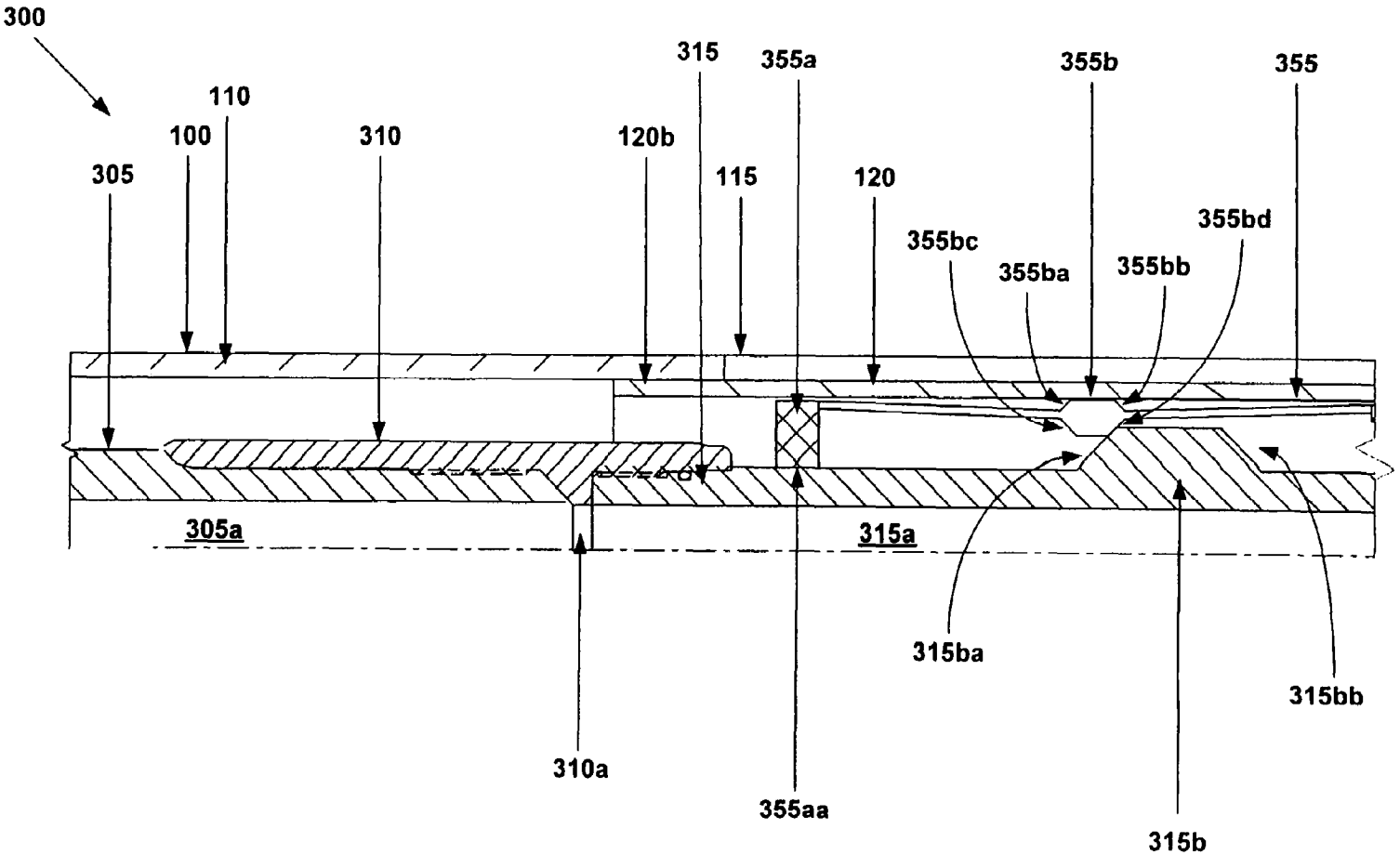
Figure 4B:
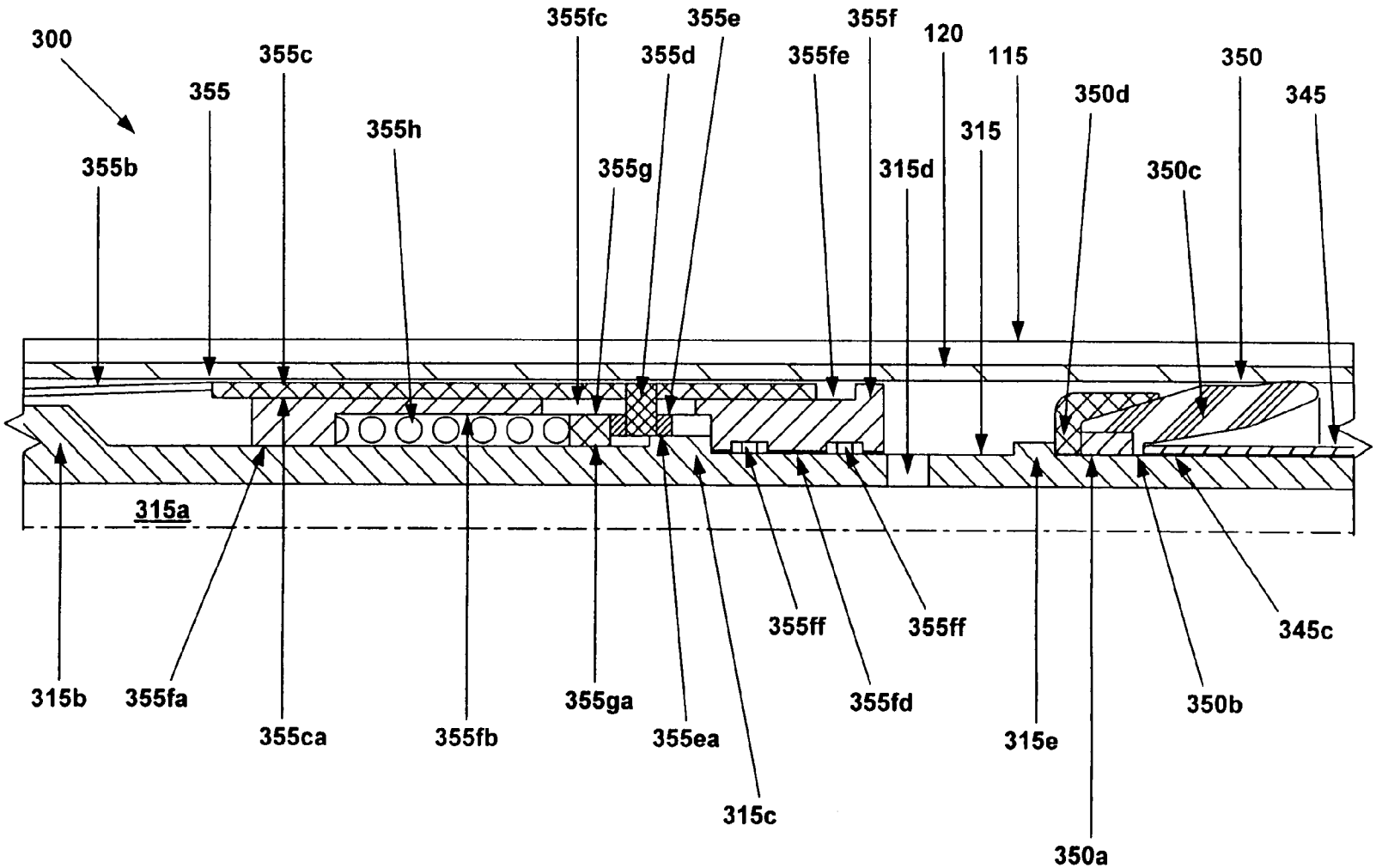
Figure 4C:
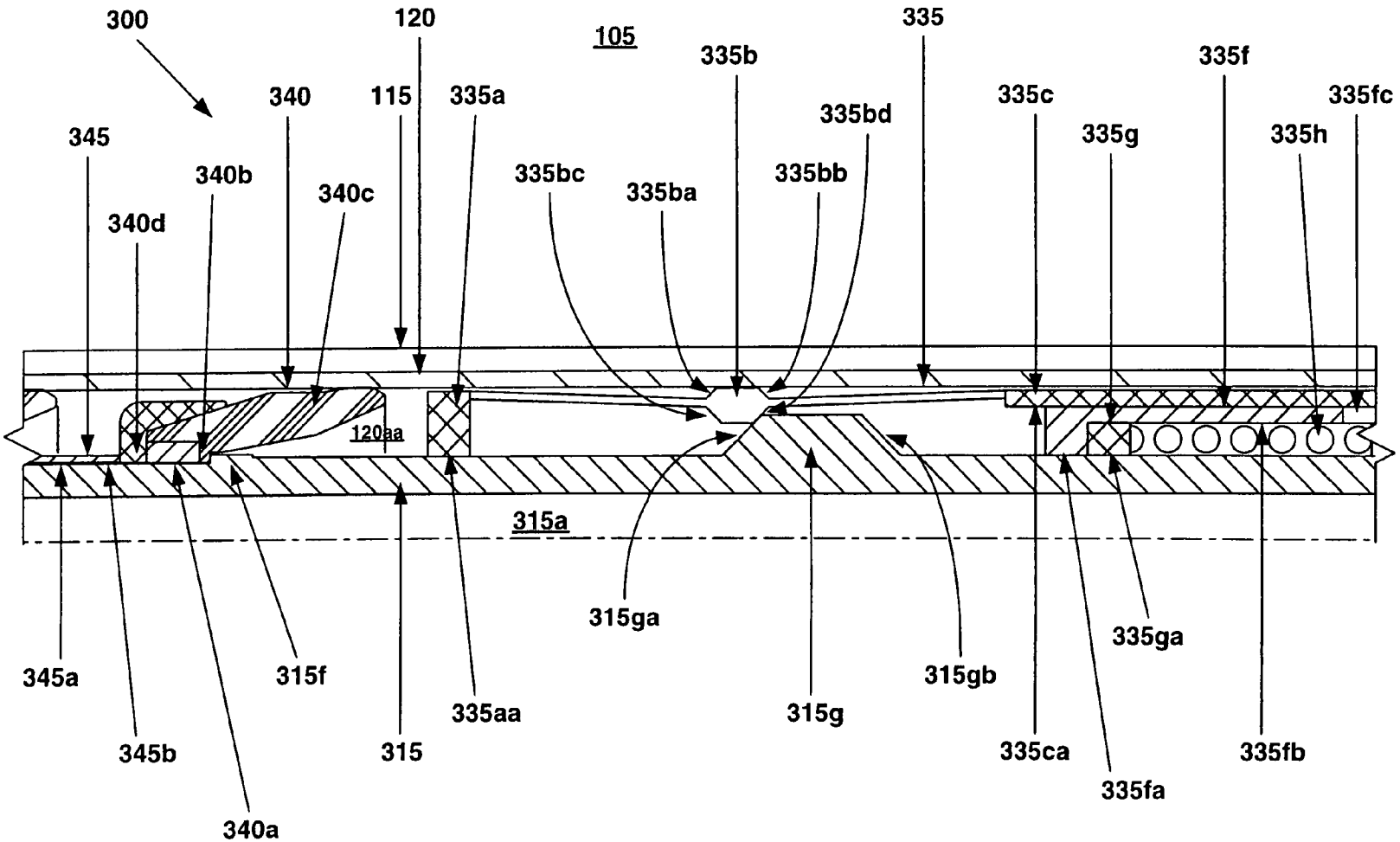
Figure 4D:
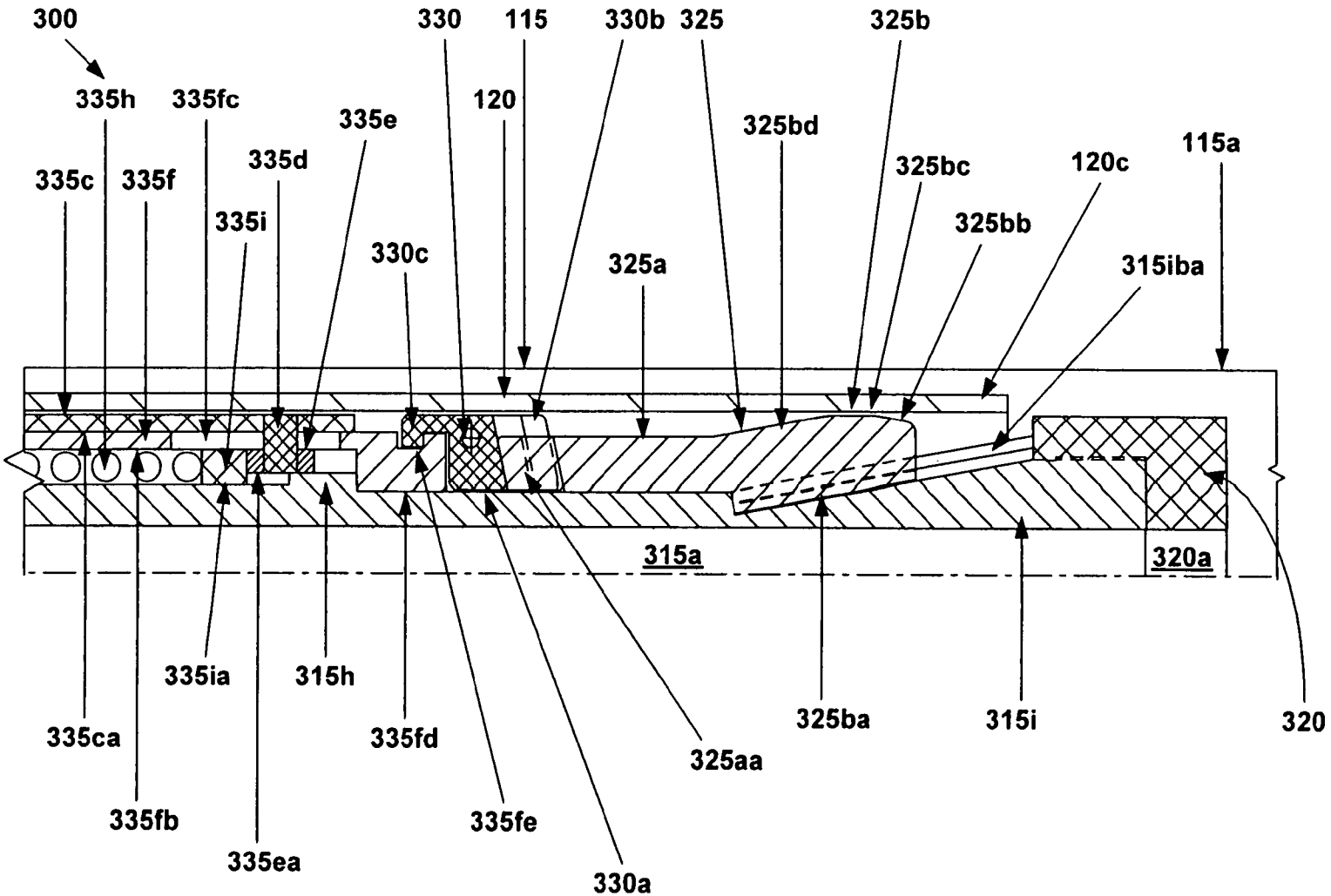
Figure 5:
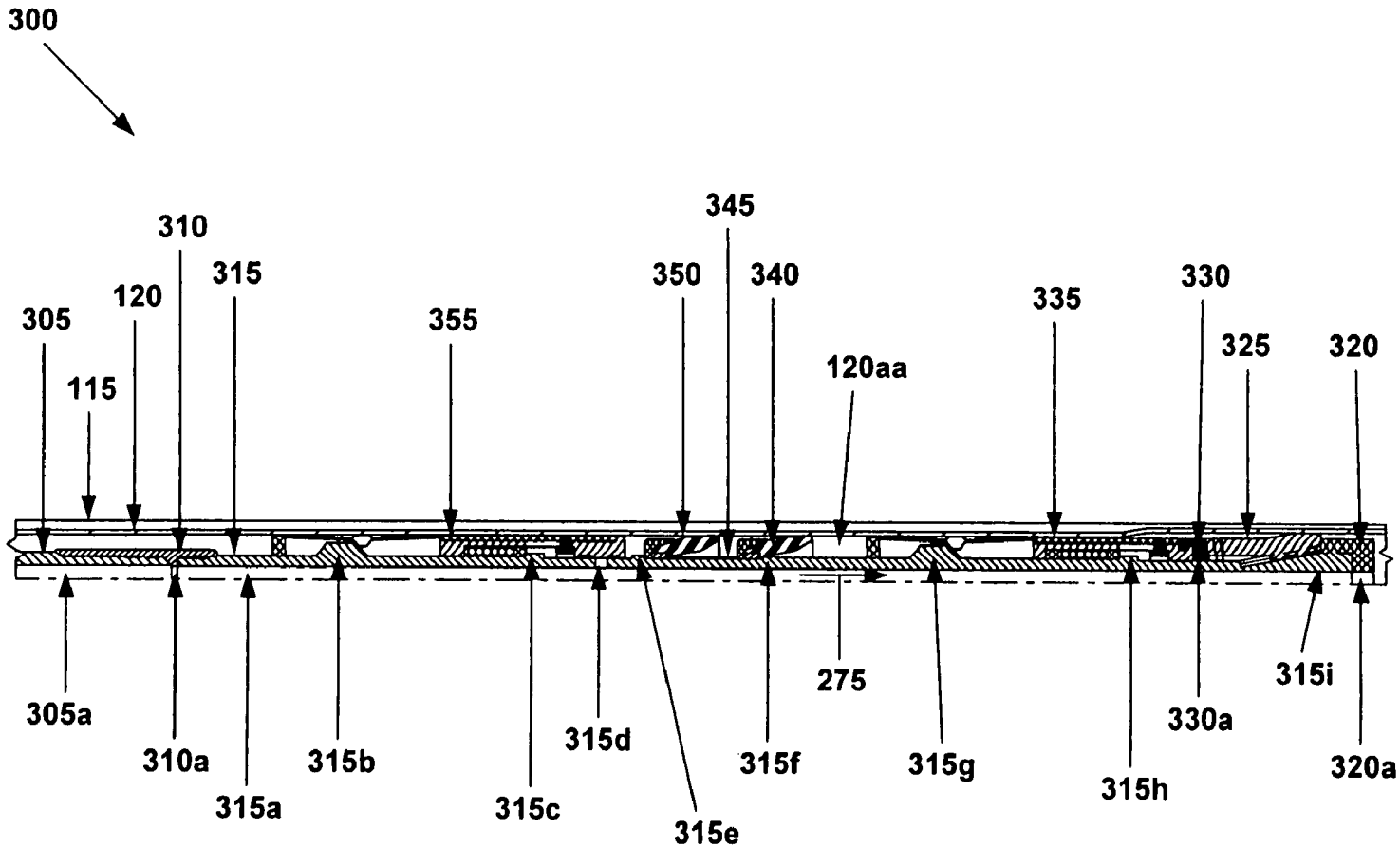
FIGS. 5 and 5*a*-5*d* are fragmentary cross-sectional illustrations of an embodiment of the operation of the apparatus of FIGS. 4 and 4*a*-4*d* during the radial expansion of the expandable tubular member within the borehole within the subterranean formation.
Figure 5A:
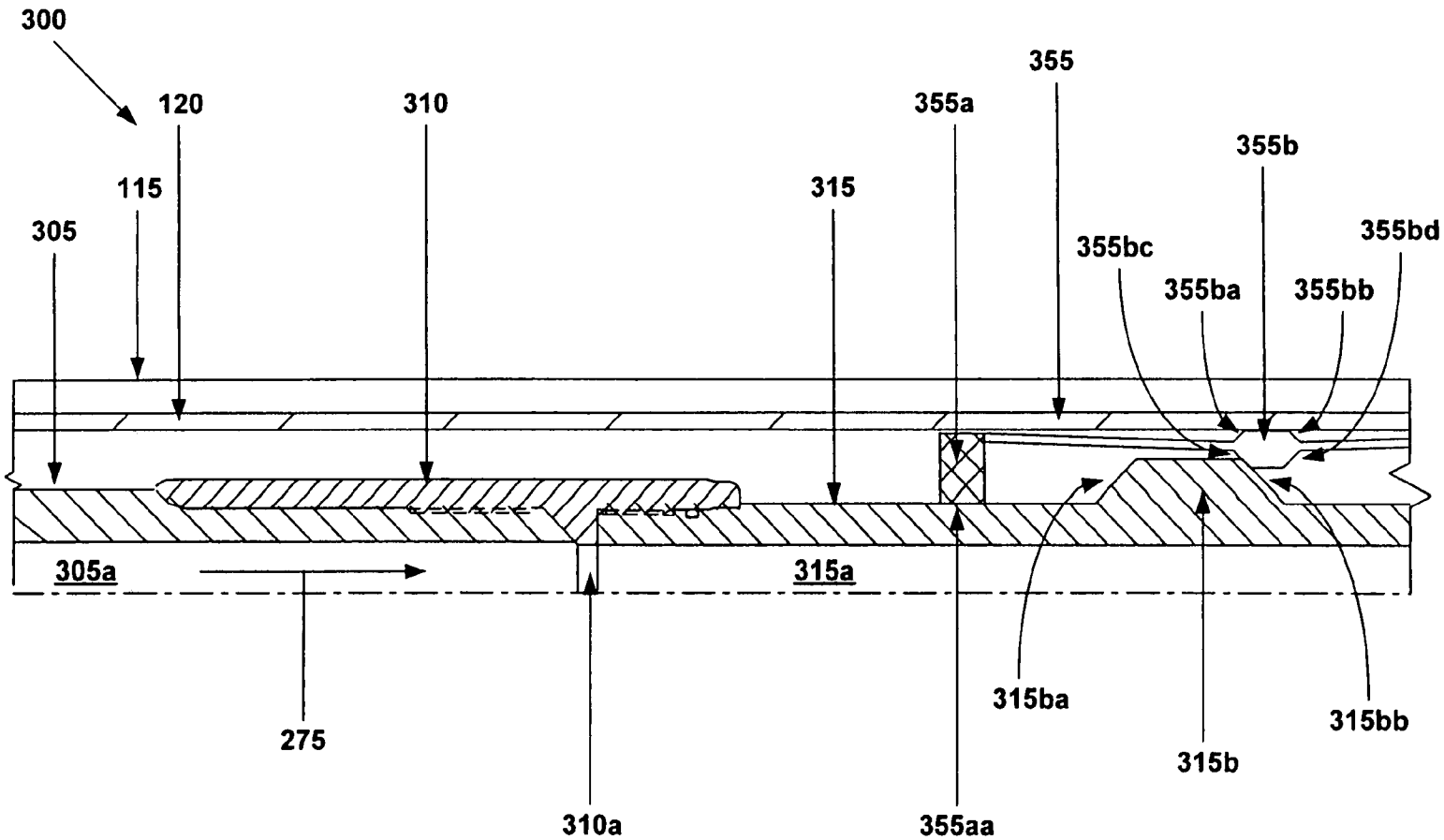
Figure 5B:
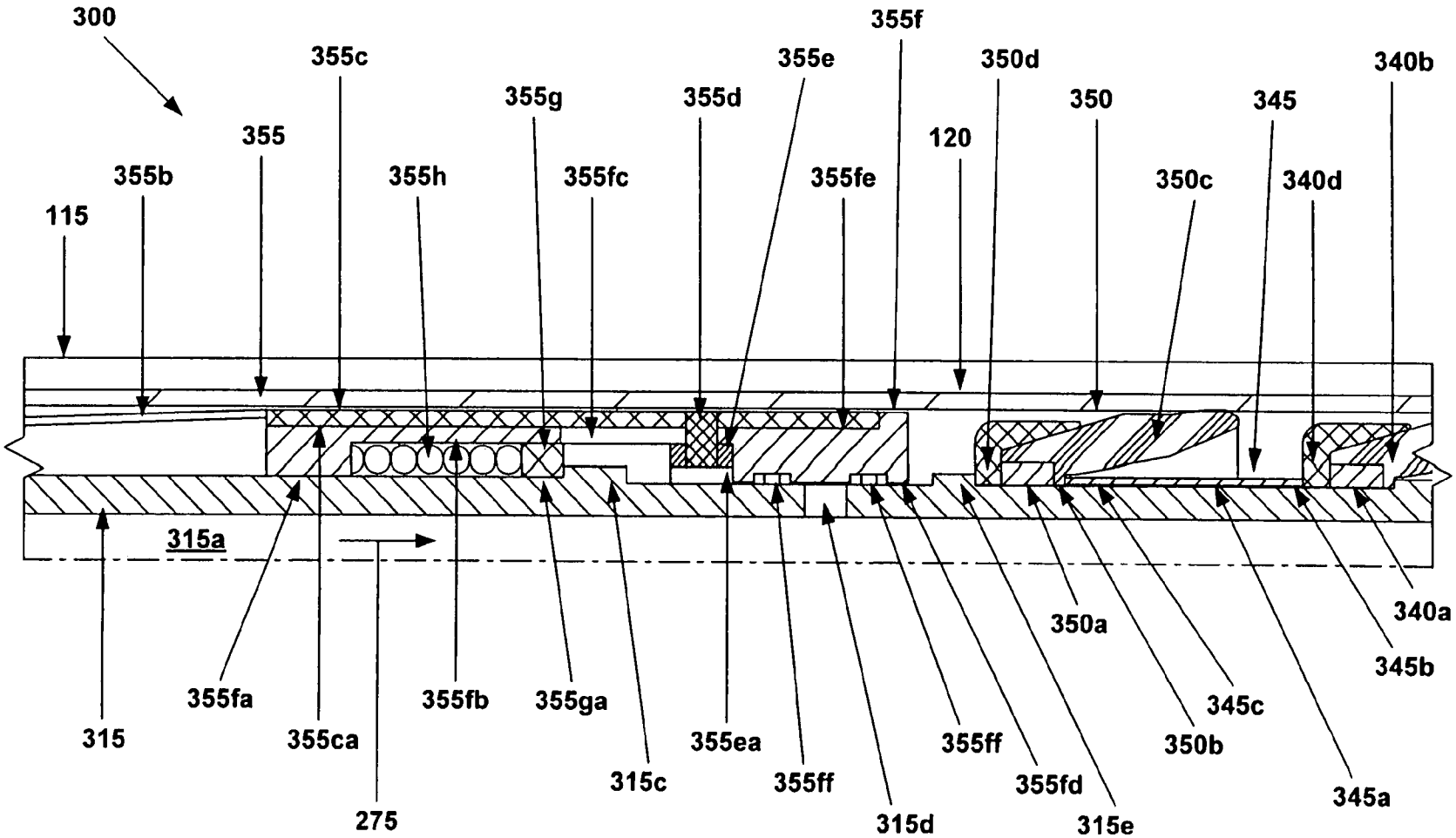
Figure 5C:
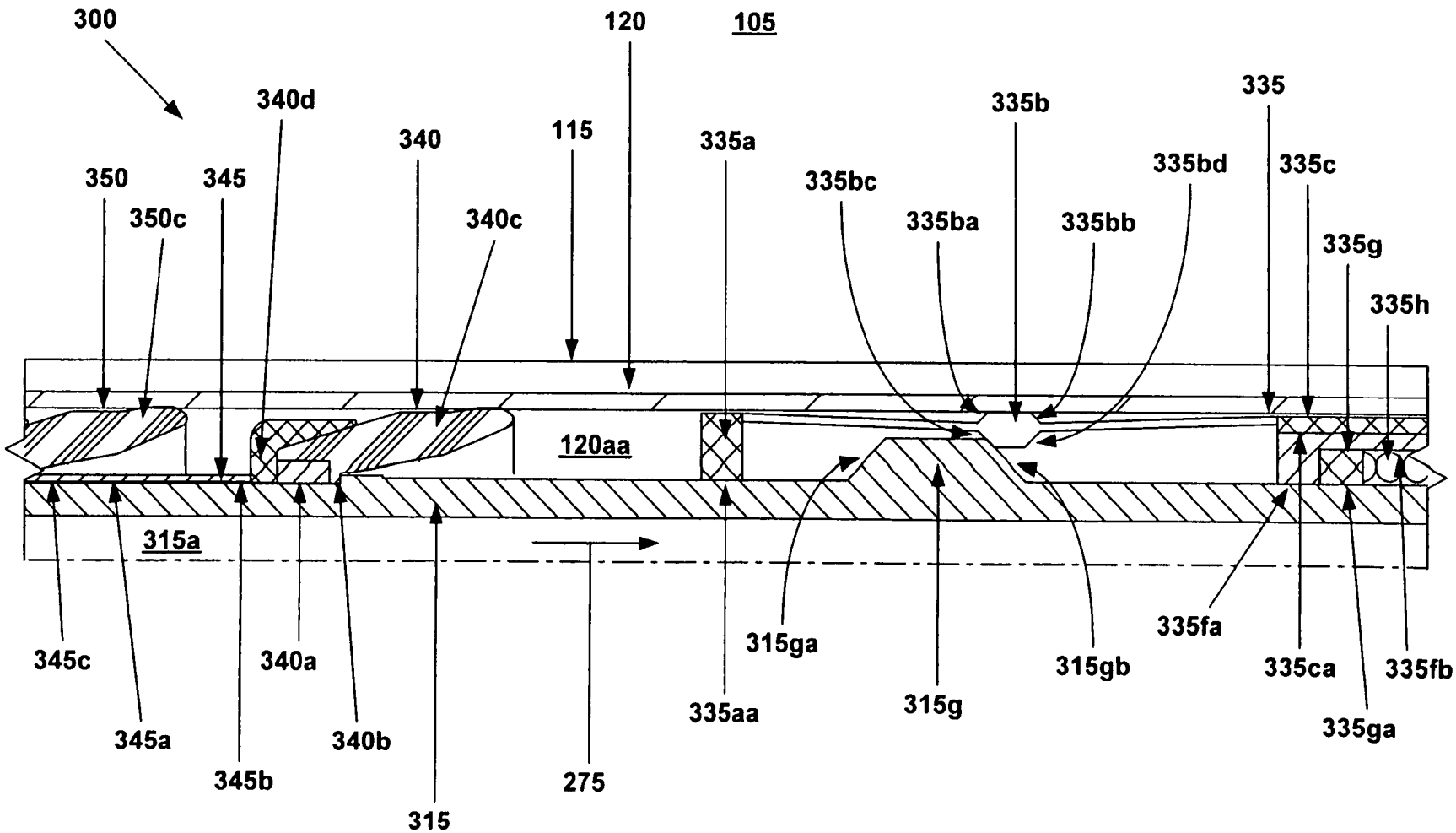
Figure 5D:
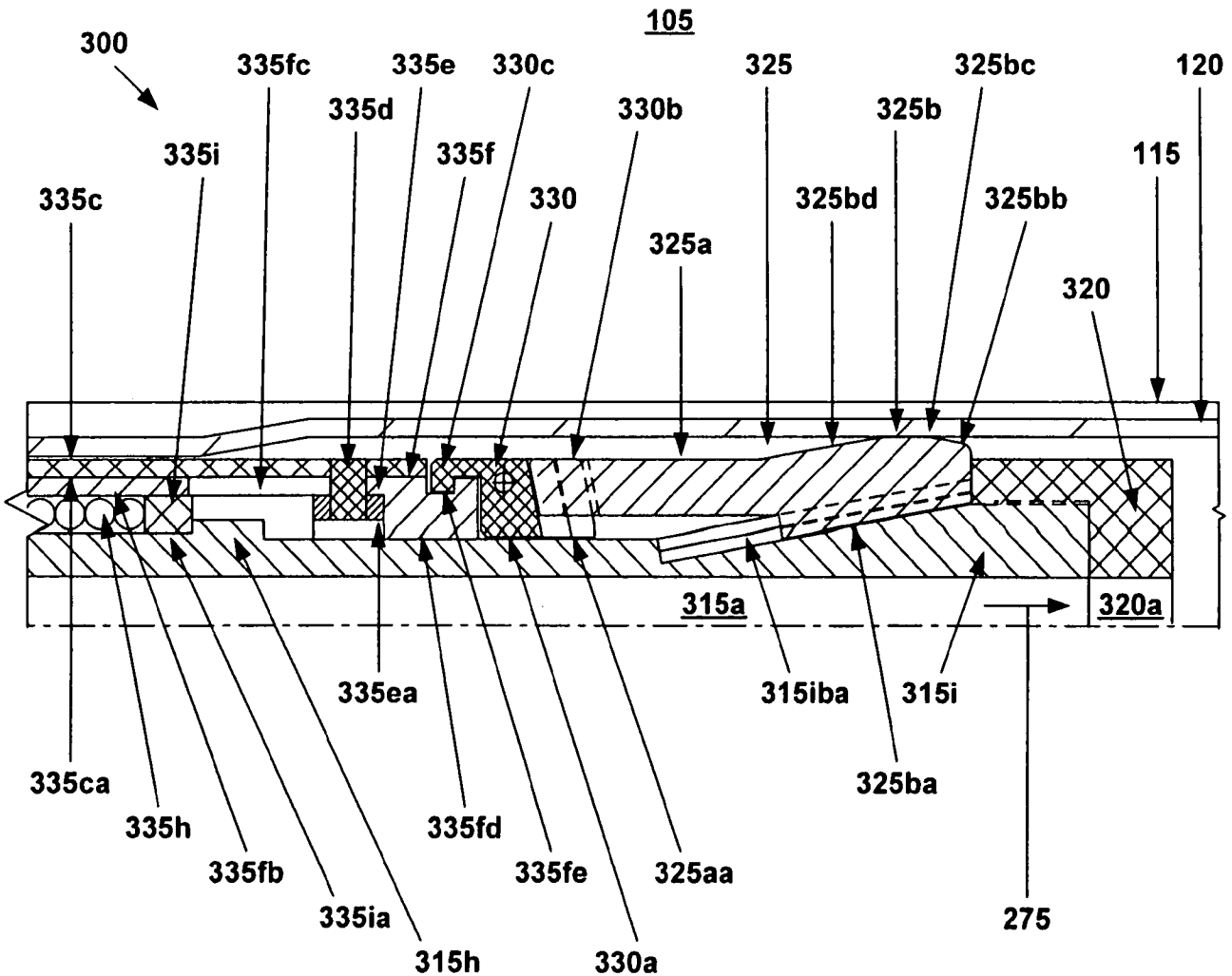

As illustrated in FIG. 3*i*, in an exemplary embodiment, the external surfaces, 325*bb*, 325*bc*, and 325*bd*, of the second ends 325*b* of the expansion cone segments 325 are adapted to mate with one another in order to interlock adjacent expansion cone segments.

A split ring collar 330 that defines a passage 330*a* for receiving the tubular support member 315 is provided that includes a first end that includes plurality of T-shaped slots 330*b* for receiving and mating with corresponding T-shaped retaining members 325*aa* of the expansion cone segments 325 and a second end that includes an L-shaped retaining member 330*c*. In an exemplary embodiment, the split ring collar 330 is a conventional split ring collar commercially available from Halliburton Energy Services modified in accordance with the teachings of the present disclosure.

A collet assembly 335 is provided that includes a support ring 335*a* that defines a passage 335*aa* for receiving the tubular support member 315 and is coupled to an end of a resilient collet 335*b* having upper and lower sets of oppositely tapered shoulders, 335*ba* and 335*bb*, and, 335*bc* and 335*bd*, respectively, that is positioned proximate the fourth flange 315*g* of the tubular support member 315. The other end of the collet 335*b* is coupled to an end of a tubular sleeve 335*c* that defines a passage 335*ca*. The other end of the tubular sleeve 335*c* is coupled to an end of a pin 335*d*. The other end of the pin 335*d* is coupled to a ring 335*e* that defines a passage 335*ea* for receiving the fifth flange 315*h* of the tubular support member 315. An end of a tubular coupling sleeve 335*f* that defines a passage 335*fa* for receiving the tubular support member 315 is received within the opening 335*ca* of the tubular sleeve 335*c* that includes a recess 335*fb* for receiving the fifth flange 315*h* of the tubular support member 315 and the ring 335*e*, and a radial passage 335*fc* for receiving the pin 335*d*. Another end of the tubular coupling sleeve 335*f* includes a passage 335*fd* for receiving the tubular support member 315 and a slot 335*fe* for receiving the L-shaped retaining member 330*c* of the split ring collar 330. A ring 335*g* that defines a passage 335*ga* for receiving the tubular support member 315, a spring 335*h*, and a ring 335*i* that defines a passage 335*ia* for receiving the tubular support member 315 are also received within the recess 335*fb*. The ring 335*g* is positioned proximate one end of the recess 335*fb*, the ring 335*i* is positioned proximate the fifth flange 315*h* of the tubular support member 315 within the other end of the recess, and the spring 335*h* is positioned between the rings.

A first conventional packer cup assembly 340 that defines a passage 340*a* for receiving the tubular support member 315 includes a first end 340*b* that mates with the fourth flange 315*f* of the tubular support member, a conventional sealing cup 340*c*, and a second end 340*d*. A tubular spacer 345 that defines a passage 345*a* for receiving the tubular support member 315 includes a first end 345*b* that mates with the. second end 340*d* of the first packer cup assembly 340 and a second end 345*c*. A second conventional packer cup assembly 350 that defines a passage 350*a* for receiving the tubular support member 315 includes a first end 350*b* that mates with the second end 345*c* of the spacer 345, a conventional sealing cup 350*c*, and a second end 350*d* that mates with the third flange 315*e* of the tubular support member.

A collet assembly 355 is provided that includes a support ring 355*a* that defines a passage 355*aa* for receiving the tubular support member 315 and is coupled to an end of a resilient collet 355*b* having upper and lower sets of oppositely tapered shoulders, 355*ba* and 355*bb*, and, 355*bc* and 355*bd*, respectively, that is positioned proximate the first flange 315*b* of the tubular support member 315. The other end of the collet 355*b* is coupled to an end of a tubular sleeve 355*c* that defines a passage 355*ca*. The other end of the tubular sleeve 355*c* is coupled to an end of a pin 355*d*. The other end of the pin 355*d* is coupled to a ring 355*e* that defines a passage 355*ea* for receiving the second flange 315*c* of the tubular support member 315. An end of a tubular sleeve 355*f* that defines a passage 355*fa* for receiving the tubular support member 315 is received within the opening 355*ca* of the tubular sleeve 355*c* that includes a recess 355*fb* for receiving the second flange 315*c* of the tubular support member 315 and the ring 355*e*, and a radial passage 355*fc* for receiving the pin 355*d*. Another end of the tubular sleeve 355*f* includes a passage 355*fd* for receiving the tubular support member 315, a recess 355*fe* for receiving an end of the tubular sleeve 355*c*, and sealing members 355*ff*. A ring 355*g* that defines a passage 355*ga* for receiving the tubular support member 315 and a spring 355*h* are also received within the recess 355*fb*. An end of the ring 355*g* is positioned proximate the second flange 315*c* of the tubular support member 315 within an end of the recess 355*fb* and the other end of the ring is positioned an end of the spring 355*h*. The other end of the spring 355*h* is positioned proximate the other end of the recess 355*fb*.

In an exemplary embodiment, during operation of the apparatus 300, as illustrated in FIGS. 3 and 3*a*-3*j*, the apparatus may be initially positioned in the wellbore 100, within the casing 110, with the collet assemblies 335 and 355 positioned in a neutral position in which the radial passage 315*d* of the tubular support member 315 is not covered by the tubular sleeve 355*f* and the expansion cone segments 325 are not driven up the tapered hexagonal portion 315*ib* of the expansion cone support body 315*i* of the tubular support member 315 into contact with the stop member 320. In this manner, fluidic materials within the interior 315*a* of the tubular support member 315 may pass through the radial passage 315*d* into the annulus between the apparatus 300 and the casing 110 thereby preventing over pressurization of the annulus. Furthermore, in this manner, the outside diameter of the expansion cone segments 325 is less than or equal to the outside diameter of the stop member 320 thereby permitting the apparatus 300 to be displaced within the casing 110.

As illustrated in FIGS. 4, and 4*a*-4*d*, the apparatus 300 may then be positioned in the tubular member 120. During the insertion of the apparatus into the tubular member 120, the upper end 120*b* of the tubular member may impact the tapered shoulders, 335*bb* and 355*bb*, of the collets, 335*b* and 355*b*, respectively, thereby driving the collets backward until the tapered shoulders, 335*bd* and 355*bd*, of the collets are positioned proximate the tapered shoulders, 315*ga* and 315*ba*, respectively, of the tubular support member. As a result, the support rings, 335*a* and 355*a*, the collets, 335*b* and 355*b*, the tubular sleeves, 335*c* and 355*c*, the pins, 335*d* and 355*d*, the rings, 335*e* and 355*e*, and the rings, 335*g* and 355*g*, of the collet assemblies, 335 and 355, respectively, are driven backward, compressing the springs, 335*h* and 355*h*, thereby applying axial biasing forces to the tubular coupling sleeve 335*f* and the tubular sleeve 355*f*, respectively. In this manner, an axial biasing force is applied to the split ring collar 330 and the expansion cone segments 325 that prevents the expansion cone segments from being driven up the tapered hexagonal portion 315*ib* of the expansion cone support body 315*i* of the tubular support member 315 into contact with the stop member 320. Thus, the outside diameter of the expansion cone segments 325 is maintained in a position that is less than the inside diameter of the tubular member 120 thereby permitting the apparatus 300 to be displaced within the tubular member. Furthermore, in this manner, an axial biasing force is applied to the tubular sleeve 355*f* thereby preventing the tubular sleeve from covering the radial passage 315*d* in the tubular support member 315. Thus, fluidic materials within the interior 315*a* of the tubular support member 315 may pass through the radial passage 315*d* into the annulus between the apparatus 300 and the tubular member 120 thereby preventing over pressurization of the annulus.

The apparatus 300 may then be at least partially positioned in the open hole section 115*a* of the wellbore section 115, beyond the lower end 120*c* of the tubular member 120. In an exemplary embodiment, that portion of the apparatus 300 that includes the stop member 320, the expansion cone segments 325, the split ring collar 330, the collet assembly 335, the packer cup assembly 340, the spacer 345, the packer cup assembly 350, and the collet assembly 355 is then positioned in the open hole section 115*a* of the wellbore section 115, beyond the lower end 120 of the tubular member for reasons to be described. Because the collets, 335*b* and 355*b*, are resilient, once the apparatus 300 has been positioned in the open hole section 115*a* of the wellbore section 115, beyond the lower end 120*c* of the tubular member 120, the tapered shoulders, 335*ba* and 355*ba*, of the collets may spring outwardly in the radial direction.

The apparatus 300 may then be repositioned at least partially back within the tubular member 120. During the reinsertion of the apparatus into the tubular member 120, the lower end 120*c* of the tubular member may impact the tapered shoulders, 335*ba* and 355*ba*, of the collets, 335*b* and 355*b*, respectively, thereby driving the collets forward until the tapered shoulders, 335*bc* and 355*bc*, of the collets are positioned proximate the tapered shoulders, 315*gb* and 315*bb*, respectively, of the tubular support member 315. As a result, the support rings, 335*a* and 355*a*, the collets, 335*b* and 355*b*, the tubular sleeves, 335*c* and 355*c*, the pins, 335*d* and 355*d*, the rings, 335*e* and 355*e*, the tubular coupling sleeve 335*f*, the tubular sleeve 355*f*, the rings, 335*g* and 355*g*, and the ring 335*i* of the collet assemblies, 335 and 355, respectively, are driven forward, thereby compressing the springs, 335*h* and 355*h*, thereby sealing off the radial passage 315*d* and driving the expansion cone segments 325 up the tapered hexagonal portion 315*ib* of the expansion cone support body 315*i* of the tubular support member 315 into contact with the stop member 320.

As a result, the outside diameter of the expansion cone segments 325 is now greater than the inside diameter of expandable tubular member 120 thereby permitting the apparatus 300 to be used to radially expand and plastically deform the tubular member, and fluidic materials within the interior 315*a* of the tubular support member 315 may no longer pass through the radial passage 315*d* into the annulus between the apparatus 300 and the tubular member thereby permitting the interior of the apparatus to be pressurized.

The apparatus 300 may then be operated to radially expand and plastically deform the tubular member 120 by applying an upward axial force to the tubular support member 315 and/or by injecting a pressurized fluidic material into the tubular support member.

In particular, as illustrated in FIGS. 5 and 5*a*-5*d*, the expandable tubular member 120 may then be radially expanded using the apparatus 300 by injecting a fluidic material 275 into the apparatus through the passages 305*a*, 310*a*, 315*a*, and 320*a*. The injection of the fluidic material 275 may pressurize the interior 120*a* of the expandable tubular member 120. In addition, because the packer cup assemblies, 340 and 350, seal off an annular region 120*aa* below the packer cup assemblies between the expandable tubular member 120 and the tubular support member 315, the injection of the fluidic material 275 may also pressurize the annular region.

The continued injection of the fluidic material 275 may then pressurize the interior 120*a* of the expandable tubular member 120 thereby plastically deforming and radially expanding the expandable tubular member off of the expansion cone segments 325. Because the outer surfaces, 325*bb* and 325*bc*, of the expansion cone segments 325 are tapered, the plastic deformation and radial expansion of the expandable tubular member 120 proximate the expansion cone segments is facilitated. Furthermore, in an exemplary embodiment, the continued injection of the fluidic material 275 also pressurizes the annular region 120*aa* defined between the interior surface of the expandable tubular member 120 and the exterior surface of the tubular support member 315 that is bounded on the upper end by the packer cup assembly 340 and on the lower end by the expansion cone segments 325. Furthermore, in an exemplary embodiment, the pressurization of the annular region 120*aa* also radially expands at least a portion of the surrounding portion of the expandable tubular member 120. In this manner, the plastic deformation and radial expansion of the expandable tubular member 120 is enhanced. Furthermore, during operation of the apparatus 300, the packer cup assemblies 340 and 350 prevent the pressurized fluidic material 275 from passing above and beyond the packer cup assemblies and thereby define the length of the pressurized annular region 120*aa*. In an exemplary embodiment, the pressurization of the annular region 120*aa* decreases the operating pressures required for plastic deformation and radial expansion of the expandable tubular member 120 by as much as 50% and also reduces the angle of attack of the tapered external surfaces, 325*bb* and 325*bc*, of the expansion cone segments 325.

The radial expansion of the expandable tubular member 120 may then continue until the upper end 120*b* of the expandable tubular member is radially expanded and plastically deformed along with the overlapping portion of the wellbore casing 110. Because the expansion cone segments 325 may be adjustable positioned from an outside diameter less than the inside diameter of the expandable tubular member 120 to an outside diameter substantially equal to the inside diameter of the pre-existing casing 110, the resulting wellbore casing, including the casing 110 and the radially expanded tubular member 120, created by the operation of the apparatus 300 may have a single substantially constant inside diameter thereby providing a mono-diameter wellbore casing.

During the radial expansion process, the expansion cone segments 325 may be raised out of the expanded portion of the tubular member 120 by applying an upward axial force to the tubular support member 315. In a preferred embodiment, during the radial expansion process, the expansion cone segments 325 are raised at approximately the same rate as the tubular member 120 is expanded in order to keep the tubular member stationary relative to the new wellbore section 115.

In a preferred embodiment, when the upper end portion of the expandable tubular member 120 and the lower portion of the wellbore casing 110 that overlap with one another are plastically deformed and radially expanded by the expansion cone segments 325, the expansion cone segments are displaced out of the wellbore 100 by both the operating pressure within the interior of the tubular member 120 and a upwardly directed axial force applied to the tubular support member 305.

In a preferred embodiment, the operating pressure and flow rate of the fluidic material 275 is controllably ramped down when the expansion cone segments 325 reach the upper end portion of the expandable tubular member 120. In this manner, the sudden release of pressure caused by the complete radial expansion and plastic deformation of the expandable tubular member 120 off of the expansion cone segments 325 can be minimized. In a preferred embodiment, the operating pressure is reduced in a substantially linear fashion from 100% to about 10% during the end of the extrusion process beginning when the expansion cone segments 325 are within about 5 feet from completion of the extrusion process.

Alternatively, or in combination, the wall thickness of the upper end portion of the expandable tubular member 120 is tapered in order to gradually reduce the required operating pressure for plastically deforming and radially expanding the upper end portion of the tubular member. In this manner, shock loading of the apparatus is at least reduced.

Alternatively, or in combination, a shock absorber is provided in the tubular support member 305 in order to absorb the shock caused by the sudden release of pressure. The shock absorber may comprise, for example, any conventional commercially available shock absorber, bumper sub, or jars adapted for use in wellbore operations.

Alternatively, or in combination, an expansion cone catching structure is provided in the upper end portion of the expandable tubular member 120 in order to catch or at least decelerate the expansion cone segments 325.

Alternatively, or in combination, during the radial expansion process, an upward axial force is applied to the tubular support member 315 sufficient to plastically deform and radially expand the tubular member 120 off of the external surfaces, 225*bb* and 225*bc*, of the expansion cone segments 325.

Alternatively, or in combination, in order to facilitate the pressurization of the interior 120*a* of the expandable tubular member by the injection of the fluidic materials 275, the region within the wellbore section 115 below the apparatus 300 may be fluidicly sealed off in a convention manner using, for example, a packer.

Once the radial expansion process is completed, the tubular support member 305, the tubular support member 310, the tubular support member 315, the end stop 320, the expansion cone segments 325, the split ring collar 330, the collet assembly 335, the packer cup assembly 340, the spacer 345, the packer cup assembly 350, and the collet assembly 355 are removed from the wellbores 100 and 115.

Referring to FIGS. 6 and 6*a*-6*k*, an alternative embodiment of an apparatus 400 for forming a wellbore casing in a subterranean formation will now be described. The apparatus 400 includes a tubular support member 405 defining an internal passage 405*a* that is coupled to an end of a tubular coupling 410 defining an internal passage 410*a*. The other end of the tubular coupling 410 is coupled to an end of a tubular support member 415 defining an internal passage 415*a* that includes a first flange 415*b*, a first radial passage 415*c*, a second radial passage 415*d*, a second flange 415*e*, a stepped flange 415*f*, a third flange 415*g*, a fourth flange 415*h*, a fifth flange 415*i*, and an expansion cone body 415*j*. The other end of the tubular support member 415 is coupled to a tubular end stop 420 that defines a passage 420*a*.

Figure 6:
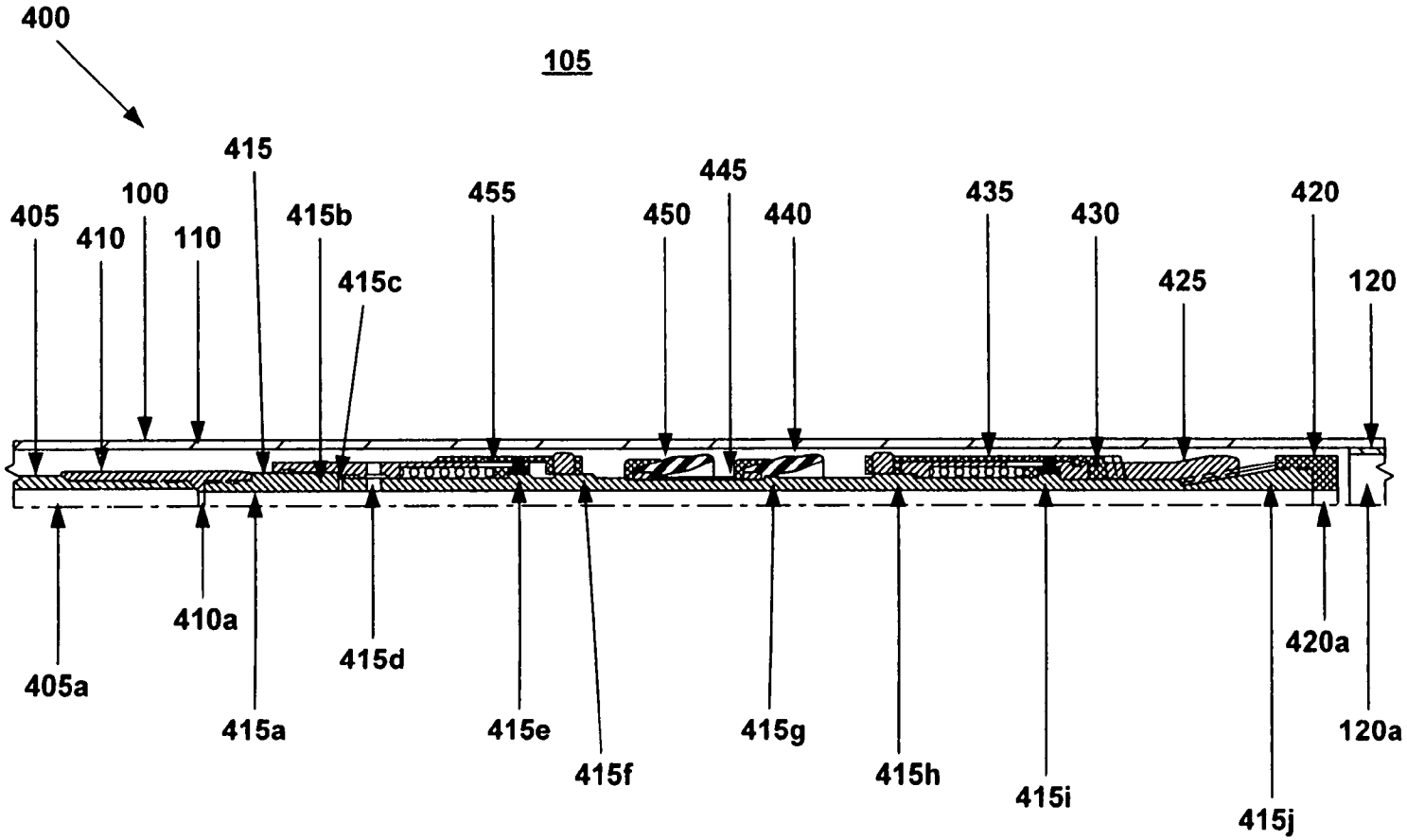
FIGS. 6 and 6*a*-6*d* are fragmentary cross-sectional illustrations of an embodiment of the placement of an apparatus for radially expanding a tubular member within a borehole within a subterranean formation.
Figure 6A:
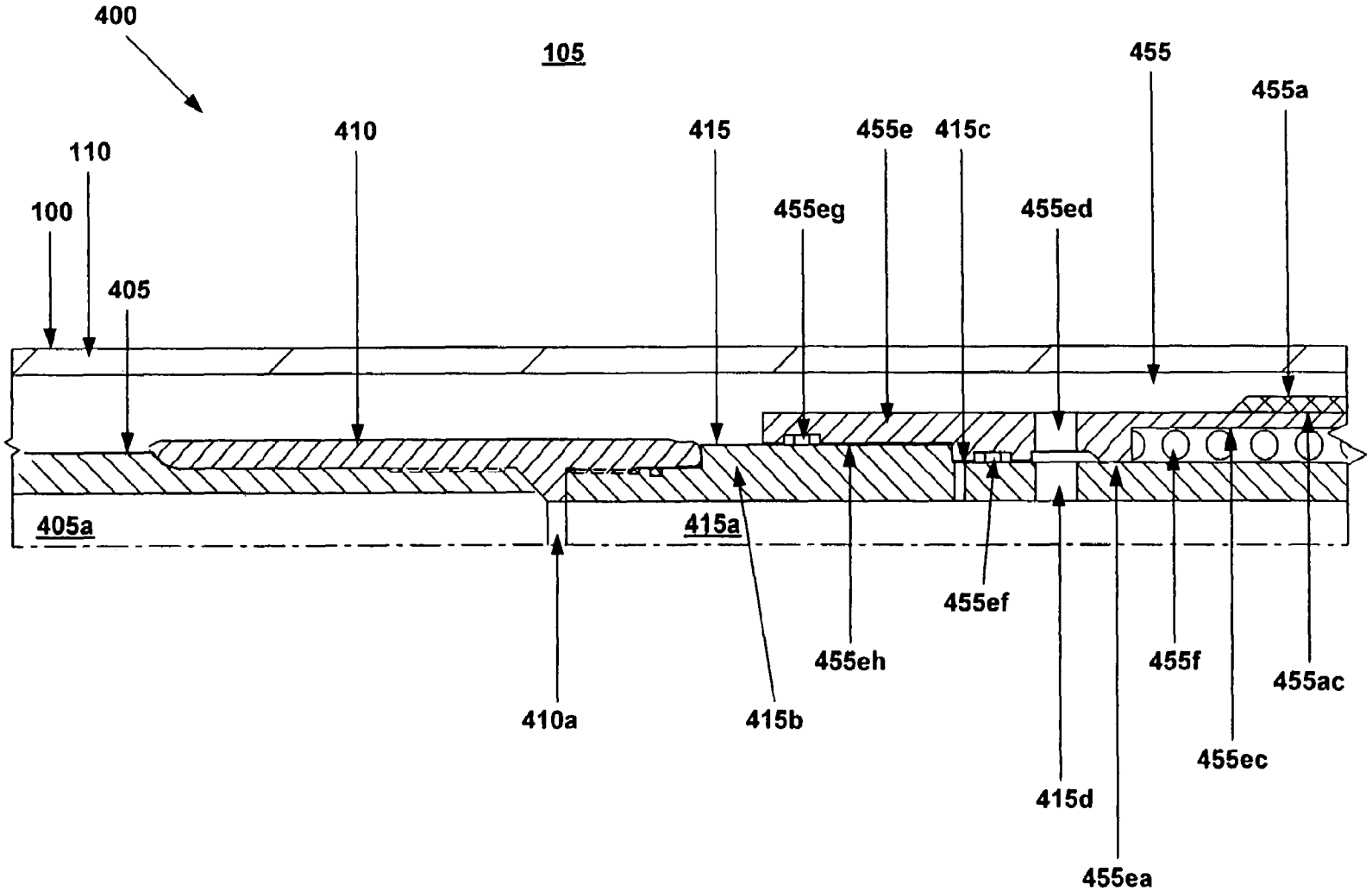
Figure 6B:
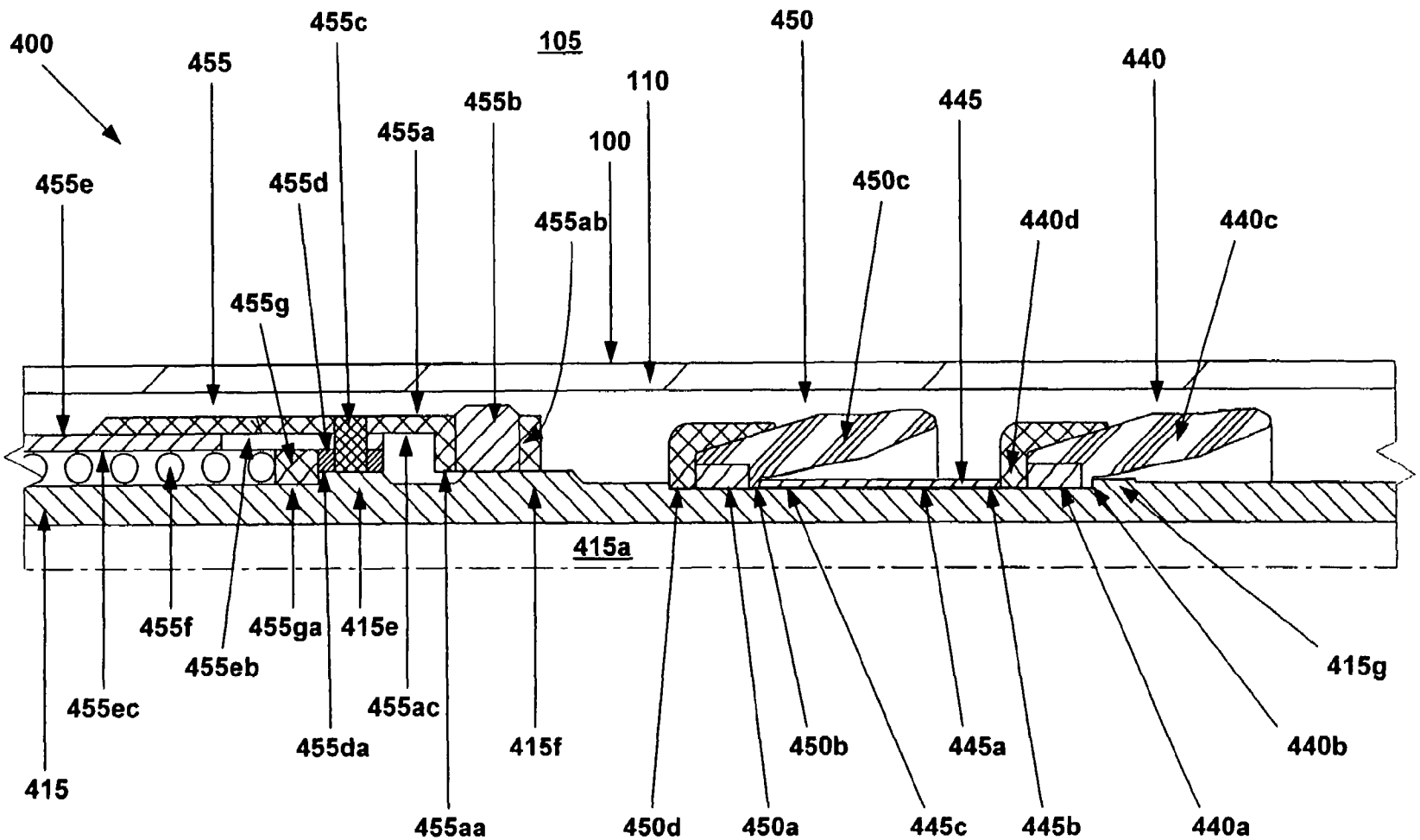
Figure 6C:
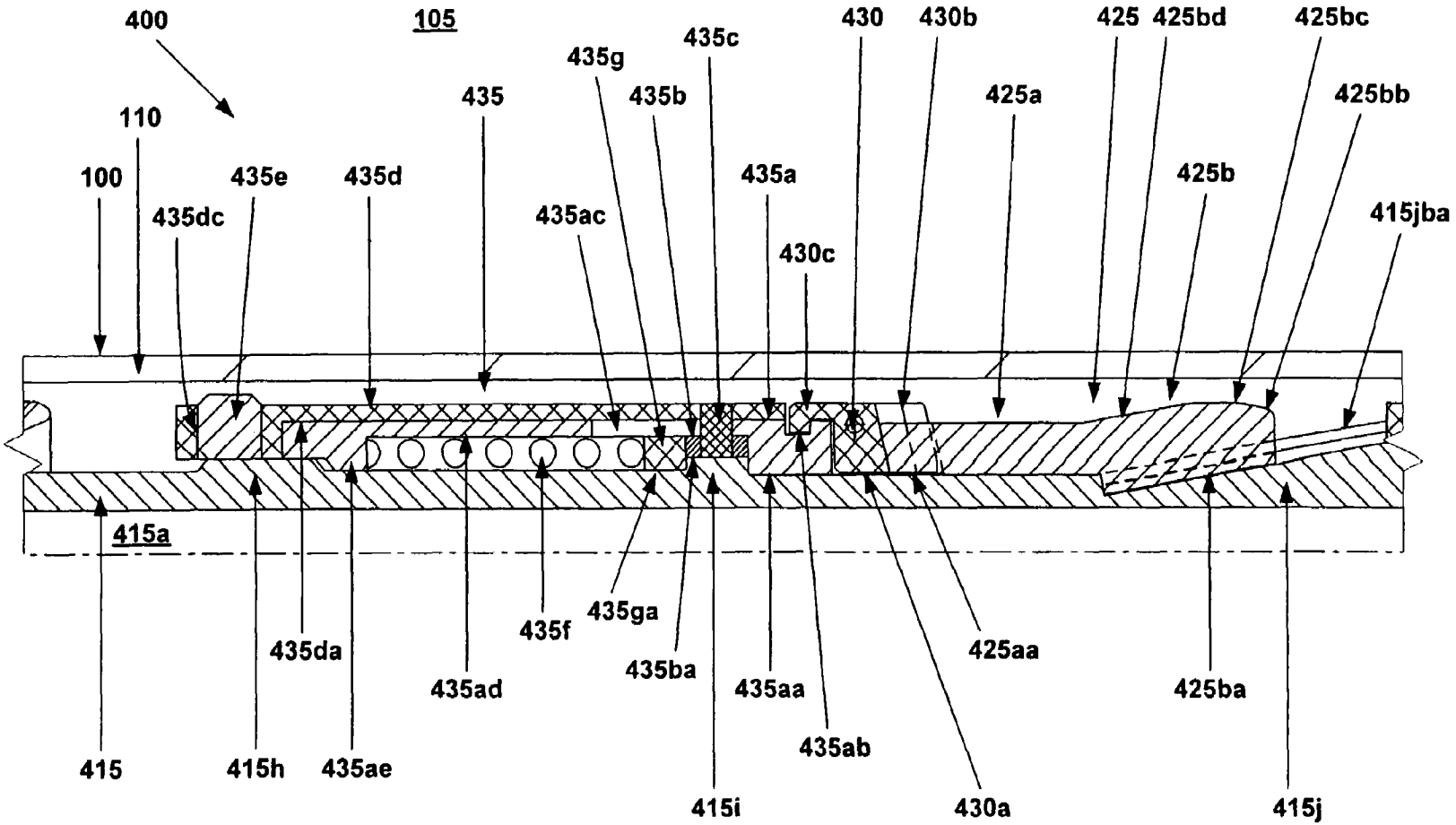
Figure 6D:
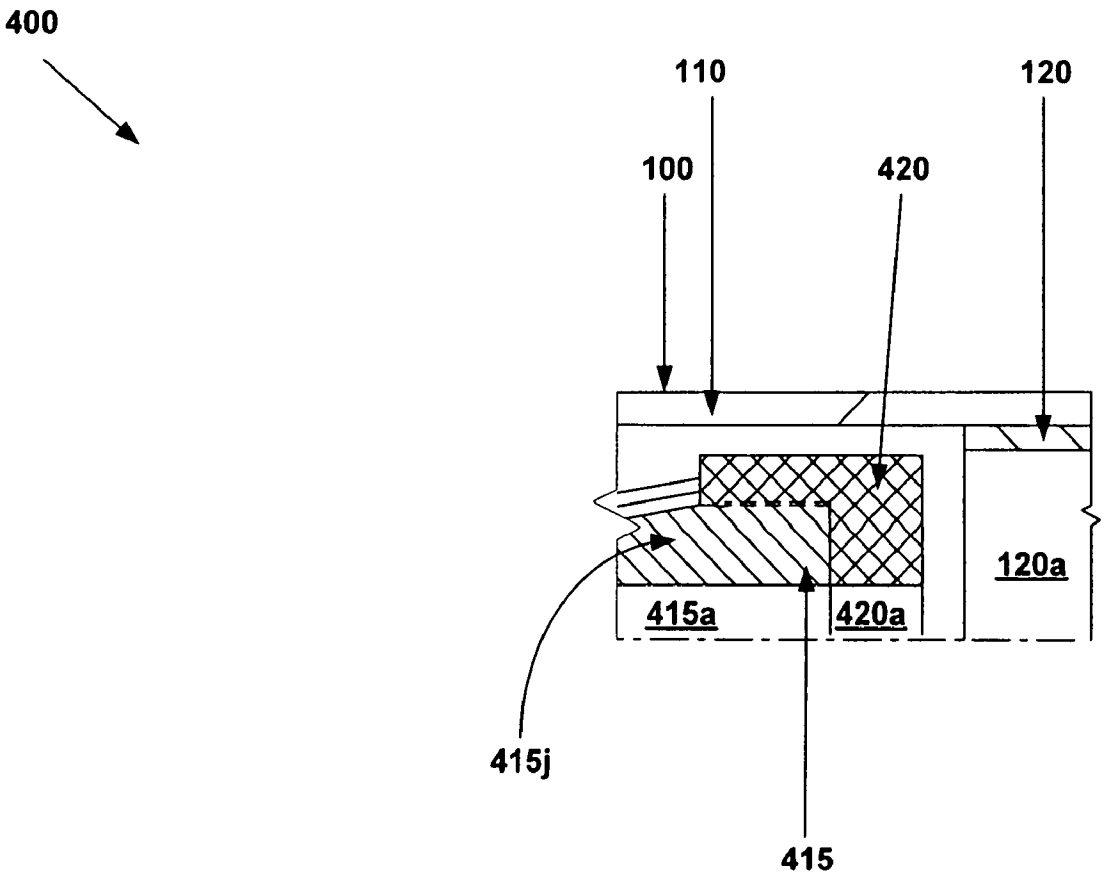
Figure 6F:
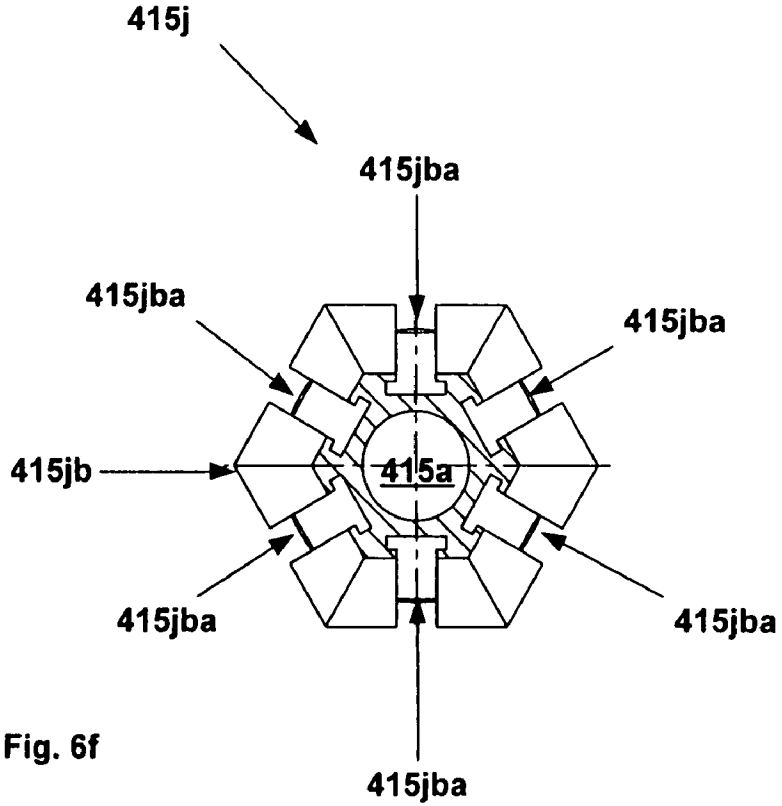
FIG. 6*f*is a cross-sectional view of the expansion cone support body of FIG. 6*e*.
Figure 6E:
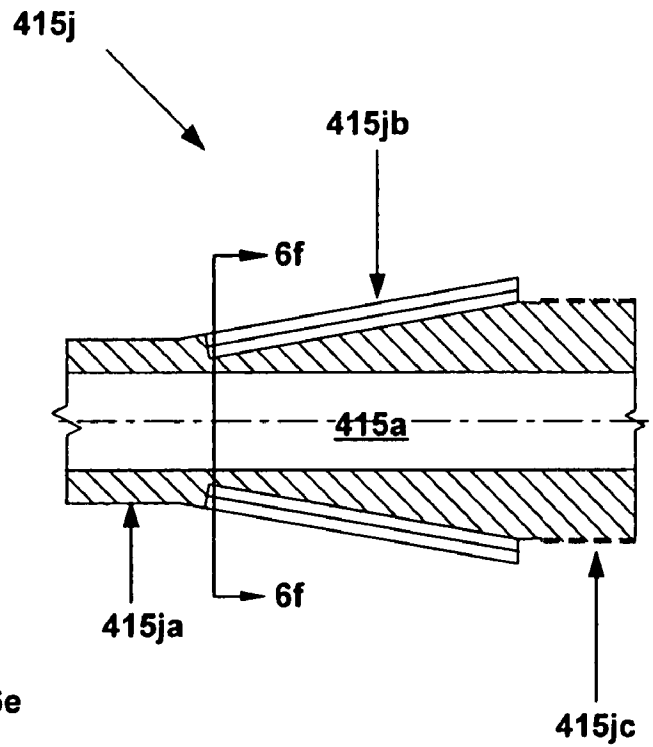
FIG. 6*e*is a cross-sectional view of an embodiment of the expansion cone support body of the apparatus of FIGS. 6 and 6*a*-6*d*.
Figure 6H:
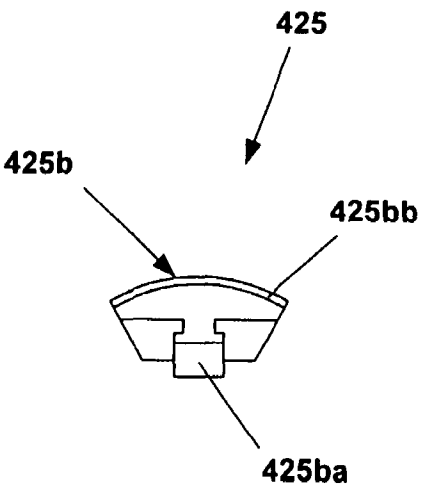
FIG. 6*h* is a front view of the expansion cone segment of FIG. 6*g*.
Figure 6G:
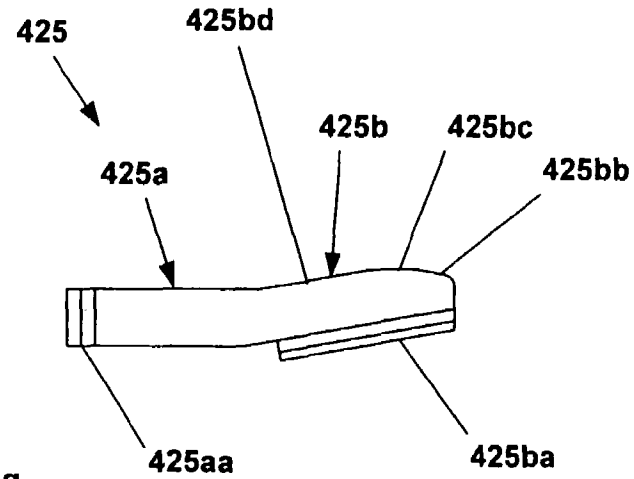
FIG. 6*g*is a side view of an embodiment of an expansion cone segment for use in the apparatus of FIGS. 6 and 6*a*-6*d*.
Figure 6I:
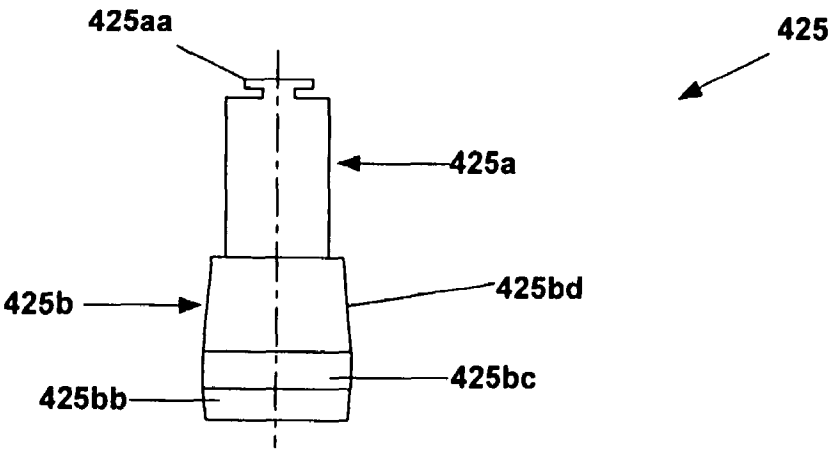
FIG. 6*i* is a top view of the expansion cone segment of FIG. 6*g*.

As illustrated in FIGS. 6*e*and 6*f*, the expansion cone support body 415*j* includes a first end 415*ja*, a tapered hexagonal portion 415*jb* that includes a plurality of T-shaped slots 415*jba* provided on each of the external faceted surfaces of the tapered hexagonal portion, and a second end 415*jc*. In an exemplary embodiment, the angle of attack of the tapered hexagonal portion 415*jb* ranges from about 35 to 50 degrees for reasons to be described.

As illustrated in FIGS. 6, 6*a*-6*d*, and 6*g*-6*i*, a plurality of expansion cone segments 425 are provided that include first ends 425*a* that include T-shaped retaining members 425*aa* and second ends 425*b* that include T-shaped retaining members 425*ba* that mate with and are received within corresponding T-shaped slots 415*jba* on the tapered hexagonal portion 415*jb* of the expansion cone support body 415*j*, first external surfaces 425*bb*, second external surfaces 425*bc*, and third external surfaces 425*bd*. Thus, in an exemplary embodiment, a total of six expansion cone segments 425 are provided that are slidably coupled to corresponding sides of the tapered hexagonal portion 415*jb* of the expansion cone support body 415*j*.

In an exemplary embodiment, the widths of the first external surfaces 425*bb* of the expansion cone segments 425 increase in the direction of the second external surfaces 425*bc*, the widths of the second external surfaces are substantially constant, and the widths of the third external surfaces 425*bd* decrease in the direction of the first ends 425*a* of the expansion cone segments for reasons to be described. In an exemplary embodiment, the first external surfaces 425*bb* of the expansion cone segments 425 taper upwardly in the direction of the second external surfaces 425*bc*, the second external surfaces taper upwardly in the direction of the third external surfaces 425*bd*, and the third external surfaces 425*bd* taper downwardly in the direction of the first ends 425*a* of the expansion cone segments for reasons to be described. In an exemplary embodiment, the angle of attack of the taper of the first external surfaces 425*bb* of the expansion cone segments 425 are greater than the angle of attack of the taper of the second external surfaces 425*bc*. In an exemplary embodiment, the first and second external surfaces, 425*bb* and 425*bc*, of the expansion cone segments 425 are arcuate such that when the expansion cone segments 425 are displaced in the direction of the end stop 420, the first and second external surfaces of the expansion cone segments provide a substantially continuous outer circumferential surface for reasons to be described.

Figure 6J:
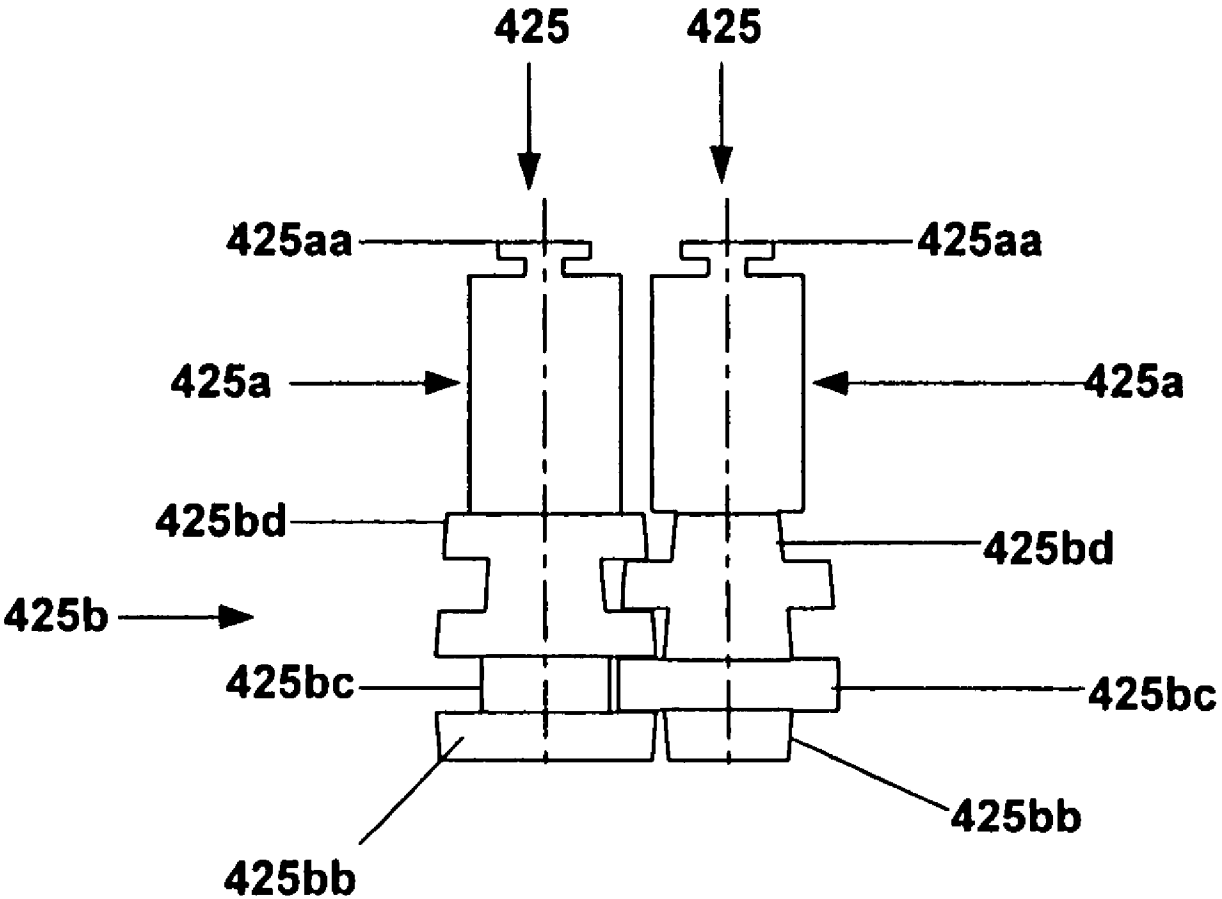
FIG. 6*j* is a top view of an embodiment of interlocking expansion cone segments for use in the apparatus of FIGS. 6 and 6*a*-6*d*.
Figure 6K:
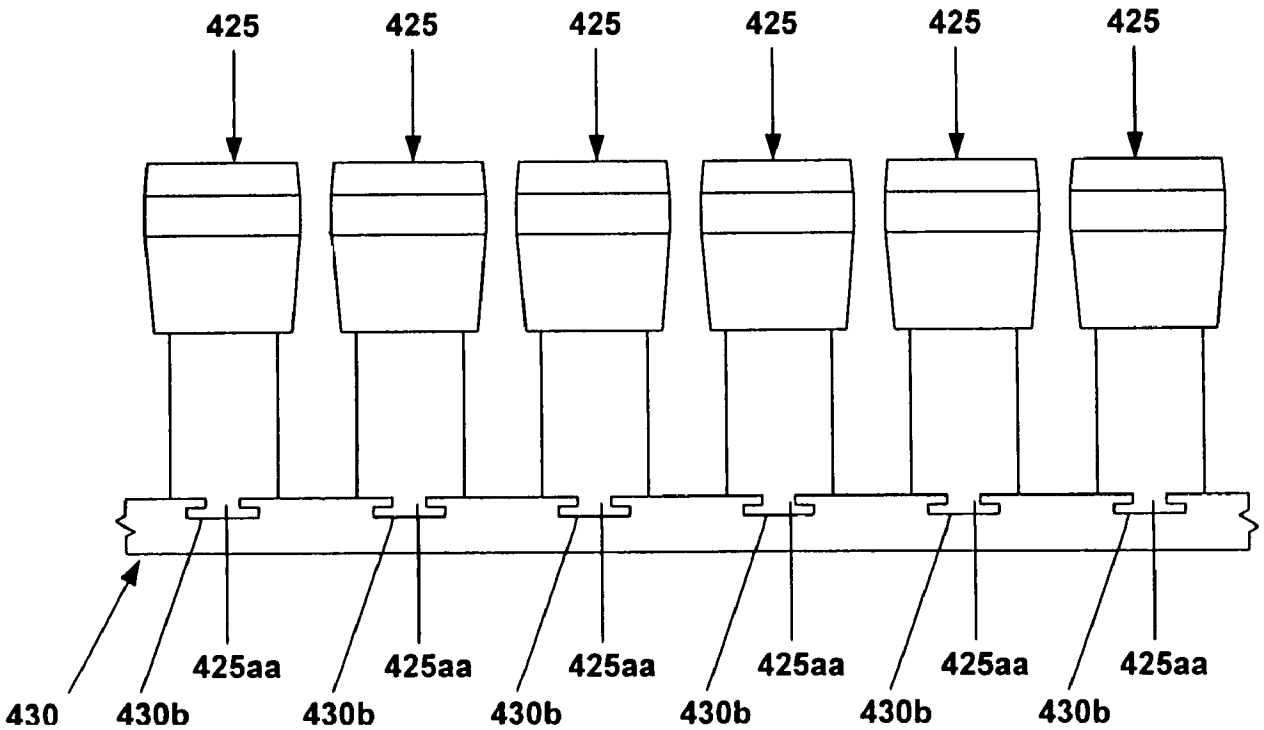
FIG. 6*k* is a top fragmentary circumferential view of an embodiment of the coupling arrangement between the expansion cone segments and the split ring collar for use in the apparatus of FIGS. 6 and 6*a*-6*d*.
Figure 7:
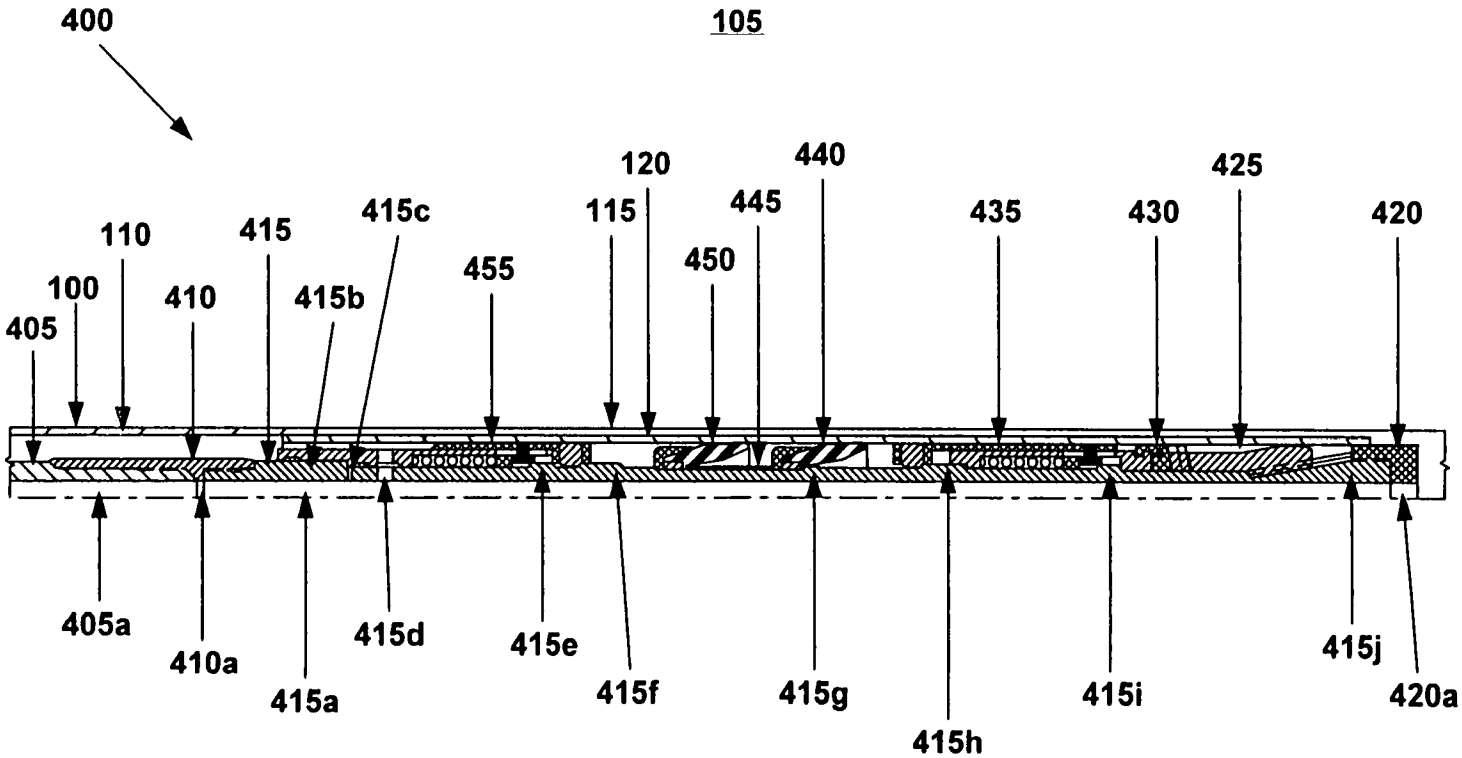
FIGS. 7 and 7*a*-7*c* are fragmentary cross-sectional illustrations of an embodiment of the placement of the apparatus of FIGS. 6 and 6*a*-6*d* including an expandable tubular member within a borehole within a subterranean formation.
Figure 7A:
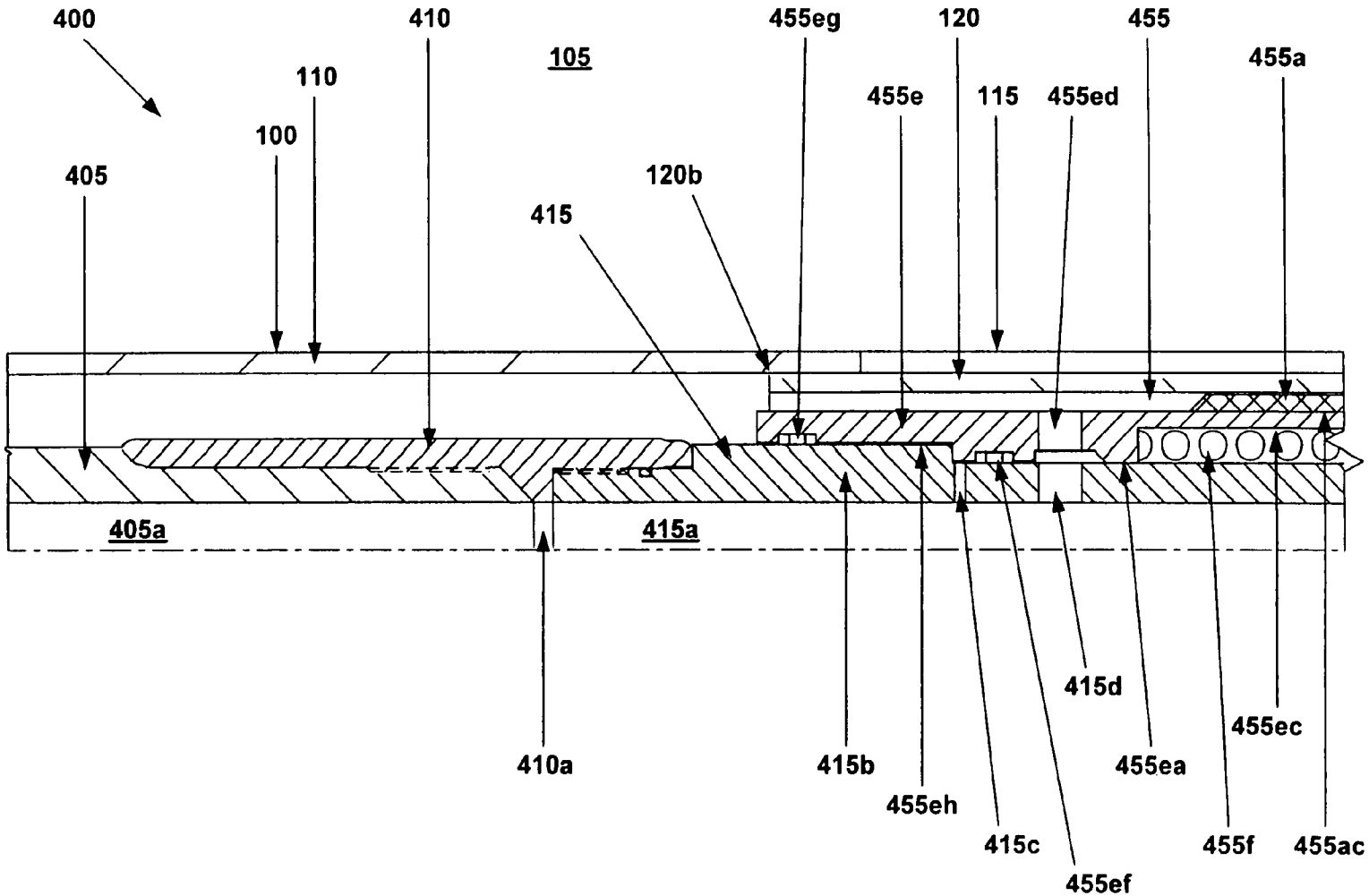
Figure 7B:
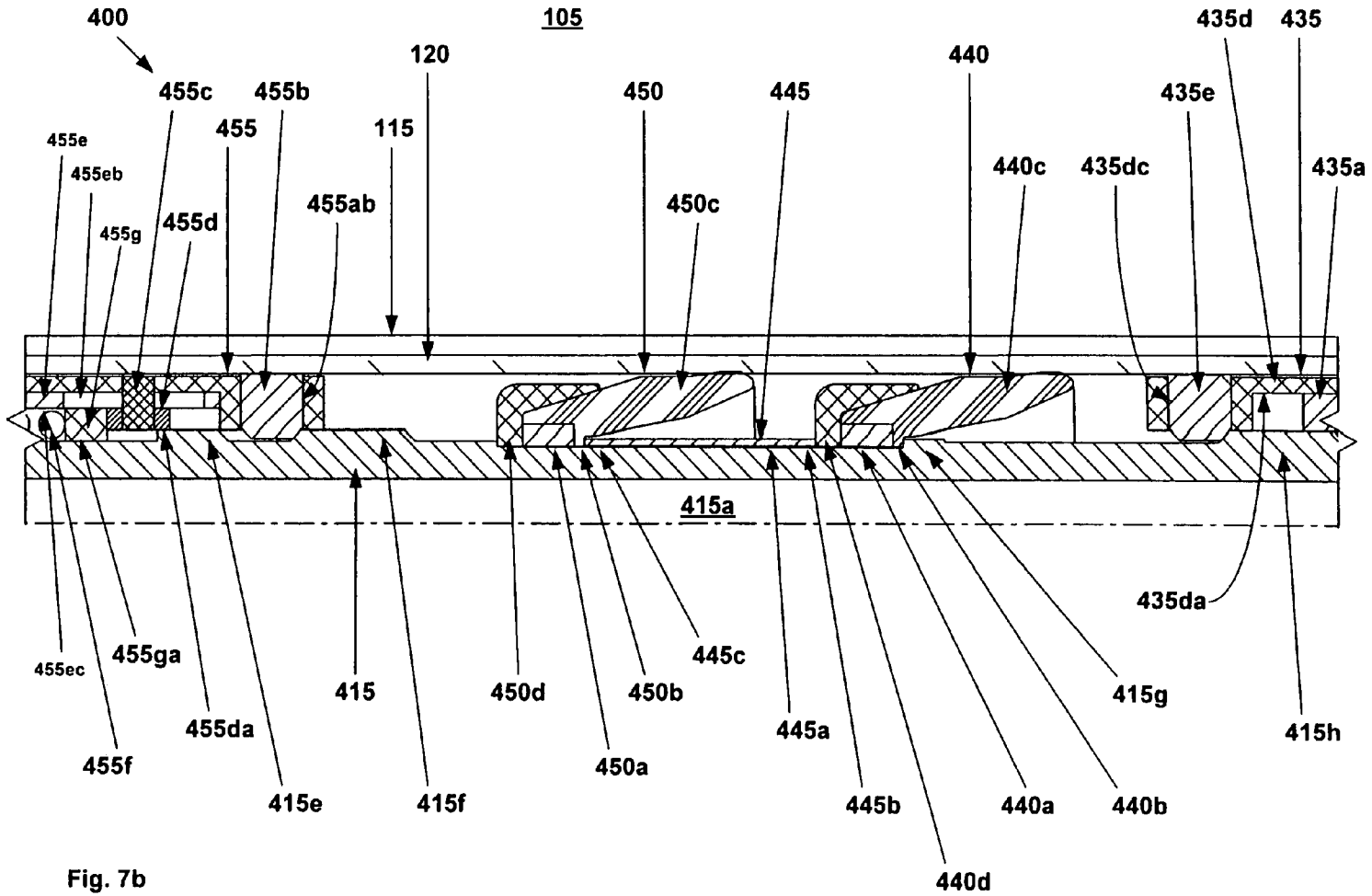
Figure 7C:
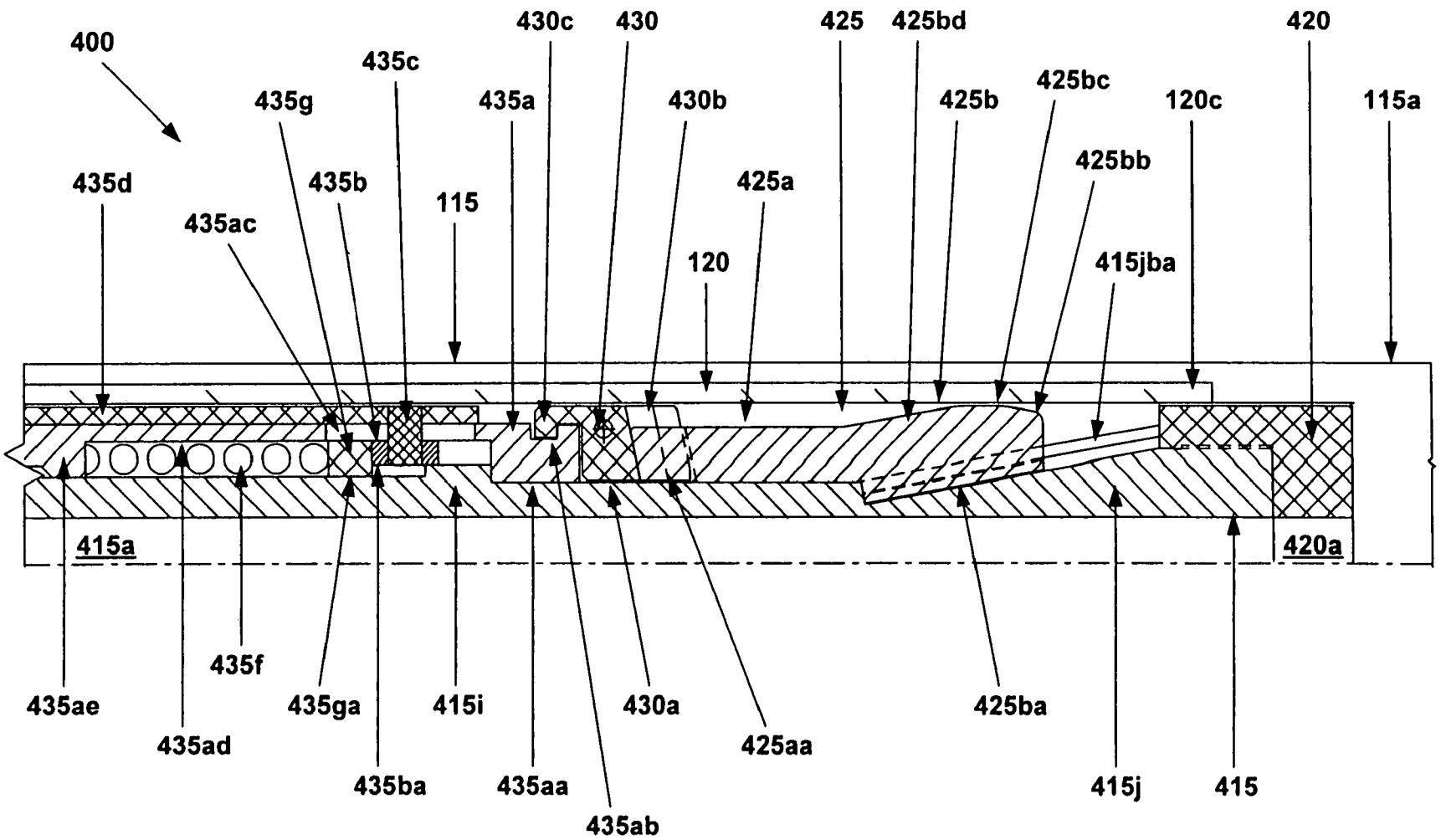
Figure 8:
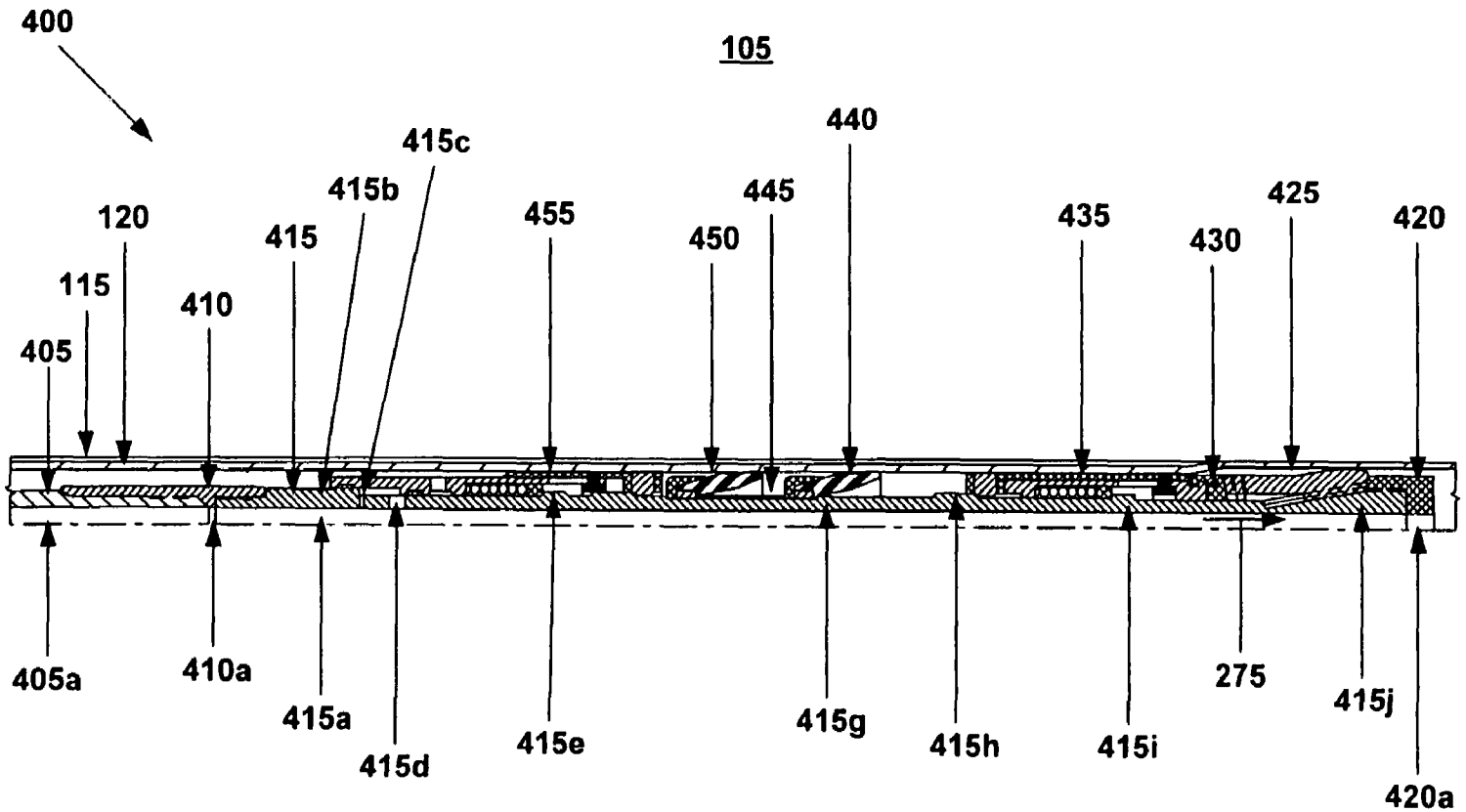
FIGS. 8 and 8*a*-8*d* are fragmentary cross-sectional illustrations of an embodiment of the operation of the apparatus of FIGS. 7 and 7*a*-7*d* during the radial expansion of the expandable tubular member within a borehole within a subterranean formation.
Figure 8A:
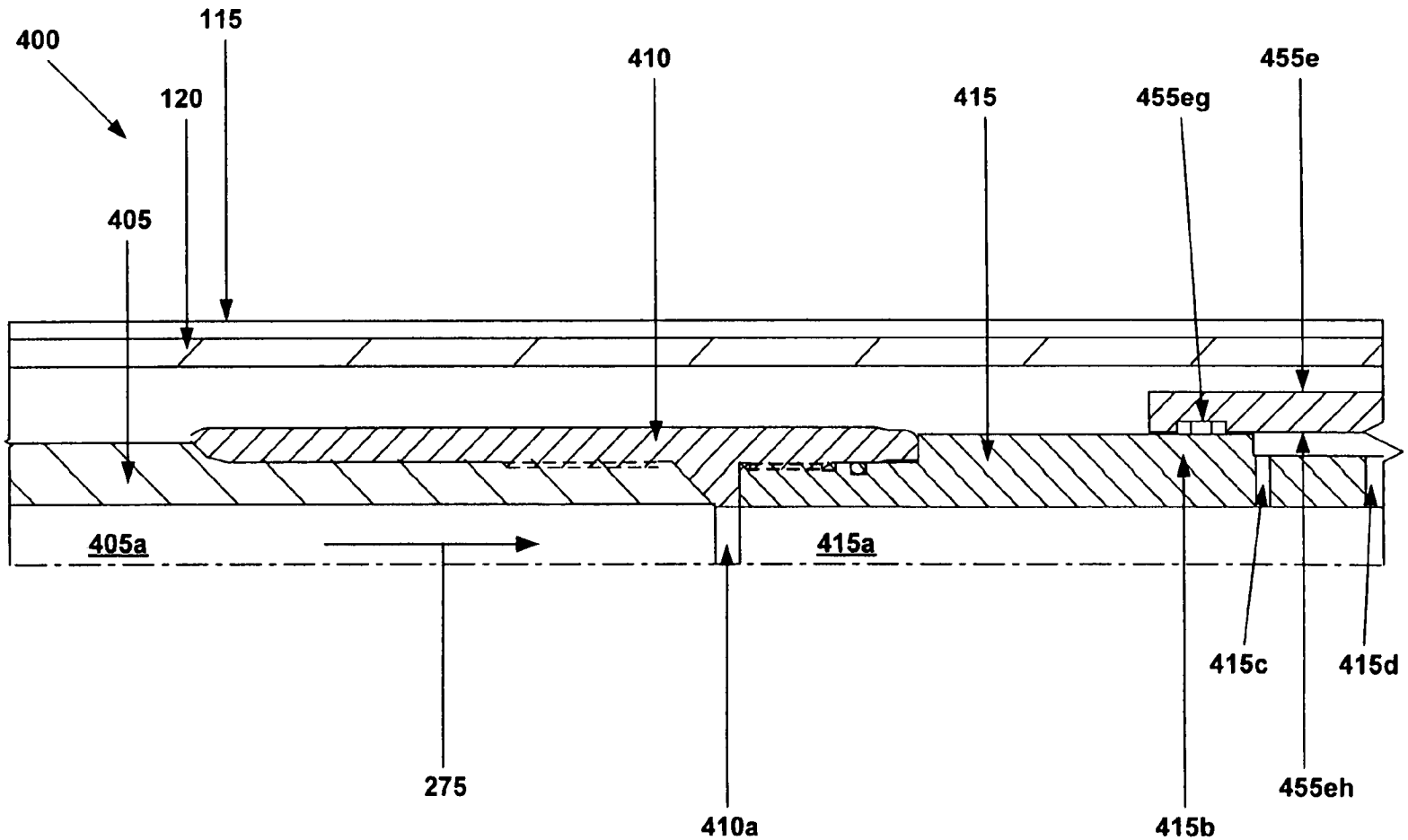
Figure 8B:
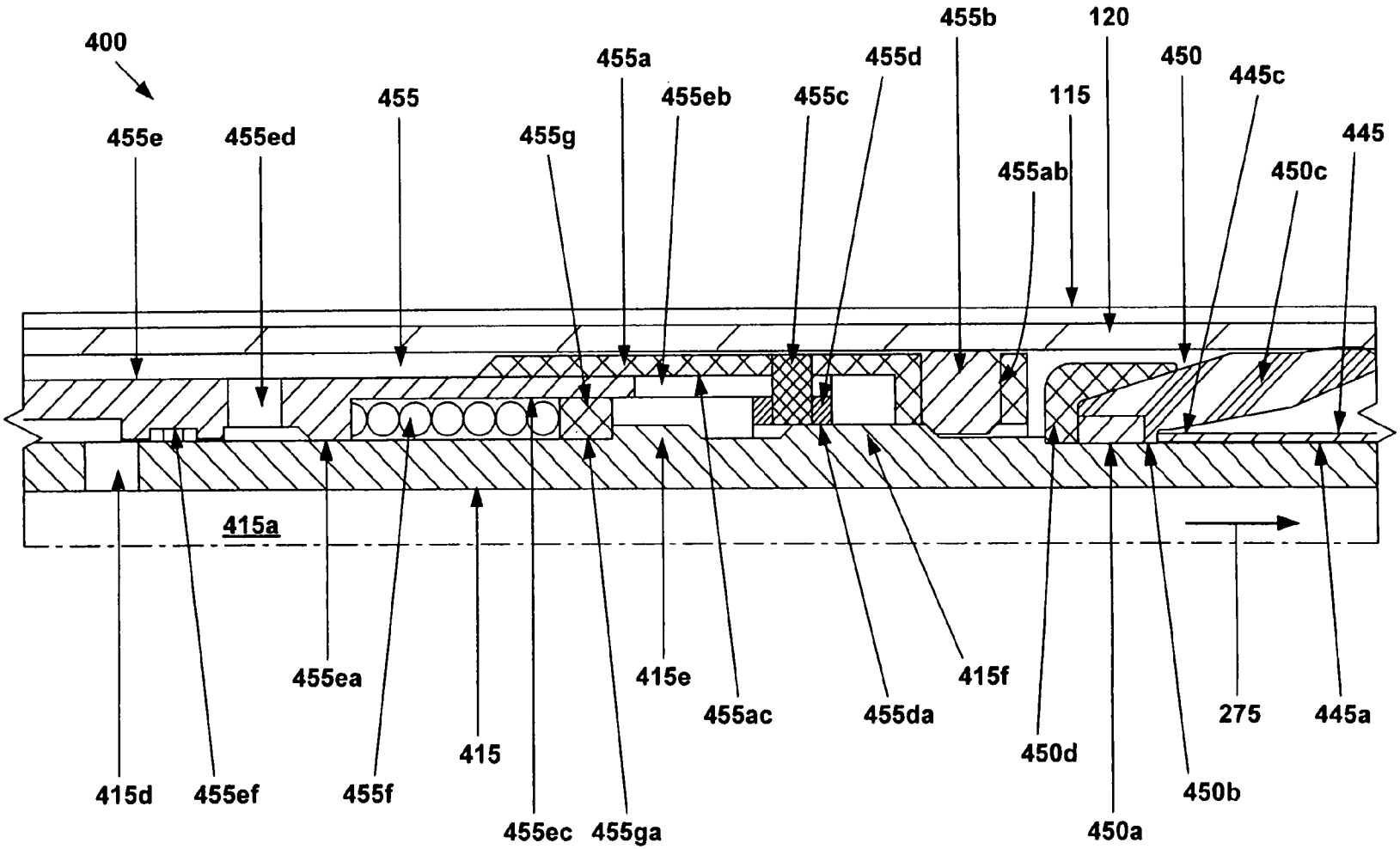
Figure 8C:
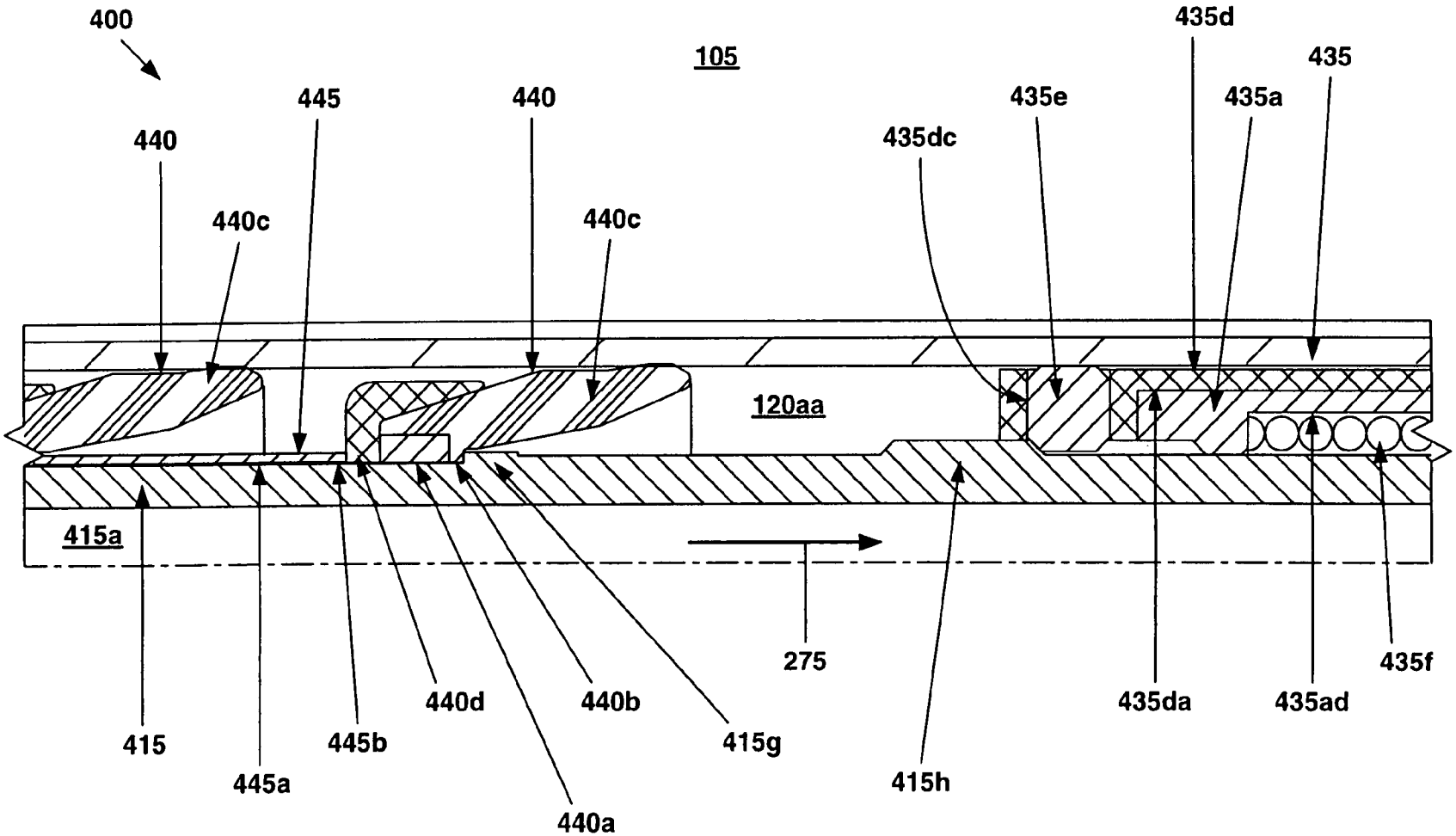
Figure 8D:
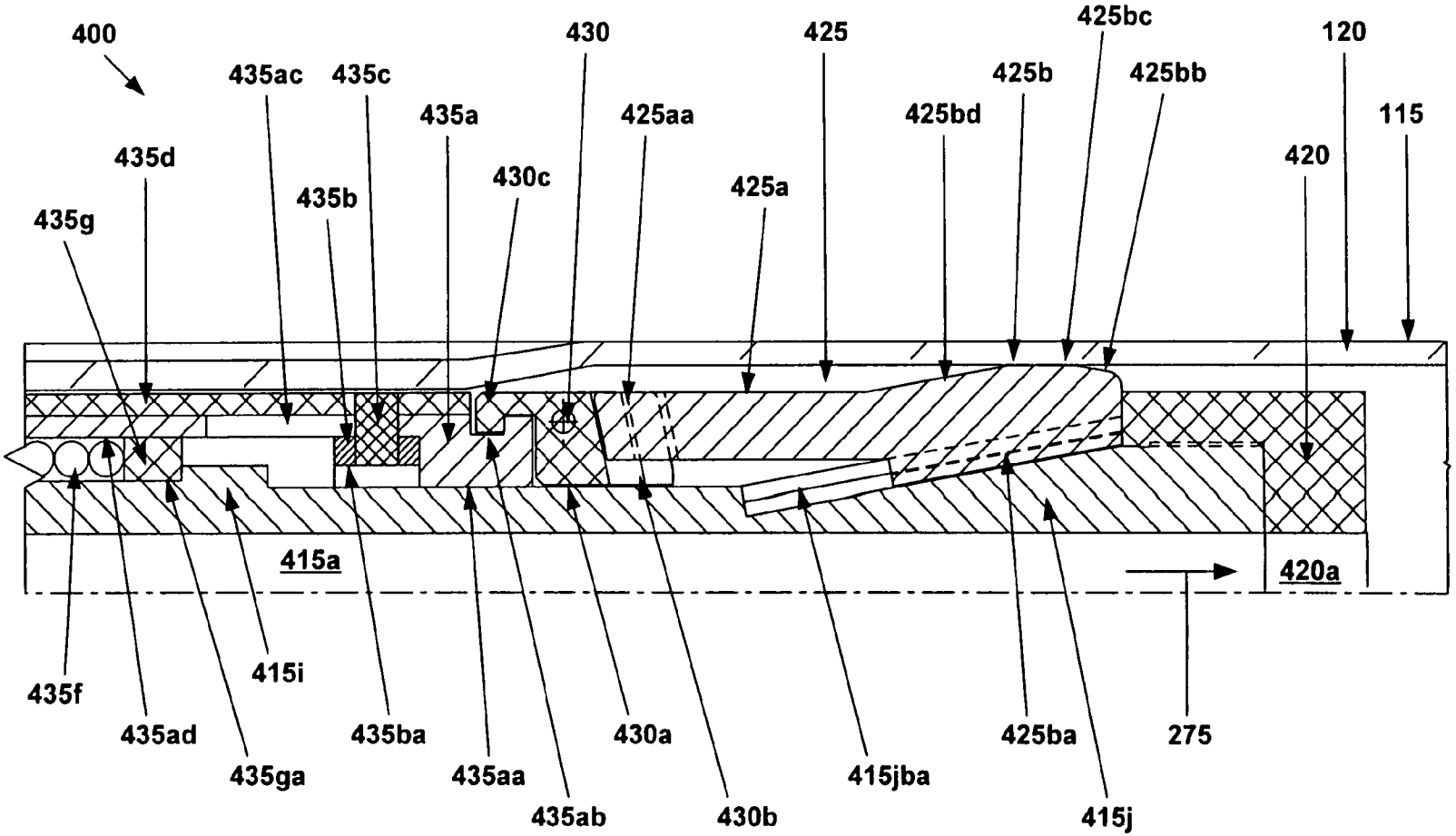

As illustrated in FIG. 6*j*, in an exemplary embodiment, the external surfaces, 425*bb*, 425*bc*, and 425*bd*, of the second ends 425*b* of the expansion cone segments 425 are adapted to mate with one another in order to interlock adjacent expansion cone segments.

A split ring collar 430 that defines a passage 430*a* for receiving the tubular support member 415 is provided that includes a first end that includes plurality of T-shaped slots 430*b* for receiving and mating with corresponding T-shaped retaining members 425*aa* of the expansion cone segments 425 and a second end that includes an L-shaped retaining member 430*c*. In an exemplary embodiment, the split ring collar 430 is a conventional split ring collar commercially available from Halliburton Energy Services modified in accordance with the teachings of the present disclosure.

A dog assembly 435 is provided that includes a tubular sleeve 435*a* that defines a passage 435*aa* for receiving the tubular support member 415 that includes a first end that includes a slot 435*ab* for receiving and mating with the L-shaped retaining member 430*c* of the split ring collar 430, a radial passage 435*ac*, and a recess 435*ad* for receiving the fifth flange 415*a* of the tubular support member 415. A second end of the tubular sleeve 435*a* includes a flange 435*ae* that mates with the fourth flange 415*h* of the tubular support member 415. A retaining ring 435*b* that defines a passage 435*ba* for receiving the fifth flange 415*i* is received within the recess 435*ad* of the tubular sleeve 435*a* and is coupled to an end of a load transfer pin 435*c*. The opposite end of the load transfer pin 435*c* is received within the radial passage 435*ac* of the tubular sleeve 435*a* and is coupled to an end of a tubular sleeve 435*d* that includes a recess 435*da* at a first end for receiving the tubular sleeve 435*a*, and a radial opening 435*dc* for receiving a conventional resilient dog 435*e*. A spring 435*f* and a ring 435*g* that defines a passage 435*ga* for receiving the tubular support member 415 are received within the recess 435*ad* of the tubular sleeve 435*a* between a first end of the recess and the fifth flange 415*i* of the tubular support member.

A first conventional packer cup assembly 440 that defines a passage 440*a* for receiving the tubular support member 415 includes a first end 440*b* that mates with the fourth flange 415*g* of the tubular support member, a conventional sealing cup 440*c*, and a second end 440*d*. A tubular spacer 445 that defines a passage 445*a* for receiving the tubular support member 415 includes a first end 445*b* that mates with the second end 440*d* of the first packer cup assembly 440 and a second end 445*c*. A second conventional packer cup assembly 450 that defines a passage 450*a* for receiving the tubular support member 415 includes a first end 450*b* that mates with the second end 445*c* of the spacer 445, a conventional sealing cup 450*c*, and a second end 450*d* that mates with the stepped flange 415*f* of the tubular support member.

A dog assembly 455 is provided that includes a tubular sleeve 455*a* that defines a passage 455*aa* for receiving the tubular support member 415. A first end of the tubular sleeve 455*a* includes a radial opening 455*ab* for receiving a conventional resilient dog 455*b*. A second end of the tubular sleeve 455*a* includes a recess 455*ac* and is coupled to an end of a load transfer pin 455*c*. The opposite end of the load transfer pin 455*c* is coupled to a retaining ring 455*d* that defines a passage 455*da* for receiving the tubular support member 415. A tubular sleeve 455*e* is received within the recess 455*ac* of the tubular sleeve 455*a* that defines a passage 455*ea* for receiving the tubular support member 415 and includes a first end that includes a radial passage 455*eb* for receiving the load transfer pin 455*c* and a recess 455*ec* for receiving a spring 455*f*. A ring 455*g* that defines a passage 455*ga* for receiving the tubular support member 415 is further received within the recess 455*ec* of the tubular sleeve 455*e* between the spring 455*f* and the second flange 415*e* of the tubular support member 415. A second end of the tubular sleeve 455*e* includes a radial passage 455*ed*, sealing members, 455*ef* and 455*eg*, and a recess 455*eh* that mates with the first flange 415*b* of the tubular support member 415.

In an exemplary embodiment, during operation of the apparatus 400, as illustrated in FIGS. 6 and 6*a*-6*k*, the apparatus may be initially positioned in the wellbore 100, within the casing 110, with the dog assemblies 435 and 455 positioned in a neutral position in which the radial passage 415*d* of the tubular support member 415 is fluidicly coupled to the radial passage 455*ed* of the dog assembly 455 and the expansion cone segments 425 are not driven up the tapered hexagonal portion 415*jb* of the expansion cone support body 415*j* of the tubular support member 415 into contact with the stop member 320. In this manner, fluidic materials within the interior 415*a* of the tubular support member 415 may pass through the radial passages, 415*d* and 455*ed*, into the annulus between the apparatus 400 and the casing 110 thereby preventing over pressurization of the annulus. Furthermore, in this manner, the outside diameter of the expansion cone segments 425 is less than or equal to the outside diameter of the stop member 420 thereby permitting the apparatus 400 to be displaced within the casing 110.

As illustrated in FIGS. 7, and 7*a*-7*c*, the apparatus 400 may then be positioned in the tubular member 120. During the insertion of the apparatus into the tubular member 120, the upper end 120*b* of the tubular member may impact the ends of the resilient dogs, 435*e* and 455*b*, of the dog assemblies, 435 and 455, respectively, thereby driving the resilient dogs, 435*e* and 455*b*, backwards off of and adjacent to one side of the flanges, 415*h* and 415*f*, respectively. As a result of the backward axial displacement of the resilient dog 435*e*, the tubular sleeve 435*d*, the pin 435*c*, the retaining ring 435*b*, and the ring 435*g* of the dog assembly 435 are driven backward thereby compressing the spring 435*f* and applying an axial biasing force to the tubular sleeve 435*a* that prevents the expansion cone segments 425 from being displaced toward the end stop 420. As a result of the backward axial displacement of the resilient dog 455*b*, the tubular sleeve 455*a*, the pin 455*c*, the retaining ring 455*d*, and the ring 455*g* of the dog assembly 455 are driven backward thereby compressing the spring 455*f* and applying an axial biasing force to the tubular sleeve 455*e* that prevents the radial passages, 415*d* and 455*ed* from being fluidicly decoupled.

The apparatus 400 may then be at least partially positioned in the open hole section 115*a* of the wellbore section 115, beyond the lower end 120*c* of the tubular member 120. In an exemplary embodiment, that portion of the apparatus 400 that includes the stop member 420, the expansion cone segments 425, the split ring collar 430, the dog assembly 435, the packer cup assembly 440, the spacer 445, the packer cup assembly 450, and the dog assembly 455 is then positioned in the open hole section 115*a* of the wellbore section 115, beyond the lower end 120 of the tubular member for reasons to be described. Because the dogs, 435*e* and 455*b*, of the dog assemblies, 435 and 455, respectively, are resilient, once the apparatus 400 has been positioned in the open hole section 115*a* of the wellbore section 115, beyond the lower end 120*c* of the tubular member 120, the resilient dogs, 435*e* and 455*b*, of the dog assemblies may spring outwardly in the radial direction.

The apparatus 400 may then be repositioned at least partially back within the tubular member 120. During the reinsertion of the apparatus into the tubular member 120, the lower end 120*c* of the tubular member may impact the ends of the resilient dogs, 435*e* and 455*b*, of the dog assemblies, 435 and 455, respectively, thereby driving the resilient dogs forward until the resilient dogs are positioned beyond and adjacent to the other side of the flanges, 415*h* and 415*f*, of the tubular support member 415.

As a result, of the forward axial displacement of the resilient dog 435*e*, the tubular sleeve 435*a*, the retaining ring 435*b*, the pin 435*c*, the tubular sleeve 435*d*, the spring 435*f*, and the ring 435*g* of the dog assembly 435 are displaced in the forward axial direction thereby also displacing the split ring collar 430 and the expansion cone segments 425 in the forward axial direction. As a result, the expansion cone segments 425 are driven up the tapered hexagonal portion 415*jb* of the expansion cone support body 415*j* of the tubular support member 415 into contact with the stop member 320.

As a result of the forward axial displacement of the resilient dog 455*b*, the tubular sleeve 455*a*, the pin 455*c*, the retaining ring 455*d*, the tubular sleeve 455*e*, the spring 455*f*, and the ring 455*g* of the dog assembly 455 are driven forward in the axial direction thereby fluidicly decoupling the radial passages, 415*d* and 455*ed*, and fluidicly coupling the radial passages 415*c* and 415*d*. As a result fluidic materials within the tubular support member 415 may not pass into the annulus between the tubular support member and the tubular member 120.

As a result of the forward axial displacement of the resilient dog 435*e*, the outside diameter of the expansion cone segments 425 is now greater than the inside diameter of expandable tubular member 120 thereby permitting the apparatus 400 to be used to radially expand and plastically deform the tubular member, and fluidic materials within the interior 415*a* of the tubular support member 415 may no longer pass through the radial passages, 415*d* and 455*ed*, into the annulus between the apparatus 400 and the tubular member thereby permitting the interior of the apparatus to be pressurized.

The apparatus 400 may then be operated to radially expand and plastically deform the tubular member 120 by applying an upward axial force to the tubular support member 415 and/or by injecting a pressurized fluidic material into the tubular support member.

In particular, as illustrated in FIGS. 8 and 8*a*-8*d*, the expandable tubular member 120 may then be radially expanded using the apparatus 400 by injecting a fluidic material 275 into the apparatus through the passages 405*a*, 310*a*, 415*a*, and 420*a*. The injection of the fluidic material 275 may pressurize the interior 120*a* of the expandable tubular member 120. In addition, because the packer cup assemblies, 440 and 450, seal off an annular region 120*aa* below the packer cup assemblies between the expandable tubular member 120 and the tubular support member 415, the injection of the fluidic material 275 may also pressurize the annular region.

The continued injection of the fluidic material 275 may then pressurize the interior 120*a* of the expandable tubular member 120 thereby plastically deforming and radially expanding the expandable tubular member off of the expansion cone segments 425. Because the outer surfaces, 425*bb* and 425*bc*, of the expansion cone segments 425 are tapered, the plastic deformation and radial expansion of the expandable tubular member 120 proximate the expansion cone segments is facilitated. Furthermore, in an exemplary embodiment, the continued injection of the fluidic material 275 also pressurizes the annular region 120*aa* defined between the interior surface of the expandable tubular member 120 and the exterior surface of the tubular support member 415 that is bounded on the upper end by the packer cup assembly 440 and on the lower end by the expansion cone segments 425. Furthermore, in an exemplary embodiment, the pressurization of the annular region 120*aa* also radially expands at least a portion of the surrounding portion of the expandable tubular member 120. In this manner, the plastic deformation and radial expansion of the expandable tubular member 120 is enhanced. Furthermore, during operation of the apparatus 300, the packer cup assemblies 440 and 450 prevent the pressurized fluidic material 275 from passing above and beyond the packer cup assemblies and thereby define the length of the pressurized annular region 120*aa*. In an exemplary embodiment, the pressurization of the annular region 120*aa* decreases the operating pressures required for plastic deformation and radial expansion of the expandable tubular member 120 by as much as 50% and also reduces the angle of attack of the tapered external surfaces, 425*bb* and 425*bc*, of the expansion cone segments 425.

The radial expansion of the expandable tubular member 120 may then continue until the upper end 120*b* of the expandable tubular member is radially expanded and plastically deformed along with the overlapping portion of the wellbore casing 110. Because the expansion cone segments 425 may be adjustably positioned from an outside diameter less than the inside diameter of the expandable tubular member 120 to an outside diameter substantially equal to the inside diameter of the pre-existing casing 110, the resulting wellbore casing, including the casing 110 and the radially expanded tubular member 120, created by the operation of the apparatus 400 may have a single substantially constant inside diameter thereby providing a mono-diameter wellbore casing.

During the radial expansion process, the expansion cone segments 425 may be raised out of the expanded portion of the tubular member 120 by applying an upward axial force to the tubular support member 415. In a preferred embodiment, during the radial expansion process, the expansion cone segments 425 are raised at approximately the same rate as the tubular member 120 is expanded in order to keep the tubular member stationary relative to the new wellbore section 115.

In a preferred embodiment, when the upper end portion of the expandable tubular member 120 and the lower portion of the wellbore casing 110 that overlap with one another are plastically deformed and radially expanded by the expansion cone segments 425, the expansion cone segments are displaced out of the wellbore 100 by both the operating pressure within the interior of the tubular member 120 and a upwardly directed axial force applied to the tubular support member 405.

In a preferred embodiment, the operating pressure and flow rate of the fluidic material 275 is controllably ramped down when the expansion cone segments 425 reach the upper end portion of the expandable tubular member 120. In this manner, the sudden release of pressure caused by the complete radial expansion and plastic deformation of the expandable tubular member 120 off of the expansion cone segments 425 can be minimized. In a preferred embodiment, the operating pressure is reduced in a substantially linear fashion from 100% to about 10% during the end of the extrusion process beginning when the expansion cone segments 425 are within about 5 feet from completion of the extrusion process.

Alternatively, or in combination, the wall thickness of the upper end portion of the expandable tubular member 120 is tapered in order to gradually reduce the required operating pressure for plastically deforming and radially expanding the upper end portion of the tubular member. In this manner, shock loading of the apparatus is at least reduced.

Alternatively, or in combination, a shock absorber is provided in the tubular support member 405 in order to absorb the shock caused by the sudden release of pressure. The shock absorber may comprise, for example, any conventional commercially available shock absorber, bumper sub, or jars adapted for use in wellbore operations.

Alternatively, or in combination, an expansion cone catching structure is provided in the upper end portion of the expandable tubular member 120 in order to catch or at least decelerate the expansion cone segments 425.

Alternatively, or in combination, during the radial expansion process, an upward axial force is applied to the tubular support member 415 sufficient to plastically deform and radially expand the tubular member 120 off of the external surfaces, 225*bb* and 225*bc*, of the expansion cone segments 425.

Alternatively, or in combination, in order to facilitate the pressurization of the interior 120*a* of the expandable tubular member by the injection of the fluidic materials 275, the region within the wellbore section 115 below the apparatus 400 may be fluidicly sealed off in a convention manner using, for example, a packer.

Once the radial expansion process is completed, the tubular support member 405, the tubular support member 410, the tubular support member 415, the end stop 420, the expansion cone segments 425, the split ring collar 430, the dog assembly 435, the packer cup assembly 440, the spacer 445, the packer cup assembly 450, and the dog assembly 455 are removed from the wellbores 100 and 115.

Referring now to FIGS. 9, 9*a*, 10 and 10*a*, an embodiment of an adjustable expansion cone assembly 500 will be described. The assembly 500 includes a tubular support member 505 that defines a passage 505*a* and includes a flange 505*b*, an expansion cone support flange assembly 505*c*, and an end stop 505*d*. The expansion cone support flange assembly 505*c* includes a tubular body 505*ca* and a plurality of equally spaced apart expansion cone segment support members 505*cb* that extend outwardly from the tubular body in the radial direction that each include identical bases 505*cba* and extensions 505*cbb*. The support members 505*cb* further include first sections 505*cbc* having arcuate conical outer surfaces and second sections 505*cbd* having arcuate cylindrical outer surfaces for reasons to be described.

An expansion cone segment assembly 510 is provided that includes a tubular support 510*a* defining a passage 510*aa* for receiving the tubular support member 505 and a slot 510*ab*. A plurality of spaced apart and substantially identical resilient expansion cone segment collets 510*b* extend from the tubular support 510*a* in the axial direction that include expansion cone segments 510*ba* extending therefrom in the axial direction. Each of the expansion cone segments 510*ba* further include arcuate conical expansion surfaces 510*baa* for radially expanding an expandable tubular member.

A split ring collar 515 is provided that defines a passage 515*a* for receiving the tubular support member 505 that includes an L-shaped retaining member 515*b* at one end for mating with the slot 510*ab* of the tubular support 510*a* of the expansion cone segment assembly 510. Another end of the split ring collar 515 includes an L-shaped retaining member 515*c*. A tubular sleeve 520 is provided that defines a passage 520*a* for receiving the tubular support member 505 that includes a slot 520*b* for receiving the L-shaped retaining member 515*c* of the split ring collar 515.

Figure 9:
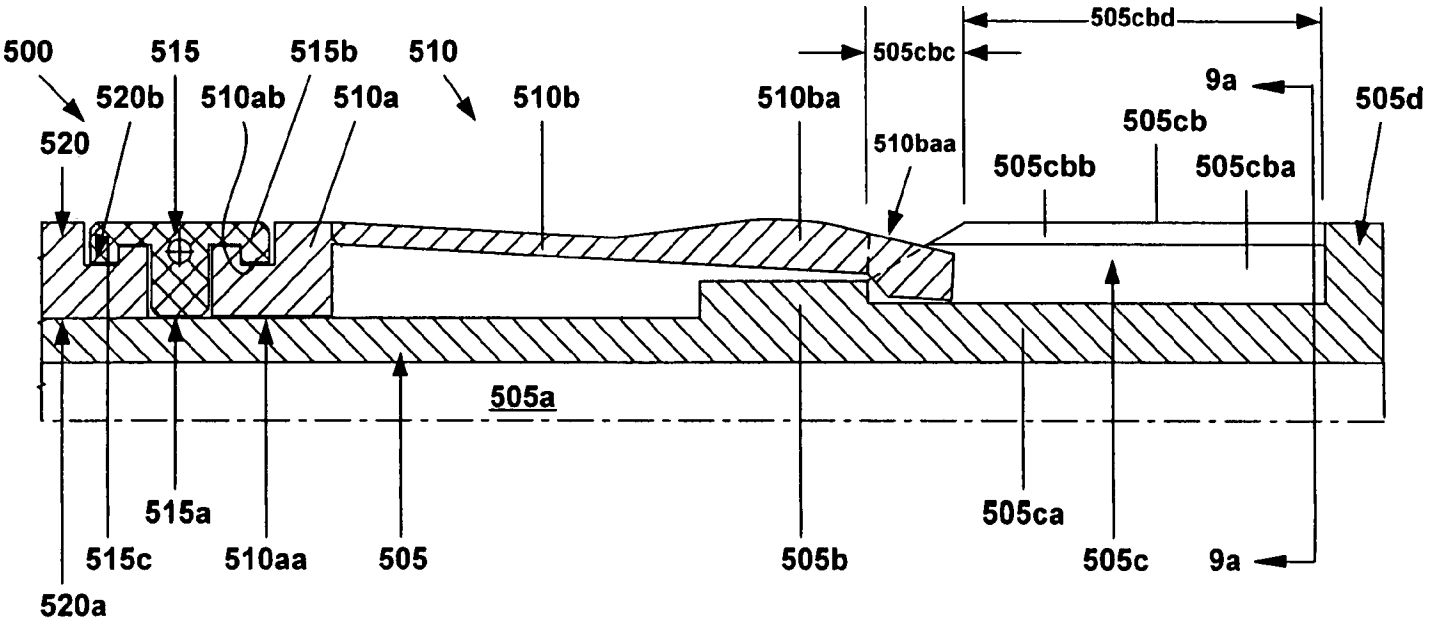
FIG. 9 is a fragmentary cross sectional illustration of an embodiment of an expansion cone assembly in an unexpanded position.
Figure 9A:
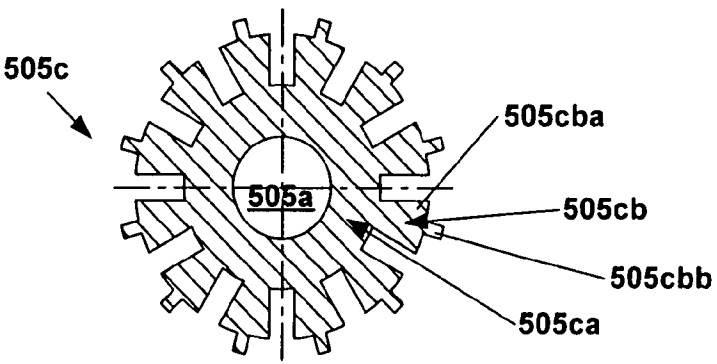
FIG. 9*a* is a cross sectional illustration of the expansion cone assembly of FIG. 9.
Figure 10:
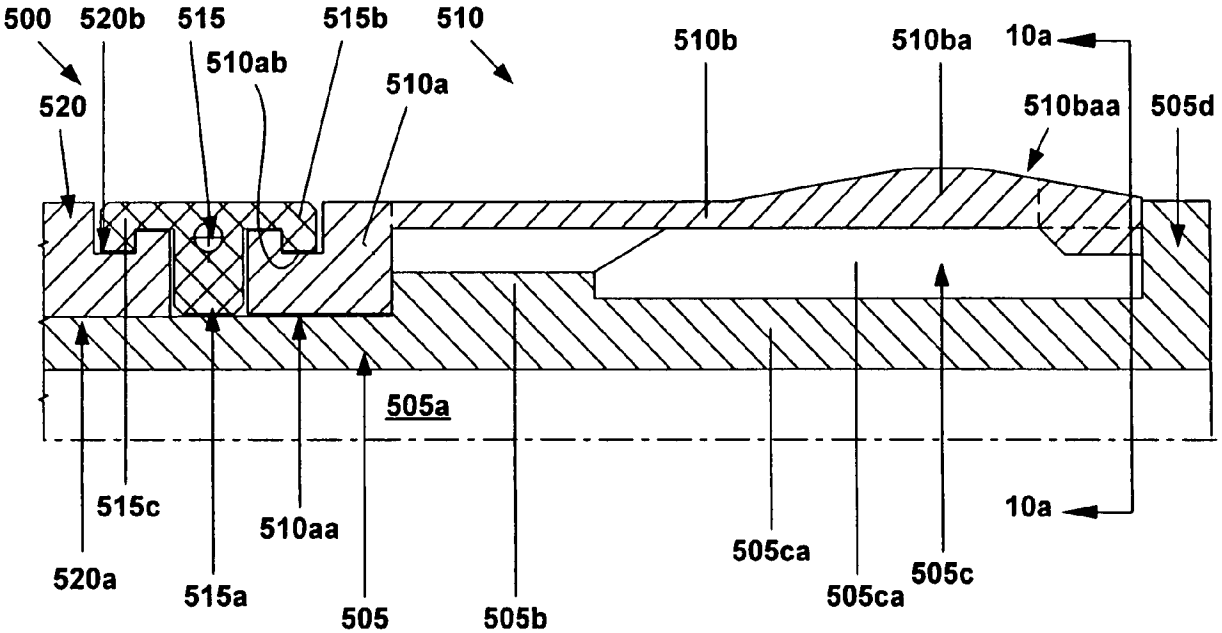
FIG. 10 is a fragmentary cross sectional illustration of the expansion cone assembly of FIG. 9 in an expanded position.
Figure 10A:
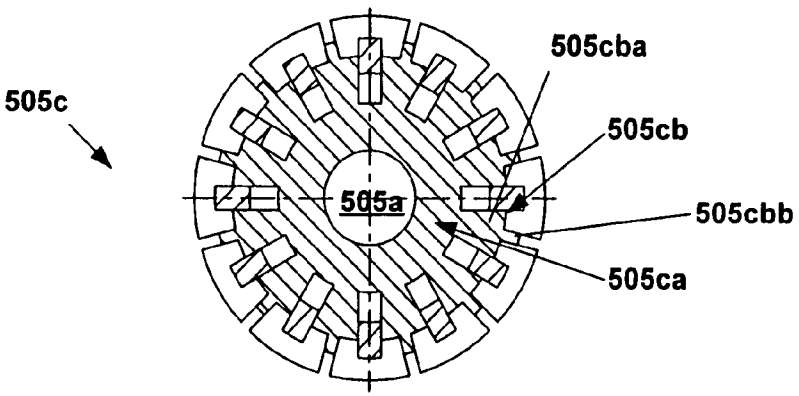
FIG. 10*a* is a cross sectional illustration of the expansion cone assembly of FIG. 10.

During operation of the assembly 500, as illustrated in FIGS. 9 and 9*a*, in an unexpanded position, the expansion cone segments 510*ba* of the expansion cone segment assembly 510 are positioned adjacent to the base of the conical section 505*cbc* of the expansion cone segment support members 505*cb* with the outside diameter of the expansion cone segments less than or equal to the maximum outside diameter of the assembly. As illustrated in FIGS. 10 and 10*a*, the assembly 500 may then be expanded by displacing the tubular sleeve 520, the split ring collar 515, and the expansion cone segment assembly 510 in the axial direction towards the expansion cone segment support members 505*cb*. As a result, the expansion cone segments 510*ba* are driven up the conical section 505*cbc* of the expansion cone segment support members 505*cb* and then onto the cylindrical section 505*cbd* of the expansion cone segment support members until the expansion cone segments impact the end stop 505*d*. In this manner, the outside diameter of the expansion segments 510*ba* is greater than the maximum diameter of the remaining components of the assembly 500. Furthermore, the conical outer surfaces 510*baa* of the expansion cone segments 510*ba* may now be used to radially expand a tubular member. Note that the extensions 505*cbb* of the expansion cone segment support members 505*cb* provide support in the circumferential direction to the adjacent expansion cone segments 510*ba*. In an exemplary embodiment, the outer conical surfaces 510*baa* of the expansion cone segments 510*ba* in the expanded position of the assembly 500 provide a substantially continuous outer conical surfaces in the circumferential direction.

The assembly 500 may then be returned to the unexpanded position by displacing the tubular sleeve 520, the split ring collar 515, and the expansion cone segment assembly 510 in the axial direction away from the expansion cone segment support members 505*cb*. As a result, the expansion cone segments 510*ba* are displaced off of the cylindrical section 505*cbd* and the conical section 505*cbc* of the expansion cone segment support members 505*cb*. Because the collets 510*b* of the expansion cone segment assembly 510 are resilient, the expansion segments 510*ba* are thereby returned to a position in which the outside diameter of the expansion cone segments is less than or equal to the maximum diameter of the remaining components of the assembly 500.

In several alternative embodiments, the assembly 500 is incorporated into the assemblies 200, 300 and/or 400.

Referring now to FIGS. 11, 11*a*, 12 and 12*a*, an embodiment of an adjustable expansion cone assembly 600 will be described. The assembly 600 includes a tubular support member 605 that defines a passage 605*a* and includes an expansion cone support flange assembly 605*b*, and an end stop 605*c*. The expansion cone support flange assembly 605*b* includes a tubular body 605*ba* and a plurality of equally spaced apart expansion cone segment substantially identical support members 605*bb* that extend outwardly from the tubular body in the radial direction. The support members 605*bb* further include first sections 605*bba* having arcuate cylindrical outer surfaces, second sections 605*bbb* having arcuate conical outer surfaces, and third sections 605*bbc* having arcuate cylindrical outer surfaces for reasons to be described.

An expansion cone segment assembly 610 is provided that includes a tubular support 610*a* defining a passage 610*aa* for receiving the tubular support member 605 and a slot 610*ab*. A plurality of spaced apart and substantially identical resilient expansion cone segment collets 610*b* extend from the tubular support 610*a* in the axial direction that include expansion cone segments 610*ba* extending therefrom in the axial direction. Each of the expansion cone segments 610*ba* further include arcuate conical expansion surfaces 610*baa* for radially expanding an expandable tubular member.

A split ring collar 615 is provided that defines a passage 615*a* for receiving the tubular support member 605 that includes an L-shaped retaining member 615*b* at one end for mating with the slot 610*ab* of the tubular support 610*a* of the expansion cone segment assembly 610. Another end of the split ring collar 615 includes an L-shaped retaining member 615*c*. A tubular sleeve 620 is provided that defines a passage 620*a* for receiving the tubular support member 605 that includes a slot 620*b* for receiving the L-shaped retaining member 615*c* of the split ring collar 615.

Figure 11:
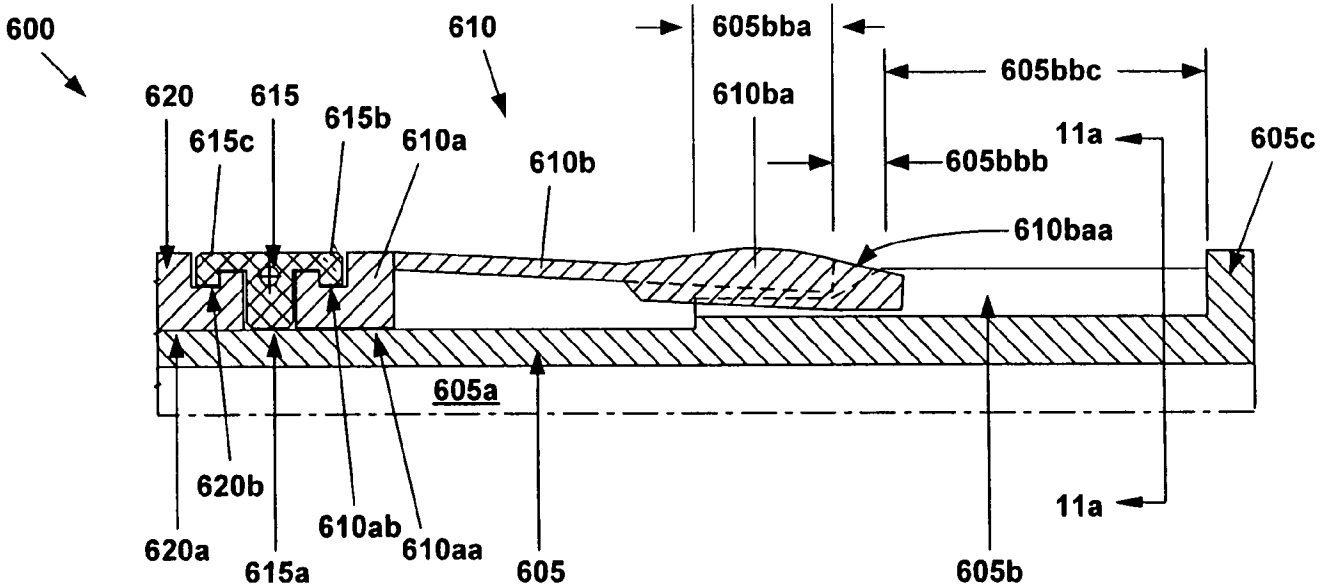
FIG. 11 is a fragmentary cross sectional illustration of an embodiment of an expansion cone assembly in an unexpanded position.
Figure 11A:
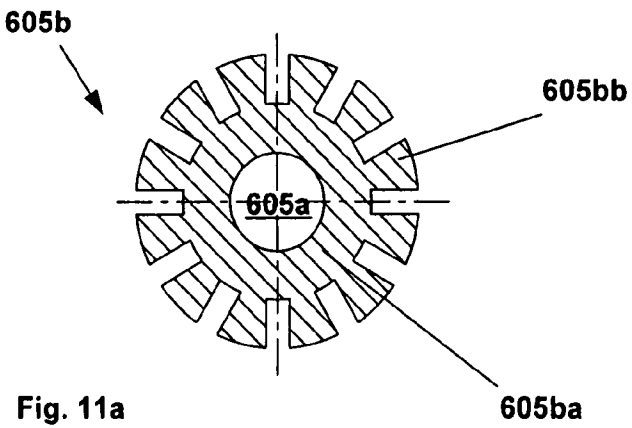
FIG. 11*a* is a cross sectional illustration of the expansion cone assembly of FIG. 11.
Figure 12:
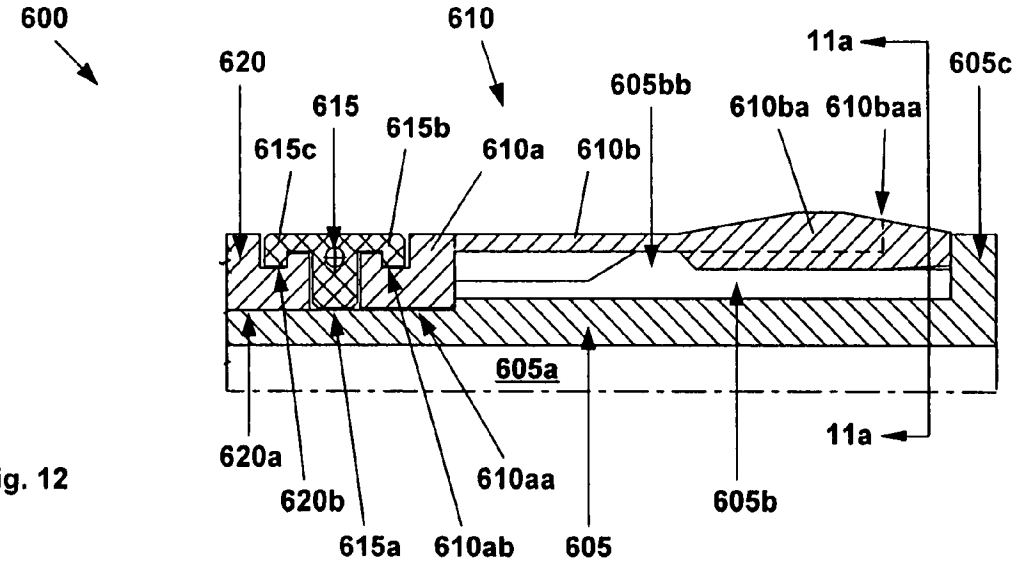
FIG. 12 is a fragmentary cross sectional illustration of the expansion cone assembly of FIG. 11 in an expanded position.
Figure 12A:
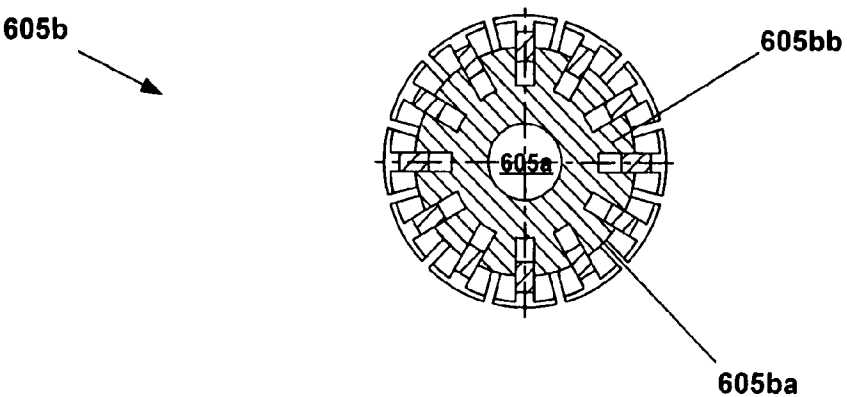
FIG. 12*a* is a cross sectional illustration of the expansion cone assembly of FIG. 12.
Figure 13:
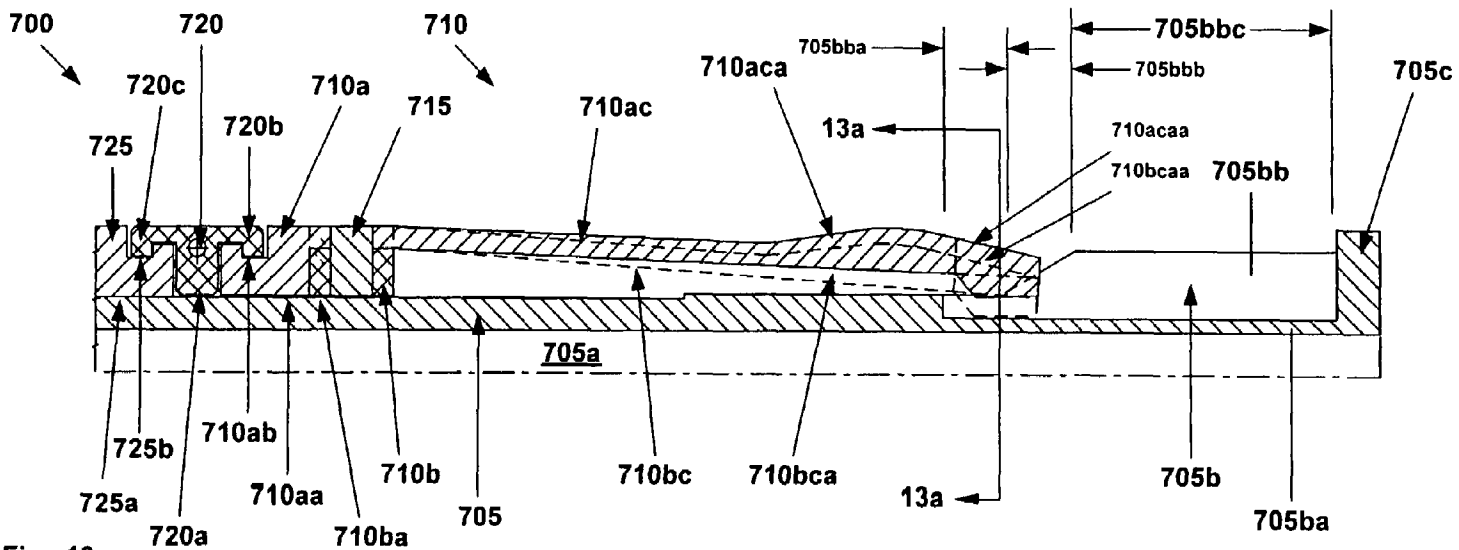
FIG. 13 is a fragmentary cross sectional illustration of an embodiment of an expansion cone assembly in an unexpanded position.
Figure 13A:
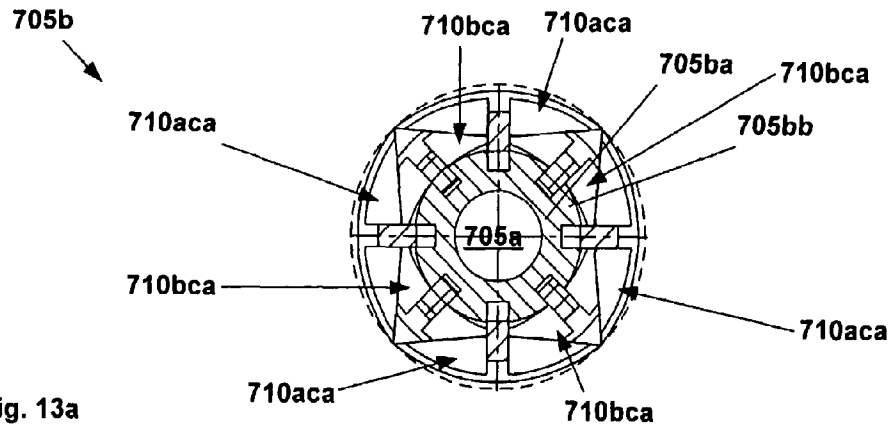
FIG. 13*a* is a cross sectional illustration of the expansion cone assembly of FIG. 13.
Figure 13B:
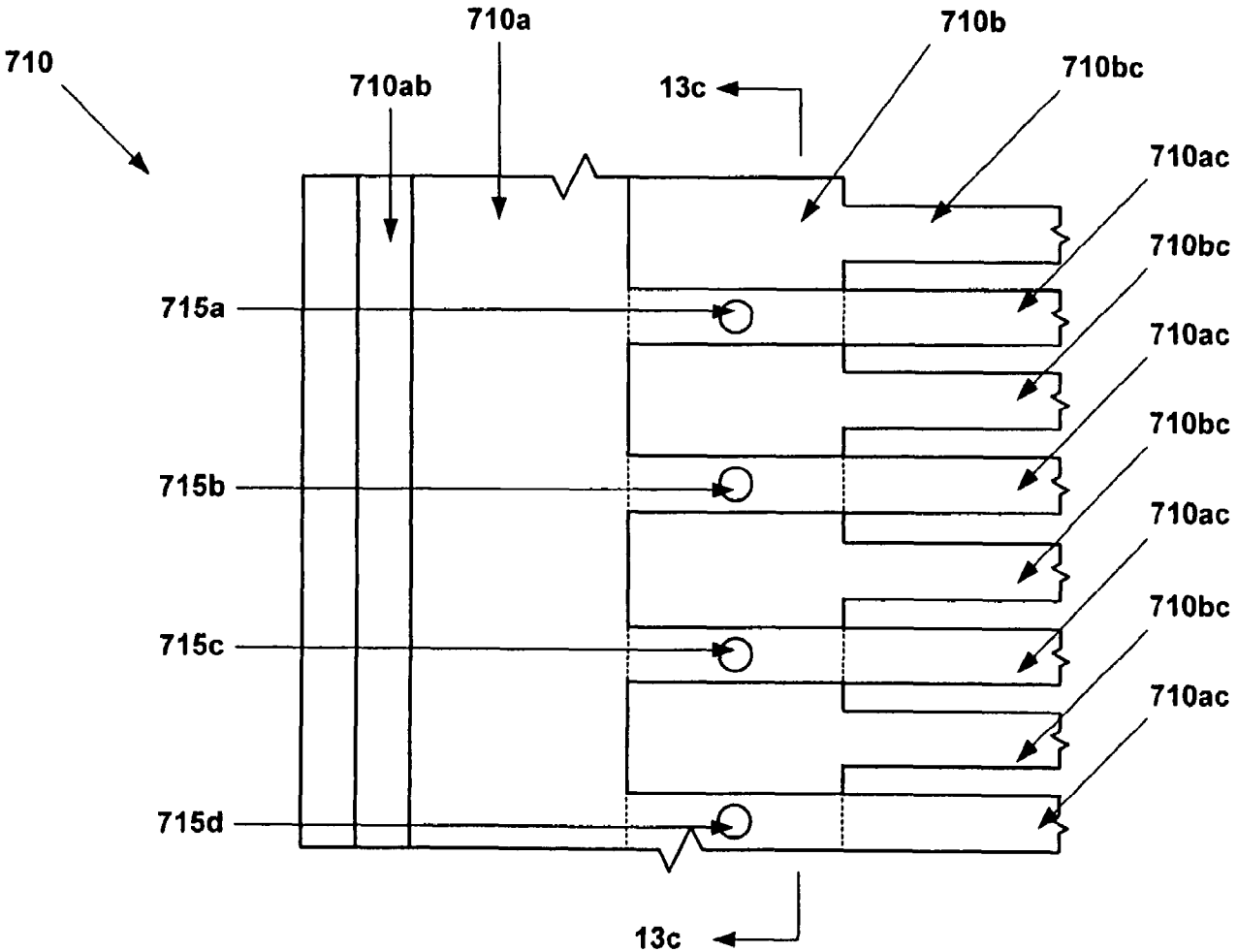
FIG. 13*b* is a fragmentary top circumferential illustration of the expansion cone segment assembly of FIG. 13 that illustrates the interleaved sets of collets.
Figure 13C:
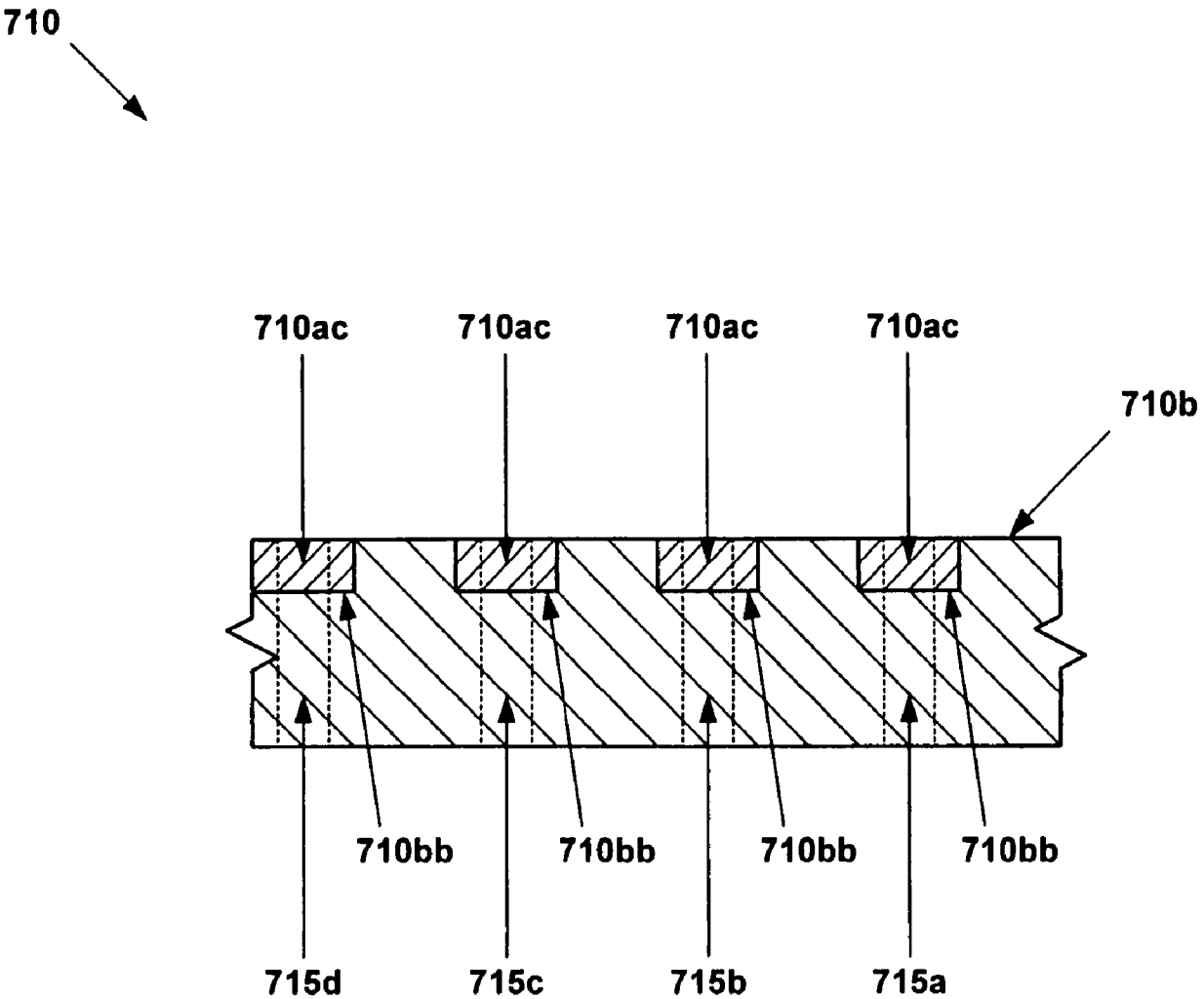
FIG. 13*c* is a fragmentary cross sectional illustration of the interleaved collets of FIG. 13*b*.

During operation of the assembly 600, as illustrated in FIGS. 11 and 11*a*, in an unexpanded position, the expansion cone segments 610*ba* of the expansion cone segment assembly 610 are positioned on the cylindrical section 605*bba*, adjacent to the base of the conical section 605*bbb*, of the expansion cone segment support members 605*bb* with the outside diameter of the expansion cone segments less than or equal to the maximum outside diameter of the assembly. As illustrated in FIGS. 12 and 12*a*, the assembly 600 may then be expanded by displacing the tubular sleeve 620, the split ring collar 615, and the expansion cone segment assembly 610 in the axial direction towards the expansion cone segment support members 605*bb*. As a result, the expansion cone segments 610*ba* are driven up the conical section 605*bbb* of the expansion cone segment support members 605*bb* and then onto the cylindrical section 605*bbc* of the expansion cone segment support members until the expansion cone segments impact the end stop 605*c*. In this manner, the outside diameter of the expansion segments 610*ba* is greater than the maximum diameter of the remaining components of the assembly 600. Furthermore, the conical outer surfaces 610*baa* of the expansion cone segments 610*ba* may now be used to radially expand a tubular member. In an exemplary embodiment, the outer conical surfaces 610*baa* of the expansion cone segments 610*ba* in the expanded position of the assembly 600 provide a substantially continuous outer conical surfaces in the circumferential direction.

The assembly 600 may then be returned to the unexpanded position by displacing the tubular sleeve 620, the split ring collar 615, and the expansion cone segment assembly 610 in the axial direction away from the expansion cone segment support members 605*bb*. As a result, the expansion cone segments 610*ba* are displaced off of the cylindrical section 605*bbc* and the conical section 605*bbb* and back onto the cylindrical section 605*bba* of the expansion cone segment support members 605*bb*. Because the collets 610*b* of the expansion cone segment assembly 610 are resilient, the expansion segments 610*ba* are thereby returned to a position in which the outside diameter of the expansion cone segments is less than or equal to the maximum diameter of the remaining components of the assembly 600.

In several alternative embodiments, the assembly 600 is incorporated into the assemblies 200, 300 and/or 400.

Referring now to FIGS. 13, 13*a*, 13*b*, 13*c*, 14 and 14*a*, an embodiment of an adjustable expansion cone assembly 700 will be described. The assembly 700 includes a tubular support member 705 that defines a passage 705*a* and includes an expansion cone support flange assembly 705*b*, and an end stop 705*c*. The expansion cone support flange assembly 705*b* includes a tubular body 705*ba* and a plurality of equally spaced apart expansion cone segment substantially identical support members 705*bb* that extend outwardly from the tubular body in the radial direction. The support members 705*bb* further include first sections 705*bba* having arcuate cylindrical outer surfaces, second sections 705*bbb* having arcuate conical outer surfaces, and third sections 705*bbc* having arcuate cylindrical outer surfaces for reasons to be described.

An expansion cone segment assembly 710 is provided that includes a first tubular support 710*a* defining a passage 710*aa* for receiving the tubular support member 705 that includes a slot 710*ab* and a second tubular support 710*b* defining a passage 710*ba* for receiving the tubular support member 705 that includes a plurality of spaced apart and substantially identical axial slots 710*bb*. A plurality of spaced apart and substantially identical resilient expansion cone segment collets 710*ac* extend from the first tubular support 710*a* in the axial direction and are received within corresponding ones of the axial slots 710*bb* in the second tubular support 710*b* that include substantially identical expansion cone segments 710*aca* extending therefrom in the axial direction. A plurality of spaced apart and substantially identical resilient expansion cone segment collets 710*bc* extend from the second tubular support 710*b* in the axial direction that are interleaved and overlap with the expansion cone segment collets 710*ac* and that include substantially identical expansion cone segments 710*bca* extending therefrom in the axial direction. Each of the expansion cone segments, 710*aca* and 710*bca*, further include arcuate conical expansion surfaces, 710*acaa* and 710*bcaa*, respectively, for radially expanding an expandable tubular member. A plurality of pins 715*a*-715*d* couple the expansion cone segment collets 710*ac* to the second tubular support 710*b*.

A split ring collar 720 is provided that defines a passage 720*a* for receiving the tubular support member 705 that includes an L-shaped retaining member 720*b* at one end for mating with the slot 710*ab* of the first tubular support 710*a* of the expansion cone segment assembly 710. Another end of the split ring collar 720 includes an L-shaped retaining member 720*c*. A tubular sleeve 725 is provided that defines a passage 725*a* for receiving the tubular support member 705 that includes a slot 725*b* for receiving the L-shaped retaining member 720*c* of the split ring collar 720.

Figure 14:
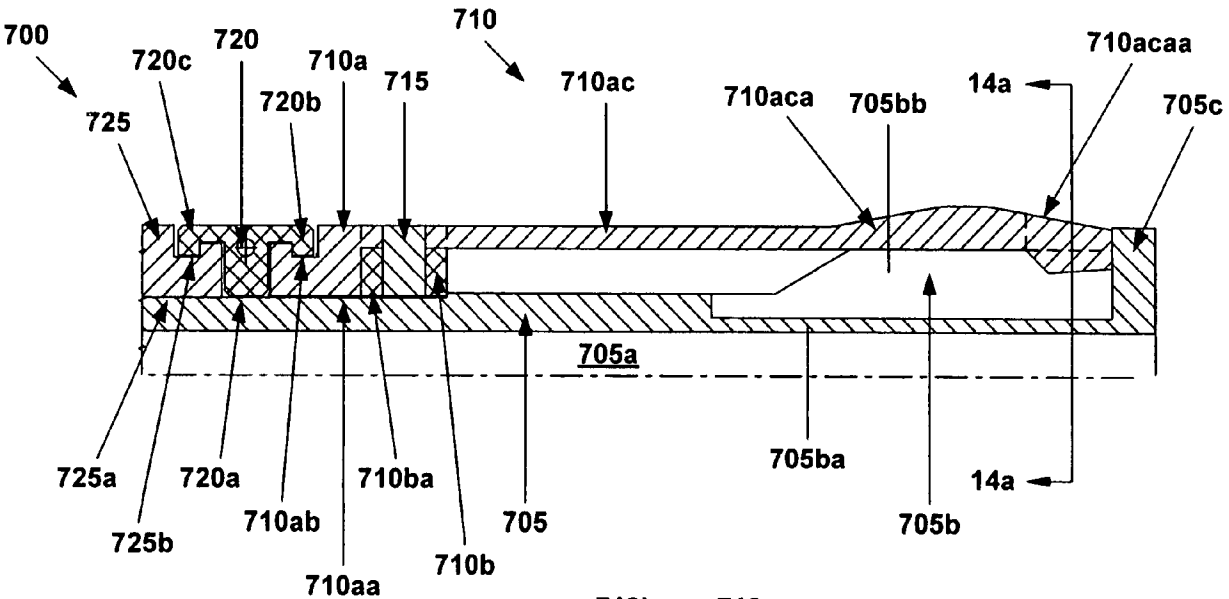
FIG. 14 is a fragmentary cross sectional illustration of the expansion cone assembly of FIG. 13 in an expanded position.
Figure 14A:
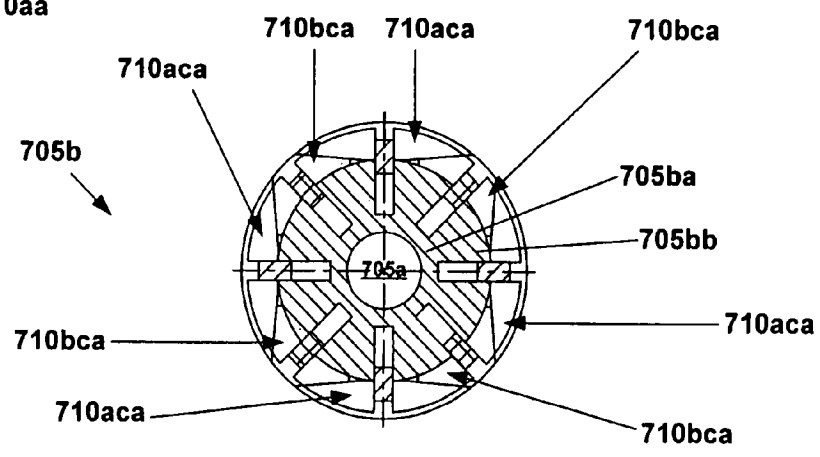
FIG. 14*a* is a cross sectional illustration of the expansion cone assembly of FIG. 14.

During operation of the assembly 700, as illustrated in FIGS. 13, 13*a*, 13*b*, and 13*c*, in an unexpanded position, the expansion cone segments 710*aca* of the expansion cone segment assembly 710 overlap with and are positioned over the expansion cone segments 710*bca* of the expansion cone segment assembly, adjacent to the base of the conical section 705*bbb*, of the expansion cone segment support members 705*bb* with the outside diameter of the expansion cone segments less than or equal to the maximum outside diameter of the assembly. As illustrated in FIGS. 14 and 14*a*, the assembly 700 may then be expanded by displacing the tubular sleeve 725, the split ring collar 720, and the expansion cone segment assembly 710 in the axial direction towards the expansion cone segment support members 705*bb*. As a result, the expansion cone segments, 710*aca* and 710*bca*, are driven up the conical section 705*bbb* of the expansion cone segment support members 705*bb* and then onto the cylindrical section 705*bbc* of the expansion cone segment support members until the expansion cone segments impact the end stop 705*c*. In this manner, the outside diameter of the expansion segments, 710*aca* and 710*bca*, is greater than the maximum diameter of the remaining components of the assembly 700. Furthermore, the conical outer surfaces, 710*acaa* and 710*bcaa*, of the expansion cone segments, 710*aca* and 710*bca*, respectively, may now be used to radially expand a tubular member. In an exemplary embodiment, the outer conical surfaces, 710*acaa* and 710*bcaa*, of the expansion cone segments, 710*aca* and 710*bca*, respectively, in the expanded position of the assembly 700 provide a substantially continuous outer conical surfaces in the circumferential direction.

The assembly 700 may then be returned to the unexpanded position by displacing the tubular sleeve 720, the split ring collar 715, and the expansion cone segment assembly 710 in the axial direction away from the expansion cone segment support members 705*bb*. As a result, the expansion cone segments, 710*aca* and 710*bca*, are displaced off of the cylindrical section 705*bbc* and the conical section 705*bbb* and back onto the cylindrical section 705*bba* of the expansion cone segment support members 705*bb*. Because the collets, 710*ac* and 710*bc*, of the expansion cone segment assembly 710 are resilient, the expansion segments, 710*aca* and 710*bca*, are thereby returned to a position in which the outside diameter of the expansion cone segments is less than or equal to the maximum diameter of the remaining components of the assembly 700.

In several alternative embodiments, the assembly 700 is incorporated into the assemblies 200, 300 and/or 400.

Referring to FIGS. 15 and 15*a*-15*j*, an alternative embodiment of an apparatus 800 for forming a wellbore casing in a subterranean formation will now be described. The apparatus 800 includes a tubular support member 805 defining an internal passage 805*a* that is coupled to an end of a tubular coupling 810 defining an internal passage 810*a*. The other end of the tubular coupling 810 is coupled to an end of a tubular support member 815 defining an internal passage 815*a* having a throat passage 815*aa* that includes a first radial passage 815*b*, a first flange 815*c* having a second radial passage 815*d*, a second flange 815*e* having opposite shoulders, 815*ea* and 815*eb*, a third flange 815*f*, and an expansion cone support body 815*g*. The other end of the tubular support member 815 is coupled to a tubular end stop 820 that defines a passage 820*a*.

Figure 15:
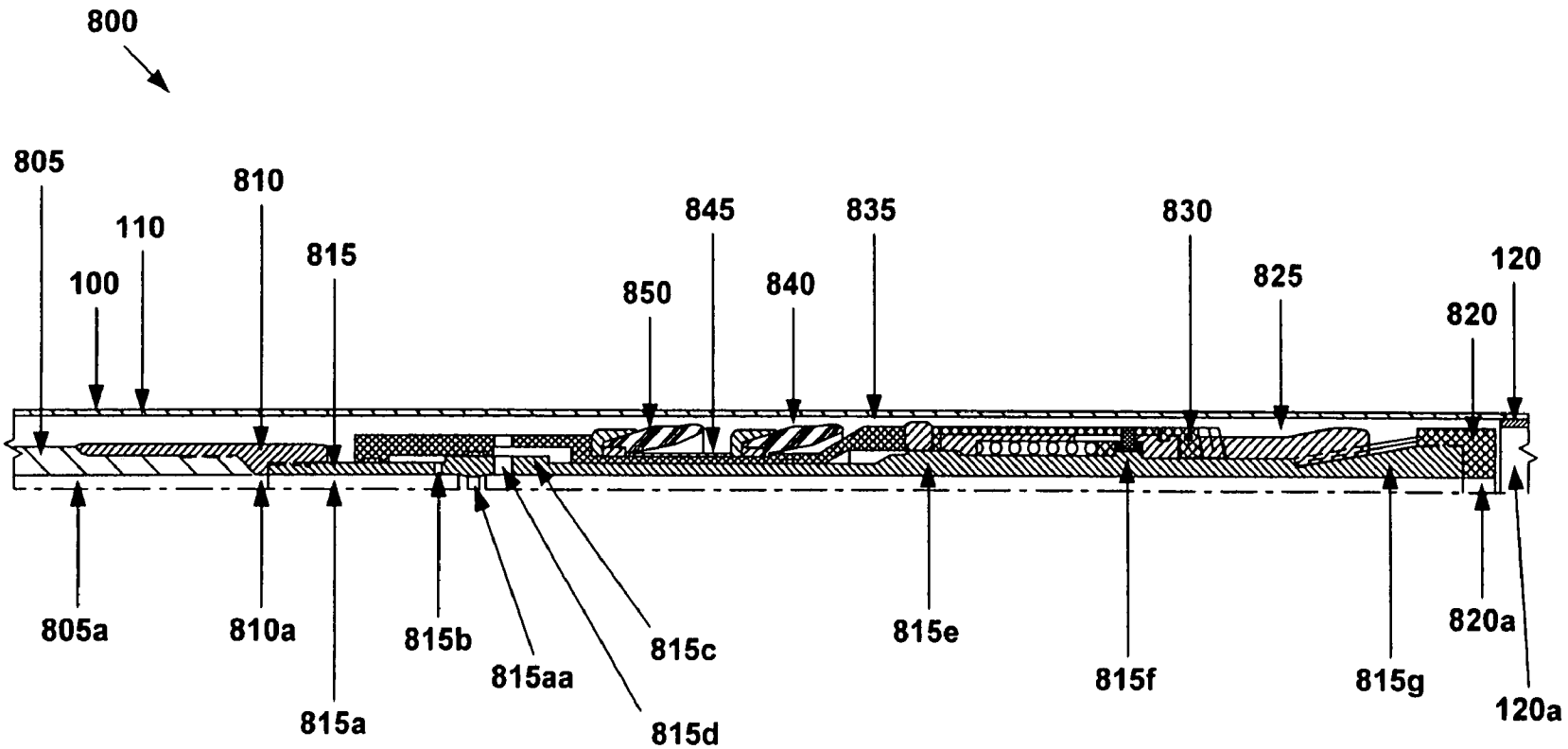
FIGS. 15 and 15*a*-15*c* are fragmentary cross-sectional illustrations of an embodiment of the placement of an apparatus for radially expanding a tubular member within a borehole within a subterranean formation.
Figure 15A:
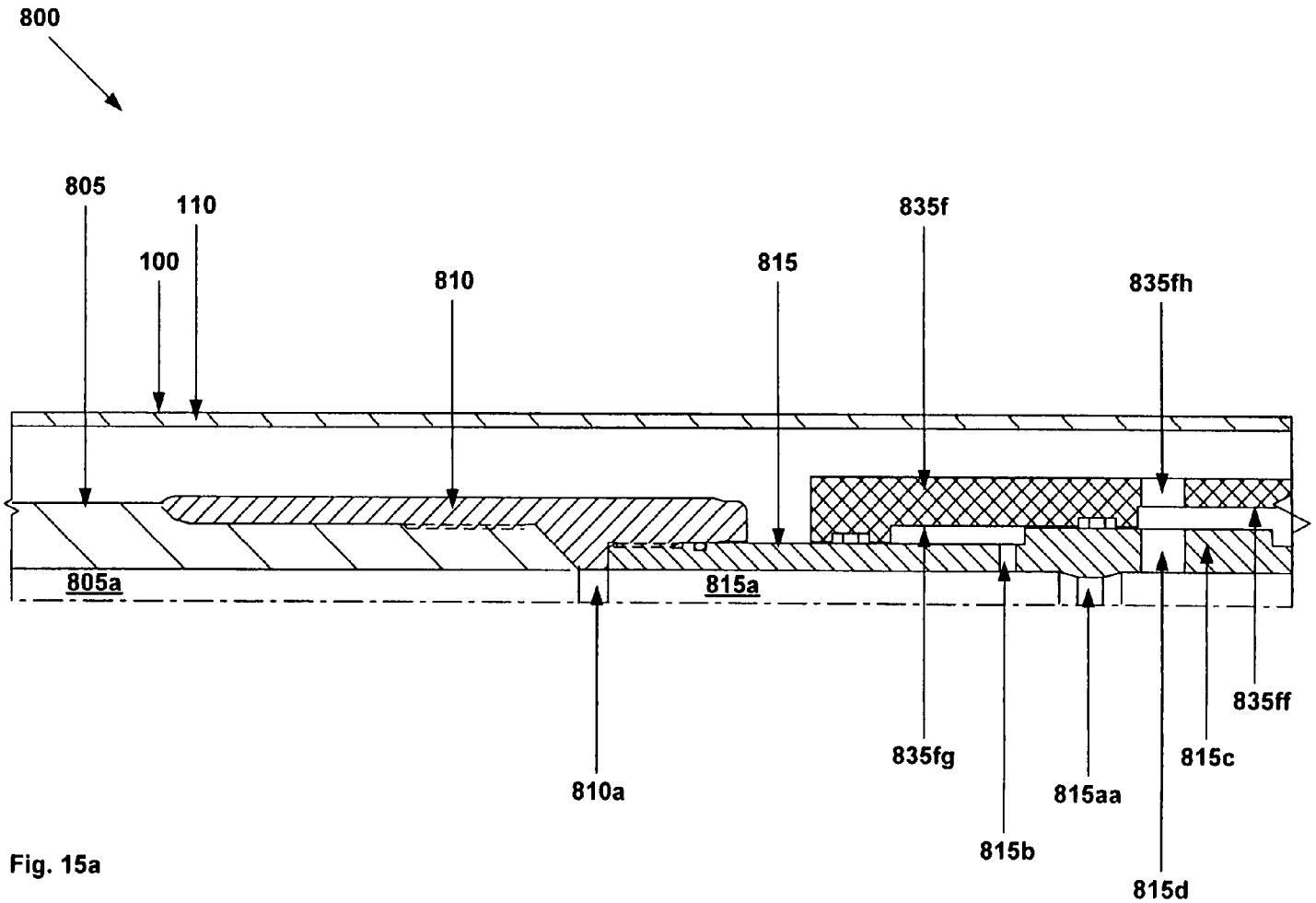
Figure 15B:
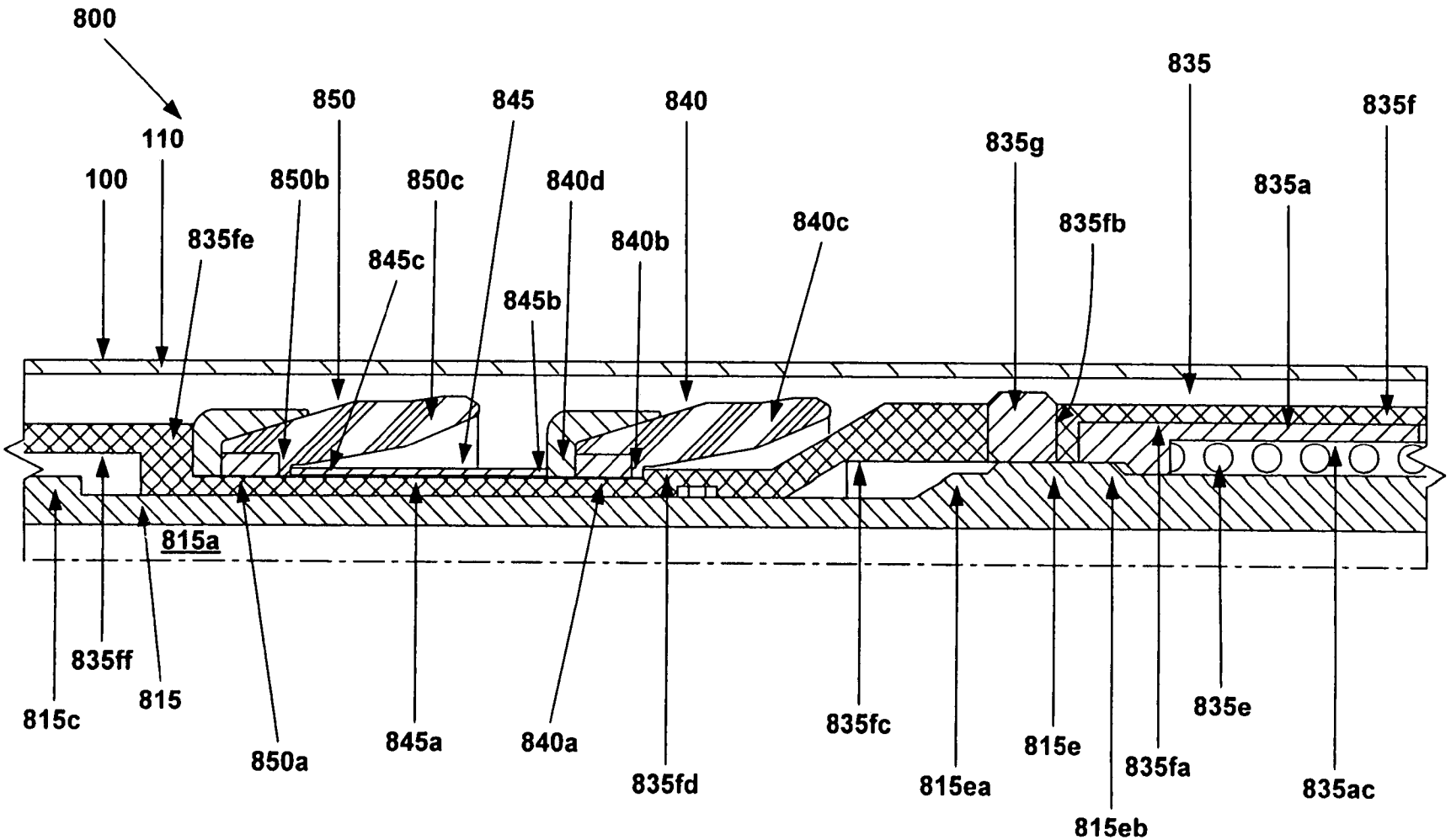
Figure 15C:
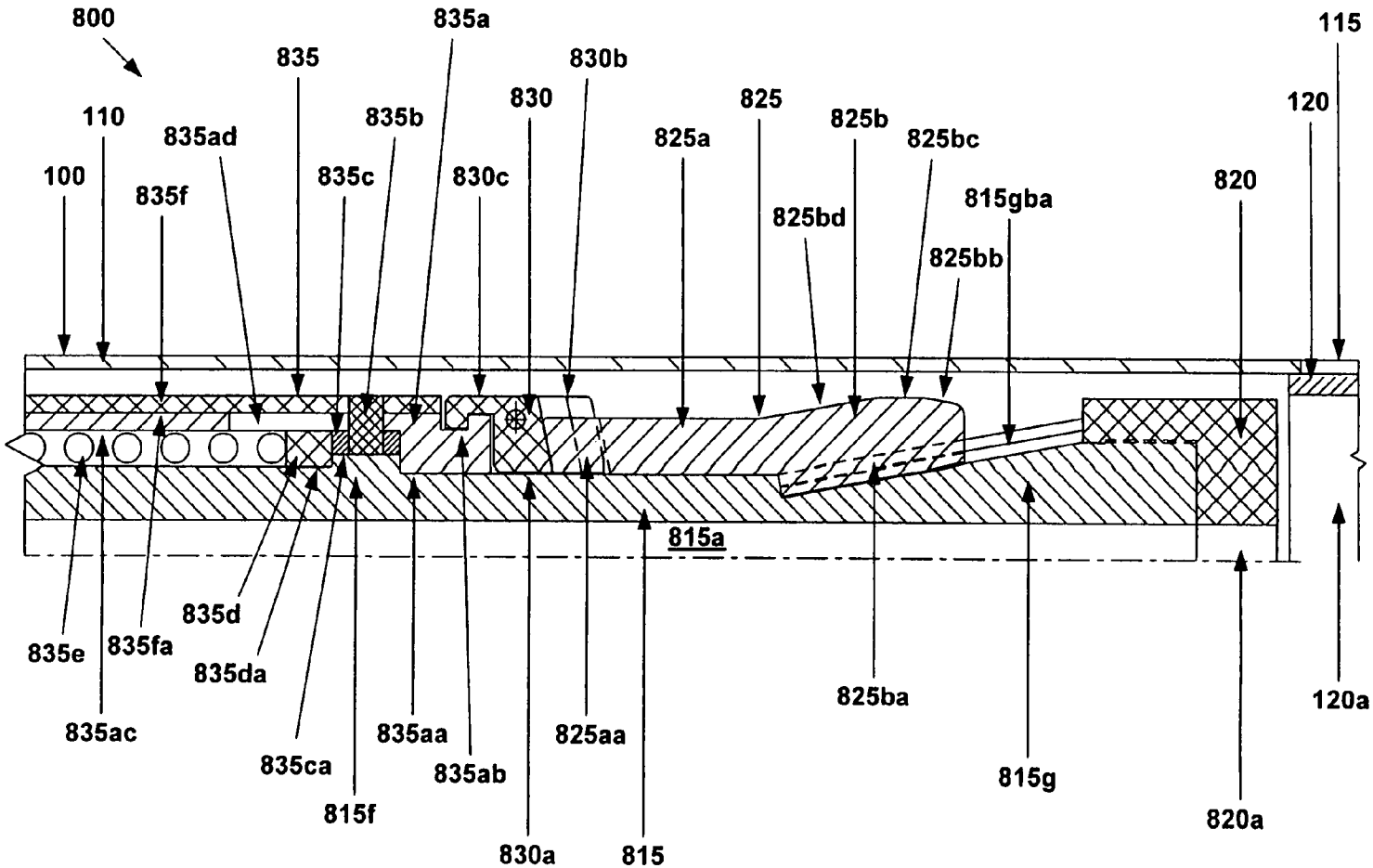
Figure 15E:
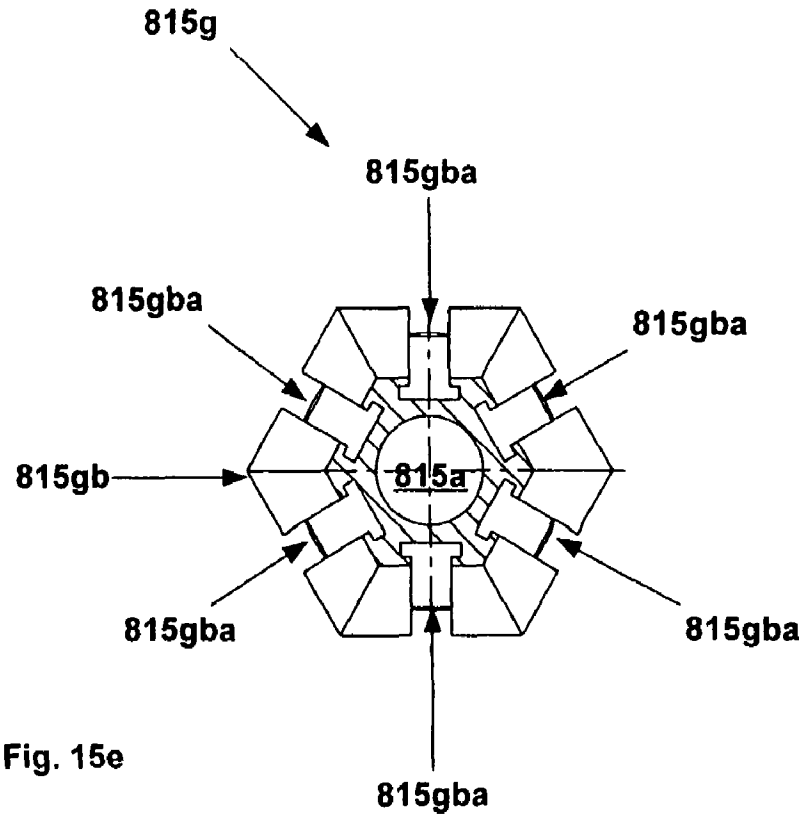
FIG. 15*e* is a cross-sectional view of the expansion cone support body of FIG. 15*d*.
Figure 15D:
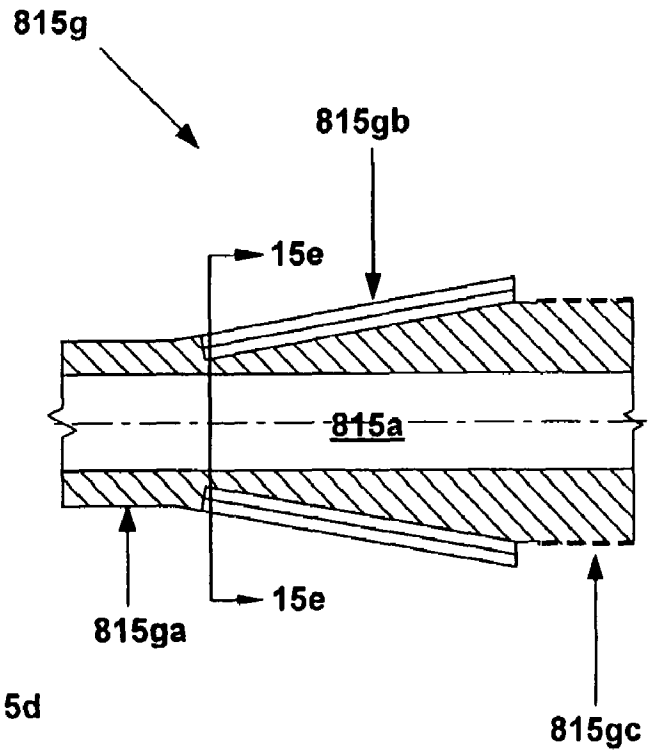
FIG. 15*d* is a cross-sectional view of an embodiment of the expansion cone support body of the apparatus of FIGS. 15 and 15*a*-15*c*.
Figure 15G:
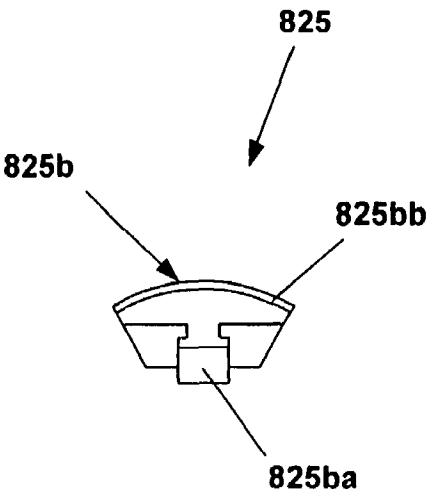
FIG. 15*g* is a front view of the expansion cone segment of FIG. 15*f*.
Figure 15F:
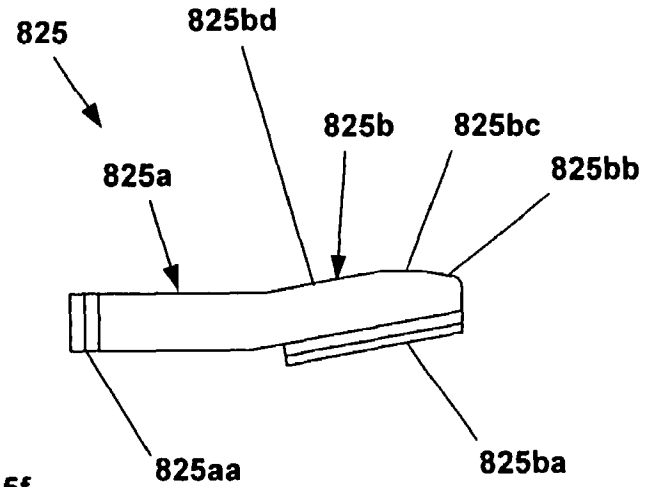
FIG. 15*f* is a side view of an embodiment of an expansion cone segment for use in the apparatus of FIGS. 15 and 15*a*-15*c*.
Figure 15H:
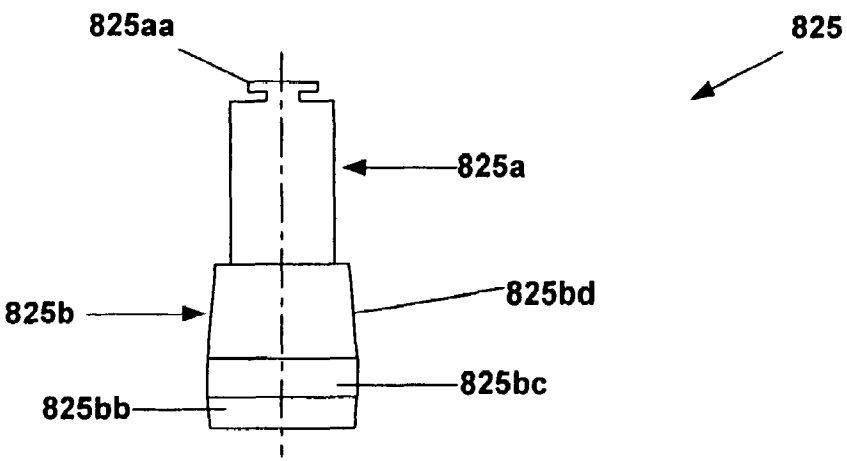
FIG. 15*h* is a top view of the expansion cone segment of FIG. 15*f*.

As illustrated in FIGS. 15*d* and 15*e*, the expansion cone support body 815*g* includes a first end 815*ga*, a tapered hexagonal portion 815*gb* that includes a plurality of T-shaped slots 815*gba* provided on each of the external faceted surfaces of the tapered hexagonal portion, and a second end 815*gc*. In an exemplary embodiment, the angle of attack of the tapered hexagonal portion 815*gb* ranges from about 35 to 50 degrees for reasons to be described.

As illustrated in FIGS. 15, 15*a*-15*c*, and 15*f*-15*j*, a plurality of expansion cone segments 825 are provided that include first ends 825*a* that include T-shaped retaining members 825*aa* and second ends 825*b* that include T-shaped retaining members 825*ba* that mate with and are received within corresponding T-shaped slots 815*gba* on the tapered hexagonal portion 815*gb* of the expansion cone support body 815*g*, first external surfaces 825*bb*, second external surfaces 825*bc*, and third external surfaces 825*bd*. Thus, in an exemplary embodiment, a total of six expansion cone segments 825 are provided that are slidably coupled to corresponding sides of the tapered hexagonal portion 815*gb* of the expansion cone support body 815*g*.

In an exemplary embodiment, the widths of the first external surfaces 825*bb* of the expansion cone segments 825 increase in the direction of the second external surfaces 825*bc*, the widths of the second external surfaces are substantially constant, and the widths of the third external surfaces 825*bd* decrease in the direction of the first ends 825*a* of the expansion cone segments for reasons to be described. In an exemplary embodiment, the first external surfaces 825*bb* of the expansion cone segments 825 taper upwardly in the direction of the second external surfaces 825*bc*, the second external surfaces taper upwardly in the direction of the third external surfaces 825*bd*, and the third external surfaces 825*bd* taper downwardly in the direction of the first ends 825*a* of the expansion cone segments for reasons to be described. In an exemplary embodiment, the angle of attack of the taper of the first external surfaces 825*bb* of the expansion cone segments 825 are greater than the angle of attack of the taper of the second external surfaces 825*bc*. In an exemplary embodiment, the first and second external surfaces, 825*bb* and 825*bc*, of the expansion cone segments 825 are arcuate such that when the expansion cone segments 825 are displaced in the direction of the end stop 420, the first and second external surfaces of the expansion cone segments provide a substantially continuous outer circumferential surface for reasons to be described.

Figure 15I:
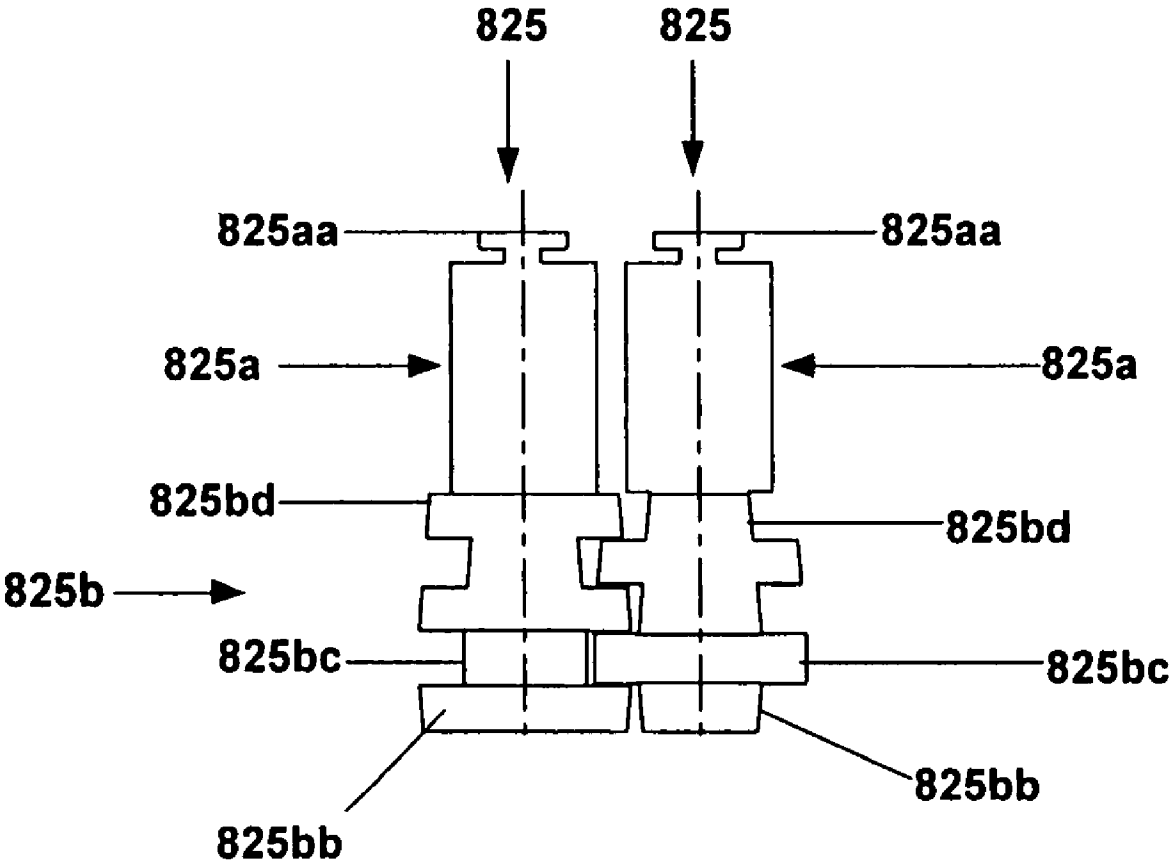
FIG. 15*i* is a top view of an embodiment of interlocking expansion cone segments for use in the apparatus of FIGS. 15 and 15*a*-15*c*.
Figure 15J:
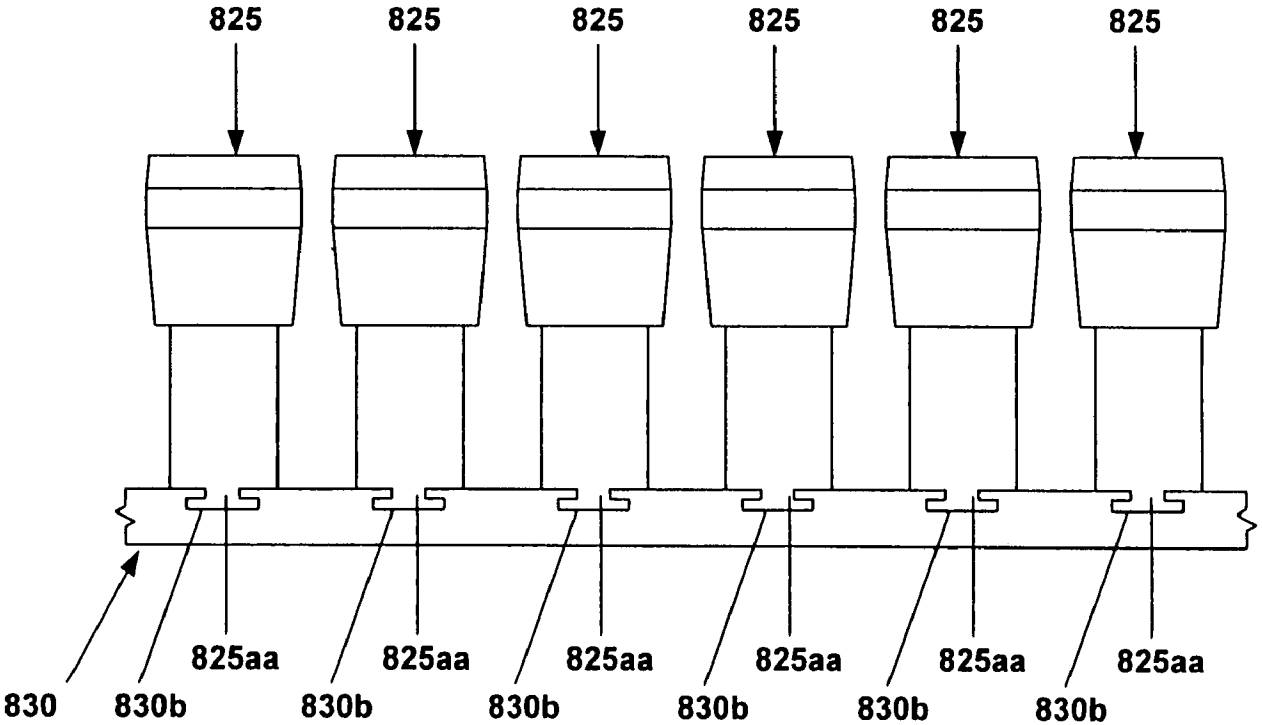
FIG. 15*j* is a top fragmentary circumferential view of an embodiment of the coupling arrangement between the expansion cone segments and the split ring collar for use in the apparatus of FIGS. 15 and 15*a*-15*c*.
Figure 16:
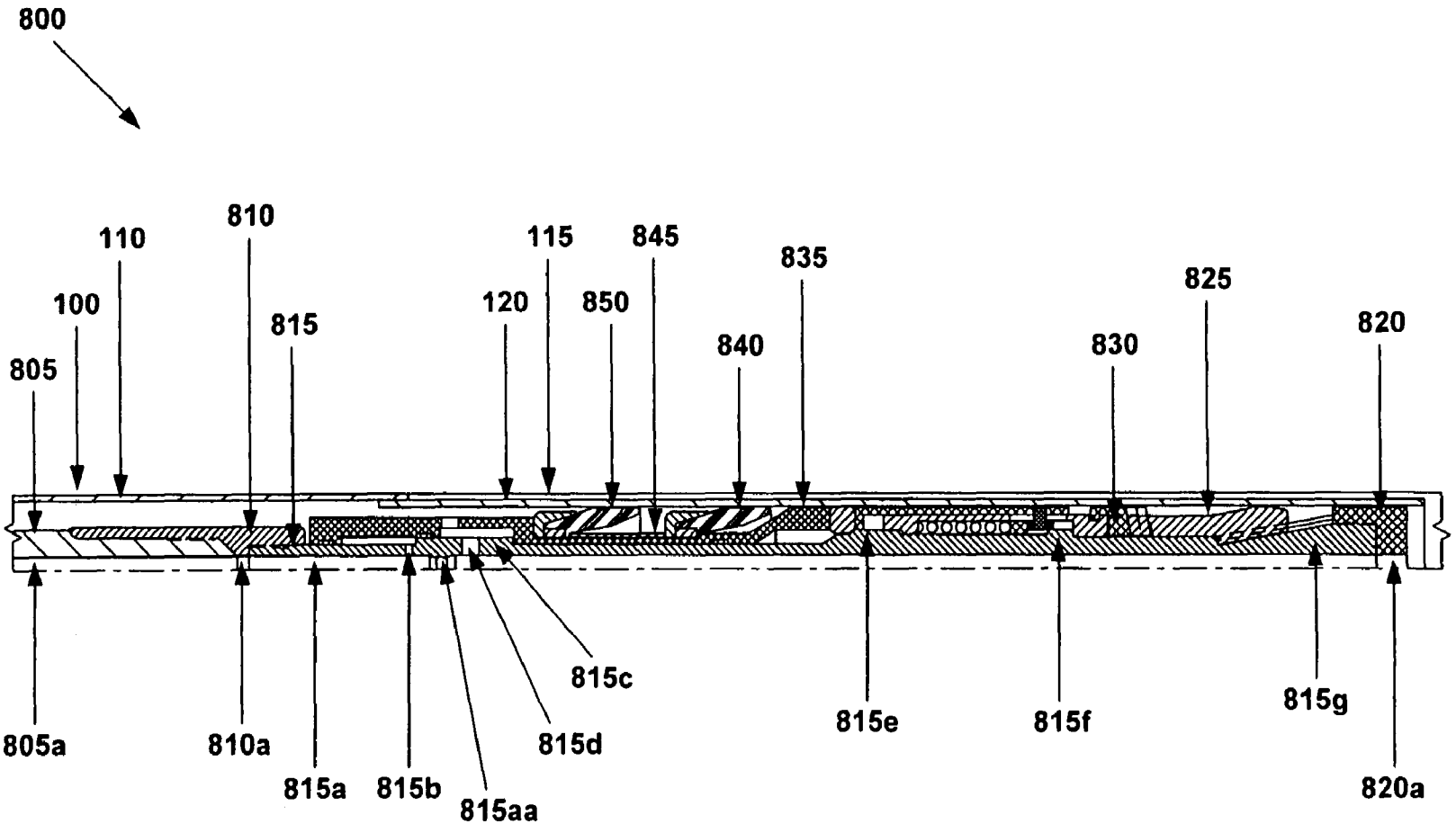
FIGS. 16 and 16*a*-16*c* are fragmentary cross-sectional illustrations of an embodiment of the placement of the apparatus of FIGS. 15 and 15*a*-15*j* including an expandable tubular member within a borehole within a subterranean formation.
Figure 16A:
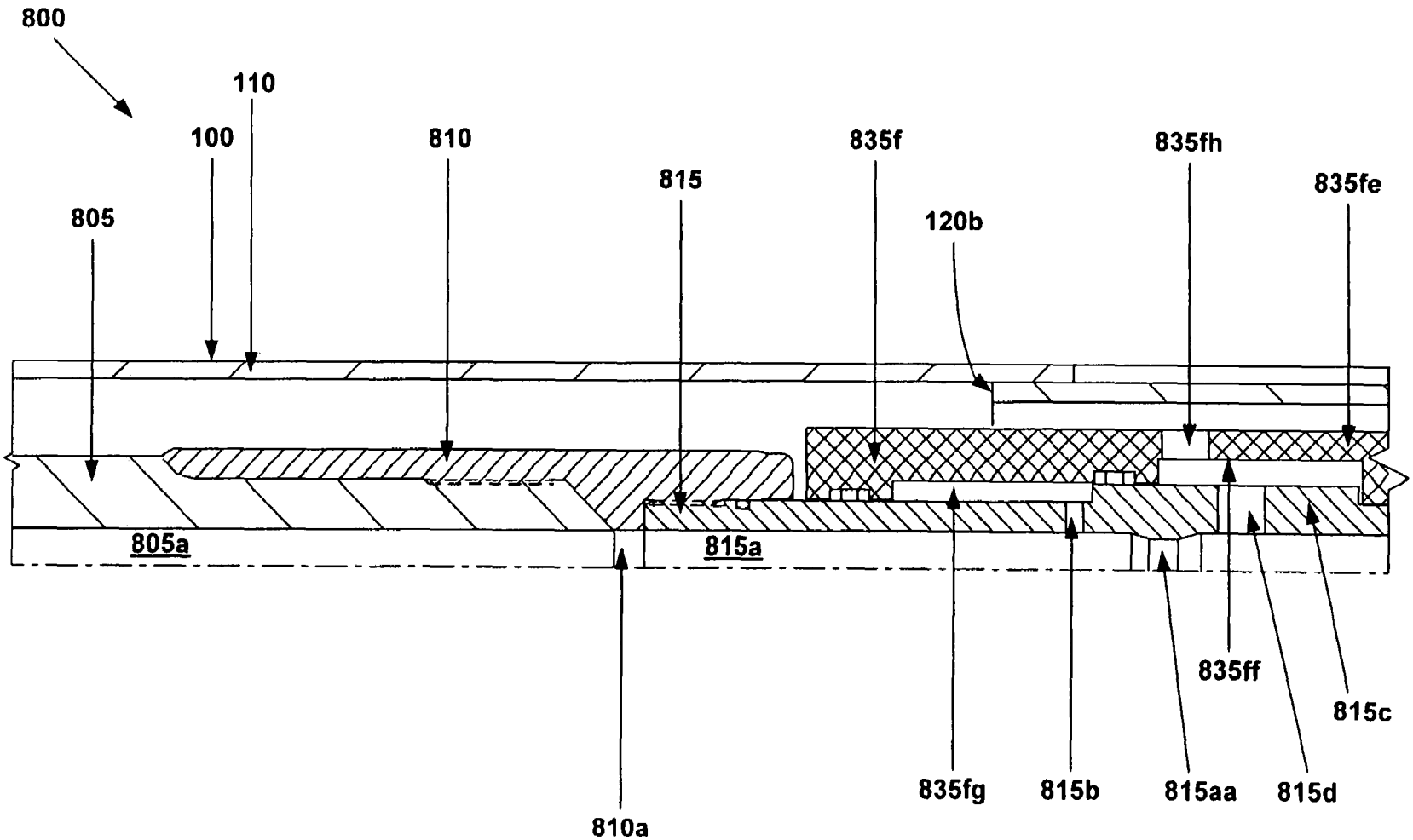
Figure 16B:
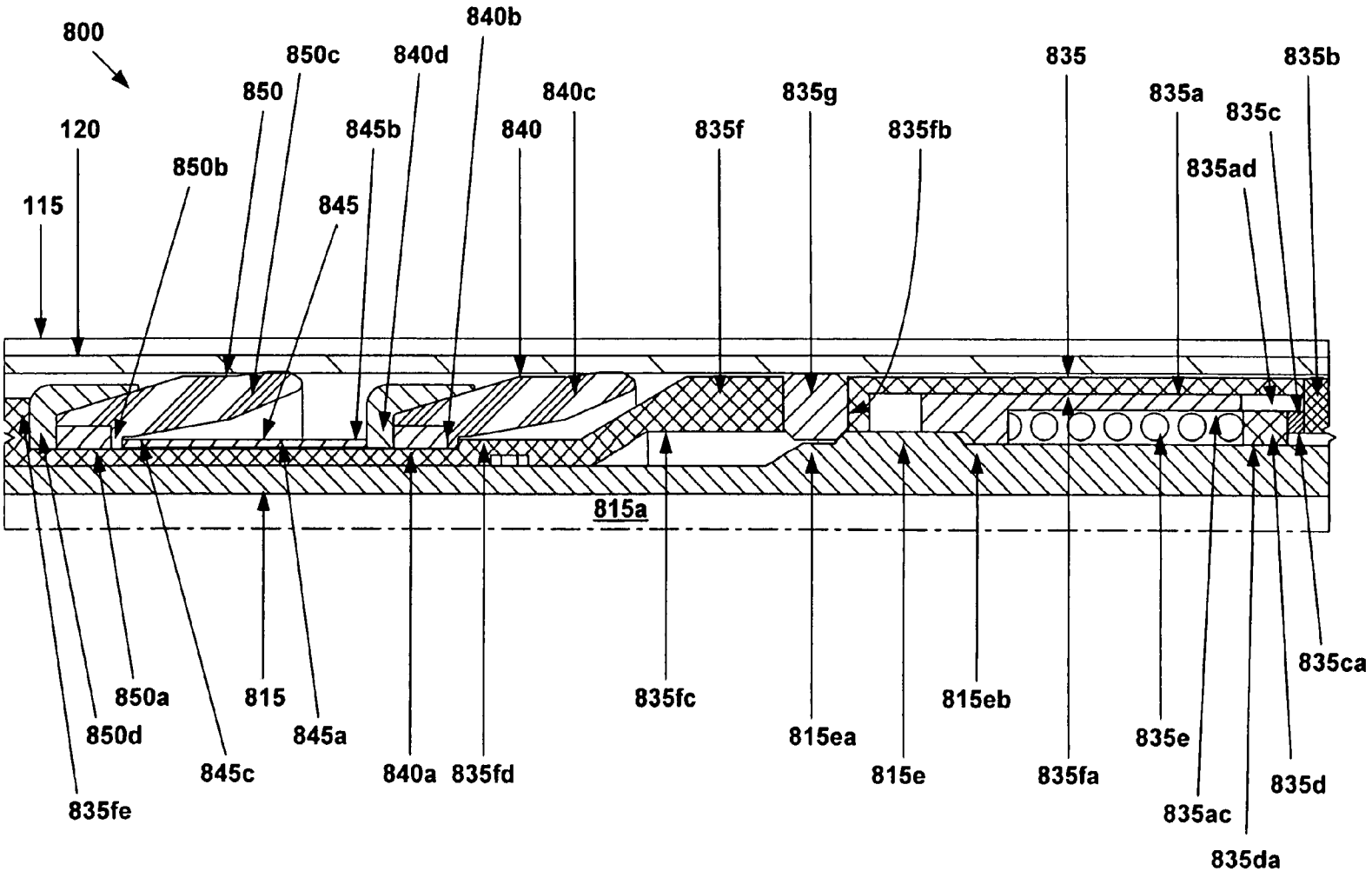
Figure 16C:
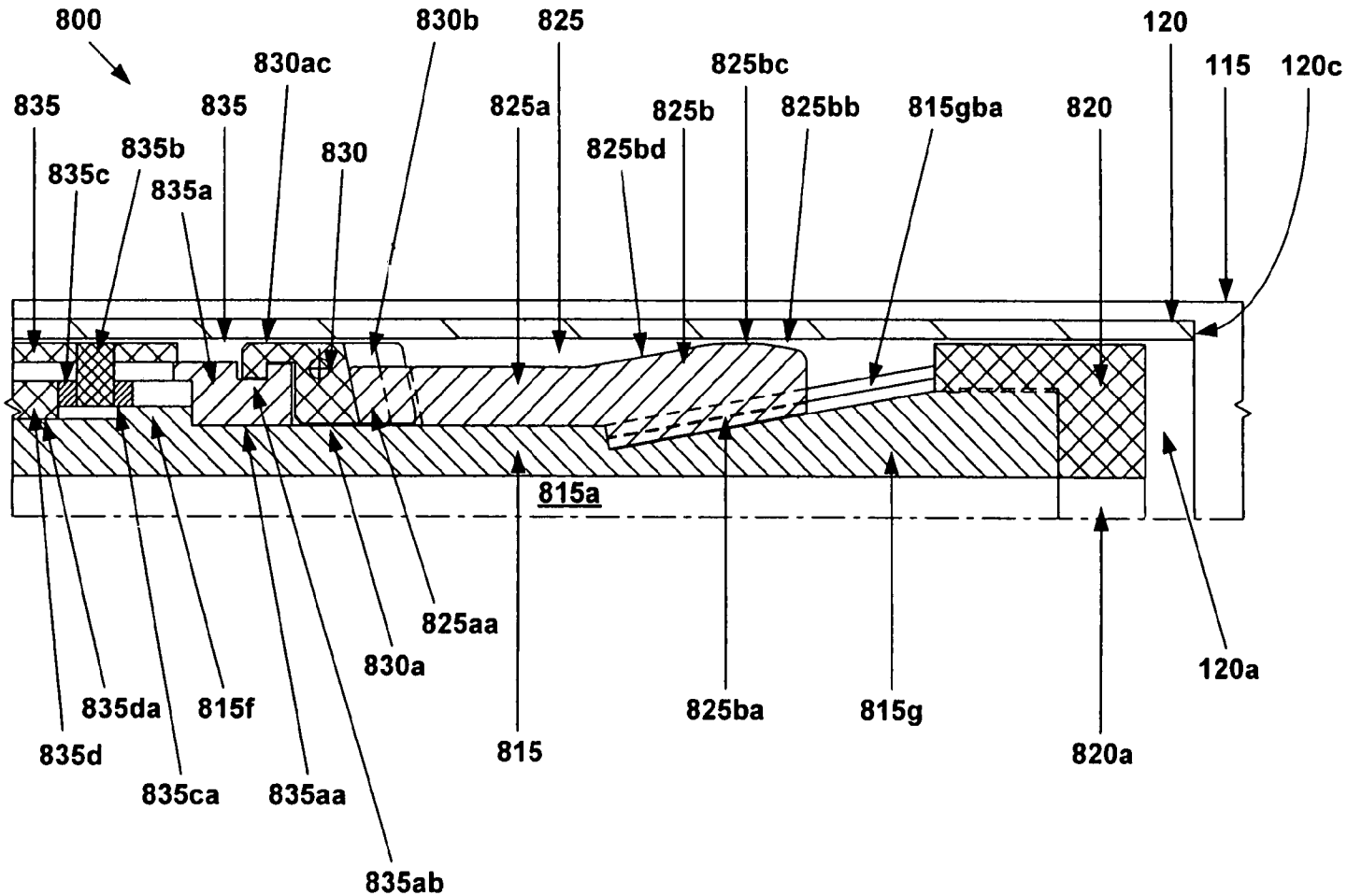
Figure 17:
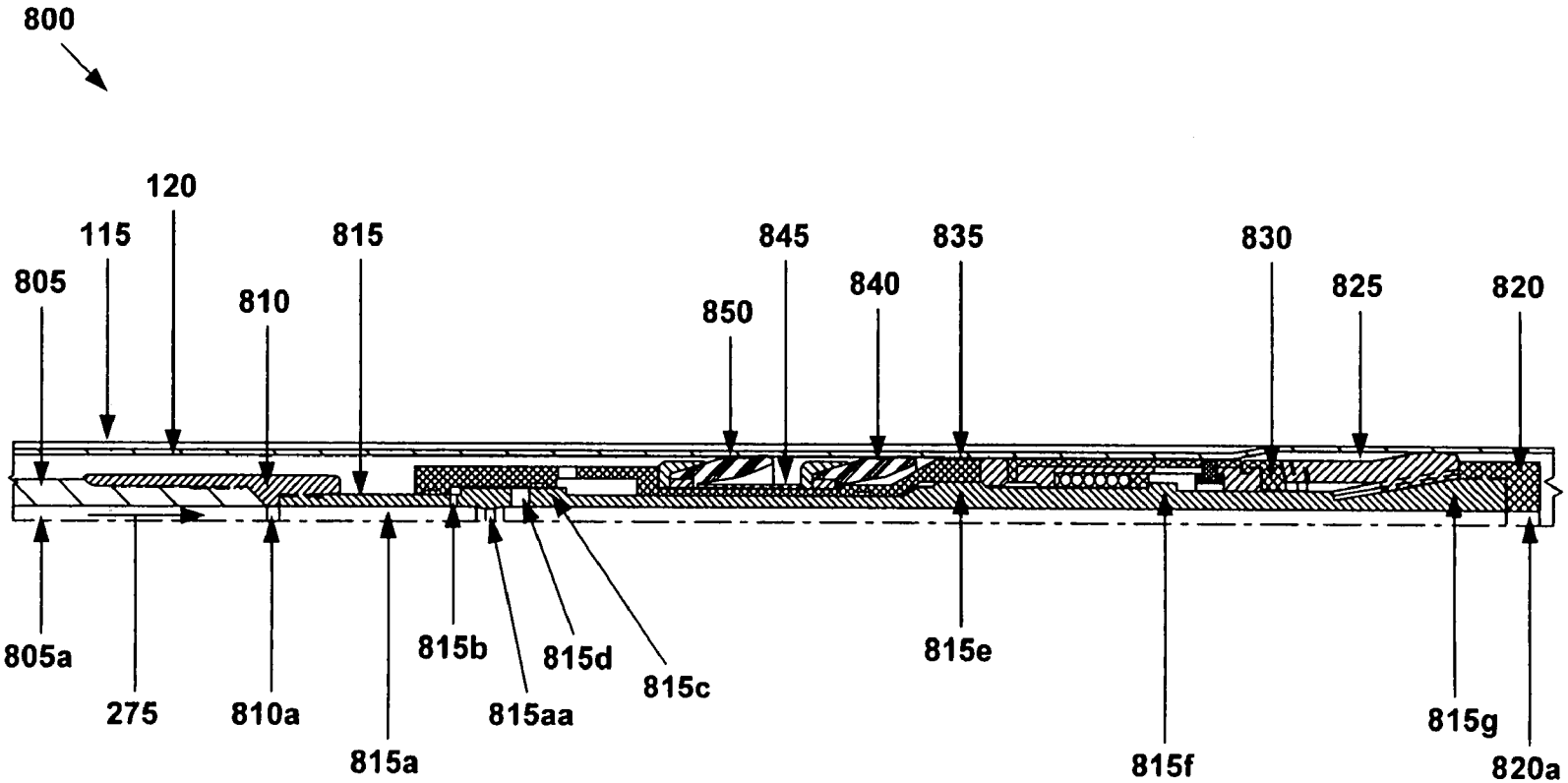
FIGS. 17 and 17*a*-17*c* are fragmentary cross-sectional illustrations of an embodiment of the operation of the apparatus of FIGS. 16 and 16*a*-16*c* during the radial expansion of the expandable tubular member within a borehole within a subterranean formation.
Figure 17A:
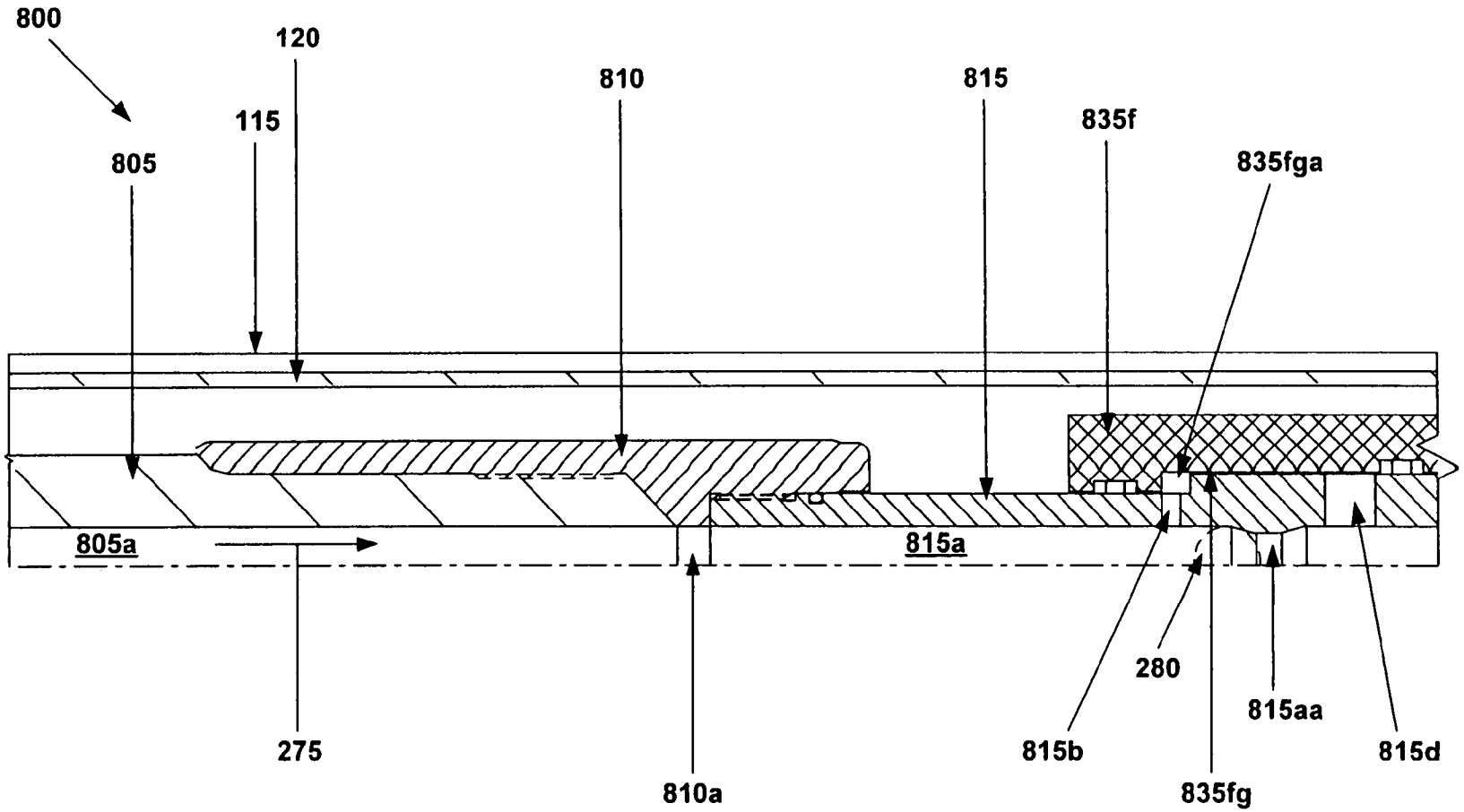
Figure 17B:
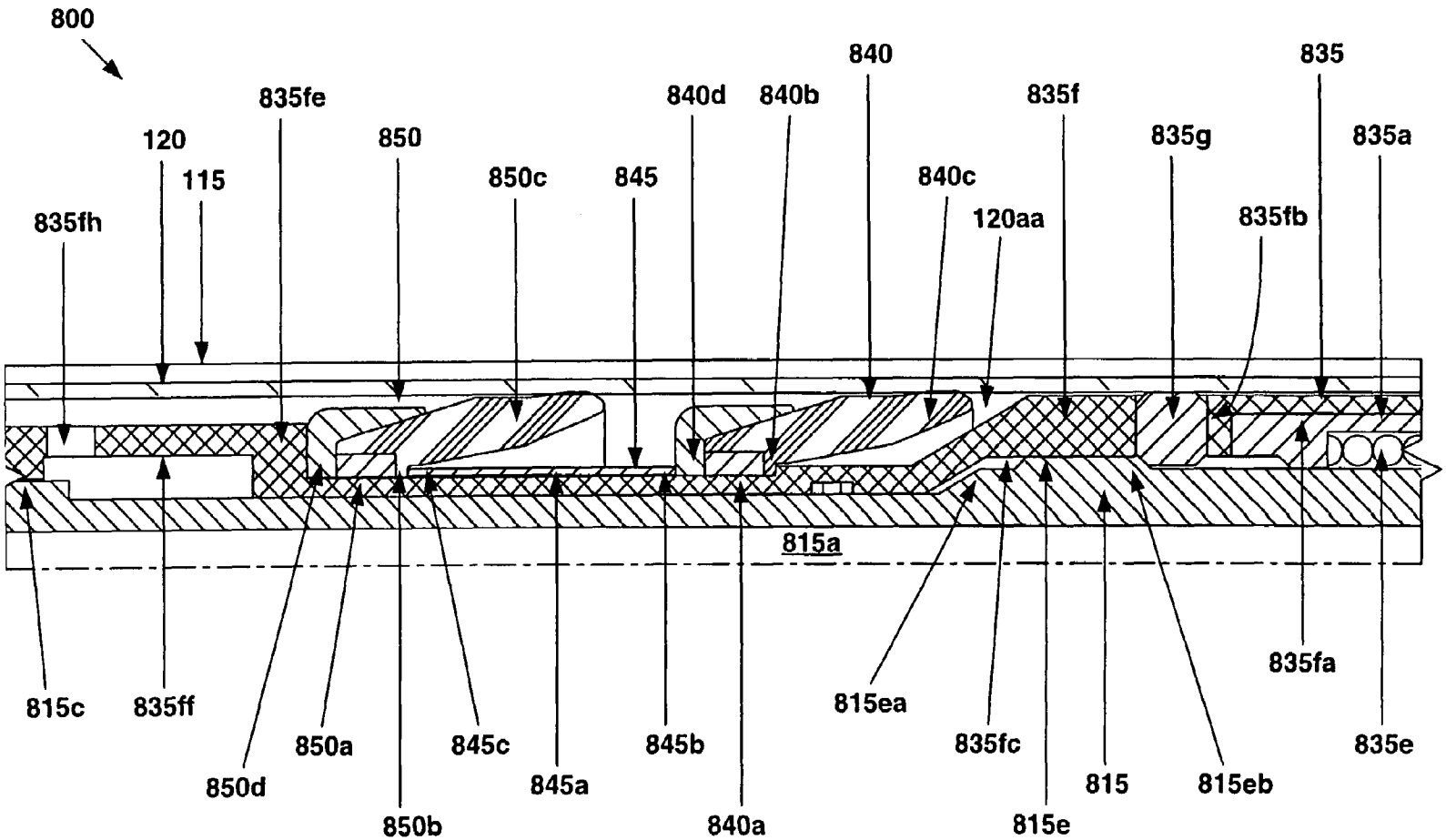
Figure 17C:
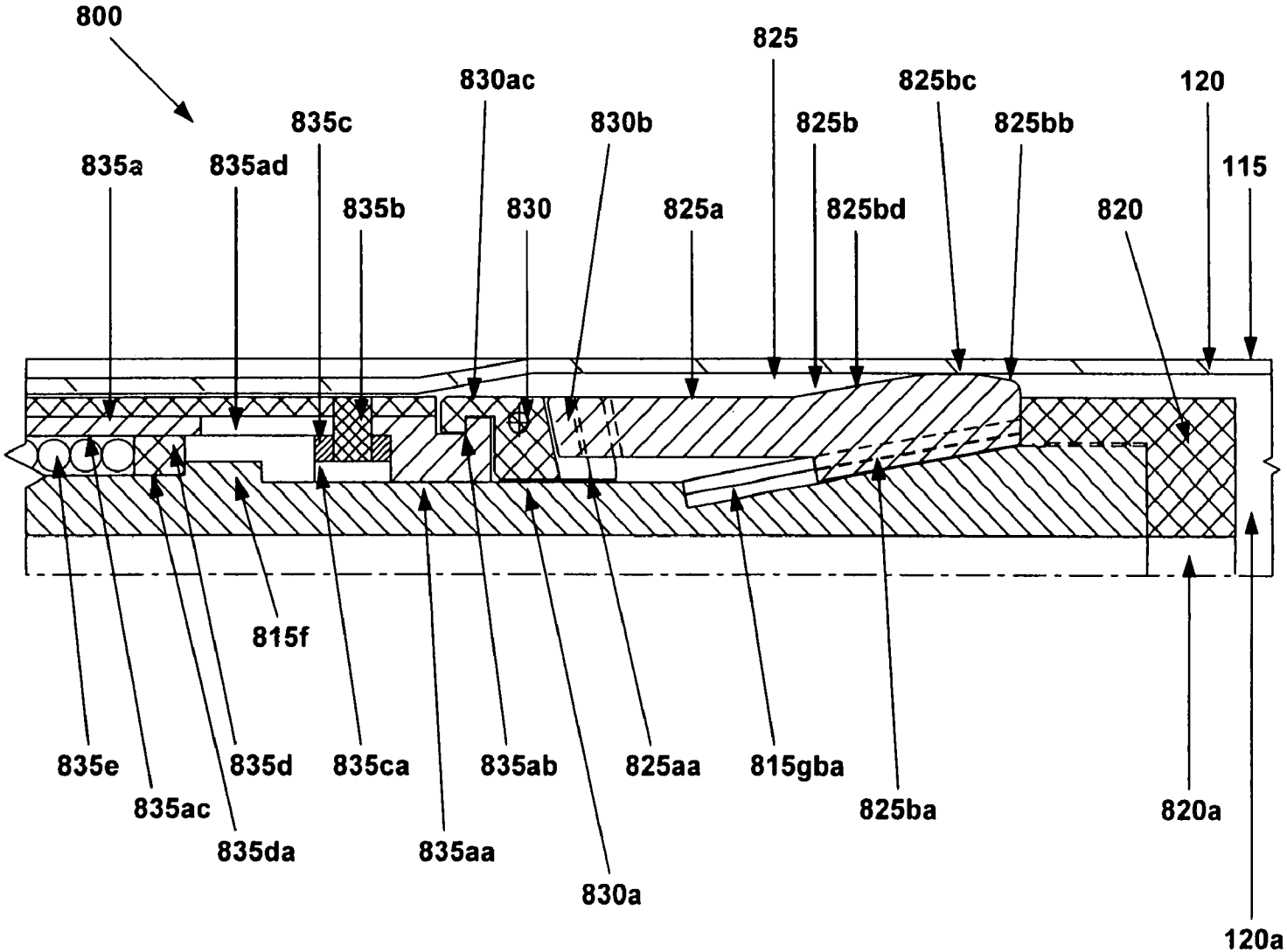
Figure 18A:
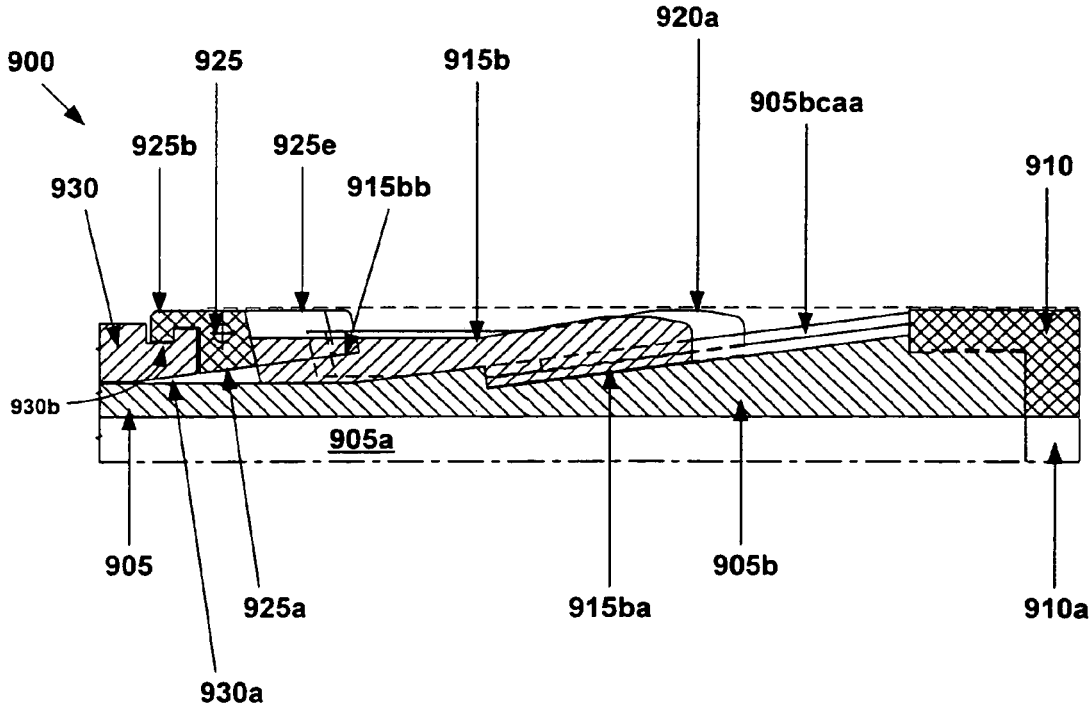
FIG. 18*a* is a cross sectional illustration of an embodiment of a segmented expansion cone assembly in an unexpanded position.
Figure 18B:
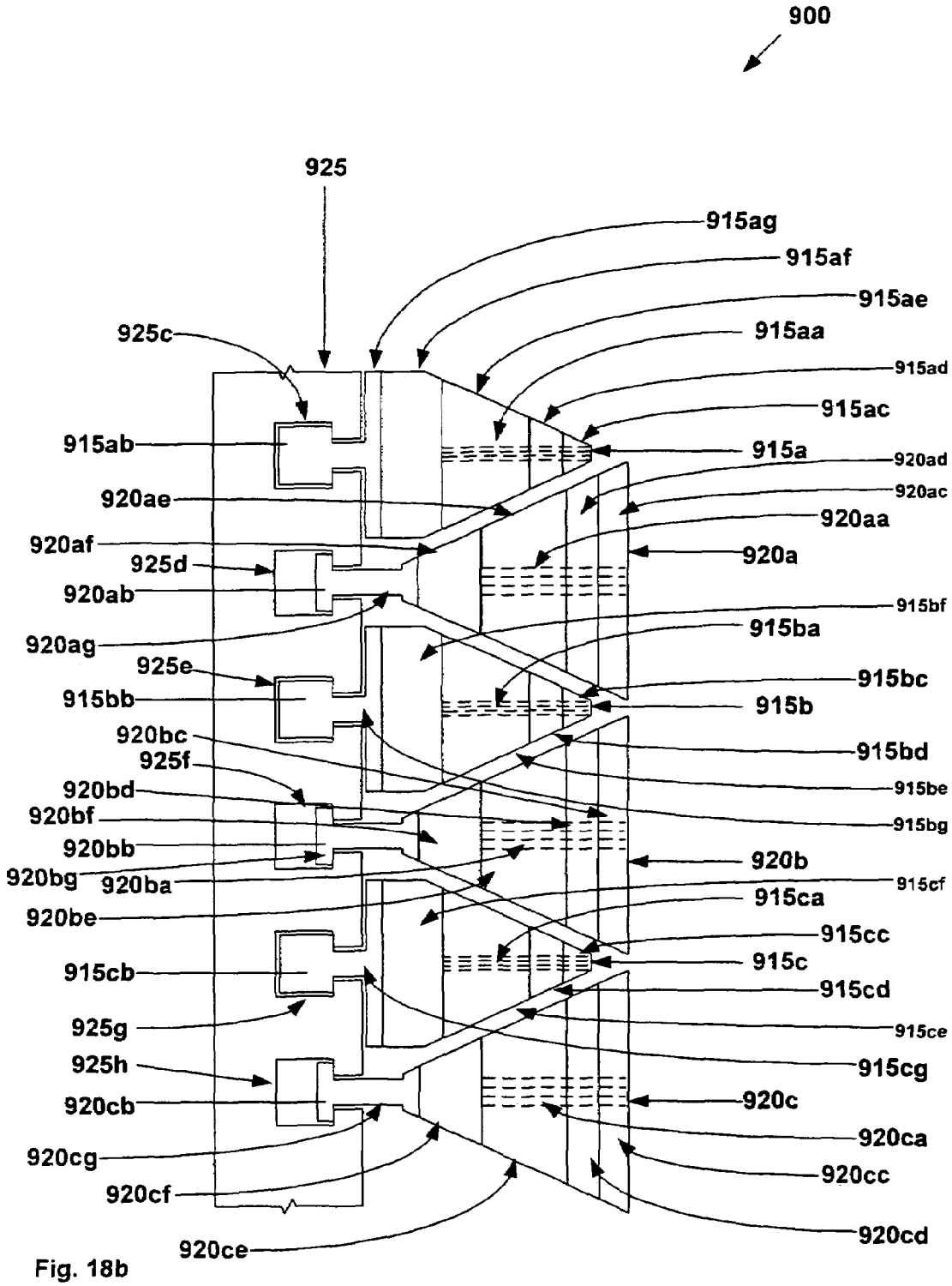
FIG. 18*b* is a fragmentary circumferential top illustration of the expansion cone and split ring collar of FIG. 18*a*.
Figure 18C:
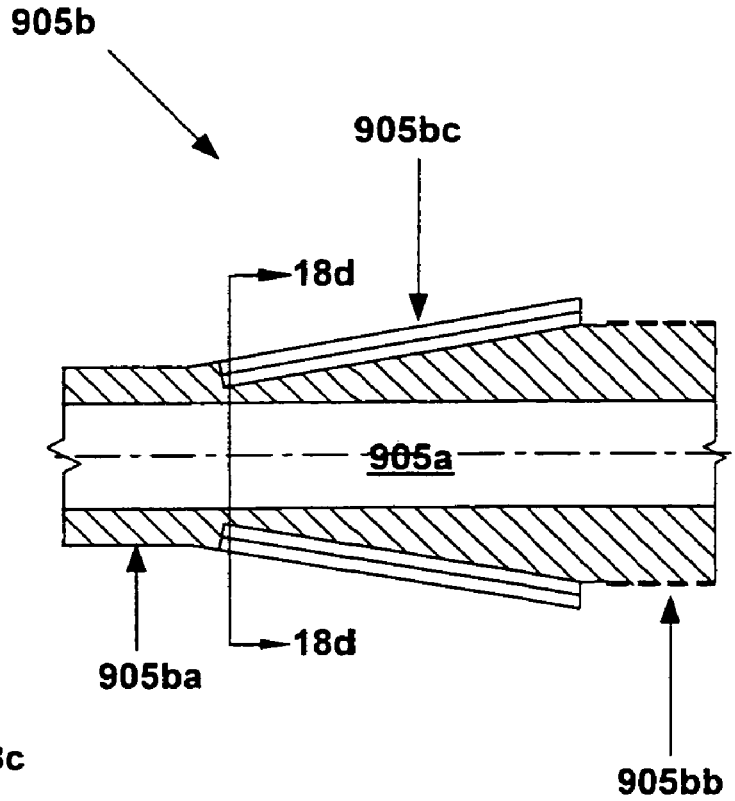
FIG. 18*c* is a fragmentary cross-sectional illustration of the expansion cone support flange of the expansion cone assembly of FIG. 18*a*.
Figure 18D:
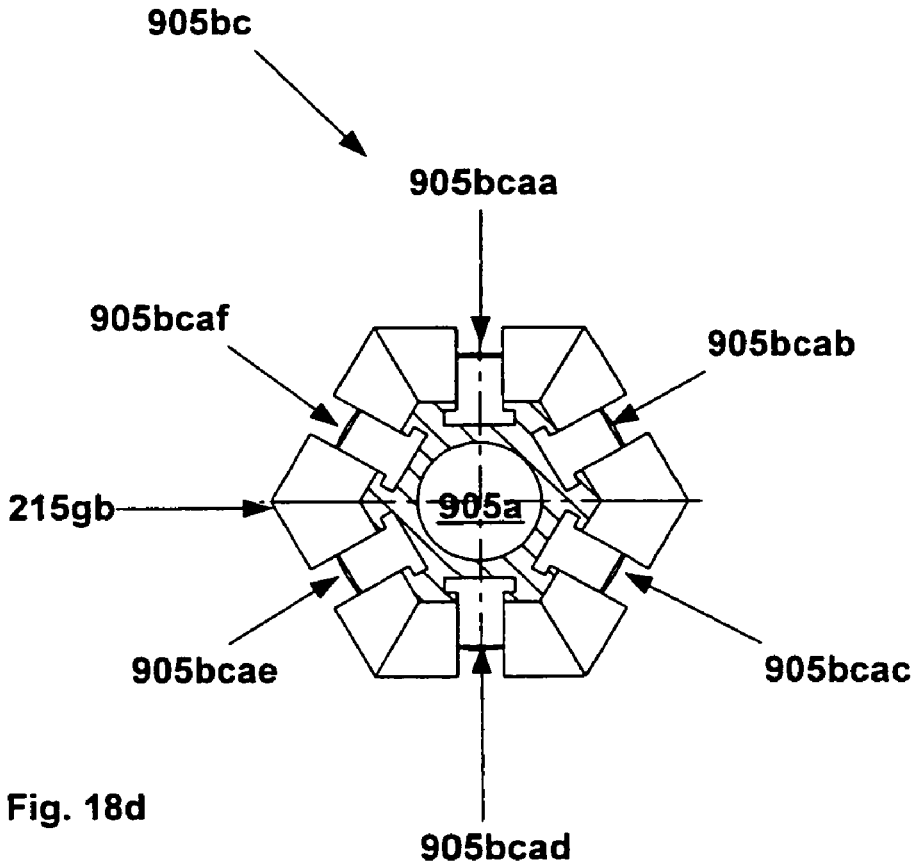
FIG. 18*d* is a cross-sectional illustration of the expansion cone support flange of FIG. 18*c*.

As illustrated in FIG. 15*i*, in an exemplary embodiment, the external surfaces, 825*bb*, 825*bc*, and 825*bd*, of the second ends 825*b* of the expansion cone segments 825 are adapted to mate with one another in order to interlock adjacent expansion cone segments.

A split ring collar 830 that defines a passage 830*a* for receiving the tubular support member 815 is provided that includes a first end that includes plurality of T-shaped slots 830*b* for receiving and mating with corresponding T-shaped retaining members 825*aa* of the expansion cone segments 825 and a second end that includes an L-shaped retaining member 830*c*. In an exemplary embodiment, the split ring collar 830 is a conventional split ring collar commercially available from Halliburton Energy Services modified in accordance with the teachings of the present disclosure.

A dog assembly 835 is provided that includes a tubular sleeve 835*a* that defines a passage 835*aa* for receiving the tubular support member 815 and includes a slot 835*ab* for receiving and mating with the L-shaped retaining member 830*c* of the split ring collar 830, a counterbore 835*ac*, and a radial passage 835*ad*. An end of a load transfer pin 835*b* passes through the radial passage 835*ad* and is coupled to a retaining ring 835*c* that defines a passage 835*ca* for receiving the flange 815*f* of the tubular support member 815 and is received within the counterbore 835*ac* of the tubular sleeve. A ring 835*d* that defines a passage 835*da* for receiving the tubular support member 815 and a spring 835*e* are also received within the counterbore 835*ac* of the tubular sleeve 835*a* between the flange 815*f* and the end of the counterbore. The other end of the load transfer pin 835*b* is coupled to an end of a tubular sleeve 835*f* that includes a counterbore 835*fa* for receiving the tubular sleeve 835*a*, a radial passage 835*fb* for receiving a conventional resilient dog 835*g*, a counterbore 835*fc* for receiving and mating with the flange 815*e* of the tubular support member 815, a flange 835*fd*, and a flange 835*fe* including counterbores, 835*ff* and 835*fg*, that mate with and receive the flange 815*c* of the tubular support member, and a radial passage 835*fh*.

A first conventional packer cup assembly 840 that defines a passage 440*a* for receiving the tubular sleeve 835*f* includes a first end 840*b* that mates with the flange 835*fd* of the tubular sleeve 835*f*, a conventional sealing cup 840*c*, and a second end 840*d*. A tubular spacer 845 that defines a passage 845*a* for receiving the tubular sleeve 835*f* includes a first end 845*b* that mates with the second end 840*d* of the first packer cup assembly 840 and a second end 845*c*. A second conventional packer cup assembly 850 that defines a passage 850*a* for receiving the tubular sleeve 835*f* includes a first end 850*b* that mates with the second end 845*c* of the spacer 845, a conventional sealing cup 850*c*, and a second end 850*d* that mates with the flange 835*fe* of the tubular sleeve.

In an exemplary embodiment, during operation of the apparatus 800, as illustrated in FIGS. 15 and 15*a*-15*j*, the apparatus may be initially positioned in the wellbore 100, within the casing 110, with the dog assembly 835 positioned in a neutral position in which the radial passage 815*d* of the tubular support member 815 is fluidicly coupled to the radial passage 835*fh* of the dog assembly 835 and the expansion cone segments 825 are not driven up the tapered hexagonal portion 815*gb* of the expansion cone support body 815*g* of the tubular support member 815 into contact with the stop member 320. In this manner, fluidic materials within the interior 815*a* of the tubular support member 815 may pass through the radial passages, 815*d* and 835*fh*, into the annulus between the apparatus 800 and the casing 110 thereby preventing over pressurization of the annulus. Furthermore, in this manner, the outside diameter of the expansion cone segments 825 is less than or equal to the outside diameter of the stop member 820 thereby permitting the apparatus 800 to be displaced within the casing 110.

As illustrated in FIGS. 16, and 16*a*-16*c*, the apparatus 800 may then be positioned in the tubular member 120. During the insertion of the apparatus into the tubular member 120, the upper end 120*b* of the tubular member may impact the end of the resilient dog 835*g* of the dog assembly 835 thereby driving the resilient dog 835*g* backwards onto the shoulder 815*ea* of the flange 815*e* of the tubular support member 815. As a result of the backward axial displacement of the resilient dog 835*g*, the tubular sleeve 835*f*, the pin 835*b*, the retaining ring 835*c*, the ring 835*d*, and the spring 835*e* of the dog assembly 835 are driven backward thereby compressing the spring 835*e* and applying an axial biasing force to the tubular sleeve 835*a* that prevents the expansion cone segments 825 from being displaced toward the end stop 820.

The apparatus 800 may then be at least partially positioned in the open hole section 115*a* of the wellbore section 115, beyond the lower end 120*c* of the tubular member 120. In an exemplary embodiment, that portion of the apparatus 800 that includes the stop member 820, the expansion cone segments 825, the split ring collar 830, and the dog assembly 835 is then positioned in the open hole section 115*a* of the wellbore section 115, beyond the lower end 120 of the tubular member for reasons to be described. Because the dog 835*g* of the dog assembly 835 is resilient, once the apparatus 800 has been positioned in the open hole section 115*a* of the wellbore section 115, beyond the lower end 120*c* of the tubular member 120, the resilient dog of the dog assembly may spring outwardly in the radial direction.

The apparatus 800 may then be repositioned at least partially back within the tubular member 120. During the reinsertion of the apparatus into the tubular member 120, the lower end 120*c* of the tubular member may impact the ends of the resilient dog 835*g* of the dog assembly 835 thereby driving the resilient dog forward until the resilient dog is positioned onto the shoulder 815*eb* of the flange 815*e* of the tubular support member 815.

As a result of the forward axial displacement of the resilient dog 835*g*, the tubular sleeve 835*f*, the spring 835*e*, the ring 835*d*, the ring 835*c*, the pin 835*b*, and the tubular sleeve 835*a* are displaced in the forward axial direction thereby also displacing the split ring collar 830 and the expansion cone segments 825 in the forward axial direction. As a result, the expansion cone segments 825 are driven up the tapered hexagonal portion 815*gb* of the expansion cone support body 815*g* of the tubular support member 815 into contact with the stop member 320. Furthermore, as a result of the forward axial displacement of the tubular sleeve 835*f*, the radial passages, 815*d* and 835*fh*, are fluidicly decoupled. As a result fluidic materials within the tubular support member 815 may not pass into the annulus between the tubular support member and the tubular member 120.

As a result of the forward axial displacement of the resilient dog 435*e*, the outside diameter of the expansion cone segments 825 is now greater than the inside diameter of expandable tubular member 120 thereby permitting the apparatus 800 to be used to radially expand and plastically deform the tubular member, and fluidic materials within the interior 815*a* of the tubular support member 815 may no longer pass through the radial passages, 815*d* and 455*ed*, into the annulus between the apparatus 800 and the tubular member thereby permitting the interior of the apparatus to be pressurized.

The apparatus 800 may then be operated to radially expand and plastically deform the tubular member 120 by applying an upward axial force to the tubular support member 815 and/or by injecting a pressurized fluidic material into the tubular support member.

In particular, as illustrated in *figs*. 17 and 17*a*-17*c*, the expandable tubular member 120 may then be radially expanded using the apparatus 800 by injecting a fluidic material 275 into the apparatus through the passages 805*a*, 810*a*, 815*a*, and 820*a*. The injection of the fluidic material 275 may pressurize the interior 120*a* of the expandable tubular member 120. In addition, because the packer cup assemblies, 840 and 850, seal off an annular region 120*aa* below the packer cup assemblies between the expandable tubular member 120 and the tubular support member 815, the injection of the fluidic material 275 may also pressurize the annular region.

The continued injection of the fluidic material 275 may then pressurize the interior 120*a* of the expandable tubular member 120 thereby plastically deforming and radially expanding the expandable tubular member off of the expansion cone segments 825. Because the outer surfaces, 825*bb* and 825*bc*, of the expansion cone segments 825 are tapered, the plastic deformation and radial expansion of the expandable tubular member 120 proximate the expansion cone segments is facilitated. Furthermore, in an exemplary embodiment, the continued injection of the fluidic material 275 also pressurizes the annular region 120*aa* defined between the interior surface of the expandable tubular member 120 and the exterior surface of the tubular support member 815 that is bounded on the upper end by the packer cup assembly 840 and on the lower end by the expansion cone segments 825. Furthermore, in an exemplary embodiment, the pressurization of the annular region 120*aa* also radially expands at least a portion of the surrounding portion of the expandable tubular member 120. In this manner, the plastic deformation and radial expansion of the expandable tubular member 120 is enhanced. Furthermore, during operation of the apparatus 300, the packer cup assemblies 840 and 850 prevent the pressurized fluidic material 275 from passing above and beyond the packer cup assemblies and thereby define the length of the pressurized annular region 120*aa*. In an exemplary embodiment, the pressurization of the annular region 120*aa* decreases the operating pressures required for plastic deformation and radial expansion of the expandable tubular member 120 by as much as 50% and also reduces the angle of attack of the tapered external surfaces, 825*bb* and 825*bc*, of the expansion cone segments 825.

The radial expansion of the expandable tubular member 120 may then continue until the upper end 120*b* of the expandable tubular member is radially expanded and plastically deformed along with the overlapping portion of the wellbore casing 110. Because the expansion cone segments 825 may be adjustably positioned from an outside diameter less than the inside diameter of the expandable tubular member 120 to an outside diameter substantially equal to the inside diameter of the pre-existing casing 110, the resulting wellbore casing, including the casing 110 and the radially expanded tubular member 120, created by the operation of the apparatus 800 may have a single substantially constant inside diameter thereby providing a mono-diameter wellbore casing.

During the radial expansion process, the expansion cone segments 825 may be raised out of the expanded portion of the tubular member 120 by applying an upward axial force to the tubular support member 815. In a preferred embodiment, during the radial expansion process, the expansion cone segments 825 are raised at approximately the same rate as the tubular member 120 is expanded in order to keep the tubular member stationary relative to the new wellbore section 115.

In a preferred embodiment, when the upper end portion of the expandable tubular member 120 and the lower portion of the wellbore casing 110 that overlap with one another are plastically deformed and radially expanded by the expansion cone segments 825, the expansion cone segments are displaced out of the wellbore 100 by both the operating pressure within the interior of the tubular member 120 and a upwardly directed axial force applied to the tubular support member 405.

In a preferred embodiment, the operating pressure and flow rate of the fluidic material 275 is controllably ramped down when the expansion cone segments 825 reach the upper end portion of the expandable tubular member 120. In this manner, the sudden release of pressure caused by the complete radial expansion and plastic deformation of the expandable tubular member 120 off of the expansion cone segments 825 can be minimized. In a preferred embodiment, the operating pressure is reduced in a substantially linear fashion from 100% to about 10% during the end of the extrusion process beginning when the expansion cone segments 825 are within about 5 feet from completion of the extrusion process.

Alternatively, or in combination, the wall thickness of the upper end portion of the expandable tubular member 120 is tapered in order to gradually reduce the required operating pressure for plastically deforming and radially expanding the upper end portion of the tubular member. In this manner, shock loading of the apparatus is at least reduced.

Alternatively, or in combination, a shock absorber is provided in the tubular support member 805 in order to absorb the shock caused by the sudden release of pressure. The shock absorber may comprise, for example, any conventional commercially available shock absorber, bumper sub, or jars adapted for use in wellbore operations.

Alternatively, or in combination, an expansion cone catching structure is provided in the upper end portion of the expandable tubular member 120 in order to catch or at least decelerate the expansion cone segments 825.

Alternatively, or in combination, during the radial expansion process, an upward axial force is applied to the tubular support member 815 sufficient to plastically deform and radially expand the tubular member 120 off of the external surfaces, 225*bb* and 225*bc*, of the expansion cone segments 825.

Alternatively, or in combination, in order to facilitate the pressurization of the interior 120*a* of the expandable tubular member by the injection of the fluidic materials 275, the region within the wellbore section 115 below the apparatus 800 may be fluidicly sealed off in a convention manner using, for example, a packer.

Once the radial expansion process is completed, the tubular support member 805, the tubular support member 810, the tubular support member 815, the end stop 820, the expansion cone segments 825, the split ring collar 830, the dog assembly 835, the packer cup assembly 840, the spacer 845, and the packer cup assembly 850 are removed from the wellbores 100 and 115.

If the expansion cone segments 825 become lodged within the expandable tubular member 120 during the radial expansion process, then a ball 280 may be placed in the throat 815*aa* of the passage 815*a* of the tubular support member 815. The continued injection of the fluidic material 275 following the placement of the ball 280 in the throat 815*aa* of the passage 815*a* of the tubular support member will then pressurize the radial passage 815*b* and an annular portion 835*fga* of the counterbore 835*fg*. As a result of the pressurization of the annular portion 835*fga* of the counterbore 835*fg*, the tubular sleeve 835*f*, the pin 835*b*, the retaining ring 835*c*, the ring 835*d*, the spring 835*e*, and the tubular sleeve 835*a* of the dog assembly 835, and the split ring collar 830 are driven backward thereby displacing the expansion cone segments 825 backwards in the axial direction away from the end stop 820. In this manner, the outside diameter of the expansion cone segments 825 is thereby reduced and the apparatus 800 may then be removed from the expandable tubular member 120.

Referring now to FIGS. 18*a*, 18*b*, 18*c*, and 18*d*, an embodiment of an adjustable expansion cone assembly 900 will be described. The assembly 900 includes a tubular support member 905 that defines a passage 905*a* and includes an expansion cone support flange assembly 905*b* that is coupled to an end stop 910 that defines a passage 910*a*. The expansion cone support flange assembly 905*b* includes a first tubular end 905*ba*, a second tubular end 905*bb*, and an intermediate hexagonal conical tubular body 905*bc* that includes a plurality of substantially identical and equally spaced apart expansion cone segment support slots 905*bcaa*-905*bcaf* on each of the facets of the hexagonal tubular body.

A plurality of first expansion cone segments 915*a*-915*c* are provided that include T-shaped retaining members 915*aa*-915*ca* that mate with and are movably received within the T-shaped slots 905*bcaa*, 905*bcac*, and 905*bcae* of the hexagonal conical tubular body 905*bc* of the expansion cone support assembly 905*b*, T-shaped retaining members 915*ab*-915*cb*, exterior top surfaces 915*ac*-915*cc*, exterior top surfaces 915*ad*-915*cd*, exterior top surfaces 915*ae*-915*ce*, exterior top surfaces 915*af*-915*cf*, and exterior top surfaces 915*ag*-915*cg*. In an exemplary embodiment, the exterior top surfaces 915*ac*-915*cc* and the exterior top surfaces 915*ad*-915*cd* are arcuate conical surfaces in which the angle of attack of the exterior top surfaces 915*ac*-915*cc* is greater than the angle of attack of the exterior top surfaces 915*ad*-915*cd*.

A plurality of second expansion cone segments 920*a*-920*c*, that are interleaved with and complementary shaped to the first expansion cone segments 915*a*-915*c*, are also provided that include T-shaped retaining members 920*aa*-920*ca* that mate with and are movably received within the T-shaped slots 905*bcab*, 905*bcad*, and 905*bcaf* of the hexagonal conical tubular body 905*bc* of the expansion cone support assembly 905*b*, T-shaped retaining members 920*ab*-920*cb*, exterior top surfaces 920*ac*-920*cc*, exterior top surfaces 920*ad*-920*cd*, exterior top surfaces 920*ae*-920*ce*, exterior top surfaces 920*af*-920*cf*, and exterior top surfaces 920*ag*-920*cg*. In an exemplary embodiment, the exterior top surfaces 920*ac*-920*cc* and the exterior top surfaces 920*ad*-920*cd* are arcuate conical surfaces in which the angle of attack of the exterior top surfaces 920*ac*-920*cc* is greater than the angle of attack of the exterior top surfaces 920*ad*-920*cd*.

A split ring collar 925 is provided that defines a passage 925*a* for receiving the tubular support member 905 that includes an L-shaped retaining member 925*b* at one end and another end of the split ring collar 925 includes T-shaped slots, 925*c*, 925*d*, 925*e*, 925*f*, 925*g*, and 925*h*, for mating with and receiving the T-shaped retaining members, 915*ab*, 920*ab*, 915*bb*, 920*bb*, 915*cb*, and 920*cb*, of the expansion cone segments, 915*a*, 920*a*, 915*b*, 920*b*, 915*c*, and 920*c*, respectively. A tubular sleeve 930 is provided that defines a passage 930*a* for receiving the tubular support member 905 and that also includes a slot 930*b* for receiving and mating with the L-shaped retaining member 925*b* of the split ring collar 925.

During operation of the assembly 900, as illustrated in FIGS. 18*a*, 18*b*, 18*c*, and 18*d*, in an unexpanded position, the expansion cone segments, 915*a*, 915*b*, 915*c*, 915*d*, 920*a*, 920*b*, 920*c*, and 920*d* are positioned adjacent to the base of the hexagonal conical tubular body 905*bc* of the expansion cone support flange 905*b* away from the end stop 910. In this manner, the outside diameter of the expansion cone segments is less than or equal to the maximum outside diameter of the assembly. Furthermore, in the unexpanded position, the expansion cone segments, 915*a*, 915*b*, and 915*c*, are positioned further away from the end stop 910 than the expansion cone segments, 920*a*, 920*b*, and 920*c*.

Figure 19A:
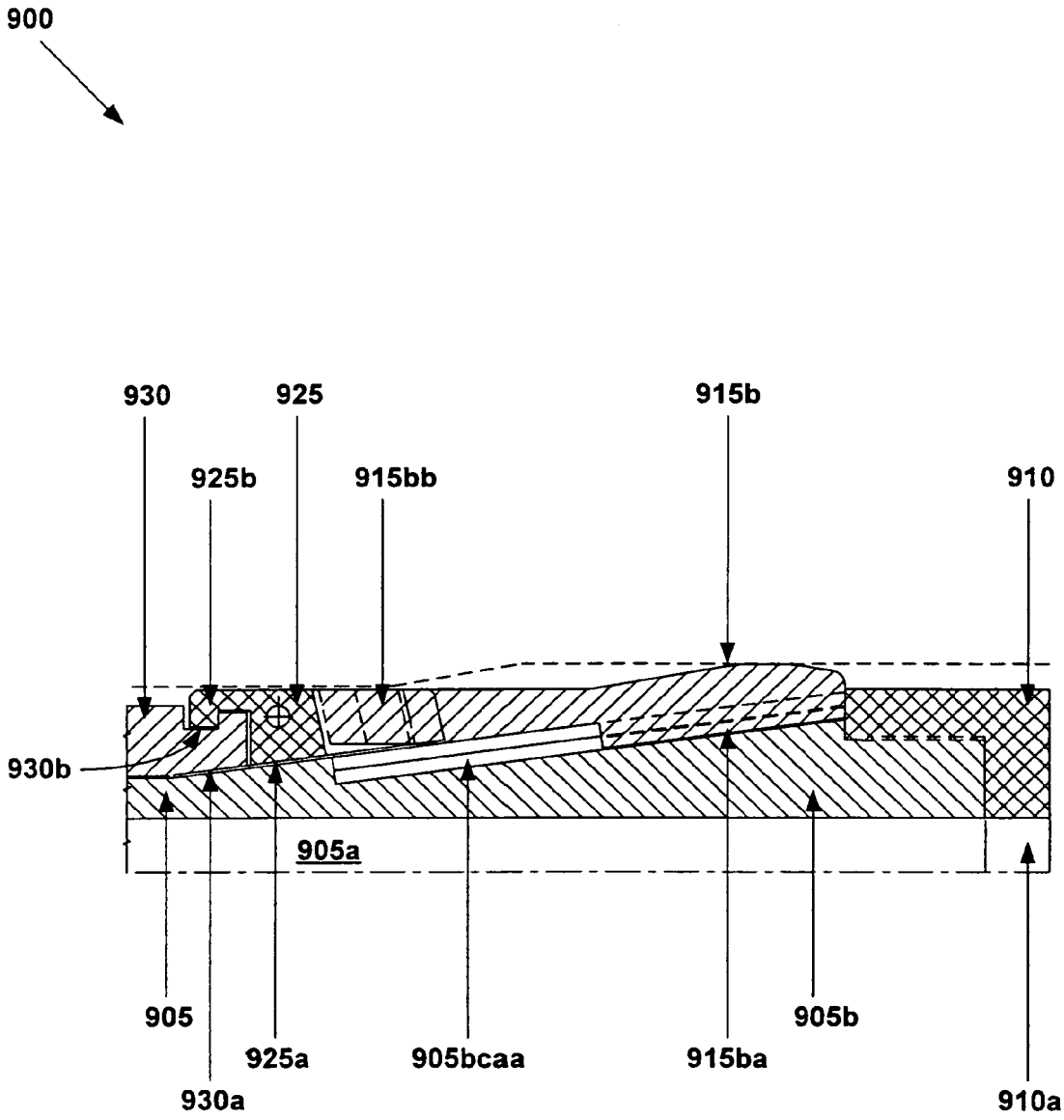
FIG. 19*a* is a cross sectional illustration of an embodiment of the segmented expansion cone assembly of FIG. 18*a* in an expanded position.
Figure 19B:
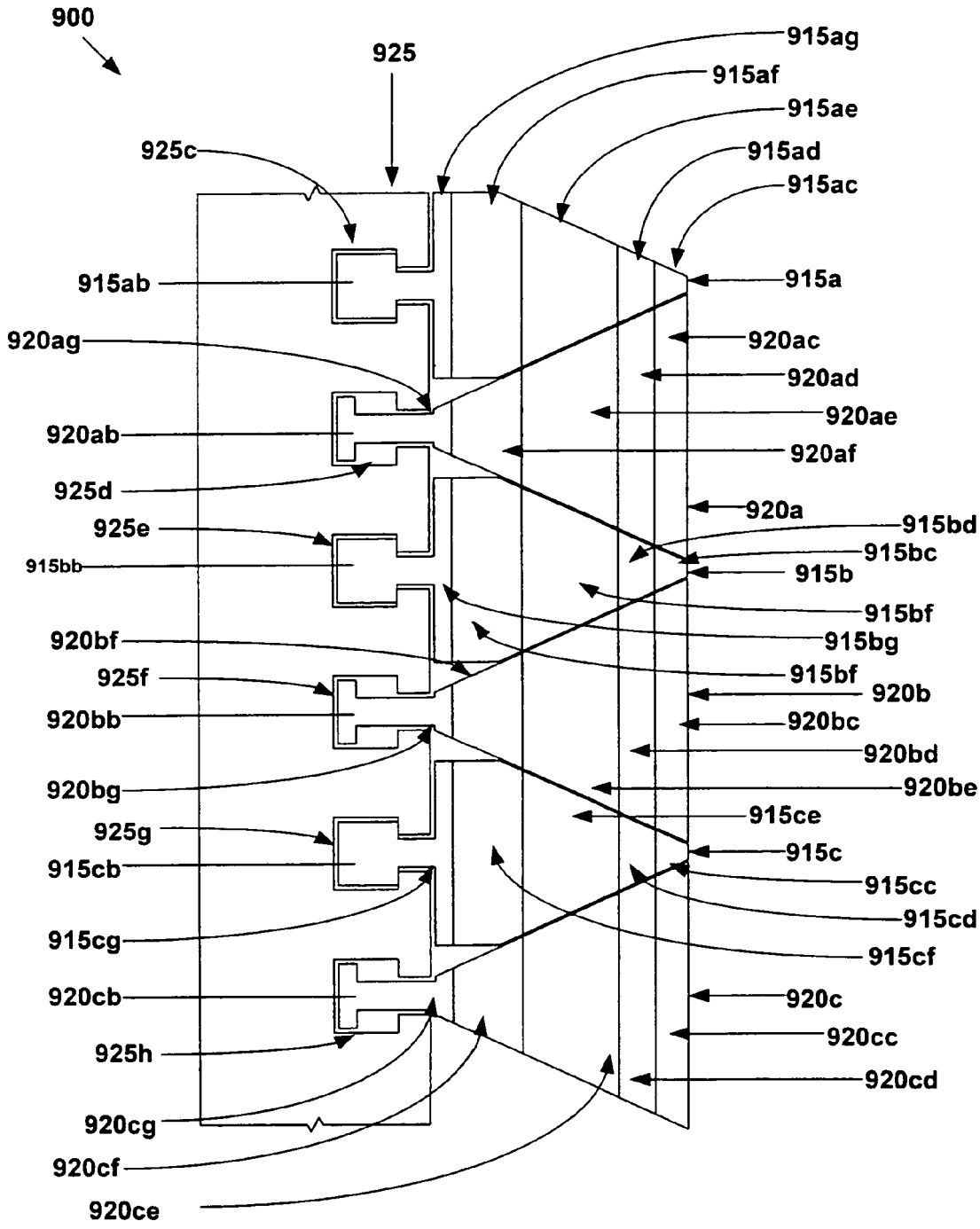
FIG. 19*b* is a fragmentary circumferential top view of the expansion cone of FIG. 19*a*.

As illustrated in FIGS. 19 and 19*a*, the assembly 900 may then be expanded by displacing the tubular sleeve 930 and the split ring collar 925 in the axial direction towards the expansion cone segment support members 705*bb*. As a result, the expansion cone segments, 915*a*, 915*b*, 915*c*, 920*a*, 920*b*, 920*c*, are driven up the hexagonal conical tubular body 905*bc* of the expansion cone support flange 905*b* until the expansion cone segments impact the end stop 910. In this manner, the outside diameter of the expansion segments, 915*a*, 915*b*, 915*c*, 920*a*, 920*b*, and 920*c*, is greater than the maximum diameter of the remaining components of the assembly 900. Furthermore, the conical outer surfaces, 915*ac*, 915*bc*, 915*cc*, 920*ac*, 920*bc*, and 920*cc*, and the conical outer surfaces, 915*ad*, 915*bd*, 915*cd*, 920*ad*, 920*bd*, and 920*cd* of the expansion cone segments, 915*a*, 915*b*, 915*c*, 920*a*, 920*b*, and 920*c*, respectively, may now be used to radially expand a tubular member. In an exemplary embodiment, the outer conical surfaces, 915*ac*, 915*bc*, 915*cc*, 920*ac*, 920*bc*, and 920*cc*, and the conical outer surfaces, 915*ad*, 915*bd*, 915*cd*, 920*ad*, 920*bd*, and 920*cd* of the expansion cone segments, 915*a*, 915*b*, 915*c*, 920*a*, 920*b*, and 920*c*, respectively, in the expanded position of the assembly 900, provide a substantially continuous outer conical surfaces in the circumferential direction. Furthermore, note that in the expanded position of the assembly 900, the first set of expansion cone segments, 915*a*, 915*b*, and 915*c*, are brought into alignment with the second set of expansion cone segments, 920*a*, 920*b*, and 920*c*.

The assembly 900 may then be returned to the unexpanded position by displacing the tubular sleeve 930 and the split ring collar 925 in the axial direction away from the end stop 910. As a result, the expansion cone segments, 915*a*, 915*b*, 915*c*, 920*a*, 920*b*, and 920*c*, are displaced away from the end top 910, down the conical hexagonal tubular member 905*bc* and thereby are returned to a position in which the outside diameter of the expansion cone segments is less than or equal to the maximum diameter of the remaining components of the assembly 900.

In several alternative embodiments, the assembly 900 is incorporated into the assemblies 200, 300, 400, and 800.

Figure 20A:
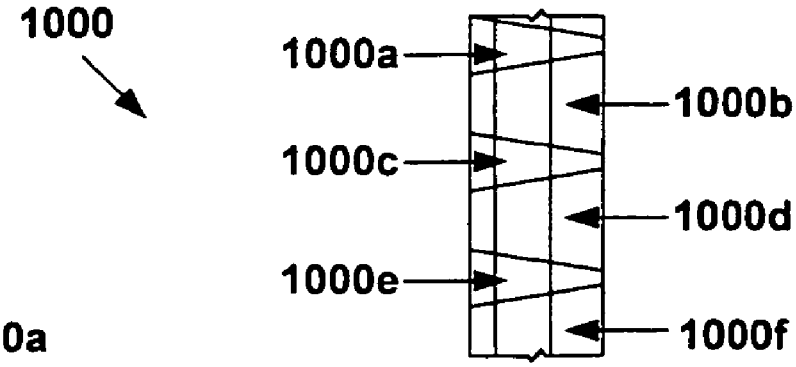
FIGS. 20*a*-20*m* are top circumferential views of various alternative embodiments of interlocking expansion cone segment geometries.

Referring to FIG. 20*a*, an embodiment of an expansion cone segment assembly 1000 includes interlocking expansion cone segments, 1000*a*, 1000*b*, 1000*c*, 1000*d*, 1000*e*, and 1000*f*.

Figure 20B:
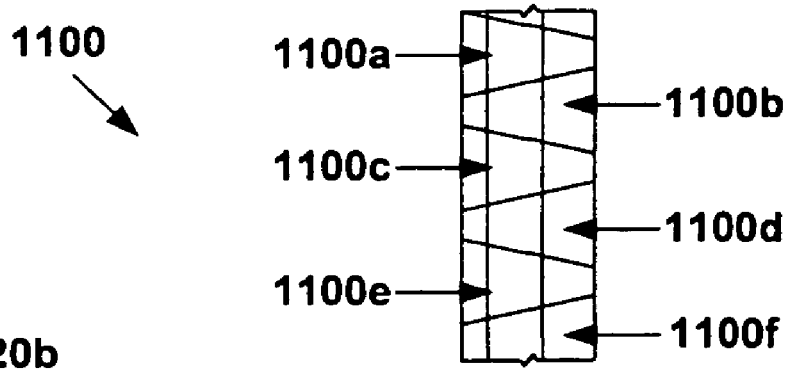

Referring to FIG. 20*b*, an embodiment of an expansion cone segment assembly 1100 includes interlocking expansion cone segments, 1100*a*, 1100*b*, 1100*c*, 1100*d*, 1100*e*, and 1100*f*.

Figure 20C:
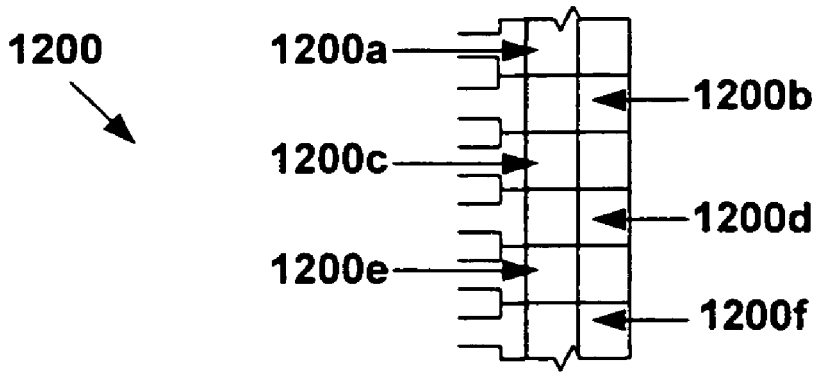

Referring to FIG. 20*c*, an embodiment of an expansion cone segment assembly 1200 includes interlocking expansion cone segments, 1200*a*, 1200*b*, 1200*c*, 1200*d*, 1200*e*, and 1200*f*.

Figure 20D:
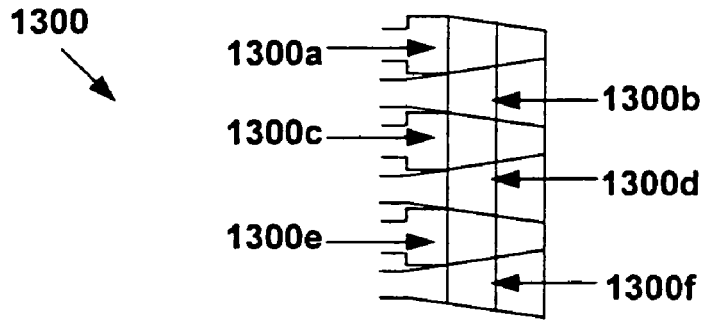

Referring to FIG. 20*d*, an embodiment of an expansion cone segment assembly 1300 includes interlocking expansion cone segments, 1300*a*, 1300*b*, 1300*c*, 1300*d*, 1300*e*, and 1300*f*.

Figure 20E:
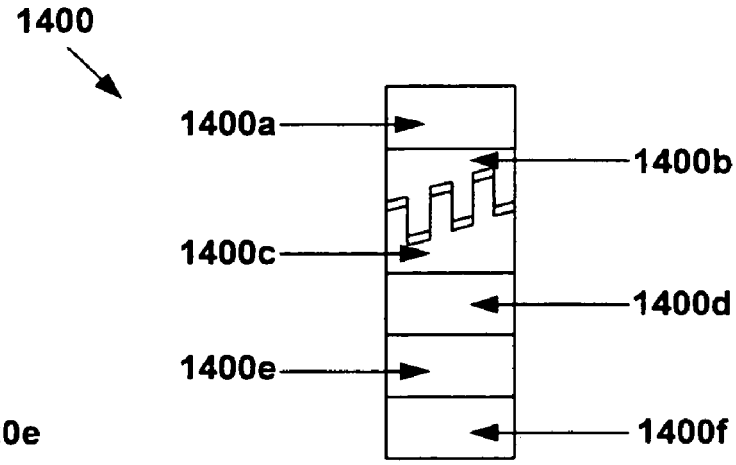

Referring to FIG. 20*e*, an embodiment of an expansion cone segment assembly 1400 includes interlocking expansion cone segments, 1400*a*, 1400*b*, 1400*c*, 1400*d*, 1400*e*, and 1400*f*.

Figure 20F:
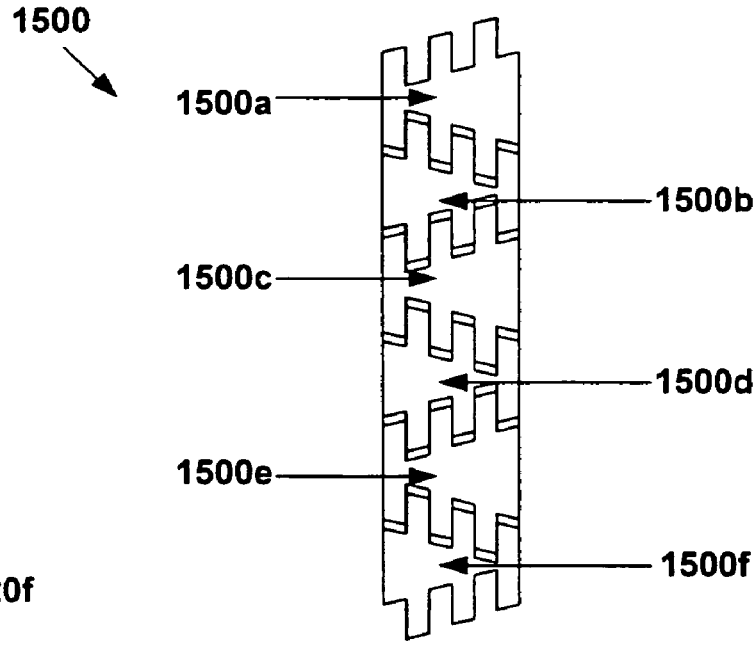

Referring to FIG. 20*f*, an embodiment of an expansion cone segment assembly 1500 includes interlocking expansion cone segments, 1500*a*, 1500*b*, 1500*c*, 1500*d*, 1500*e*, and 1500*f*.

Figure 20G:
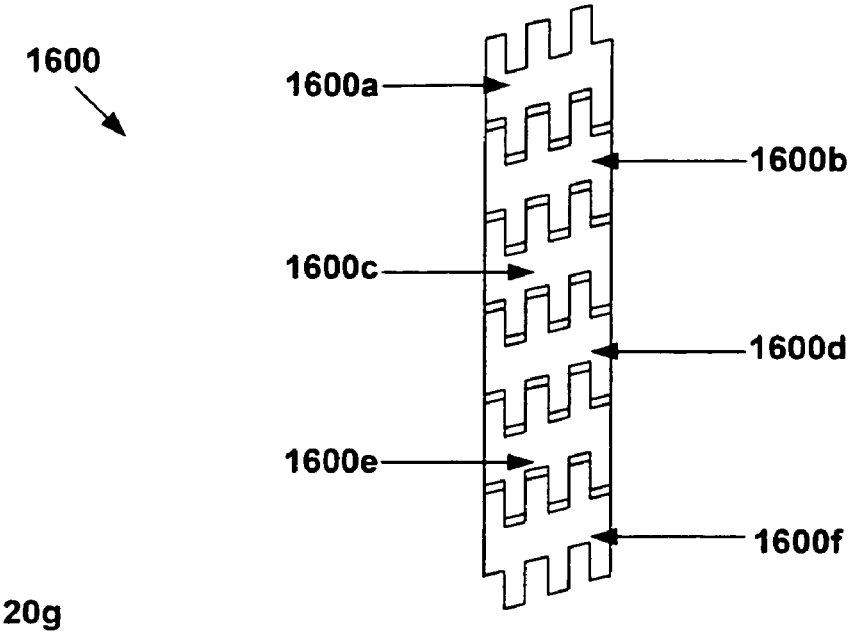

Referring to FIG. 20*g*, an embodiment of an expansion cone segment assembly 1600 includes interlocking expansion cone segments, 1600*a*, 1600*b*, 1600*c*, 1600*d*, 1600*e*, and 1600*f*.

Figure 20H:
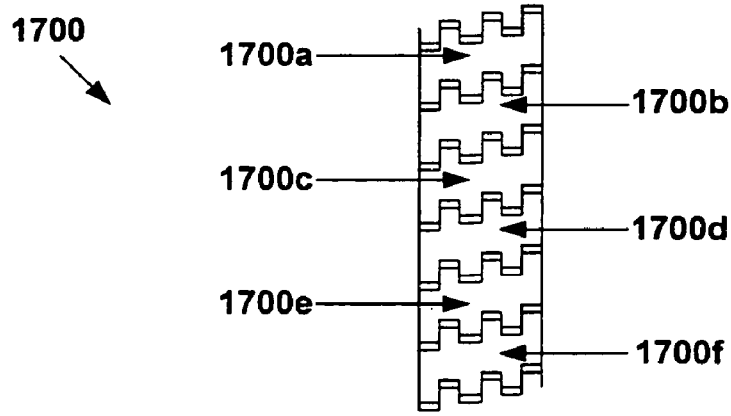

Referring to FIG. 20*h*, an embodiment of an expansion cone segment assembly 1700 includes interlocking expansion cone segments, 1700*a*, 1700*b*, 1700*c*, 1700*d*, 1700*e*, and 1700*f*.

Figure 20I:
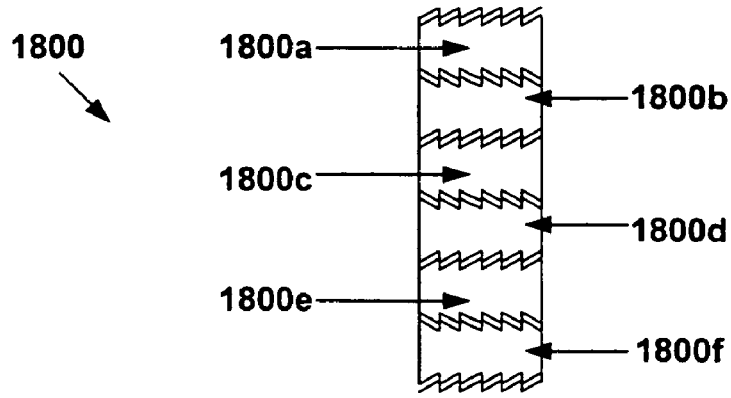

Referring to FIG. 20*i*, an embodiment of an expansion cone segment assembly 1800 includes interlocking expansion cone segments, 1800*a*, 1800*b*, 1800*c*, 1800*d*, 1800*e*, and 1800*f*.

Figure 20J:
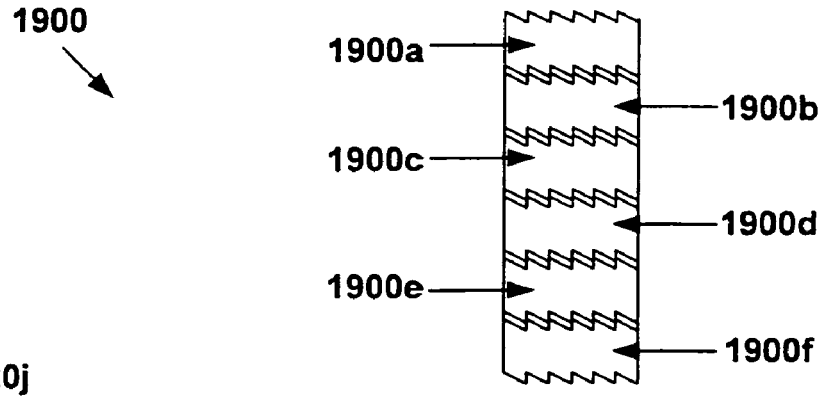

Referring to FIG. 20*j*, an embodiment of an expansion cone segment assembly 1900 includes interlocking expansion cone segments, 1900*a*, 1900*b*, 1900*c*, 1900*d*, 1900*e*, and 1900*f*.

Figure 20K:
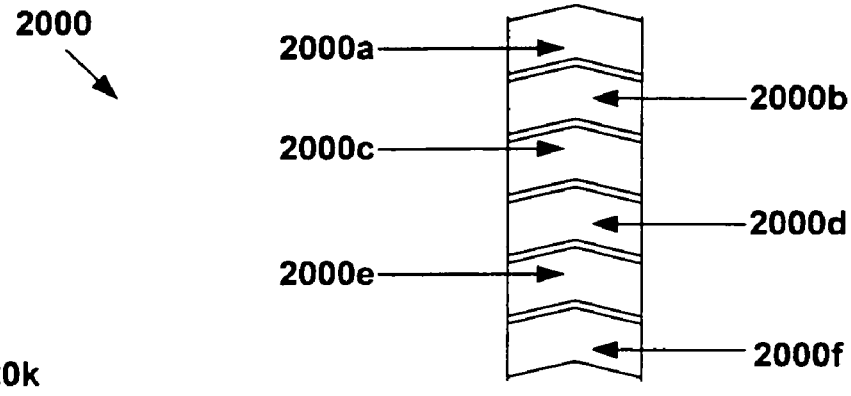

Referring to FIG. 20*k*, an embodiment of an expansion cone segment assembly 2000 includes interlocking expansion cone segments, 2000*a*, 2000*b*, 2000*c*, 2000*d*, 2000*e*, and 2000*f*.

Figure 20L:
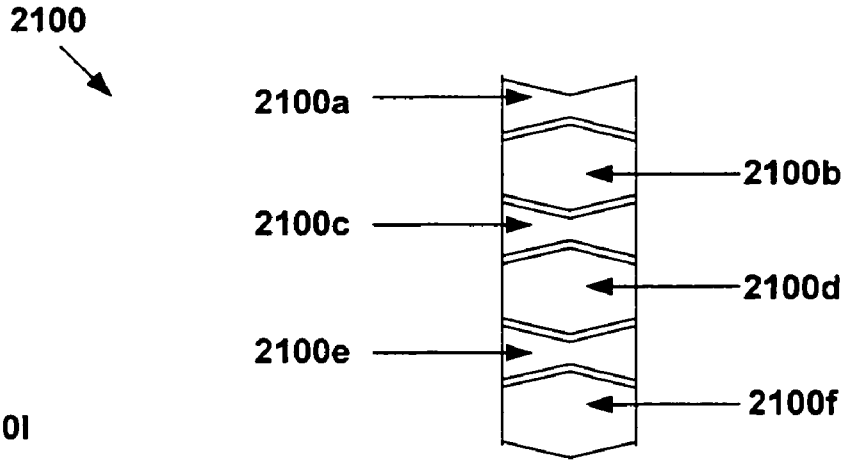

Referring to FIG. 20*l*, an embodiment of an expansion cone segment assembly 2100 includes interlocking expansion cone segments, 2100*a*, 2100*b*, 2100*c*, 2100*d*, 2100*e*, and 2100*f*.

Figure 20M:
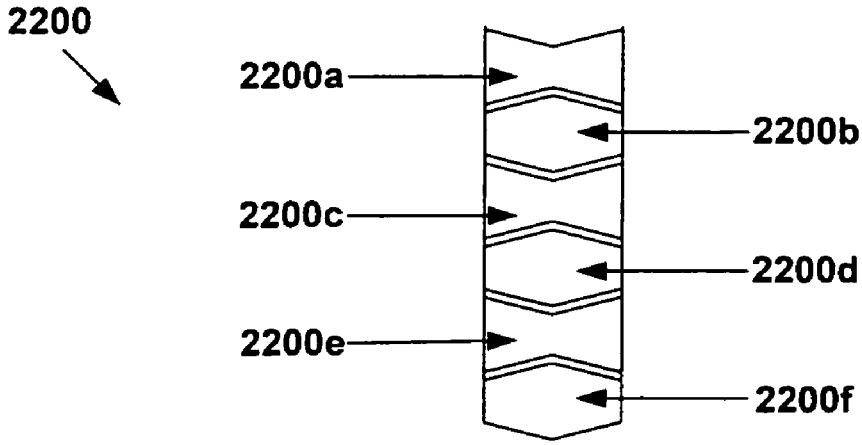

Referring to FIG. 20*m*, an embodiment of an expansion cone segment assembly 2200 includes interlocking expansion cone segments, 2200*a*, 2200*b*, 2200*c*, 2200*d*, 2200*e*, and 2200*f*.

The expansion cone segment assemblies 1000, 1100, 1200, 1300, 1400, 1500, 1600, 1700, 1800, 1900, 2000, 2100, and 2200 provide enhanced operational properties such as, for example, efficient radial expansion of expandable tubular members and durability during operation.

In several alternative embodiments, the design and operational features of the apparatus 200, 300, 400, 500, 600, 700, 800, 900, 1000, 1100, 1200, 1300, 1400, 1500, 1600, 1700, 1800, 1900, 2000, 2100, and 2200 may be combined, in whole or in part, and/or the design and operational elements of the apparatus 200, 300, 400, 500, 600, 700, 800, 900, 1000, 1100, 1200, 1300, 1400, 1500, 1600, 1700, 1800, 1900, 2000, 2100, and 2200 may be interspersed among each other.

In several alternative embodiments, the apparatus 200, 300, 400, 500, 600, 700, 800, 900, and 1000, 1100, 1200, 1300, 1400, 1500, 1600, 1700, 1800, 1900, 2000, 2100, and 2200 may be used to form or repair wellbore casings, pipelines, or structural supports.

In several alternative embodiments, the apparatus 200, 300, 400, 500, 600, 700, 800, 900, 1000, 1100, 1200, 1300, 1400, 1500, 1600, 1700, 1800, 1900, 2000, 2100, and 2200 include two or more expansion cone segments that may be movably support and guided on a tapered expansion cone support body that may, for example, be conical, or may be a multi-sided body.

In several alternative embodiments, the design and operation of the apparatus 200, 300, 400, 500, 600, 700, 800, 900, 1000, 1100, 1200, 1300, 1400, 1500, 1600, 1700, 1800, 1900, 2000, 2100, and 2200 are provided substantially as disclosed in one or more of the following: (1) U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, filed on Feb. 10, 2000, (4) U.S. patent application Ser. No. 09/440,338, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application serial no. PCT/US00/18635, filed on Jul. 9, 2000, (11) U.S. provisional patent application Ser. No. 60/162,671, filed on Nov. 1, 1999, (12) U.S. provisional patent application Ser. No. 60/154,047, filed on Sep. 16, 1999, (13) U.S. provisional patent application Ser. No. 60/159,082, filed on Oct. 12, 1999, (14) U.S. provisional patent application Ser. No. 60/159,039, filed on Oct. 12, 1999, (15) U.S. provisional patent application Ser. No. 60/159,033, filed on Oct. 12, 1999, (16) U.S. provisional patent application Ser. No. 60/212,359, filed on Jun. 19, 2000, (17) U.S. provisional patent application Ser. No. 60/165,228, filed on Nov. 12, 1999, (18) U.S. provisional patent application Ser. No. 60/221,443, filed on Jul. 28, 2000, (19) U.S. provisional patent application Ser. No. 60/221,645, filed on Jul. 28, 2000, (20) U.S. provisional patent application Ser. No. 60/233,638, filed on Sep. 18, 2000, (21) U.S. provisional patent application Ser. No. 60/237,334, filed on Oct. 2, 2000, (22) U.S. provisional patent application Ser. No. 60/270,007, filed on Feb. 20, 2001; and (23) U.S. provisional patent application Ser. No. 60/262,434, filed on Jan. 17, 2001; and (24) U.S. provisional patent application Ser. No. 60/259,486, filed on Jan. 3, 2001, the disclosures of which are incorporated herein by reference.

An apparatus for radially expanding a tubular member has been described that includes a tubular support member that includes a first tubular support body defining a longitudinal passage, a first lug coupled to and extending from the first tubular support body in the radial direction, a second lug coupled to and extending from the first tubular support body in the radial direction, and an expansion cone support body coupled to the first tubular support body. The expansion cone support body includes an N-sided tapered tubular support member, wherein each side of the multi-sided tapered tubular support member defines a T-shaped slot. N expansion cone segments are movably coupled to the expansion cone support body, each including an expansion cone segment body including arcuate conical outer surfaces, a first T-shaped retaining member coupled to the expansion cone segment body for movably coupling the expansion cone segment body to a corresponding one of the T-shaped slots of the expansion cone support body, and a second T-shaped retaining member coupled to the expansion cone segment body. A split ring collar assembly is movably coupled to the exterior of the tubular support member that includes a second tubular support body defining N T-shaped slots for movably receiving corresponding ones of the second T-shaped retaining members of the expansion cone segments, and an L-shaped retaining member coupled to the second tubular support body. A first drag block assembly is movably coupled to the tubular support member that includes a first drag block body defining a slot for receiving and mating with the L-shaped retaining member of the split ring collar, and a first J-shaped slot for receiving the first lug, and one or more first drag blocks coupled to the first drag block body. A second drag block assembly is movably coupled to the tubular support member that includes a second drag block body defining a second J-shaped slot for receiving the second lug, and one or more second drag blocks coupled to the second drag block body. First and second packer cups are coupled to the tubular support member between the first and second drag block assemblies.

An apparatus for radially expanding a tubular member has also been described that includes a tubular support member that includes a first tubular support body defining a longitudinal passage, a first flange coupled to the first tubular support body, a second flange coupled to the first tubular support body, a first tapered flange coupled to the first tubular support body, a second tapered flange coupled to the first tubular support body, and an expansion cone support body coupled to the first tubular support body. The expansion cone support body includes an N-sided tapered tubular support member, wherein each side of the multi-sided tapered tubular support member defines a T-shaped slot. N expansion cone segments are movably coupled to the expansion cone support body, each including an expansion cone segment body including arcuate conical outer surfaces, a first T-shaped retaining member coupled to the expansion cone segment body for movably coupling the expansion cone segment body to a corresponding one of the T-shaped slots of the expansion cone support body, and a second T-shaped retaining member coupled to the expansion cone segment body. A split ring collar is movably coupled to the exterior of the tubular support member that includes a second tubular support body that defines N T-shaped slots for movably receiving corresponding ones of the second T-shaped retaining members of the expansion cone segments, and an L-shaped retaining member coupled to the second tubular support body. A first collet assembly is movably coupled to the tubular support member that includes a first tubular sleeve that defines a slot for receiving and mating with the L-shaped retaining member of the split ring collar, a first counterbore for receiving the first flange, and a first radial passage, a first spring received within the first counterbore, a first retaining ring received within the first counterbore, a first load transfer pin coupled to the first retaining ring and extending through the first radial passage, a second tubular sleeve coupled to the first load transfer pin, a first resilient collet coupled to the second tubular sleeve and positioned above the first tapered flange, and a third tubular sleeve coupled to the first resilient collet. A second collet assembly is movably coupled to the tubular support member that includes a fourth tubular sleeve that defines a second counterbore for receiving the second flange, and a second radial passage, a second spring received within the second counterbore, a second retaining ring received within the second counterbore, a second load transfer pin coupled to the second retaining ring and extending through the second radial passage, a fifth tubular sleeve coupled to the second load transfer pin, a second resilient collet coupled to the fifth tubular sleeve and positioned above the second tapered flange, and a sixth tubular sleeve coupled to the second resilient collet. First and second packer cups coupled to the tubular support member between the first and second collet assemblies.

An apparatus for radially expanding a tubular member has also been described that includes a tubular support member that includes a first tubular support body defining a longitudinal passage, a first radial passage defined in the first tubular support body fluidicly coupled to the longitudinal passage, a first flange coupled to the first tubular support body, a second flange coupled to the first tubular support body, a first tapered flange coupled to the first tubular support body, a second tapered flange coupled to the first tubular support body, and an expansion cone support body coupled to the first tubular support body. The expansion cone support body includes an N-sided tapered tubular support member, wherein each side of the multi-sided tapered tubular support member defines a T-shaped slot. N expansion cone segments are movably coupled to the expansion cone support body, each including an expansion cone segment body including arcuate conical outer surfaces, a first T-shaped retaining member coupled to the expansion cone segment body for movably coupling the expansion cone segment body to a corresponding one of the T-shaped slots of the expansion cone support body, and a second T-shaped retaining member coupled to the expansion cone segment body. A split ring collar is movably coupled to the exterior of the tubular support member that includes a second tubular support body that defines N T-shaped slots for movably receiving corresponding ones of the second T-shaped retaining members of the expansion cone segments, and an L-shaped retaining member coupled to the second tubular support body. A first dog assembly is movably coupled to the tubular support member that includes a first tubular sleeve that defines a slot for receiving and mating with the L-shaped retaining member of the split ring collar, a first counterbore for receiving the first flange, and a second radial passage, a first spring received within the first counterbore, a first retaining ring received within the first counterbore, a first load transfer pin coupled to the first retaining ring and extending through the second radial passage, and a second tubular sleeve coupled to the first load transfer pin that defines a second counterbore for receiving the first tubular sleeve, a first resilient dog coupled to the second tubular sleeve and positioned adjacent to the first tapered flange. A second dog assembly is movably coupled to the tubular support member that includes a third tubular sleeve that defines a second counterbore for receiving the second flange, a third radial passage, and a fourth radial passage fluidicly coupled to the first radial passage, a second spring received within the second counterbore, a second retaining ring received within the second counterbore, a second load transfer pin coupled to the second retaining ring and extending through the third radial passage, a fourth tubular sleeve coupled to the second load transfer pin, and a second resilient dog coupled to the fourth tubular sleeve and positioned adjacent to the second tapered flange. First and second packer cups are coupled to the tubular support member between the first and second dog assemblies.

An apparatus for radially expanding a tubular member has also been described that includes a tubular support member that includes a first tubular support body defining a longitudinal passage including a throat passage, a first radial passage defined in the first tubular support body fluidicly coupled to the longitudinal passage, a first flange coupled to the first tubular support body, a second flange coupled to the first tubular support body that defines a second radial passage defined in the second flange fluidicly coupled to the longitudinal passage, a tapered flange coupled to the first tubular support body, and an expansion cone support body coupled to the first tubular support body. The expansion cone support body includes an N-sided tapered tubular support member, wherein each side of the multi-sided tapered tubular support member defines a T-shaped slot. N expansion cone segments are movably coupled to the expansion cone support body, each including an expansion cone segment body including arcuate conical outer surfaces, a first T-shaped retaining member coupled to the expansion cone segment body for movably coupling the expansion cone segment body to a corresponding one of the T-shaped slots of the expansion cone support body, and a second T-shaped retaining member coupled to the expansion cone segment body. A split ring collar is movably coupled to the exterior of the tubular support member that includes a second tubular support body that defines N T-shaped slots for movably receiving corresponding ones of the second T-shaped retaining members of the expansion cone segments, and an L-shaped retaining member coupled to the second tubular support body. A dog assembly is movably coupled to the tubular support member that includes a first tubular sleeve that defines a slot for receiving and mating with the L-shaped retaining member of the split ring collar, a first counterbore for receiving the first flange, and a third radial passage, a spring received within the first counterbore, a retaining ring received within the first counterbore, a load transfer pin coupled to the retaining ring and extending through the third radial passage, a second tubular sleeve coupled to the first load transfer pin that defines a first counterbore for receiving the first tubular sleeve, a second counterbore for receiving and mating with the tapered flange, and includes a third flange that defines a third counterbore for receiving the second flange, a fourth counterbore for receiving the second flange, and a fourth radial passage, and a resilient dog coupled to the second tubular sleeve and positioned adjacent to the tapered flange. First and second packer cups are coupled to the tubular support member between the resilient dog and the third flange.

An adjustable expansion cone assembly has also been described that includes a tubular support member that includes a tubular support body and an expansion cone support body coupled to the tubular support body. The expansion cone support body includes an N-sided tapered tubular support member, wherein each side of the multi-sided tapered tubular support member defines a T-shaped slot. N expansion cone segments are movably coupled to the expansion cone support body, each including an expansion cone segment body including arcuate conical outer surfaces, a first T-shaped retaining member coupled to the expansion cone segment body for movably coupling the expansion cone segment body to a corresponding one of the T-shaped slots of the expansion cone support body, and a second T-shaped retaining member coupled to the expansion cone segment body. A split ring collar is movably coupled to the exterior of the tubular support member that includes a second tubular support body that defines N T-shaped slots for movably receiving corresponding ones of the second T-shaped retaining members of the expansion cone segments, and an L-shaped retaining member coupled to the second tubular support body. A tubular actuating sleeve is movably coupled to the tubular support member that includes a third tubular support body that defines a slot for receiving and mating with the L-shaped retaining member of the split ring collar.

An adjustable expansion cone assembly has also been described that includes a tubular support member that includes a first tubular support body, and an expansion cone support body coupled to the tubular support body. The expansion cone support body includes a tapered tubular support member defining N stepped slots. An expansion cone assembly is movably coupled to the tubular support member that includes a second tubular support body movably coupled to the first tubular support body defining an L-shaped slot, and N expansion cone segments extending from the second tubular support member. Each expansion cone segment includes a resilient collet coupled to the second tubular support member, an expansion cone segment body coupled to the resilient collet including arcuate conical outer surfaces, and a retaining member coupled to the expansion cone segment body for movably coupling the expansion cone segment body to a corresponding one of the stepped slots of the expansion cone support body. A split ring collar is movably coupled to the exterior of the tubular support member that includes a third tubular support body, a first L-shaped retaining member coupled to the third tubular support body for mating with the L-shaped slot of the second tubular support body of the expansion cone assembly, and a second L-shaped retaining member coupled to the third tubular body. A tubular actuating sleeve is movably coupled to the tubular support member that includes a third tubular support body that defines a slot for receiving and mating with the second L-shaped retaining member of the split ring collar.

An adjustable expansion cone assembly has also been described that includes a tubular support member that includes a first tubular support body, and an expansion cone support body coupled to the tubular support body. The expansion cone support body includes a tapered tubular support member defining N slots. An expansion cone assembly is movably coupled to the tubular support member that includes a second tubular support body movably coupled to the first tubular support body defining an L-shaped slot, and N expansion cone segments extending from the second tubular support member. Each expansion cone segment includes a resilient collet coupled to the second tubular support member, an expansion cone segment body coupled to the resilient collet including arcuate conical outer surfaces, and a retaining member coupled to the expansion cone segment body for movably coupling the expansion cone segment body to a corresponding one of the slots of the expansion cone support body. A split ring collar is movably coupled to the exterior of the tubular support member that includes a third tubular support body, a first L-shaped retaining member coupled to the third tubular support body for mating with the L-shaped slot of the second tubular support body, and a second L-shaped retaining member coupled to the third tubular support body. A tubular actuating sleeve is movably coupled to the tubular support member that includes a third tubular support body that defines a slot for receiving and mating with the second L-shaped retaining member of the split ring collar.

An adjustable expansion cone assembly has also been described that includes a tubular support member that includes a first tubular support body, and an expansion cone support body coupled to the tubular support body. The expansion cone support body includes a tapered tubular support member defining N slots. An expansion cone assembly is movably coupled to the tubular support member that includes a second tubular support body movably coupled to the first tubular support body defining an L-shaped slot, N/2 first expansion cone segments extending from the second tubular support member, and N/2 second expansion cone segments extending from the second tubular member. Each first expansion cone segment includes a first resilient collet coupled to the second tubular support member, a first expansion cone segment body coupled to the resilient collet including arcuate conical outer surfaces, and a first retaining member coupled to the expansion cone segment body for movably coupling the expansion cone segment body to a corresponding one of the slots of the expansion cone support body. Each second expansion cone segment includes a second resilient collet coupled to the second tubular support member, a second expansion cone segment body coupled to the resilient collet including arcuate conical outer surfaces, and a second retaining member coupled to the expansion cone segment body for movably coupling the expansion cone segment body to a corresponding one of the slots of the expansion cone support body. The second expansion cone segments overlap and are interleaved with the first expansion cone segments. A split ring collar is movably coupled to the exterior of the tubular support member that includes a third tubular support body, a first L-shaped retaining member coupled to the third tubular support body for mating with L-shaped slot of the second tubular support body, and a second L-shaped retaining member coupled to the third tubular support body. A tubular actuating sleeve is movably coupled to the tubular support member that includes a third tubular support body that defines a slot for receiving and mating with the second L-shaped retaining member of the split ring collar.

An adjustable expansion cone assembly has also been described that includes a tubular support member that includes a first tubular support body, and an expansion cone support body coupled to the first tubular support body. The expansion cone support body includes an N-sided tapered tubular support member, wherein each side of the multi-sided tapered tubular support member defines a T-shaped slot. N/2 first expansion cone segments are movably coupled to the expansion cone support body, each including a first expansion cone segment body including arcuate conical outer surfaces, a first T-shaped retaining member coupled to the first expansion cone segment body for movably coupling the first expansion cone segment body to a corresponding one of the T-shaped slots of the expansion cone support body, and a second T-shaped retaining member coupled to the first expansion cone segment body. N/2 second expansion cone segments are also movably coupled to the expansion cone support body, each including a second expansion cone segment body including arcuate conical outer surfaces, a third T-shaped retaining member coupled to the second expansion cone segment body for movably coupling the second expansion cone segment body to a corresponding one of the T-shaped slots of the expansion cone support body, and a fourth T-shaped retaining member coupled to the expansion cone segment body. The first and second expansion cone segments are interleaved. The first expansion cone segment bodies are complementary shaped with respect to the second expansion cone segment bodies. A split ring collar assembly is movably coupled to the exterior of the tubular support member that includes a second tubular support body that defines N T-shaped slots for movably receiving corresponding ones of the second and fourth T-shaped retaining members of the interleaved first and second expansion cone segments, and an L-shaped retaining member coupled to the second tubular support body. A tubular actuating sleeve movably coupled to the tubular support member that includes a third tubular support body that defines a slot for receiving and mating with the L-shaped retaining member of the split ring collar.

An apparatus for radially expanding a tubular member has also been described that includes a tubular support member that includes a first tubular support body defining a longitudinal passage, a first lug coupled to and extending from the first tubular support body in the radial direction, and a second lug coupled to and extending from the first tubular support body in the radial direction. An adjustable expansion cone assembly is movably coupled to the tubular support member. A first drag block assembly is movably coupled to the tubular support member that includes a first drag block body coupled to the adjustable expansion cone assembly that defines: a first J-shaped slot for receiving the first lug, and one or more first drag blocks coupled to the first drag block body. A second drag block assembly is movably coupled to the tubular support member that includes a second drag block body that defines: a second J-shaped slot for receiving the second lug, and one or more second drag blocks coupled to the second drag block body. First and second packer cups are coupled to the tubular support member between the first and second drag block assemblies.

An apparatus for radially expanding a tubular member has also been described that includes a tubular support member that includes a first tubular support body defining a longitudinal passage, a first flange coupled to the first tubular support body, a second flange coupled to the first tubular support body, a first tapered flange coupled to the first tubular support body, and a second tapered flange coupled to the first tubular support body. An adjustable expansion cone assembly is movably coupled to the tubular support member. A first collet assembly is movably coupled to the tubular support member that includes a first tubular sleeve coupled to the adjustable expansion cone assembly and defines a first counterbore for receiving the first flange, and a first radial passage, a first spring received within the first counterbore, a first retaining ring received within the first counterbore, a first load transfer pin coupled to the first retaining ring and extending through the first radial passage, a second tubular sleeve coupled to the first load transfer pin, a first resilient collet coupled to the second tubular sleeve and positioned above the first tapered flange, and a third tubular sleeve coupled to the first resilient collet. A second collet assembly is movably coupled to the tubular support member that includes a fourth tubular sleeve that defines: a second counterbore for receiving the second flange, and a second radial passage, a second spring received within the second counterbore, a second retaining ring received within the second counterbore, a second load transfer pin coupled to the second retaining ring and extending through the second radial passage, a fifth tubular sleeve coupled to the second load transfer pin, a second resilient collet coupled to the fifth tubular sleeve and positioned above the second tapered flange, and a sixth tubular sleeve coupled to the second resilient collet. First and second packer cups are coupled to the tubular support member between the first and second collet assemblies.

An apparatus for radially expanding a tubular member has also been described that includes a tubular support member that includes a first tubular support body defining a longitudinal passage, a first radial passage defined in the first tubular support body fluidicly coupled to the longitudinal passage, a first flange coupled to the first tubular support body, a second flange coupled to the first tubular support body, a first tapered flange coupled to the first tubular support body, and a second tapered flange coupled to the first tubular support body. An adjustable expansion cone assembly is movably coupled to the tubular support member. A first dog assembly is movably coupled to the tubular support member that includes a first tubular sleeve coupled to the adjustable expansion cone assembly that defines: a first counterbore for receiving the first flange, and a second radial passage, a first spring received within the first counterbore, a first retaining ring received within the first counterbore, a first load transfer pin coupled to the first retaining ring and extending through the second radial passage, a second tubular sleeve coupled to the first load transfer pin that defines: a second counterbore for receiving the first tubular sleeve, a first resilient dog coupled to the second tubular sleeve and positioned adjacent to the first tapered flange. A second dog assembly is movably coupled to the tubular support member that includes a third tubular sleeve that defines a second counterbore for receiving the second flange, a third radial passage, and a fourth radial passage fluidicly coupled to the first radial passage, a second spring received within the second counterbore, a second retaining ring received within the second counterbore, a second load transfer pin coupled to the second retaining ring and extending through the third radial passage, a fourth tubular sleeve coupled to the second load transfer pin, a second resilient dog coupled to the fourth tubular sleeve and positioned adjacent to the second tapered flange. First and second packer cups are coupled to the tubular support member between the first and second dog assemblies.

An apparatus for radially expanding a tubular member has also been described that includes a tubular support member that includes a first tubular support body defining a longitudinal passage including a throat passage, a first radial passage defined in the first tubular support body fluidicly coupled to the longitudinal passage, a first flange coupled to the first tubular support body, and a second flange coupled to the first tubular support body that defines: a second radial passage defined in the second flange fluidicly coupled to the longitudinal passage. An adjustable expansion cone assembly is movably coupled to the tubular support member. A dog assembly is movably coupled to the tubular support member that includes a first tubular sleeve coupled to the adjustable expansion cone assembly that defines a first counterbore for receiving the first flange, and a third radial passage, a spring received within the first counterbore, a retaining ring received within the first counterbore, a load transfer pin coupled to the retaining ring and extending through the third radial passage, a second tubular sleeve coupled to the first load transfer pin that defines: a first counterbore for receiving the first tubular sleeve, a second counterbore for receiving and mating with the tapered flange, and includes a third flange that defines a third counterbore for receiving the second flange, a fourth counterbore for receiving the second flange, and a fourth radial passage, and a resilient dog coupled to the second tubular sleeve and positioned adjacent to the tapered flange. First and second packer cups are coupled to the tubular support member between the resilient dog and the third flange.

An apparatus for radially expanding a tubular member has also been described that includes a tubular support member, an adjustable expansion cone assembly movably coupled to the tubular support member, and means for adjusting the adjustable expansion cone assembly.

An adjustable expansion cone assembly has also been described that includes a tubular support member. An adjustable expansion cone is movably coupled to the tubular support member that includes a plurality of expansion cone segments, and means for guiding the expansion cone segments on the tubular support member. The assembly further includes means for adjusting the adjustable expansion cone.

A method of operating an adjustable expansion cone assembly including a plurality of expansion cone segments has also been described that includes guiding the expansion cone segments on a tapered body, and controllably displacing the expansion cone segments along the tapered body.

A method of operating an adjustable expansion cone assembly including a plurality of expansion cone segments has also been described that includes guiding the expansion cone segments on a multi-sided tapered body, interlocking the expansion cone segments, and controllably displacing the expansion cone segments along the tapered body.

A method of operating an adjustable expansion cone assembly including a plurality of expansion cone segments has also been described that includes resiliently guiding the expansion cone segments on a multi-sided tapered body, guiding each of the expansion cone segments on opposite sides in the circumferential direction, interlocking the expansion cone segments, and controllably displacing the expansion cone segments along the tapered body.

A method of operating an adjustable expansion cone assembly including a plurality of expansion cone segments has also been described that includes dividing the expansion cone segments into first and second groups of expansion cone segments, interleaving the first and second groups of expansion cone segments, overlapping the first and second groups of expansion cone segments, resiliently guiding the expansion cone segments on a multi-sided tapered body, guiding each of the expansion cone segments on opposite sides in the circumferential direction, and controllably displacing the expansion cone segments along the tapered body.

A method of operating an adjustable expansion cone assembly including a plurality of expansion cone segments has also been described that includes dividing the expansion cone segments into first and second groups of expansion cone segments, interleaving the first and second groups of expansion cone segments, guiding the expansion cone segments on a multi-sided tapered body, and controllably displacing the expansion cone segments along the tapered body while also relatively displacing the first and second groups of expansion cone segments in opposite directions.

A method of plastically deforming and radially expanding an expandable tubular member using an apparatus including a tubular support member, an adjustable expansion cone assembly movably coupled to the tubular support member, and an actuator movably coupled to the tubular support member for adjusting the adjustable expansion cone assembly, has also been described that includes coupling a first end of the expandable tubular member to a tubular structure, locking the actuator to the tubular support member of the apparatus, inserting the apparatus into the first end of the expandable tubular member, moving the actuator and the adjustable expansion cone assembly of the apparatus out of the second end of the expandable tubular member, reinserting the actuator of the apparatus into the second end of the expandable tubular member, unlocking the actuator from the tubular support member of the apparatus, rotating the actuator relative to the tubular support member of the apparatus, and increasing the outside diameter of the adjustable expansion cone assembly by moving the tubular support member relative to the actuator, the adjustable expansion cone assembly and the expandable tubular member, and plastically deforming and radially expanding the expandable tubular member by moving the adjustable expansion cone assembly through the expandable tubular member.

A method of plastically deforming and radially expanding an expandable tubular member using an apparatus including a tubular support member, an adjustable expansion cone assembly movably coupled to the tubular support member, and an actuator movably coupled to the tubular support member for adjusting the adjustable expansion cone assembly, has also been described that includes coupling a first end of the expandable tubular member to a tubular structure, inserting the apparatus into the first end of the expandable tubular member in a first direction, displacing the actuator of the apparatus in a second direction opposite to the first direction, applying a resilient biasing force to the adjustable expansion cone assembly in the second direction, moving the actuator and the adjustable expansion cone assembly of the apparatus out of the second end of the expandable tubular member, reinserting the actuator of the apparatus into the second end of the expandable tubular member in the second direction, increasing the outside diameter of the adjustable expansion cone assembly by displacing the actuator and the adjustable expansion cone assembly relative to the expandable tubular member in the first direction, and plastically deforming and radially expanding the expandable tubular member by moving the adjustable expansion cone assembly through the expandable tubular member in the second direction.

An adjustable expansion cone assembly has also been described that includes a plurality of expansion cone segments, means for guiding the expansion cone segments on a tapered body, and means for controllably displacing the expansion cone segments along the tapered body.

An adjustable expansion cone assembly has also been described that includes a plurality of expansion cone segments, means for guiding the expansion cone segments on a multi-sided tapered body, means for interlocking the expansion cone segments, and means for controllably displacing the expansion cone segments along the tapered body.

An adjustable expansion cone assembly has also been described that includes a plurality of expansion cone segments, means for resiliently guiding the expansion cone segments on a multi-sided tapered body, means for guiding each of the expansion cone segments on opposite sides in the circumferential direction, means for interlocking the expansion cone segments, and means for controllably displacing the expansion cone segments along the tapered body.

An adjustable expansion cone assembly has also been described that includes a plurality of expansion cone segments, means for dividing the expansion cone segments into first and second groups of expansion cone segments, means for interleaving the first and second groups of expansion cone segments, means for overlapping the first and second groups of expansion cone segments, means for resiliently guiding the expansion cone segments on a multi-sided tapered body, means for guiding each of the expansion cone segments on opposite sides in the circumferential direction, and means for controllably displacing the expansion cone segments along the tapered body.

An adjustable expansion cone assembly has also been described that includes a plurality of expansion cone segments, means for dividing the expansion cone segments into first and second groups of expansion cone segments, means for interleaving the first and second groups of expansion cone segments, means for guiding the expansion cone segments on a multi-sided tapered body, and means for controllably displacing the expansion cone segments along the tapered body while also relatively displacing the first and second groups of expansion cone segments in opposite directions.

An apparatus for plastically deforming and radially expanding an expandable tubular member has also been described that includes a tubular support member, an adjustable expansion cone assembly movably coupled to the tubular support member, means for actuating the adjustable expansion cone assembly, means for locking the actuator to the tubular support member of the apparatus, means for unlocking the actuator from the tubular support member of the apparatus, and means for increasing the outside diameter of the adjustable expansion cone assembly by moving the tubular support member relative to the actuator, the adjustable expansion cone assembly, and the expandable tubular member.

An apparatus for plastically deforming and radially expanding an expandable tubular member has also been described that includes a tubular support member, an adjustable expansion cone assembly movably coupled to the tubular support member, means for actuating the adjustable expansion cone assembly, means for displacing the actuator of the apparatus in a first direction, means for applying a resilient biasing force to the adjustable expansion cone assembly when the actuator is displaced in the first direction, and means for increasing the outside diameter of the adjustable expansion cone assembly by displacing the actuator and the adjustable expansion cone assembly relative to the expandable tubular member in a second direction opposite to the first direction.

Although illustrative embodiments of the invention have been shown and described, a wide range of modification, changes and substitution is contemplated in the foregoing disclosure. In some instances, some features of the present invention may be employed without a corresponding use of the other features. Accordingly, it is appropriate that the appended claims be construed broadly and in a manner consistent with the scope of the invention.

The invention claimed is:

1. An apparatus for radially expanding a tubular member, comprising:

a tubular support member comprising:

a first tubular support body defining a longitudinal passage;

a first lug coupled to and extending from the first tubular support body in the radial direction;

a second lug coupled to and extending from the first tubular support body in the radial direction; and an expansion cone support body coupled to the first tubular support body comprising:

an N-sided tapered tubular support member;

wherein each side of the multi-sided tapered tubular support member defines a T-shaped slot;

N expansion cone segments movably coupled to the expansion cone support body, each comprising:

an expansion cone segment body including arcuate conical outer surfaces;

a first T-shaped retaining member coupled to the expansion cone segment body for movably coupling the expansion cone segment body to a corresponding one of the T-shaped slots of the expansion cone support body; and a second T-shaped retaining member coupled to the expansion cone segment body;

a split ring collar assembly movably coupled to the exterior of the tubular support member comprising:

a second tubular support body defining:

N T-shaped slots for movably receiving corresponding ones of the second T-shaped retaining members of the expansion cone segments; and an L-shaped retaining member coupled to the second tubular support body;

a first drag block assembly movably coupled to the tubular support member that comprises:

a first drag block body defining:

a slot for receiving and mating with the L-shaped retaining member of the split ring collar; and a first J-shaped slot for receiving the first lug; and one or more first drag blocks coupled to the first drag block body;

a second drag block assembly movably coupled to the tubular support member that comprises:

a second drag block body defining:

a second J-shaped slot for receiving the second lug; and one or more second drag blocks coupled to the second drag block body; and first and second packer cups coupled to the tubular support member between the first and second drag block assemblies.

2. An apparatus for radially expanding a tubular member, comprising:

a tubular support member comprising:

a first tubular support body defining a longitudinal passage;

a first flange coupled to the first tubular support body;

a second flange coupled to the first tubular support body;

a first tapered flange coupled to the first tubular support body;

a second tapered flange coupled to the first tubular support body; and an expansion cone support body coupled to the first tubular support body comprising:

an N-sided tapered tubular support member;

wherein each side of the multi-sided tapered tubular support member defines a T-shaped slot;

N expansion cone segments movably coupled to the expansion cone support body, each comprising:

an expansion cone segment body including arcuate conical outer surfaces;

a first T-shaped retaining member coupled to the expansion cone segment body for movably coupling the expansion cone segment body to a corresponding one of the T-shaped slots of the expansion cone support body; and a second T-shaped retaining member coupled to the expansion cone segment body;

a split ring collar movably coupled to the exterior of the tubular support member comprising:

a second tubular support body that defines:

N T-shaped slots for movably receiving corresponding ones of the second T-shaped retaining members of the expansion cone segments; and an L-shaped retaining member coupled to the second tubular support body;

a first collet assembly movably coupled to the tubular support member that comprises:

a first tubular sleeve defining:

a slot for receiving and mating with the L-shaped retaining member of the split ring collar;

a first counterbore for receiving the first flange; and a first radial passage;

a first spring received within the first counterbore;

a first retaining ring received within the first counterbore;

a first load transfer pin coupled to the first retaining ring and extending through the first radial passage;

a second tubular sleeve coupled to the first load transfer pin;

a first resilient collet coupled to the second tubular sleeve and positioned above the first tapered flange; and a third tubular sleeve coupled to the first resilient collet;

a second collet assembly movably coupled to the tubular support member that comprises:

a fourth tubular sleeve defining:

a second counterbore for receiving the second flange; and a second radial passage;

a second spring received within the second counterbore;

a second retaining ring received within the second counterbore;

a second load transfer pin coupled to the second retaining ring and extending through the second radial passage;

a fifth tubular sleeve coupled to the second load transfer pin;

a second resilient collet coupled to the fifth tubular sleeve and positioned above the second tapered flange; and a sixth tubular sleeve coupled to the second resilient collet; and first and second packer cups coupled to the tubular support member between the first and second collet assemblies.

3. An apparatus for radially expanding a tubular member, comprising:

a tubular support member comprising:

a first tubular support body defining a longitudinal passage;

a first radial passage defined in the first tubular support body fluidicly coupled to the longitudinal passage;

a first flange coupled to the first tubular support body;

a second flange coupled to the first tubular support body;

a first tapered flange coupled to the first tubular support body;

a second tapered flange coupled to the first tubular support body; and an expansion cone support body coupled to the first tubular support body comprising:

an N-sided tapered tubular support member;

wherein each side of the multi-sided tapered tubular support member defines a T-shaped slot;

N expansion cone segments movably coupled to the expansion cone support body, each comprising:

an expansion cone segment body including arcuate conical outer surfaces;

a first T-shaped retaining member coupled to the expansion cone segment body for movably coupling the expansion cone segment body to a corresponding one of the T-shaped slots of the expansion cone support body; and a second T-shaped retaining member coupled to the expansion cone segment body;

a split ring collar movably coupled to the exterior of the tubular support member comprising:
a second tubular support body defining:
N T-shaped slots for movably receiving corresponding ones of the second T-shaped retaining members of the expansion cone segments; and
an L-shaped retaining member coupled to the second tubular support body;
a first dog assembly movably coupled to the tubular support member that comprises:
a first tubular sleeve defining:
a slot for receiving and mating with the L-shaped retaining member of the split ring collar;
a first counterbore for receiving the first flange; and
a second radial passage;
a first spring received within the first counterbore;
a first retaining ring received within the first counterbore;
a first load transfer pin coupled to the first retaining ring and extending through the second radial passage;
a second tubular sleeve coupled to the first load transfer pin defining:
a second counterbore for receiving the first tubular sleeve;
a first resilient dog coupled to the second tubular sleeve and positioned adjacent to the first tapered flange;
a second dog assembly movably coupled to the tubular support member that comprises:
a third tubular sleeve defining:
a second counterbore for receiving the second flange;
a third radial passage; and
a fourth radial passage fluidicly coupled to the first radial passage;
a second spring received within the second counterbore;
a second retaining ring received within the second counterbore;
a second load transfer pin coupled to the second retaining ring and extending through the third radial passage;
a fourth tubular sleeve coupled to the second toad transfer pin;
a second resilient dog coupled to the fourth tubular sleeve and positioned adjacent to the second tapered flange; and
first and second packer cups coupled to the tubular support member between the first and second dog assemblies.

4. An apparatus for radially expanding a tubular member, comprising:
a tubular support member comprising:
a first tubular support body defining a longitudinal passage including a throat passage;
a first radial passage defined in the first tubular support body fluidicly coupled to the longitudinal passage;
a first flange coupled to the first tubular support body;
a second flange coupled to the first tubular support body defining:
a second radial passage defined in the second flange fluidicly coupled to the longitudinal passage;
a tapered flange coupled to the first tubular support body; and
an expansion cone support body coupled to the first tubular support body comprising:
an N-sided tapered tubular support member;
wherein each side of the multi-sided tapered tubular support member defines a T-shaped slot;
N expansion cone segments movably coupled to the expansion cone support body, each comprising:
an expansion cone segment body including arcuate conical outer surfaces;
a first T-shaped retaining member coupled to the expansion cone segment body for movably coupling the expansion cone segment body to a corresponding one of the T-shaped slots of the expansion cone support body; and
a second T-shaped retaining member coupled to the expansion cone segment body;
a split ring collar movably coupled to the exterior of the tubular support member comprising:
a second tubular support body defining:
N T-shaped slots for movably receiving corresponding ones of the second T-shaped retaining members of the expansion cone segments; and
an L-shaped retaining member coupled to the second tubular support body;
a dog assembly movably coupled to the tubular support member that comprises:
a first tubular sleeve defining:
a slot for receiving and mating with the L-shaped retaining member of the split ring collar;
a first counterbore for receiving the first flange; and
a third radial passage;
a spring received within the first counterbore;
a retaining ring received within the first counterbore;
a load transfer pin coupled to the retaining ring and extending through the third radial passage;
a second tubular sleeve coupled to the first load transfer pin that defines:
a first counterbore for receiving the first tubular sleeve;
a second counterbore for receiving and mating with the tapered flange; and
comprises:
a third flange defining:
a third counterbore for receiving the second flange;
a fourth counterbore for receiving the second flange; and
a fourth radial passage; and
a resilient dog coupled to the second tubular sleeve and positioned adjacent to the tapered flange; and
first and second packer cups coupled to the tubular support member between the resilient dog and the third flange.

5. An adjustable expansion cone assembly, comprising:
a tubular support member comprising:
a tubular support body; and
an expansion cone support body coupled to the tubular support body comprising:
an N-sided tapered tubular support member;
wherein each side of the multi-sided tapered tubular support member defines a T-shaped slot;
N expansion cone segments movably coupled to the expansion cone support body, each comprising:
an expansion cone segment body including arcuate conical outer surfaces;
a first T-shaped retaining member coupled to the expansion cone segment body for movably coupling the expansion cone segment body to a corresponding one of the T-shaped slots of the expansion cone support body; and
a second T-shaped retaining member coupled to the expansion cone segment body;
a split ring collar movably coupled to the exterior of the tubular support member comprising:

a second tubular support body defining:

N T-shaped slots for movably receiving corresponding ones of the second T-shaped retaining members of the expansion cone segments; and an L-shaped retaining member coupled to the second tubular support body; and a tubular actuating sleeve movably coupled to the tubular support member that comprises:

a third tubular support body defining:

a slot for receiving and mating with the L-shaped retaining member of the split ring collar.

6. An adjustable expansion cone assembly, comprising:

a tubular support member comprising:

a first tubular support body; and an expansion cone support body coupled to the tubular support body comprising:

a tapered tubular support member defining N stepped slots;

an expansion cone assembly movably coupled to the tubular support member comprising:

a second tubular support body movably coupled to the first tubular support body defining an L-shaped slot; and N expansion cone segments extending from the second tubular support member, each expansion cone segment comprising:

a resilient collet coupled to the second tubular support member;

an expansion cone segment body coupled to the resilient collet including arcuate conical outer surfaces; and a retaining member coupled to the expansion cone segment body for movably coupling the expansion cone segment body to a corresponding one of the stepped slots of the expansion cone support body;

a split ring collar movably coupled to the exterior of the tubular support member comprising:

a third tubular support body;

a first L-shaped retaining member coupled to the third tubular support body for mating with the L-shaped slot of the second tubular support body of the expansion cone assembly; and a second L-shaped retaining member coupled to the third tubular body; and a tubular actuating sleeve movably coupled to the tubular support member that comprises:

a third tubular support body defining:

a slot for receiving and mating with the second L-shaped retaining member of the split ring collar.

7. An adjustable expansion cone assembly, comprising:

a tubular support member comprising:

a first tubular support body; and expansion cone support body coupled to the tubular support body comprising:

a tapered tubular support member defining N slots;

an expansion cone assembly movably coupled to the tubular support member comprising:

a second tubular support body movably coupled to the first tubular support body defining an L-shaped slot; and N expansion cone segments extending from the second tubular support member, each expansion cone segment comprising:

a resilient collet coupled to the second tubular support member;

an expansion cone segment body coupled to the resilient collet including arcuate conical outer surfaces; and a retaining member coupled to the expansion cone segment body for movably coupling the expansion cone segment body to a corresponding one of the slots of the expansion cone support body;

a split ring collar movably coupled to the exterior of the tubular support member comprising:

a third tubular support body;

a first 1-shaped retaining member coupled to the third tubular support body for mating with the L-shaped slot of the second tubular support body; and a second L-shaped retaining member coupled to the third tubular support body; and a tubular actuating sleeve movably coupled to the tubular support member that comprises:

a third tubular support body defining:

a slot for receiving and mating with the second L-shaped retaining member of the split ring collar.

8. An adjustable expansion cone assembly, comprising:

a tubular support member comprising:

a first tubular support body; and an expansion cone support body coupled to the tubular support body comprising:

a tapered tubular support member defining N slots;

an expansion cone assembly movably coupled to the tubular support member comprising:

a second tubular support body movably coupled to the first tubular support body defining an L-shaped slot; and N/2 first expansion cone segments extending from the second tubular support member, each first expansion cone segment comprising:

a first resilient collet coupled to the second tubular support member;

a first expansion cone segment body coupled to the resilient collet including arcuate conical outer surfaces; and a first retaining member coupled to the expansion cone segment body for movably coupling the expansion cone segment body to a corresponding one of the slots of the expansion cone support body;

N/2 second expansion cone segments extending from the second tubular support member, each second expansion cone segment comprising:

a second resilient collet coupled to the second tubular support member;

a second expansion cone segment body coupled to the resilient collet including arcuate conical outer surfaces; and a second retaining member coupled to the expansion cone segment body for movably coupling the expansion cone segment body to a corresponding one of the slots of the expansion cone support body;

wherein the second expansion cone segments overlap and are interleaved with the first expansion cone segments;

a split ring collar movably coupled to the exterior of the tubular support member comprising:

a third tubular support body;

a first L-shaped retaining member coupled to the third tubular support body for mating with L-shaped slot of the second tubular support body; and a second L-shaped retaining member coupled to the third tubular support body; and a tubular actuating sleeve movably coupled to the tubular support member that comprises:
a third tubular support body defining:
a slot for receiving and mating with the second L-shaped retaining member of the split ring collar.

9. An adjustable expansion cone assembly, comprising:
a tubular support member comprising:
a first tubular support body; and
an expansion cone support body coupled to the first tubular support body comprising:
an N-sided tapered tubular support member;
wherein each side of the multi-sided tapered tubular support member defines a T-shaped slot;
N/2 first expansion cone segments movably coupled to the expansion cone support body, each comprising:
a first expansion cone segment body including arcuate conical outer surfaces;
a first T-shaped retaining member coupled to the first expansion cone segment body for movably coupling the first expansion cone segment body to a corresponding one of the T-shaped slots of the expansion cone support body; and
a second T-shaped retaining member coupled to the first expansion cone segment body;
N/2 second expansion cone segments movably coupled to the expansion cone support body, each comprising:
a second expansion cone segment body including arcuate conical outer surfaces;
a third T-shaped retaining member coupled to the second expansion cone segment body for movably coupling the second expansion cone segment body to a corresponding one of the T-shaped slots of the expansion cone support body; and
a fourth T-shaped retaining member coupled to the expansion cone segment body;
wherein the first and second expansion cone segments are interleaved;
wherein the first expansion cone segment bodies are complementary shaped with respect to the second expansion cone segment bodies;
a split ring collar assembly movably coupled to the exterior of the tubular support member comprising:
a second tubular support body defining:
N T-shaped slots for movably receiving corresponding ones of the second and fourth T-shaped retaining members of the interleaved first and second expansion cone segments; and
an L-shaped retaining member coupled to the second tubular support body; and
a tubular actuating sleeve movably coupled to the tubular support member that comprises:
a third tubular support body defining:
a slot for receiving and mating with the L-shaped retaining member of the split ring collar.

10. An apparatus for radially expanding a tubular member, comprising:
a tubular support member comprising:
a first tubular support body defining a longitudinal passage;
a first lug coupled to and extending from the first tubular support body in the radial direction; and
a second lug coupled to and extending from the first tubular support body in the radial direction;
an adjustable expansion cone assembly movably coupled to the tubular support member;
a first drag block assembly movably coupled to the tubular support member that comprises:
a first drag block body coupled to the adjustable expansion cone assembly defining:
a first J-shaped slot for receiving the first lug; and
one or more first drag blocks coupled to the first drag block body;
a second drag block assembly movably coupled to the tubular support member that comprises:
a second drag block body defining:
a second J-shaped slot for receiving the second lug; and
one or more second drag blocks coupled to the second drag block body; and
first and second packer cups coupled to the tubular support member between the first and second drag block assemblies.

11. The apparatus of claim 10, wherein the tubular support member further comprises:
an expansion cone support body coupled to the first tubular support body comprising:
an N-sided tapered tubular support member;
wherein each side of the multi-sided tapered tubular support member defines a T-shaped slot;
wherein the adjustable expansion cone assembly comprises:
N expansion cone segments movably coupled to the expansion cone support body, each comprising:
an expansion cone segment body including arcuate conical outer surfaces;
a first T-shaped retaining member coupled to the expansion cone segment body for movably coupling the expansion cone segment body to a corresponding one of the T-shaped slots of the expansion cone support body; and
a second T-shaped retaining member coupled to the expansion cone segment body; and
a split ring collar movably coupled to the exterior of the tubular support member comprising:
a second tubular support body defining:
N T-shaped slots for movably receiving corresponding ones of the second T-shaped retaining members of the expansion cone segments; and
an L-shaped retaining member coupled to the second tubular support body; and
wherein the first drag block body further defines:
a slot for receiving and mating with the L-shaped retaining member of the split ring collar.

12. The apparatus of claim 10, wherein the tubular support member further comprises:
an expansion cone support body coupled to the tubular support body comprising:
a tapered tubular support member defining N stepped slots;
wherein the adjustable expansion cone assembly comprises:
an expansion cone assembly movably coupled to the tubular support member comprising:
a second tubular support body movably coupled to the first tubular support body defining an L-shaped slot; and
N expansion cone segments extending from the second tubular support member, each expansion cone segment comprising:
a resilient collet coupled to the second tubular support member;
an expansion cone segment body coupled to the resilient collet including arcuate conical outer surfaces; and a retaining member coupled to the expansion cone segment body for movably coupling the expansion cone segment body to a corresponding one of the stepped slots of the expansion cone support body; and a split ring collar movably coupled to the exterior of the tubular support member comprising:

a third tubular support body:

a first L-shaped retaining member coupled to the third tubular support body for mating with the L-shaped slot of the second tubular support body; and a second L-shaped retaining member coupled to the third tubular support member;

wherein the first drag block body further defines:

a slot for receiving and mating with the second t-shaped retaining member of the split ring collar.

13. The apparatus of claim 10, wherein the tubular support member further comprises:

an expansion cone support body coupled to the first tubular support body comprising:

a tapered tubular support member defining N slots;

wherein the adjustable expansion cone assembly comprises:

an expansion cone assembly movably coupled to the tubular support member comprising:

a second tubular support body movably coupled to the first tubular support body defining an L-shaped slot; and N expansion cone segments extending from the second tubular support member, each expansion cone segment comprising:

a resilient collet coupled to the second tubular support member;

an expansion cone segment body coupled to the resilient collet including arcuate conical outer surfaces; and a retaining member coupled to the expansion cone segment body for movably coupling the expansion cone segment body to a corresponding one of the slots of the expansion cone support body; and a split ring collar movably coupled to the exterior of the tubular support member comprising:

a third tubular support body;

a first L-shaped retaining member coupled to the third tubular support body for mating with L-shaped slot of the second tubular support body; and a second L-shaped retaining member coupled to the third tubular support body;

wherein the first drag block body further defines:

a slot for receiving and mating with the second L-shaped retaining member of the split ring collar.

14. The apparatus of claim 10, wherein the tubular support member further comprises:

an expansion cone support body coupled to the tubular support body comprising:

a tapered tubular support member defining N slots;

wherein the adjustable expansion cone assembly comprises:

an expansion cone assembly movably coupled to the tubular support member comprising:

a second tubular support body movably coupled to the first tubular support body defining an L-shaped slot; and N/2 first expansion cone segments extending from the second tubular support member, each first expansion cone segment comprising:

a first resilient collet coupled to the second tubular support member;

a first expansion cone segment body coupled to the resilient collet including arcuate conical outer surfaces; and a first retaining member coupled to the expansion cone segment body for movably coupling the expansion cone segment body to a corresponding one of the slots of the expansion cone support body;

N/2 second expansion cone segments extending from the second tubular support member, each second expansion cone segment comprising:

a second resilient collet coupled to the second tubular support member;

a second expansion cone segment body coupled to the resilient collet including arcuate conical outer surfaces; and a second retaining member coupled to the expansion cone segment body for movably coupling the expansion cone segment body to a corresponding one of the slots of the expansion cone support body;

wherein the second expansion cone segments overlap and are interleaved with the first expansion cone segments; and a split ring collar movably coupled to the exterior of the tubular support member comprising:

a third tubular support body;

a first L-shaped retaining member coupled to the third tubular support body for mating with the 1-shaped slot of the second tubular support body; and a second L-shaped retaining member coupled to the third tubular support body;

wherein the first drag block body further defines:

a slot for receiving and mating with the second L-shaped retaining member of the split ring collar.

15. The apparatus of claim 10, wherein the tubular support member further comprises:

an expansion cone support body coupled to the first tubular support body comprising:

an N-sided tapered tubular support member;

wherein each side of the multi-sided tapered tubular support member defines a T-shaped slot;

wherein the adjustable expansion cone assembly comprises:

N12 first expansion cone segments movably coupled to the expansion cone support body, each comprising:

a first expansion cone segment body including arcuate conical outer surfaces;

a first T-shaped retaining member coupled to the first expansion cone segment body for movably coupling the first expansion cone segment body to a corresponding one of the T-shaped slots of the expansion cone support body; and a second T-shaped retaining member coupled to the first expansion cone segment body;

N/2 second expansion cone segments movably coupled to the expansion cone support body, each comprising:

a second expansion cone segment body including arcuate conical outer surfaces;

a third T-shaped retaining member coupled to the second expansion cone segment body for movably coupling the second expansion cone segment body to a corresponding one of the T-shaped slots of the expansion cone support body; and a fourth T-shaped retaining member coupled to the expansion cone segment body;

wherein the first and second expansion cone segments are interleaved;

wherein the first expansion cone segment bodies are complementary shaped with respect to the second expansion cone segment bodies; and a split ring collar assembly movably coupled to the exterior of the tubular support member comprising:

a second tubular support body defining:

N T-shaped slots for movably receiving corresponding ones of the second and fourth T-shaped retaining members of the interleaved first and second expansion cone segments; and an L-shaped retaining member coupled to the second tubular support body; and wherein the first drag block body further defines:

a slot for receiving and mating with the L-shaped retaining member of the split ring collar.

16. An apparatus for radially expanding a tubular member, comprising:

a tubular support member comprising:

a first tubular support body defining a longitudinal passage;

a first flange coupled to the first tubular support body;

a second flange coupled to the first tubular support body;

a first tapered flange coupled to the first tubular support body; and a second tapered flange coupled to the first tubular support body;

an adjustable expansion cone assembly movably coupled to the tubular support member;

a first collet assembly movably coupled to the tubular support member that comprises:

a first tubular sleeve coupled to the adjustable expansion cone assembly and defining:

a first counterbore for receiving the first flange; and a first radial passage;

a first spring received within the first counterbore;

a first retaining ring received within the first counterbore;

a first load transfer pin coupled to the first retaining ring and extending through the first radial passage;

a second tubular sleeve coupled to the first load transfer pin;

a first resilient collet coupled to the second tubular sleeve and positioned above the first tapered flange; and a third tubular sleeve coupled to the first resilient collet;

a second collet assembly movably coupled to the tubular support member that comprises:

a fourth tubular sleeve defining:

a second counterbore for receiving the second flange; and a second radial passage;

a second spring received within the second counterbore;

a second retaining ring received within the second counterbore;

a second load transfer pin coupled to the second retaining ring and extending through the second radial passage;

a fifth tubular sleeve coupled to the second load transfer pin;

a second resilient collet coupled to the fifth tubular sleeve and positioned above the second tapered flange; and a sixth tubular sleeve coupled to the second resilient collet; and first and second packer cups coupled to the tubular support member between the first and second collet assemblies.

17. The apparatus of claim 16, wherein the tubular support member further comprises:

an expansion cone support body coupled to the first tubular support body comprising:

an N-sided tapered tubular support member;

wherein each side of the multi-sided tapered tubular support member defines a T-shaped slot;

wherein the adjustable expansion cone assembly comprises:

N expansion cone segments movably coupled to the expansion cone support body, each comprising:

an expansion cone segment body including arcuate conical outer surfaces;

a first T-shaped retaining member coupled to the expansion cone segment body for movably coupling the expansion cone segment body to a corresponding one of the T-shaped slots of the expansion cone support body; and a second T-shaped retaining member coupled to the expansion cone segment body; and a split ring collar movably coupled to the exterior of the tubular support member comprising:

a second tubular support body defining:

N T-shaped slots for movably receiving corresponding ones of the second T-shaped retaining members of the expansion cone segments; and an L-shaped retaining member coupled to the second tubular support body; and wherein the first tubular sleeve of the first collet assembly further defines:

a slot for receiving and mating with the L-shaped retaining member of the split ring collar.

18. The apparatus of claim 16, wherein the tubular support member further comprises:

an expansion cone support body coupled to the tubular support body comprising:

a tapered tubular support member defining N stepped slots;

wherein the adjustable expansion cone assembly comprises:

an expansion cone assembly movably coupled to the tubular support member comprising:

a second tubular support body movably coupled to the first tubular support body defining an L-shaped slot; and N expansion cone segments extending from the second tubular support member, each expansion cone segment comprising:

a resilient collet coupled to the second tubular support member;

an expansion cone segment body coupled to the resilient collet including arcuate conical outer surfaces; and a retaining member coupled to the expansion cone segment body for movably coupling the expansion cone segment body to a corresponding one of the stepped slots of the expansion cone support body; and a split ring collar movably coupled to the exterior of the tubular support member comprising:

a third tubular support body:

a first L-shaped retaining member coupled to the third tubular support body for mating with the L-shaped slot of the second tubular support body; and a second L-shaped retaining member coupled to the third tubular support member;

wherein the first tubular sleeve of the first collet assembly further defines:

a slot for receiving and mating with the second L-shaped retaining member of the split ring collar.

19. The apparatus of claim 16, wherein the tubular support member further comprises:

an expansion cone support body coupled to the first tubular support body comprising:

a tapered tubular support member defining N slots;

wherein the adjustable expansion cone assembly comprises:

an expansion cone assembly movably coupled to the tubular support member comprising:

a second tubular support body movably coupled to the first tubular support body defining an L-shaped slot; and N expansion cone segments extending from the second tubular support member, each expansion cone segment comprising:

a resilient collet coupled to the second tubular support member;

an expansion cone segment body coupled to the resilient collet including arcuate conical outer surfaces; and a retaining member coupled to the expansion cone segment body for movably coupling the expansion cone segment body to a corresponding one of the slots of the expansion cone support body; and a split ring collar movably coupled to the exterior of the tubular support member comprising:

a third tubular support body;

a first L-shaped retaining member coupled to the third tubular support body for mating with L-shaped slot of the second tubular support body; and a second L-shaped retaining member coupled to the third tubular support body;

wherein the first tubular sleeve of the first collet assembly further defines:

a slot for receiving and mating with the second L-shaped retaining member of the split ring collar.

20. The apparatus of claim 16, wherein the tubular support member further comprises:

an expansion cone support body coupled to the tubular support body comprising:

a tapered tubular support member defining N slots;

wherein the adjustable expansion cone assembly comprises:

an expansion cone assembly movably coupled to the tubular support member comprising:

a second tubular support body movably coupled to the first tubular support body defining an L-shaped slot; and N/2 first expansion cone segments extending from the second tubular support member, each first expansion cone segment comprising:

a first resilient collet coupled to the second tubular support member;

a first expansion cone segment body coupled to the resilient collet including arcuate conical outer surfaces; and a first retaining member coupled to the expansion cone segment body for movably coupling the expansion cone segment body to a corresponding one of the slots of the expansion cone support body;

N/2 second expansion cone segments extending from the second tubular support member, each second expansion cone segment comprising:

a second resilient collet coupled to the second tubular support member;

a second expansion cone segment body coupled to the resilient collet including arcuate conical outer surfaces; and a second retaining member coupled to the expansion cone segment body for movably coupling the expansion cone segment body to a corresponding one of the slots of the expansion cone support body;

wherein the second expansion cone segments overlap and are interleaved with the first expansion cone segments; and a split ring collar movably coupled to the exterior of the tubular support member comprising:

a third tubular support body;

a first L-shaped retaining member coupled to the third tubular support body for mating with the L-shaped slot of the second tubular support body; and a second L-shaped retaining member coupled to the third tubular support body;

wherein the first tubular sleeve of the first collet assembly further defines:

a slot for receiving and mating with the second L-shaped retaining member of the split ring collar.

21. The apparatus of claim 16, wherein the tubular support member further comprises:

an expansion cone support body coupled to the first tubular support body comprising:

an N-sided tapered tubular support member;

wherein each side of the multi-sided tapered tubular support member defines a T-shaped slot;

wherein the adjustable expansion cone assembly comprises:

N/2 first expansion cone segments movably coupled to the expansion cone support body, each comprising:

a first expansion cone segment body including arcuate conical outer surfaces;

a first T-shaped retaining member coupled to the first expansion cone segment body for movably coupling the first expansion cone segment body to a corresponding one of the T-shaped slots of the expansion cone support body; and a second T-shaped retaining member coupled to the first expansion cone segment body;

N/2 second expansion cone segments movably coupled to the expansion cone support body, each comprising:

a second expansion cone segment body including arcuate conical outer surfaces;

a third T-shaped retaining member coupled to the second expansion cone segment body for movably coupling the second expansion cone segment body to a corresponding one of the T-shaped slots of the expansion cone support body; and a fourth T-shaped retaining member coupled to the expansion cone segment body;

wherein the first and second expansion cone segments are interleaved;

wherein the first expansion cone segment bodies are complementary shaped with respect to the second expansion cone segment bodies; and a split ring collar assembly movably coupled to the exterior of the tubular support member comprising:

a second tubular support body defining:

N T-shaped slots for movably receiving corresponding ones of the second and fourth T-shaped retaining members of the interleaved first and second expansion cone segments; and an L-shaped retaining member coupled to the second tubular support body; and wherein the first tubular sleeve of the first collet assembly further defines:

a slot for receiving and mating with the L-shaped retaining member of the split ring collar.

22. An apparatus for radially expanding a tubular member, comprising:

a tubular support member comprising:

a first tubular support body defining a longitudinal passage;

a first radial passage defined in the first tubular support body fluidicly coupled to the longitudinal passage;

a first flange coupled to the first tubular support body;

a second flange coupled to the first tubular support body;

a first tapered flange coupled to the first tubular support body; and a second tapered flange coupled to the first tubular support body;

an adjustable expansion cone assembly movably coupled to the tubular support member;

a first dog assembly movably coupled to the tubular support member that comprises:

a first tubular sleeve coupled to the adjustable expansion cone assembly defining:

a first counterbore for receiving the first flange; and a second radial passage;

a first spring received within the first counterbore;

a first retaining ring received within the first counterbore;

a first load transfer pin coupled to the first retaining ring and extending through the second radial passage;

a second tubular sleeve coupled to the first load transfer pin defining:

a second counterbore for receiving the first tubular sleeve;

a first resilient dog coupled to the second tubular sleeve and positioned adjacent to the first tapered flange;

a second dog assembly movably coupled to the tubular support member that comprises:

a third tubular sleeve defining:

a second counterbore for receiving the second flange;

a third radial passage; and a fourth radial passage fluidicly coupled to the first radial passage;

a second spring received within the second counterbore;

a second retaining ring received within the second counterbore;

a second load transfer pin coupled to the second retaining ring and extending through the third radial passage;

a fourth tubular sleeve coupled to the second load transfer pin;

a second resilient dog coupled to the fourth tubular sleeve and positioned adjacent to the second tapered flange; and first and second packer cups coupled to the tubular support member between the first and second dog assemblies.

23. The apparatus of claim 22, wherein the tubular support member further comprises:

an expansion cone support body coupled to the first tubular support body comprising:

an N-sided tapered tubular support member;

wherein each side of the multi-sided tapered tubular support member defines a T-shaped slot;

wherein the adjustable expansion cone assembly comprises:

N expansion cone segments movably coupled to the expansion cone support body, each comprising:

an expansion cone segment body including arcuate conical outer surfaces;

a first T-shaped retaining member coupled to the expansion cone segment body for movably coupling the expansion cone segment body to a corresponding one of the T-shaped slots of the expansion cone support body; and a second T-shaped retaining member coupled to the expansion cone segment body; and a split ring collar movably coupled to the exterior of the tubular support member comprising:

a second tubular support body defining:

N T-shaped slots for movably receiving corresponding ones of the second T-shaped retaining members of the expansion cone segments; and an L-shaped retaining member coupled to the second tubular support body; and wherein the first tubular sleeve of the first dog assembly further defines:

a slot for receiving and mating with the L-shaped retaining member of the split ring collar.

24. The apparatus of claim 22, wherein the tubular support member further comprises:

an expansion cone support body coupled to the tubular support body comprising:

a tapered tubular support member defining N stepped slots;

wherein the adjustable expansion cone assembly comprises:

an expansion cone assembly movably coupled to the tubular support member comprising:

a second tubular support body movably coupled to the first tubular support body defining an L-shaped slot; and N expansion cone segments extending from the second tubular support member, each expansion cone segment comprising:

a resilient collet coupled to the second tubular support member;

an expansion cone segment body coupled to the resilient collet including arcuate conical outer surfaces; and a retaining member coupled to the expansion cone segment body for movably coupling the expansion cone segment body to a corresponding one of the stepped slots of the expansion cone support body; and a split ring collar movably coupled to the exterior of the tubular support member comprising:

a third tubular support body:

a first L-shaped retaining member coupled to the third tubular support body for mating with the L-shaped slot of the second tubular support body; and a second L-shaped retaining member coupled to the third tubular support member; and wherein the first tubular sleeve of the first dog assembly further defines:

a slot for receiving and mating with the second L-shaped retaining member of the split ring collar.

25. The apparatus of claim 22, wherein the tubular support member further comprises:

an expansion cone support body coupled to the first tubular support body comprising:

a tapered tubular support member defining N slots;

wherein the adjustable expansion cone assembly comprises:

an expansion cone assembly movably coupled to the tubular support member comprising:

a second tubular support body movably coupled to the first tubular support body defining an L-shaped slot; and N expansion cone segments extending from the second tubular support member, each expansion cone segment comprising:

a resilient collet coupled to the second tubular support member;

an expansion cone segment body coupled to the resilient collet including arcuate conical outer surfaces; and a retaining member coupled to the expansion cone segment body for movably coupling the expansion cone segment body to a corresponding one of the slots of the expansion cone support body; and a split ring collar movably coupled to the exterior of the tubular support member comprising:

a third tubular support body;

a first L-shaped retaining member coupled to the third tubular support body for mating with L-shaped slot of the second tubular support body; and a second L-shaped retaining member coupled to the third tubular support body; and wherein the first tubular sleeve of the first dog assembly further defines:

a slot for receiving and mating with the second L-shaped retaining member of the split ring collar.

26. The apparatus of claim 22, wherein the tubular support member further comprises:

an expansion cone support body coupled to the tubular support body comprising:

a tapered tubular support member defining N slots;

wherein the adjustable expansion cone assembly comprises:

an expansion cone assembly movably coupled to the tubular support member comprising:

a second tubular support body movably coupled to the first tubular support body defining an L-shaped slot; and N/2 first expansion cone segments extending from the second tubular support member, each first expansion cone segment comprising:

a first resilient collet coupled to the second tubular support member;

a first expansion cone segment body coupled to the resilient collet including arcuate conical outer surfaces; and a first retaining member coupled to the expansion cone segment body for movably coupling the expansion cone segment body to a corresponding one of the slots of the expansion cone support body;

N/2 second expansion cone segments extending from the second tubular support member, each second expansion cone segment comprising:

a second resilient collet coupled to the second tubular support member;

a second expansion cone segment body coupled to the resilient collet including arcuate conical outer surfaces; and a second retaining member coupled to the expansion cone segment body for movably coupling the expansion cone segment body to a corresponding one of the slots of the expansion cone support body;

wherein the second expansion cone segments overlap and are interleaved with the first expansion cone segments; and a split ring collar movably coupled to the exterior of the tubular support member comprising:

a third tubular support;

a first L-shaped retaining member coupled to the third tubular support body for mating with the L-shaped slot of the second tubular support body; and a second L-shaped retaining member coupled to the third tubular support body; and wherein the first tubular sleeve of the first dog assembly further defines:

a slot for receiving and mating with the second L-shaped retaining member of the split ring collar.

27. The apparatus of claim 22, wherein the tubular support member further comprises:

an expansion cone support body coupled to the first tubular support body comprising:

an N-sided tapered tubular support member;

wherein each side of the multi-sided tapered tubular support member defines a T-shaped slot;

wherein the adjustable expansion cone assembly comprises:

N/2 first expansion cone segments movably coupled to the expansion cone support body, each comprising:

a first expansion cone segment body including arcuate conical outer surfaces;

a first T-shaped retaining member coupled to the first expansion cone segment body for movably coupling the first expansion cone segment body to a corresponding on of the T-shaped slots of the expansion cone support body; and a second T-shaped retaining member coupled to the first expansion cone segment body;

N/2 second expansion cone segments movably coupled to the expansion cone support body, each comprising:

a second expansion cone segment body including arcuate conical outer surfaces;

a third T-shaped retaining member coupled to the second expansion cone segment body for movably coupling the second expansion cone segment body to a corresponding one of the T-shaped slots of the expansion cone support body; and a fourth T-shaped retaining member coupled to the expansion cone segment body;

wherein the first and second expansion cone segments are interleaved;

wherein the first expansion cone segment bodies are complementary shaped with respect to the second expansion cone segment bodies; and a split ring collar assembly movably coupled to the exterior of the tubular support member comprising:
a second tubular support body defining:
N T-shaped slots for movably receiving corresponding ones of the second and fourth T-shaped retaining members of the interleaved first and second expansion cone segments; and
an L-shaped retaining member coupled to the second tubular support body; and
wherein the first tubular sleeve of the first dog assembly further defines:
a slot for receiving and mating with the L-shaped retaining member of the split ring collar.

28. An apparatus for radially expanding a tubular member, comprising:
a tubular support member comprising:
a first tubular support body defining a longitudinal passage including a throat passage;
a first radial passage defined in the first tubular support body fluidicly coupled to the longitudinal passage;
a first flange coupled to the first tubular support body;
a second flange coupled to the first tubular support body defining:
a second radial passage defined in the second flange fluidicly coupled to the longitudinal passage; and
an adjustable expansion cone assembly movably coupled to the tubular support member;
a dog assembly movably coupled to the tubular support member that comprises:
a first tubular sleeve coupled to the adjustable expansion cone assembly defining:
a first counterbore for receiving the first flange; and
a third radial passage;
a spring received within the first counterbore;
a retaining ring received within the first counterbore;
a load transfer pin coupled to the retaining ring and extending through the third radial passage;
a second tubular sleeve coupled to the first load transfer pin that defines:
a first counterbore for receiving the first tubular sleeve;
a second counterbore for receiving and mating with the tapered flange; and
comprises:
a third flange defining:
a third counterbore for receiving the second flange;
a fourth counterbore for receiving the second flange; and
a fourth radial passage; and
a resilient dog coupled to the second tubular sleeve and positioned adjacent to the tapered flange; and
first and second packer cups coupled to the tubular support member between the resilient dog and the third flange.

29. The apparatus of claim 28, wherein the tubular support member further comprises:
an expansion cone support body coupled to the first tubular support body comprising:
an N-sided tapered tubular support member;
wherein each side of the multi-sided tapered tubular support member defines a T-shaped slot;
wherein the adjustable expansion cone assembly comprises:
N expansion cone segments movably coupled to the expansion cone support body, each comprising:
an expansion cone segment body including arcuate conical outer surfaces;
a first T-shaped retaining member coupled to the expansion cone segment body for movably coupling the expansion cone segment body to a corresponding one of the T-shaped slots of the expansion cone support body; and
a second T-shaped retaining member coupled to the expansion cone segment body; and
a split ring collar movably coupled to the exterior of the tubular support member comprising:
a second tubular support body defining:
N T-shaped slots for movably receiving corresponding ones of the second T-shaped retaining members of the expansion cone segments; and
an L-shaped retaining member coupled to the second tubular support body; and
wherein the first tubular sleeve of the dog assembly further defines:
a slot for receiving and mating with the L-shaped retaining member of the split ring collar.

30. The apparatus of claim 28, wherein the tubular support member further comprises:
an expansion cone support body coupled to the tubular support body comprising:
a tapered tubular support member defining N stepped slots;
wherein the adjustable expansion cone assembly comprises:
an expansion cone assembly movably coupled to the tubular support member comprising:
a second tubular support body movably coupled to the first tubular support body defining an L-shaped slot; and
N expansion cone segments extending from the second tubular support member, each expansion cone segment comprising:
a resilient collet coupled to the second tubular support member;
an expansion cone segment body coupled to the resilient collet including arcuate conical outer surfaces; and
a retaining member coupled to the expansion cone segment body for movably coupling the expansion cone segment body to a corresponding one of the stepped slots of the expansion cone support body; and
a split ring collar movably coupled to the exterior of the tubular support member comprising:
a third tubular support body:
a first L-shaped retaining member coupled to the third tubular support body for mating with the L-shaped slot of the second tubular support body; and
a second L-shaped retaining member coupled to the third tubular support member; and
wherein the first tubular sleeve of the dog assembly further defines:
a slot for receiving and mating with the second L-shaped retaining member of the split ring collar.

31. The apparatus of claim 28, wherein the tubular support member further comprises:
an expansion cone support body coupled to the first tubular support body comprising:
a tapered tubular support member defining N slots;
wherein the adjustable expansion cone assembly comprises:
an expansion cone assembly movably coupled to the tubular support member comprising:

a second tubular support body movably coupled to the first tubular support body defining an L-shaped slot; and N expansion cone segments extending from the second tubular support member, each expansion cone segment comprising:

a resilient collet coupled to the second tubular support member;

an expansion cone segment body coupled to the resilient collet including arcuate conical outer surfaces; and a retaining member coupled to the expansion cone segment body for movably coupling the expansion cone segment body to a corresponding one of the slots of the expansion cone support body; and a split ring collar movably coupled to the exterior of the tubular support member comprising:

a third tubular support body;

a first L-shaped retaining member coupled to the third tubular support body for mating with L-shaped slot of the second tubular support body; and a second L-shaped retaining member coupled to the third tubular support body; and wherein the first tubular sleeve of the dog assembly further defines:

a slot for receiving and mating with the second L-shaped retaining member of the split ring collar.

32. The apparatus of claim 28, wherein the tubular support member further comprises:

an expansion cone support body coupled to the tubular support body comprising:

a tapered tubular support member defining N slots;

wherein the adjustable expansion cone assembly comprises:

an expansion cone assembly movably coupled to the tubular support member comprising:

a second tubular support body movably coupled to the first tubular support body defining an L-shaped slot; and N/2 first expansion cone segments extending from the second tubular support member, each first expansion cone segment comprising:

a first resilient collet coupled to the second tubular support member;

a first expansion cone segment body coupled to the resilient collet including arcuate conical outer surfaces; and a first retaining member coupled to the expansion cone segment body for movably coupling the expansion cone segment body to a corresponding one of the slots of the expansion cone support body;

N/2 second expansion cone segments extending from the second tubular support member, each second expansion cone segment comprising:

a second resilient collet coupled to the second tubular support member;

a second expansion cone segment body coupled to the resilient collet including arcuate conical outer surfaces; and a second retaining member coupled to the expansion cone segment body for movably coupling the expansion cone segment body to a corresponding one of the slots of the expansion cone support body;

wherein the second expansion cone segments overlap and are interleaved with the first expansion cone segments; and a split ring collar movably coupled to the exterior of the tubular support member comprising:

a third tubular support body;

a first L-shaped retaining member coupled to the third tubular support body for mating with the L-shaped slot of the second tubular support body; and a second L-shaped retaining member coupled to the third tubular support body; and wherein the first tubular sleeve of the dog assembly further defines:

a slot for receiving and mating with the second L-shaped retaining member of the split ring collar.

33. The apparatus of claim 28, wherein the tubular support member further comprises:

an expansion cone support body coupled to the first tubular support body comprising:

an N-sided tapered tubular support member;

wherein each side of the multi-sided tapered tubular support member defines a T-shaped slot;

wherein the adjustable expansion cone assembly comprises:

N/2 first expansion cone segments movably coupled to the expansion cone support body, each comprising:

a first expansion cone segment body including arcuate conical outer surfaces;

a first T-shaped retaining member coupled to the first expansion cone segment body for movably coupling the first expansion cone segment body to a corresponding one of the T-shaped slots of the expansion cone support body; and a second T-shaped retaining member coupled to the first expansion cone segment body;

N/2 second expansion cone segments movably coupled to the expansion cone support body, each comprising:

a second expansion cone segment body including arcuate conical outer surfaces;

a third T-shaped retaining member coupled to the second expansion cone segment body for movably coupling the second expansion cone segment body to a corresponding one of the T-shaped slots of the expansion cone support body; and a fourth T-shaped retaining member coupled to the expansion cone segment body;

wherein the first and second expansion cone segments are interleaved;

wherein the first expansion cone segment bodies are complementary shaped with respect to the second expansion cone segment bodies; and a split ring collar assembly movably coupled to the exterior of the tubular support member comprising:

a second tubular support body defining:

N T-shaped slots for movably receiving corresponding ones of the second and fourth T-shaped retaining members of the interleaved first and second expansion cone segments; and an L-shaped retaining member coupled to the second tubular support body; and wherein the first tubular sleeve of the dog assembly further defines:

a slot for receiving and mating with the L-shaped retaining member of the split ring collar.

34. An apparatus for radially expanding a tubular member, comprising:

a tubular support member;

an adjustable expansion cone assembly movably coupled to the tubular support member; and means for adjusting the adjustable expansion cone assembly.

35. The apparatus of claim 34, wherein the means for adjusting the adjustable expansion cone assembly comprises:

frictional means for adjusting the adjustable expansion cone assembly.

36. The apparatus of claim , wherein the means for adjusting the adjustable expansion cone assembly comprises:

resilient means for adjusting the adjustable expansion cone assembly.

37. An adjustable expansion cone assembly, comprising:

a tubular support member;

an adjustable expansion cone movably coupled to the tubular support member, comprising:

a plurality of expansion cone segments; and means for guiding the expansion cone segments on the tubular support member; and means for adjusting the adjustable expansion cone.

38. The adjustable expansion cone assembly of claim 37, wherein the adjustable expansion cone further comprises:

means for interlocking the expansion cone segments.

39. The adjustable expansion cone assembly of claim 37, wherein the means for adjusting the adjustable expansion cone comprises:

resilient means for supporting the expansion cone segments.

40. The adjustable expansion cone assembly of claim 37, wherein the expansion cone segments include first and second interleaved groups of expansion cone segments.

41. The adjustable expansion cone assembly of claim 40, wherein the means for adjusting the adjustable expansion cone comprises:

means for displacing the first and second interleaved groups of expansion cone segments in opposite directions.

42. A method of plastically deforming and radially expanding an expandable tubular member using an apparatus comprising a tubular support member, an adjustable expansion cone assembly movably coupled to the tubular support member, and an actuator movably coupled to the tubular support member for adjusting the adjustable expansion cone assembly, comprising:

coupling a first end of the expandable tubular member to a tubular structure;

locking the actuator to the tubular support member of the apparatus;

inserting the apparatus into the first end of the expandable tubular member;

moving the actuator and the adjustable expansion cone assembly of the apparatus out of the second end of the expandable tubular member;

reinserting the actuator of the apparatus into the second end of the expandable tubular member;

unlocking the actuator from the tubular support member of the apparatus;

rotating the actuator relative to the tubular support member of the apparatus; and increasing the outside diameter of the adjustable expansion cone assembly by moving the tubular support member relative to the actuator, the adjustable expansion cone assembly, and the expandable tubular member; and plastically deforming and radially expanding the expandable tubular member by moving the adjustable expansion cone assembly through the expandable tubular member.

43. The method of claim 42, wherein the tubular support member includes one or more tugs; wherein the actuator includes one or more corresponding retaining slots; and wherein locking comprises positioning the lugs into the corresponding retaining slots.

44. The method of claim 42, wherein the tubular support member includes one or more lugs; wherein the actuator includes one or more corresponding retaining slots; and wherein unlocking comprises positioning the lugs out of engagement with corresponding retaining slots.

45. The method of claim 42, wherein moving the tubular support member relative to the actuator, the adjustable expansion cone assembly, and the expandable tubular member comprises:

the actuator frictionally engaging the expandable tubular member.

46. The method of claim 42, wherein moving the adjustable expansion cone assembly through the expandable tubular member comprises:

pulling the adjustable expansion cone through the expandable tubular member.

47. The method of claim 42, further comprising:

fluidicly sealing the interface between the tubular support member of the apparatus and the expandable tubular member;

wherein moving the adjustable expansion cone assembly through the expandable tubular member comprises:

injecting a pressurized fluid into the tubular support member.

48. A method of plastically deforming and radially expanding an expandable tubular member using an apparatus comprising a tubular support member, an adjustable expansion cone assembly movably coupled to the tubular support member, and an actuator movably coupled to the tubular support member for adjusting the adjustable expansion cone assembly, comprising:

coupling a first end of the expandable tubular member to a tubular structure;

inserting the apparatus into the first end of the expandable tubular member in a first direction;

displacing the actuator of the apparatus in a second direction opposite to the first direction;

applying a resilient biasing force to the adjustable expansion cone assembly in the second direction moving the actuator and the adjustable expansion cone assembly of the apparatus out of the second end of the expandable tubular member;

reinserting the actuator of the apparatus into the second end of the expandable tubular member in the second direction;

increasing the outside diameter of the adjustable expansion cone assembly by displacing the actuator and the adjustable expansion cone assembly relative to the expandable tubular member in the first direction; and plastically deforming and radially expanding the expandable tubular member by moving the adjustable expansion cone assembly through the expandable tubular member in the second direction.

49. The method of claim 48, wherein displacing the actuator of the apparatus in the second direction comprises:

impacting the actuator with the first end of the expandable tubular member.

50. The method of claim 48, wherein displacing the actuator and the adjustable expansion cone assembly relative to the expandable tubular member in the first direction comprises:

impacting the actuator with the second end of the expandable tubular member.

51. The method of claim 48, wherein moving the adjustable expansion cone assembly through the expandable tubular member comprises:

pulling the adjustable expansion cone through the expandable tubular member.

52. The method of claim 48, further comprising:

fluidicly sealing the interface between the tubular support member of the apparatus and the expandable tubular member;

wherein moving the adjustable expansion cone assembly through the expandable tubular member comprises:

injecting a pressurized fluid into the tubular support member.

53. An adjustable expansion cone assembly, comprising:

a plurality of expansion cone segments;

means for guiding the expansion cone segments on a tapered body; and means for controllably displacing the expansion cone segments along the tapered body.

54. The assembly of claim 53, further comprising:

means for resiliently guiding the expansion cone segments on the tapered body.

55. The assembly of claim 53, further comprising:

means for interlocking the expansion cone segments.

56. The assembly of claim 53, further comprising:

means for dividing the expansion cone segments into first and second groups of expansion cone segments; and means for interleaving the first and second groups of expansion cone segments.

57. The assembly of claim 56, further comprising:

means for overlapping the first and second groups of expansion cone segments.

58. The assembly of claim 56, wherein the means for controllably displacing the expansion cone segments along the tapered body comprises:

means for displacing the first and second interleaved groups of expansion cone segments in opposite directions.

59. An adjustable expansion cone assembly, comprising:

a plurality of expansion cone segments;

means for guiding the expansion cone segments on a multi-sided tapered body;

means for interlocking the expansion cone segments; and means for controllably displacing the expansion cone segments along the tapered body.

60. An adjustable expansion cone assembly, comprising:

a plurality of expansion cone segments;

means for resiliently guiding the expansion cone segments on a multi-sided tapered body;

means for guiding each of the expansion cone segments on opposite sides in the circumferential direction;

means for interlocking the expansion cone segments; and means for controllably displacing the expansion cone segments along the tapered body.

61. An adjustable expansion cone assembly, comprising:

a plurality of expansion cone segments;

means for dividing the expansion cone segments into first and second groups of expansion cone segments;

means for interleaving the first and second groups of expansion cone segments;

means for overlapping the first and second groups of expansion cone segments;

means for resiliently guiding the expansion cone segments on a multi-sided tapered body;

means for guiding each of the expansion cone segments on opposite sides in the circumferential direction; and means for controllably displacing the expansion cone segments along the tapered body.

62. An adjustable expansion cone assembly, comprising:

a plurality of expansion cone segments;

means for dividing the expansion cone segments into first and second groups of expansion cone segments;

means for interleaving the first and second groups of expansion cone segments;

means for guiding the expansion cone segments on a multi-sided tapered body; and means for controllably displacing the expansion cone segments along the tapered body while also relatively displacing the first and second groups of expansion cone segments in opposite directions.

63. An apparatus for plastically deforming and radially expanding an expandable tubular member, comprising:

a tubular support member;

an adjustable expansion cone assembly movably coupled to the tubular support member;

means for actuating the adjustable expansion cone assembly;

means for locking the actuator to the tubular support member of the apparatus;

means for unlocking the actuator from the tubular support member of the apparatus;

means for increasing the outside diameter of the adjustable expansion cone assembly by moving the tubular support member relative to the actuator, the adjustable expansion cone assembly, and the expandable tubular member.

64. The apparatus of claim 63, wherein the tubular support member includes one or more lugs; wherein the actuator includes one or more corresponding retaining slots; and wherein the means for locking comprises positioning the lugs into the corresponding retaining slots.

65. The apparatus of claim 63, wherein the tubular support member includes one or more lugs; wherein the actuator includes one or more corresponding retaining slots; and wherein the means for unlocking comprises positioning the lugs out of engagement with corresponding retaining slots.

66. The apparatus of claim 63, further comprising:

means for fluidicly sealing the interface between the tubular support member of the apparatus and the expandable tubular member.

67. An apparatus for plastically deforming and radially expanding an expandable tubular member, comprising:

a tubular support member;

an adjustable expansion cone assembly movably coupled to the tubular support member;

means for actuating the adjustable expansion cone assembly;

means for displacing the actuator of the apparatus in a first direction;

means for applying a resilient biasing force to the adjustable expansion cone assembly when the actuator is displaced in the first direction;

means for increasing the outside diameter of the adjustable expansion cone assembly by displacing the actuator and the adjustable expansion cone assembly relative to the expandable tubular member in a second direction opposite to the first direction.

68. The apparatus of claim 67, wherein the means for displacing the actuator of the apparatus in the first direction comprises:

means for impacting the actuator.

69. The apparatus of claim 67, wherein the means for displacing the actuator and the adjustable expansion cone assembly relative to the expandable tubular member in the first direction comprises:

means for impacting the actuator.

70. An apparatus for radially expanding a tubular member, comprising:

a tubular support member;

an adjustable expansion device movably coupled to the tubular support member; and means for adjusting the adjustable expansion device.

71. The apparatus of claim 70, wherein the means for adjusting the adjustable expansion device comprises:

frictional means for adjusting the adjustable expansion device.

72. The apparatus of claim 70, wherein the means for adjusting the adjustable expansion device comprises:

resilient means for adjusting the adjustable expansion device.

73. An adjustable expansion device, comprising:

a tubular support member;

an adjustable expansion device movably coupled to the tubular support member, comprising:

a plurality of expansion segments; and means for guiding the expansion segments on the tubular support member; and means for adjusting the adjustable expansion device.

74. The adjustable expansion device of claim 73, wherein the adjustable expansion device further comprises:

means for interlocking the expansion segments.

75. The adjustable expansion device of claim 73, wherein the means for adjusting the adjustable expansion device comprises:

resilient means for supporting the expansion segments.

76. The adjustable expansion device of claim 73, wherein the expansion segments include first and second interleaved groups of expansion segments.

77. The adjustable expansion device of claim 76, wherein the means for adjusting the adjustable expansion device comprises:

means for displacing the first and second interleaved groups of expansion segments in opposite directions.

78. A method of plastically deforming and radially expanding an expandable tubular member using an apparatus comprising a tubular support member, an adjustable expansion device movably coupled to the tubular support member, and an actuator movably coupled to the tubular support member for adjusting the adjustable expansion device, comprising:

coupling a first end of the expandable tubular member to a tubular structure;

locking the actuator to the tubular support member of the apparatus;

inserting the apparatus into the first end of the expandable tubular member;

moving the actuator and the adjustable expansion device of the apparatus out of the second end of the expandable tubular member;

reinserting the actuator of the apparatus into the second end of the expandable tubular member;

unlocking the actuator from the tubular support member of the apparatus;

rotating the actuator relative to the tubular support member of the apparatus; and increasing the outside diameter of the adjustable expansion device by moving the tubular support member relative to the actuator, the adjustable expansion device, and the expandable tubular member; and plastically deforming and radially expanding the expandable tubular member by moving the adjustable expansion device through the expandable tubular member.

79. The method of claim 78, wherein the tubular support member includes one or more lugs; wherein the actuator includes one or more corresponding retaining slots; and wherein locking comprises positioning the lugs into the corresponding retaining slots.

80. The method of claim 78, wherein the tubular support member includes one or more lugs; wherein the actuator includes one or more corresponding retaining slots; and wherein unlocking comprises positioning the lugs out of engagement with corresponding retaining slots.

81. The method of claim 78, wherein moving the tubular support member relative to the actuator, the adjustable expansion device, and the expandable tubular member comprises:

the actuator frictionally engaging the expandable tubular member.

82. The method of claim 78, wherein moving the adjustable expansion device through the expandable tubular member comprises:

pulling the adjustable expansion device through the expandable tubular member.

83. The method of claim 78, further comprising:

fluidicly sealing the interface between the tubular support member of the apparatus and the expandable tubular member;

wherein moving the adjustable expansion device through the expandable tubular member comprises:

injecting a pressurized fluid into the tubular support member.

84. A method of plastically deforming and radially expanding an expandable tubular member using an apparatus comprising a tubular support member, an adjustable expansion device movably coupled to the tubular support member, and an actuator movably coupled to the tubular support member for adjusting the adjustable expansion device, comprising:

coupling a first end of the expandable tubular member to a tubular structure;

inserting the apparatus into the first end of the expandable tubular member in a first direction;

displacing the actuator of the apparatus in a second direction opposite to the first direction;

applying a resilient biasing force to the adjustable expansion device in the second direction;

moving the actuator and the adjustable expansion device of the apparatus out of the second end of the expandable tubular member;

reinserting the actuator of the apparatus into the second end of the expandable tubular member in the second direction;

increasing the outside diameter of the adjustable expansion device by displacing the actuator and the adjustable expansion device relative to the expandable tubular member in the first direction; and plastically deforming and radially expanding the expandable tubular member by moving the adjustable expansion device through the expandable tubular member in the second direction.

85. The method of claim 84, wherein displacing the actuator of the apparatus in the second direction comprises:

impacting the actuator with the first end of the expandable tubular member.

86. The method of claim 84, wherein displacing the actuator and the adjustable expansion device relative to the expandable tubular member in the first direction comprises:

impacting the actuator with the second end of the expandable tubular member.

87. The method of claim 84, wherein moving the adjustable expansion device through the expandable tubular member comprises:

pulling the adjustable expansion device through the expandable tubular member.

88. The method of claim 84, further comprising:

fluidicly sealing the interface between the tubular support member of the apparatus and the expandable tubular member;

wherein moving the adjustable expansion device through the expandable tubular member comprises:

injecting a pressurized fluid into the tubular support member.

89. An adjustable expansion device, comprising:

a plurality of expansion segments;

means for guiding the expansion segments on a tapered body; and means for controllably displacing the expansion segments along the tapered body.

90. The assembly of claim 89, further comprising:

means for resiliently guiding the expansion segments on the tapered body.

91. The assembly of claim 89, further comprising:

means for interlocking the expansion segments.

92. The assembly of claim 89, further comprising:

means for dividing the expansion segments into first and second groups of expansion segments; and means for interleaving the first and second groups of expansion segments.

93. The assembly of claim 92, further comprising:

means for overlapping the first and second groups of expansion segments.

94. The assembly of claim 92, wherein the means for controllably displacing the expansion segments along the tapered body comprises:

means for displacing the first and second interleaved groups of expansion segments in opposite directions.

95. An adjustable expansion device, comprising:

a plurality of expansion segments;

means for guiding the expansion segments on a multi-sided tapered body;

means for interlocking the expansion segments; and means for controllably displacing the expansion segments along the tapered body.

96. An adjustable expansion device, comprising:

a plurality of expansion segments;

means for resiliently guiding the expansion segments on a multi-sided tapered body;

means for guiding each of the expansion segments on opposite sides in the circumferential direction;

means for interlocking the expansion segments; and means for controllably displacing the expansion segments along the tapered body.

97. An adjustable expansion device, comprising:

a plurality of expansion segments;

means for dividing the expansion segments into first and second groups of expansion segments;

means for interleaving the first and second groups of expansion segments;

means for overlapping the first and second groups of expansion segments;

means for resiliently guiding the expansion segments on a multi-sided tapered body;

means for guiding each of the expansion segments on opposite sides in the circumferential direction; and means for controllably displacing the expansion segments along the tapered body.

98. An adjustable expansion device, comprising:

a plurality of expansion segments;

means for dividing the expansion segments into first and second groups of expansion segments;

means for interleaving the first and second groups of expansion segments;

means for guiding the expansion segments on a multi-sided tapered body; and means for controllably displacing the expansion segments along the tapered body while also relatively displacing the first and second groups of expansion segments in opposite directions.

99. An apparatus for plastically deforming and radially expanding an expandable tubular member, comprising:

a tubular support member;

an adjustable expansion device movably coupled to the tubular support member;

means for actuating the adjustable expansion device;

means for locking the actuator to the tubular support member of the apparatus;

means for unlocking the actuator from the tubular support member of the apparatus;

means for increasing the outside diameter of the adjustable expansion device by moving the tubular support member relative to the actuator, the adjustable expansion device, and the expandable tubular member.

100. The apparatus of claim 99, wherein the tubular support member includes one or more lugs; wherein the actuator includes one or more corresponding retaining slots; and wherein the means for locking comprises positioning the lugs into the corresponding retaining slots.

101. The apparatus of claim 99, wherein the tubular support member includes one or more lugs; wherein the actuator includes one or more corresponding retaining slots; and wherein the means for unlocking comprises positioning the lugs out of engagement with corresponding retaining slots.

102. The method of claim 99, further comprising:

means for fluidicly sealing the interface between the tubular support member of the apparatus and the expandable tubular member.

103. An apparatus for plastically deforming and radially expanding an expandable tubular member, comprising:

a tubular support member;

an adjustable expansion device movably coupled to the tubular support member;

means for actuating the adjustable expansion device;

means for displacing the actuator of the apparatus in a first direction;

means for applying a resilient biasing force to the adjustable expansion device when the actuator is displaced in the first direction;

means for increasing the outside diameter of the adjustable expansion device by displacing the actuator and the adjustable expansion device relative to the expandable tubular member in a second direction opposite to the first direction.

104. The apparatus of claim 103, wherein the means for displacing the actuator of the apparatus in the first direction comprises:

means for impacting the actuator.

105. The apparatus of claim 103, wherein the means for displacing the actuator and the adjustable expansion device relative to the expandable tubular member in the first direction comprises:

means for impacting the actuator.

* * * * *